US011067949B2

(12) United States Patent
Miyabe et al.

(10) Patent No.: US 11,067,949 B2
(45) **Date of Patent: *Jul. 20, 2021**

(54) CARTRIDGE AND ELECTROPHOTOGRAPHIC IMAGE FORMING APPARATUS WHICH USES CARTRIDGE

(71) Applicant: CANON KABUSHIKI KAISHA, Tokyo (JP)

(72) Inventors: Shigeo Miyabe, Numazu (JP); Takahito Ueno, Mishima (JP); Masanari Morioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/189,147

(22) Filed: Nov. 13, 2018

(65) Prior Publication Data

US 2019/0079448 A1 Mar. 14, 2019

Related U.S. Application Data

(60) Division of application No. 15/595,218, filed on May 15, 2017, now Pat. No. 10,168,665, which is a (Continued)

(30) Foreign Application Priority Data

Jun. 10, 2008 (JP) ..... 2008-151824

(51) Int. Cl.
*G03G 21/18* (2006.01)
*G03G 15/08* (2006.01)

(52) U.S. Cl.
CPC ..... *G03G 21/186* (2013.01); *G03G 15/0808* (2013.01); *G03G 15/0896* (2013.01); *G03G 21/1853* (2013.01); *G03G 2221/1657* (2013.01)

(58) Field of Classification Search
CPC ..... G03G 15/0808; G03G 21/186; G03G 2221/1657; G03G 21/1647; G03G 21/1857; G03G 15/757
See application file for complete search history.

(56) References Cited

U.S. PATENT DOCUMENTS 4,065,941 A 1/1978 Aoki
4,835,565 A 5/1989 Nagatsuna et al.
(Continued)

FOREIGN PATENT DOCUMENTS

CN 1184957 A 6/1998
CN 1346077 4/2002
(Continued)

OTHER PUBLICATIONS

Search Report and Written Opinion in Singapore Patent Application No. 201008169-3, dated Apr. 18, 2012.
(Continued)

*Primary Examiner* — Sandra Brase
(74) *Attorney, Agent, or Firm* — Venable LLP

(57) ABSTRACT

A cartridge for use with a main assembly of an electrophotographic image forming apparatus, the main assembly including a driving shaft having a rotational force applying portion, wherein the cartridge is dismountable from the main assembly in a direction substantially perpendicular to an axial direction of the driving shaft, the cartridge including i) a developing roller for developing an electrostatic latent image formed on an electrophotographic photosensitive drum, the developing roller being rotatable about an axis thereof; and ii) a coupling member engageable with the rotational force applying portion to receive a rotational force for rotating the developing roller, the coupling member being capable of taking a rotational force transmitting angular position for transmitting the rotational force for rotating the developing roller to the developing roller and a disen-
(Continued)

gaging angular position in which the coupling member is inclined away from the rotational force transmitting angular position, wherein when the cartridge is dismounted from the main assembly of the electrophotographic image forming apparatus in a direction substantially perpendicular to the axis of the developing roller, the coupling member moves from the rotational force transmitting angular position to the disengaging angular position.

108 Claims, 63 Drawing Sheets

Related U.S. Application Data division of application No. 13/866,338, filed on Apr. 19, 2013, now Pat. No. 9,684,261, which is a continuation of application No. 12/990,126, filed as application No. PCT/JP2009/060822 on Jun. 9, 2009, now abandoned.

(56) References Cited

U.S. PATENT DOCUMENTS

| | | | |
|---|---|---|---|
| 5,815,782 A | 9/1998 | Yokomori et al. | |
| 5,842,962 A | 12/1998 | Yamada et al. | |
| 5,903,803 A | 5/1999 | Kawai et al. | |
| 6,169,865 B1 | 1/2001 | Miyabe et al. | |
| 6,169,866 B1 | 1/2001 | Watanabe et al. | |
| 6,226,476 B1 | 5/2001 | Miyabe et al. | |
| 6,240,266 B1 | 5/2001 | Watanabe et al. | |
| 6,282,395 B1 | 8/2001 | Nittani et al. | |
| 6,285,847 B1 | 9/2001 | Tanizaki et al. | |
| 6,343,192 B1 | 1/2002 | Miyabe et al. | |
| 6,385,420 B1 | 5/2002 | Morioka | |
| 6,438,374 B1 | 8/2002 | Nittani et al. | |
| 6,463,242 B1 | 10/2002 | Kojima et al. | |
| 6,473,578 B2 | 10/2002 | Miyabe et al. | |
| 6,473,580 B1 | 10/2002 | Inomata | |
| 6,517,439 B1 | 2/2003 | Sears | |
| 6,574,446 B2 | 6/2003 | Kitayama | |
| 6,587,660 B2 | 7/2003 | Ueno et al. | |
| 6,671,473 B2 | 12/2003 | Miyabe | |
| 6,708,010 B2 | 3/2004 | Miyabe et al. | |
| 6,907,212 B2 | 6/2005 | Harada et al. | |
| 6,947,677 B2 | 9/2005 | Uyama et al. | |
| 6,968,141 B2 | 11/2005 | Fujita et al. | |
| 7,027,754 B2 | 4/2006 | Harada et al. | |
| 7,035,573 B2 | 4/2006 | Yamaguchi et al. | |
| 7,190,921 B2 | 3/2007 | Ishii et al. | |
| 7,664,436 B2 | 2/2010 | Aoki et al. | |
| 7,817,938 B2 | 10/2010 | Igarashi | |
| 9,684,261 B2 | 6/2017 | Miyabe et al. | |
| 10,168,665 B2 * | 1/2019 | Miyabe | G03G 21/186 |
| 2002/0025191 A1 | 2/2002 | Kitayama | |
| 2002/0172531 A1 | 11/2002 | Harada et al. | |
| 2005/0069342 A1 | 3/2005 | Kanno et al. | |
| 2006/0045566 A1 | 3/2006 | Kanno et al. | |
| 2006/0216061 A1 | 9/2006 | Yamaguchi | |
| 2007/0160376 A1 | 1/2007 | Ishida et al. | |
| 2007/0031158 A1 | 2/2007 | Kamimura | |
| 2007/0122188 A1 | 5/2007 | Igarashi | |
| 2007/0160384 A1 | 7/2007 | Sakurai et al. | |
| 2007/0160388 A1 | 7/2007 | Yoshimura et al. | |
| 2008/0152388 A1 | 6/2008 | Ueno et al. | |
| 2008/0240796 A1 | 10/2008 | Morioka et al. | |
| 2008/0260428 A1 | 10/2008 | Ueno et al. | |
| 2020/0159165 A1 * | 5/2020 | Miyabe | G03G 15/0896 |

FOREIGN PATENT DOCUMENTS

| | | |
|---|---|---|
| CN | 1385761 A | 12/2002 |
| CN | 15809070 | 2/2005 |
| CN | 1952810 A | 4/2007 |
| CN | 1971444 A | 5/2007 |
| DE | 11 2007 003 045 T5 | 10/2009 |
| DE | 11 2008 000 214 T5 | 12/2009 |
| EP | 0 797 125 A | 9/1997 |
| EP | 0 833 226 A2 | 4/1998 |
| EP | 1178370 | 2/2002 |
| EP | 1 705 532 A1 | 9/2006 |
| JP | H08-184977 | 7/1996 |
| JP | 1184957 A | 6/1998 |
| JP | H10-274914 A | 10/1998 |
| JP | H10-274915 A | 10/1998 |
| JP | H11-95639 A | 4/1999 |
| JP | 2000-214654 A | 8/2000 |
| JP | 2002-31153 A | 1/2002 |
| JP | 2002-048148 | 2/2002 |
| JP | 2004-045603 A | 2/2004 |
| JP | 2006-071808 A | 3/2006 |
| JP | 2007-052185 A | 3/2007 |
| JP | 2007-147881 A | 6/2007 |
| JP | 2007-213025 A | 8/2007 |
| KR | 2002-0011902 | 2/2002 |
| KR | 10-2005-0030554 A | 3/2005 |
| KR | 2020-0085924 A | 7/2020 |
| MX | 2009 007 095 A | 8/2009 |
| RU | 2 372 635 C2 | 11/2009 |
| TW | 200527168 A | 8/2005 |

OTHER PUBLICATIONS

Office Action in Chinese Patent Application No. 200980121411.3, dated Oct. 15, 2012, and English-language translation.
Office Action in Singapore Patent Application No. 201008169-3, dated Nov. 29, 2012.
Patent Examination Report in Australian Patent Application No. 2013200114, dated Jun. 23, 2014, with English Translation.
Decision on Grant in Russian Patent Application No. 2010154421/28(078720), dated Sep. 1, 2014 (with English translation.
Notice of Allowance in Korean Patent Application No. 10-2010-7029731, dated Nov. 4, 2014.
Notice of Allowance in Korean Patent Application No. 10-2014-7022583, dated Nov. 19, 2014.
Office Action in German Patent Application No. 11 2009 001 406.2, dated Mar. 2, 2015.
Notice of Allowance in Korean Patent Application No. 10-2014-7022591, dated May 19, 2015.
Notice of Allowance in Korean Patent Application No. 10-2015-7006806, dated May 20, 2015.
Notice of Allowance in Korean Patent Application No. 10-2014-7022589, dated May 19, 2015.
Notice of Allowance in Korean Patent Application No. 10-2014-7022588, dated May 19, 2015.
Notice of Allowance in Korean Patent Application No. 10-2014-7022582, dated May 19, 2015.
Notice of Allowance in Korean Patent Application No. 10-2014-7022585, dated May 19, 2015.
Notice of Allowance in Korean Patent Application No. 10-2014-7022584, dated May 19, 2015.
Examination Report in Malaysia Patent Application No. P1 2010005824, dated Jul. 31, 2015.
English translation dated Mar. 2, 2015 Office Action in German Patent Application No. 11 2009 001 406.2.
Office Action in Taiwanese Patent Application No. 102126892, dated Oct. 27, 2015 (with English translation).
Decision on Grant in Russian Patent Application No. 2014147192, dated Jan. 27, 2016 (with English translation).
Dec. 29, 2016 Office Action in Indian Patent Application No. 7960/CHEN/2010.
Feb. 13, 2017 Office Action in Mexican Patent Application No. MX/a/2014/004892 (with English translation).
Office Action in Chinese Patent Application No. 201410281437.7, dated Apr. 12, 2016 (with English translation).
English translation of Office Action in Korean Patent Application No. 10-2010-7029731, dated Feb. 12, 2014.

(56) References Cited

OTHER PUBLICATIONS

Office Action in Mexican Patent Application No. MX/2013/44595, dated May 15, 2013 (with English translation).
Office Action in Korean Patent Application No. 10-2010-7029731, dated Feb. 12, 2014.
Notice of Allowance in Taiwanese Patent Application No. 098119431, dated Jun. 24, 2013.
English translation dated Jul. 29, 2013 Office Action in Russian Patent Application No. 2010154421/28.
Notice of Acceptance in Australian Patent Application No. 201503439, dated May 31, 2017.
Notice of Allowance in Taiwanese Patent Application No. 105118986, dated Jun. 30, 2017.
Sep. 4, 2017 Office Action in Chinese Patent Application No. 201410281836.3.
Aug. 31, 2017 Office Action in Russian Patent Application No. 2016121623 (with English translation).
Sep. 29, 2017 Office Action in Chinese Patent Application No. 201410281825.5.
Oct. 9, 2017 Office Action in Chinese Patent Application No. 201410282708.0 (with English translation).
Sep. 29, 2017 Office Action in Chinese Patent Application No. 201410281539.9 (with English translation).
Oct. 25, 2017 Office Action in Chinese Patent Application No. 20140282719.9.
Nov. 3, 2017 Office Action in Chinese Patent Application No. 201410282711.2 (with English translation).
Examination Report in Malaysian Patent Application No. P1 2010005824, dated Mar. 30, 2018.
Communication in European Patent Application No. 09 762 562.8, dated Jun. 8, 2018.
Office Action in Korean Patent Application No. 10-2015-7012775, dated Jul. 4, 2018.
Office Action in Taiwanese Patent Application No. 106125760, dated Aug. 1, 2018 (with English translation).
Notice of Allowance in Korean Patent Application No. 10-2015-7012775, dated May 27, 2019.
Office Action in Brazilian Patent Application No. PI0914886-8, dated Jun. 4, 2019 (with partial English translation).
Decision to Grant in Russian Patent Application No. 2018145768, dated Jun. 13, 2019 (with English translation).
Search Report in Russian Patent Application No. 2019125526, dated Dec. 13, 2019 (with English translation).
Jan. 24, 2020 Notice of Acceptance in Australian Patent Application No. 2019200918.
Communication in European Patent Application No. 09 762 562.8, dated Sep. 17, 2019.
Office Action in Brazilian Patent Application No. PI0914886-8, dated Sep. 9, 2019 (with English translation).
Notice of Allowance in Korean Patent Application No. 10-2019-7025216, dated Oct. 8, 2019.
Office Action in Taiwanese Patent Application No. 107144749, dated Nov. 7, 2019
Jan. 16, 2020 Decision to Grant in Russian Patent Application No. 2019125526 (with English translation).
Notice of Acceptance dated Apr. 6, 2020 in counterpart Korean Application No. 10-2020-7000521, with English translation thereof.
Dec. 11, 2020 Office Action in German Patent Application No. 11 2009 005 570.2 (with English translation).
Nov. 4, 2020 Notice of Allowance in Korean Patent Application No. 10-2020-7019467.
Jun. 16, 2020 Office Action in European Patent Application No. 20 154 786.6.
Jun. 16, 2020 Office Action in European Patent Application No. 20 154 787.4.
Jun. 16, 2020 Office Action in European Patent Application No. 20 154 788.2.
Jun. 16, 2020 Office Action in European Patent Application No. 20 154 789.0.
Apr. 21, 2021 Office Action in Taiwanese Patent Application No. 109114921 (with English translation).
Apr. 21, 2021 Notice of Allowance in Korean Patent Application No. 10-2021-7003540.
May 7, 2021 Decision to Grant in Russian Patent Application No. 2020140027 (with English translation).

* cited by examiner (a)

(b)

(a)

(b)

(a)

(b)

(a)

(b)

(a)

(b)

(a)

(b)

(a)

(b)

(a)

(b)

(a)

(b)

(a)

(b)

CARTRIDGE AND ELECTROPHOTOGRAPHIC IMAGE FORMING APPARATUS WHICH USES CARTRIDGE

TECHNICAL FIELD

The present invention relates to a cartridge, and an electrophotographic image forming apparatus in which a cartridge is removably mountable.

Here, an electrophotographic image forming apparatus means an electrophotographic copying machine, an electrophotographic printer (laser beam printer, LED printer, etc.), and the like.

A cartridge means a development cartridge as well as a process cartridge. Here, a development cartridge means a cartridge which has a development roller for developing an electrostatic latent image formed on an electrophotographic photosensitive member, and which is removably mountable in the main assembly of an electrophotographic image forming apparatus. Some electrophotographic image forming apparatuses are structured so that the electrophotographic photosensitive member is a part of the main assembly of the image forming apparatus, whereas some electrophotographic image forming apparatuses are structured so that they employ a process cartridge (processing unit) made up of an electrophotographic photosensitive member and a development roller. A process cartridge is a cartridge in which an electrophotographic photosensitive member and one or more processing means, that is, a charging means, a development roller (developing means), and a cleaning means, are integrally disposed, and which is removably mountable in the main assembly of an electrophotographic image forming apparatus. More specifically, a process cartridge means a cartridge in which an electrophotographic photosensitive member, and at least a development roller (developing means) are integrally disposed so that they can be removably mounted in the main assembly of an electrophotographic image forming apparatus, or a cartridge in which an electrophotographic photosensitive member, a development roller (charging means), and a charging means, are integrally disposed so that they can be removably mounted in the main assembly of an electrophotographic image forming apparatus. It also means a cartridge in which an electrophotographic photosensitive member, a development roller (developing means) and a cleaning means, are integrally disposed so that they can be removably mounted in the main assembly of the electrophotographic image forming apparatus. Further, it means a cartridge in which an electrophotographic photosensitive member, a development roller (developing means), a cleaning means, and a charging means, are integrally disposed so that they can be removably mounted in the main assembly of an electrophotographic image forming apparatus.

A development cartridge or a process cartridge can be removably mounted in the main assembly of an electrophotographic image forming apparatus by a user himself or herself, making it possible for a user to maintain an image forming apparatus by himself or herself, that is, without relying on a service person. Thus, a development cartridge or a process cartridge can significantly improve an electrophotographic image forming apparatus in terms of operability, in particular, in terms of its maintenance.

BACKGROUND ART

An electrophotographic image forming apparatus uses a developing apparatus (development roller) to develop an electrostatic latent image formed on an electrophotographic photosensitive member, which is in the form of a drum (which hereafter will be referred to as photosensitive drum). Conventionally, electrophotographic image forming apparatuses are structured as follows:

In the case of some conventional electrophotographic image forming apparatuses, a cartridge (development cartridge or process cartridge) is provided with a gear. It is mounted in the main assembly of an image forming apparatus, in such a manner that the gear of the cartridge meshes with a gear with which the main assembly is provided. Thus, the development roller in the cartridge can be rotated by the rotational force transmitted to the development roller from a motor, with which the main assembly is provided, through the gear of the main assembly and the gear of the cartridge (U.S. Pat. No. 7,027,754).

In the case of the conventional electrophotographic image forming apparatuses of the other type, a cartridge is provided with the cartridge portion of the development roller coupling, whereas the main assembly is provided with the main assembly portion of the development roller coupling. Further, the main assembly is provided with a member for moving (forward or backward) the main assembly portion of the development roller coupling so that the main assembly portion of the development roller coupling can be moved forward (toward cartridge) in the axial direction of the coupling to engage the main assembly portion of the coupling with the cartridge portion of the coupling, or backward (away from cartridge) in the axial direction of the coupling to disengage the main assembly portion of the coupling from the cartridge portion of the coupling.

Thus, as the main assembly portion of the development roller coupling is rotated after the proper mounting of the cartridge into the main assembly, the rotational force of the main assembly portion of the development roller coupling is transmitted to the cartridge portion of the development roller coupling, rotating thereby the development roller (U.S. Pat. No. 2007/0,160,384).

However, the conventional structural arrangements described above make it necessary that when a cartridge is mounted into, or removed from, the main assembly of an image forming apparatus in the direction which is practically perpendicular to the axial line of the development roller in the cartridge, the main assembly portion of the developer coupling is moved in its axial direction. That is, when a cartridge is mounted or dismounted, the main assembly portion of the development roller coupling has to be moved in the horizontal direction by the opening or closing movement of the cover, with which the main assembly is provided. That is, the opening movement of the cover main assembly has to move the main assembly portion of the development roller coupling in the direction to separate from the cartridge portion of the development roller coupling, whereas the closing movement of the main assembly cover has to move the main assembly portion of the development roller coupling in the direction to engage with the cartridge portion of the development roller coupling.

In other words, one of the conventional technologies described above makes it necessary for the main assembly of an image forming apparatus to be structured so that the abovementioned rotational member (movable member) is moved in the direction parallel to its axial line by the opening or closing movement of the cartridge cover of the main assembly.

In the case of another conventional structural arrangement, it is unnecessary to move the cartridge driving gear of the main assembly forward or backward in the direction parallel to the axial line of the driving gear at the time of mounting a cartridge into the main assembly of an image forming apparatus, or dismounting the cartridge from the main assembly. Thus, this structural arrangement makes it possible to mount or dismount a cartridge in the direction which is practically perpendicular to the axial line of the cartridge driving gear of the main assembly. In the case of this structural arrangement, however, the portion through which driving force is transmitted from the main assembly to the cartridge is the interface (point of meshing) between the driving force transmitting gear of the main assembly, and the driving force receiving gear of the cartridge, making it difficult to prevent the problem that the development roller fluctuates in its rotational speed.

DISCLOSURE OF THE INVENTION

Thus, one of the primary objects of the present invention is to provide a cartridge which does not suffer from the above-described problems of the conventional technologies, and also, an electrophotographic image forming apparatus compatible with a cartridge in accordance with the present invention.

Another object of the present invention is to provide a cartridge, the development roller of which smoothly rotates even if the cartridge is mounted in an electrophotographic image forming apparatus which is not provided with a mechanism for moving the main assembly portion of the coupling for transmitting rotational force to the development, in the direction parallel to the axial line of the coupling, and also, to provide an electrophotographic image forming apparatus in which the above described cartridge is removably mountable.

A further object of the present invention is to provide a cartridge which can be removed from the main assembly of an electrophotographic image forming apparatus, which is provided with a cartridge driving shaft, in the direction which is practically perpendicular to the axial line of the cartridge driving shaft, and also, an electrophotographic image forming apparatus in which the cartridge described above is removably mountable.

A further object of the present invention is to provide a cartridge which can be mounted into the main assembly of an electrophotographic image forming apparatus, which is provided with a cartridge driving shaft, in the direction which is practically perpendicular to the axial line of the cartridge driving shaft, and also, an electrophotographic image forming apparatus in which the cartridge described above is removably mountable.

A further object of the present invention is to provide a cartridge which can be mounted into, or dismounted from, the main assembly of an electrophotographic image forming apparatus, which is provided with a cartridge driving shaft, in the direction which is practically perpendicular to the axial line of the cartridge driving shaft, and also, an electrophotographic image forming apparatus in which the above described cartridge is removably mountable.

A further object of the present invention is to provide a cartridge which is removable from the main assembly of an electrophotographic image forming apparatus having a cartridge driving shaft, in the direction which is practically perpendicular to the axial line of the cartridge driving shaft, and the development roller of which smoothly rotates, and also, to provide an electrophotographic image forming apparatus in which the above described cartridge is removably mountable.

A further object of the present invention is to provide a process cartridge which is mountable in an electrophotographic image forming apparatus having a cartridge driving shaft, in the direction which is practically perpendicular to the axial line of the cartridge driving shaft, and the development roller of which smoothly rotates, and also, to provide an electrophotographic image forming apparatus in which the above described cartridge is removably mountable.

A further object of the present invention is a cartridge which can be mounted into, or removed from, the main assembly of an electrophotographic image forming apparatus having a cartridge driving shaft, in the direction which is practically perpendicular to the axial line of the cartridge driving shaft, and the development roller of which smoothly rotates, and also, to provide an electrophotographic image forming apparatus in which the above described cartridge is removably mountable.

A further object of the present invention is to provide a cartridge, the development roller of which rotates more smoothly than the development roller in a cartridge, which receives rotational force from the main assembly of an electrophotographic image forming apparatus by the meshing of its gear with the gear of the main assembly, and also, to provide an electrophotographic image forming apparatus in which the above described cartridge is removably mountable.

A further object of the present invention is to provide a development cartridge (developing device of process cartridge), which reliably transmits rotational force to its development roller having been precisely positioned relative to the photosensitive drum, and can smoothly rotate the development roller, and also, an electrophotographic image forming apparatus in which the process cartridge is removably mountable.

There has been known the so-called contact developing method, which places a development roller in contact with a photosensitive drum to develop an electrostatic latent image on a photosensitive drum.

A further object of the present invention is to provide a cartridge which can smoothly rotates its development roller even if the development roller is moved in the direction to be separated from the photosensitive drum while it is in contact with the photosensitive drum, and also, an electrophotographic image forming apparatus in which the cartridge is removably mountable.

There has been known a combination of an electrophotographic image forming apparatus and a cartridge therefor, which is structured so that the rotational force for rotating the photosensitive drum, and the rotational force for rotating the development roller, are separately received from the main assembly of the image forming apparatus.

A further object of the present invention is to provide a cartridge structured so that the coupling through which the rotational force for rotating the photosensitive drum is moved forward or backward in the direction parallel to its axial line, and also, an electrophotographic image forming apparatus in which the cartridge is removably mountable.

According to an aspect of the present invention, there is provided a cartridge for use with a main assembly of an electrophotographic image forming apparatus, said main assembly including a driving shaft having a rotational force applying portion, wherein said cartridge is dismountable from the main assembly in a direction substantially perpendicular to an axial direction of the driving shaft, said cartridge comprising i) a developing roller for developing an electrostatic latent image formed on an electrophotographic photosensitive drum, said developing roller being rotatable about an axis thereof; and ii) a coupling member engageable with said rotational force applying portion to receive a rotational force for rotating said developing roller, said coupling member being capable of taking a rotational force transmitting angular position for transmitting the rotational force for rotating said developing roller to said developing roller and a disengaging angular position in which said coupling member is inclined away from said rotational force transmitting angular position, wherein when said cartridge is dismounted from the main assembly of the electrophotographic image forming apparatus in a direction substantially perpendicular to the axis of said developing roller, said coupling member moves from said rotational force transmitting angular position to said disengaging angular position.

According to another aspect of the present invention, there is provided an electrophotographic image forming apparatus to which a cartridge is detachably mountable, said apparatus comprising i) a driving shaft having a rotating force applying portion; and ii) a cartridge including a developing roller for developing an electrostatic latent image formed on an electrophotographic photosensitive drum, said developing roller being rotatable about an axis thereof; and a coupling member engageable with said rotational force applying portion to receive a rotational force for rotating said developing roller, said coupling member being capable of taking a rotational force transmitting angular position for transmitting the rotational force for rotating said developing roller to said developing roller and a disengaging angular position in which said coupling member is inclined away from said rotational force transmitting angular position, wherein when said cartridge is dismounted from the main assembly of the electrophotographic image forming apparatus in a direction substantially perpendicular to the axis of said developing roller, said coupling member moves from said rotational force transmitting angular position to said disengaging angular position.

The present invention made it possible to provide a cartridge which can be removed from the main assembly of an electrophotographic image forming apparatus, which is provided with a cartridge driving shaft, in the direction which is practically perpendicular to the axial line of the cartridge driving shaft, and also, an electrophotographic image forming apparatus in which the cartridge described above is removably mountable.

The present invention made it possible to provide a cartridge which can be mounted into the main assembly of an electrophotographic image forming apparatus, which is provided with a cartridge driving shaft, in the direction which is practically perpendicular to the axial line of the cartridge driving shaft, and also, an electrophotographic image forming apparatus in which the cartridge described above is removably mountable.

The present invention made it possible to provide a cartridge which can be mounted into, or dismounted from, the main assembly of an electrophotographic image forming apparatus, which is provided with a cartridge driving shaft, in the direction which is practically perpendicular to the axial line of the cartridge driving shaft, and also, an electrophotographic image forming apparatus in which the above described cartridge is removably mountable.

The present invention made it possible to provide a cartridge which is to be mounted in the main assembly of an electrophotographic image forming apparatus having no mechanism for moving its coupling for transmitting rotational force to the development roller in the cartridge, in the axial direction of the coupling, and yet, smoothly rotate its development roller.

The present invention made it possible to provide a cartridge which smoothly rotates its development roller even though it is structured so that the direction in which it is to be moved to be removed from the main assembly of an electrophotographic image forming apparatus is practically perpendicular to the axial line of the drive shaft with which the main assembly is provided.

The present invention made it possible to provide a cartridge which smoothly rotates its development roller even though it is structured so that the direction in which it is to be moved to be attached to the main assembly of an electrophotographic image forming apparatus is practically perpendicular to the axial line of the drive shaft with which the main assembly is provided.

The present invention made it possible to provide a cartridge which smoothly rotates its development roller even though it is structured so that the direction in which it is to be moved to be attached to, or removed from, the main assembly of an electrophotographic image forming apparatus is practically perpendicular to the axial line of the drive shaft with which the main assembly is provided.

The present invention made it possible to provide a combination of an electrophotographic image forming apparatus and a cartridge therefor, which rotates its development roller more smoothly than a combination of an electrophotographic image forming apparatus and a cartridge therefor, which uses a set of gears to transmit rotational force from the main assembly of the image forming apparatus to the cartridge.

The present invention made it possible to provide a combination of an electrophotographic image forming apparatus and a cartridge therefor, which reliably transmits rotational force to the development roller in the cartridge and smoothly rotates the development roller, even though the combination is structured so that the development roller is positioned relative to the photosensitive drum with which the main assembly of the apparatus is provided.

The present invention made it possible to provide a combination of an electrophotographic image forming apparatus and a cartridge therefor, which smoothly rotates the development roller in the cartridge, even if the development roller which is in contact with the photosensitive drum is moved to be separated from the photosensitive drum.

The present invention made it possible to provide a combination of an electrophotographic image forming apparatus and a cartridge therefor, the mechanism of which for the photosensitive drum to receive rotational force is structured so that the coupling of the mechanism is moved in the axial direction of the coupling.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION (Embodiment 1)

To begin with, the present invention will be described with reference to one of the examples of a development cartridge compatible with the present invention.

It should be noted here that a development cartridge is an example of a process cartridge.

(1) Description of Development Cartridge

Figure 1:
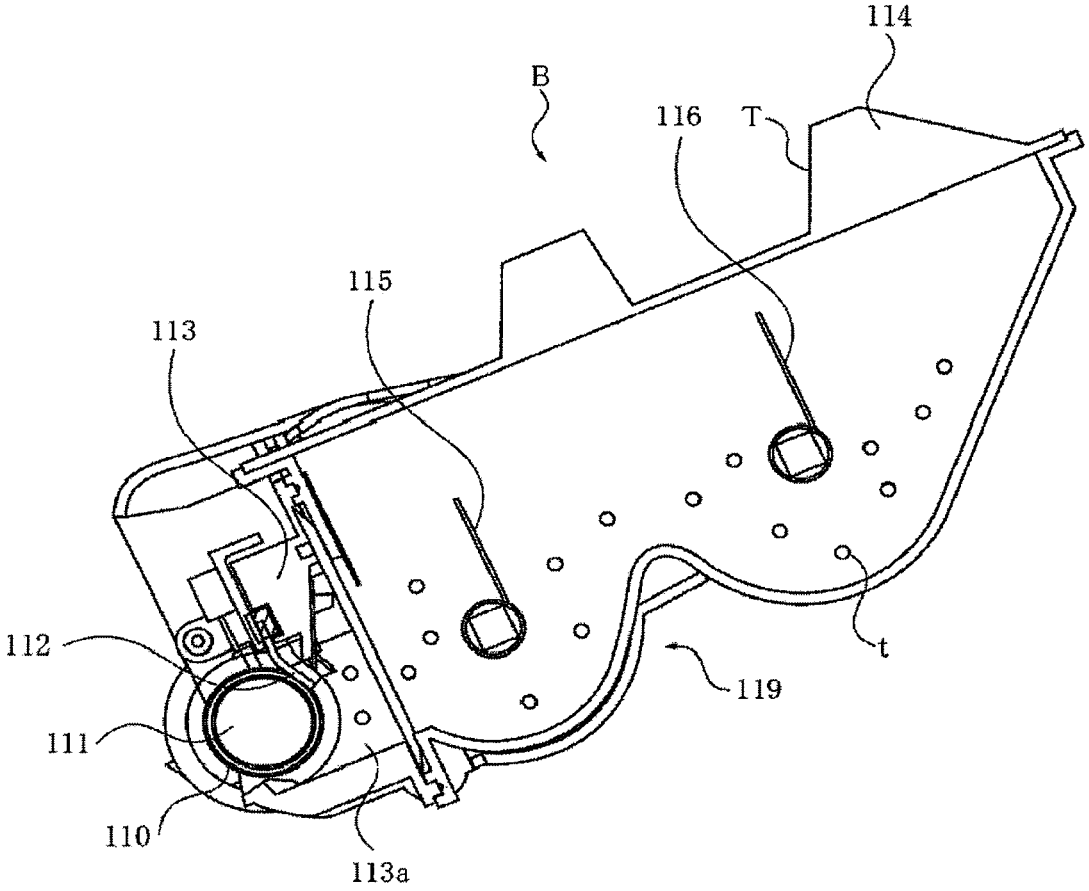
FIG. 1 is a side sectional view of a cartridge according to an embodiment of the present invention.
Figure 2:
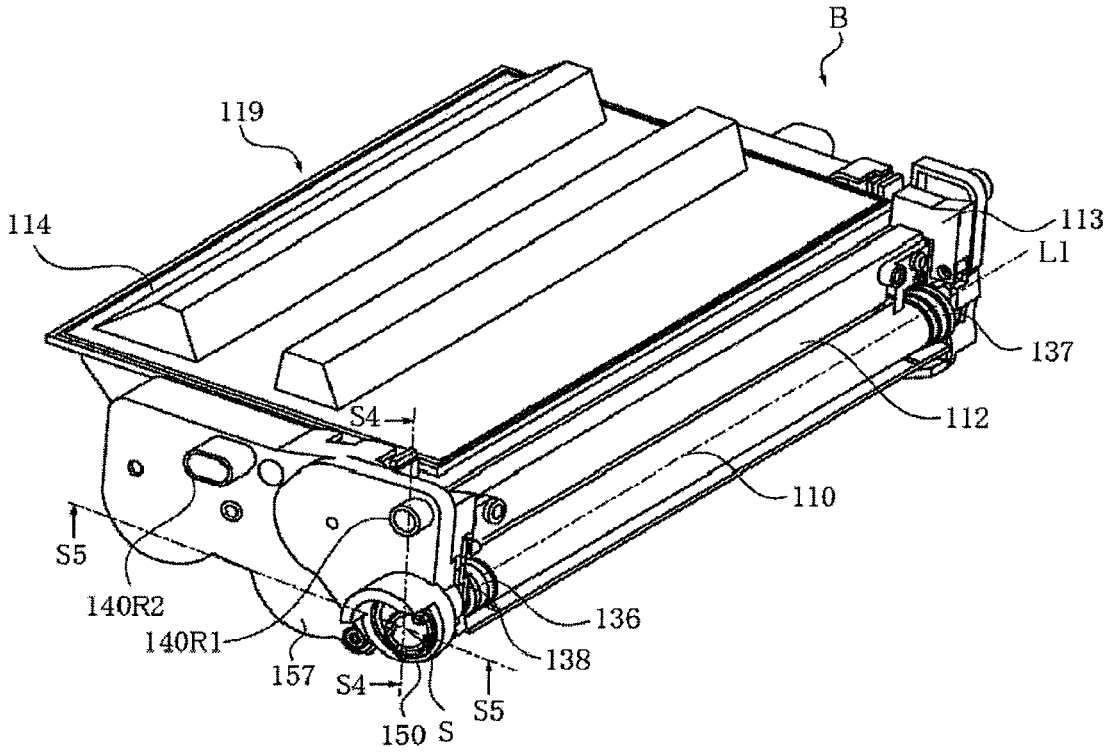
FIG. 2 is a perspective view of the cartridge according to the embodiment of the present invention.
Figure 3:
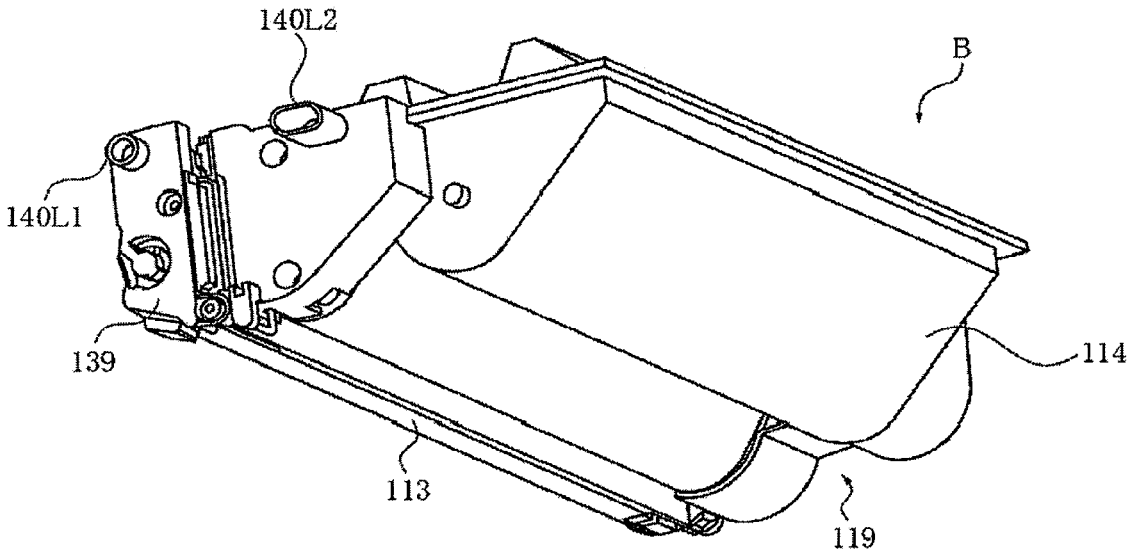
FIG. 3 is a perspective view of the cartridge according to the embodiment of the present invention.

First, referring to FIGS. 1-4, a development cartridge B (which hereafter will be referred to simply as cartridge), which is one of the embodiments of the present invention, will be described. FIG. 1 is a sectional view of the cartridge B. FIGS. 2 and 3 are perspective views of the cartridge B. Further, FIG. 4 is a sectional view of the main assembly A of an electrophotographic image forming apparatus (which hereafter will be referred to simply as main assembly A).

The cartridge B is attachable to, or detachable from, the main assembly A by a user.

Figure 4:
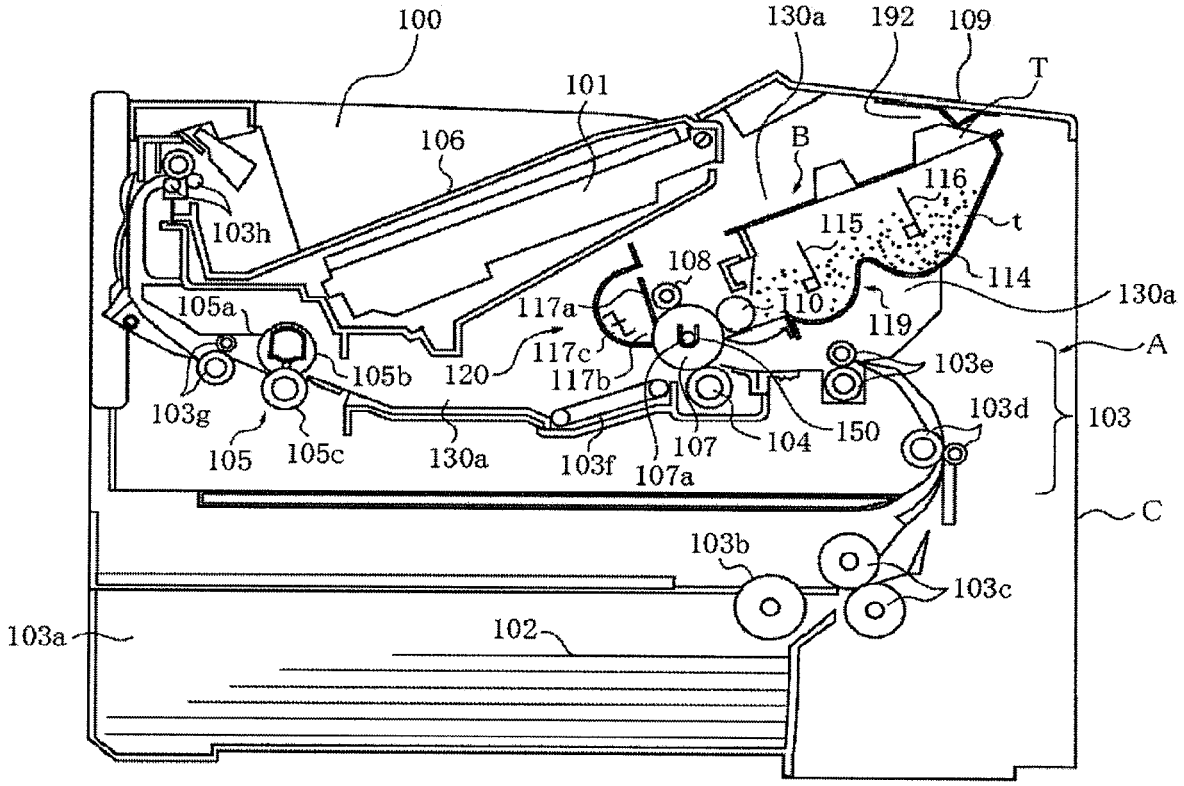
FIG. 4 is a side sectional view of a main assembly according to the embodiment of the present invention.

Referring to FIGS. 1-4, the cartridge B has a development roller 110. Referring to FIG. 4, the cartridge B is mounted in the main assembly A. It rotates by receiving rotational force from the main assembly A through a coupling mechanism (which will be described later) while the cartridge B is properly situated in its image forming position in the main assembly A.

The development roller 110 supplies the portion of an electrophotographic photosensitive drum 107 (which hereafter will be referred to simply as photosensitive drum) (FIG. 4), which is in the development area of the apparatus main assembly A, with developer t. It develops an electrostatic latent image on the peripheral surface of the photosensitive drum 107, with the use of the developer t. There is a magnetic roller 111 (stationary magnet) in the development roller 110.

The cartridge B is provided with a development blade 112, which is in contact with the development roller 110. The development blade 112 regulates the amount by which the developer t is allowed to remain on the peripheral surface of the development roller 110. It also frictionally charges the developer t.

The developer t is stored in the developer storage portion 114 of the cartridge B, and is sent into the development chamber 113*a* of the cartridge B, by the rotation of the toner stirring members 115 and 116 of the cartridge B. The development roller 110 is rotated while voltage is applied to the development roller 110. As a result, a layer of the frictionally charged developer t is formed on the peripheral surface of the development roller 110 by the development roller 110. The charged toner particles in this layer of the frictionally charged developer are transferred onto the photosensitive drum 107 in the pattern of the abovementioned electrostatic latent image; the development roller 110 develops the latent image.

The developed image on the photosensitive drum 107, that is, the image formed of the developer t, is transferred onto a sheet of recording medium 102 by a transfer roller 104. The recording medium may be any medium on which an image can be formed (onto which image formed of developer (toner) can be transferred). For example, it may be an ordinary piece of paper, OHP sheet, and the like.

The cartridge B has a development unit 119, which is made up of a developing means holding frame 113 and a developer storing frame 114. More specifically, the development unit 119 has the development roller 110, development blade 112, developing means frame portion, development chamber 113*a*, developer storing frame portion 114, and stirring members 115 and 116.

The development roller 110 is rotatable about its axial line L1.

The apparatus main assembly A is provided with a cartridge compartment 130*a*, into which a user is to mount the cartridge B by holding the cartridge B by the handhold T of the cartridge B. As the cartridge B is mounted, the coupling 150 (rotational force transmitting member, which will be described later) of the cartridge B becomes connected to the drive shaft 180 (FIG. 17), with which the apparatus main assembly A is provided, making it possible for the development roller 110, etc., to rotate by receiving rotational force from the apparatus main assembly A. In a case where a user wants to take the cartridge B out of the cartridge compartment 130*a* of the apparatus main assembly A, the user is to pull the cartridge B by grasping the handhold T. As the cartridge B is moved in the direction to be moved out of the apparatus main assembly A, the coupling 150 of the cartridge B becomes disengaged from the driving shaft 180.

The direction in which the cartridge B is to be moved to attach the cartridge B to the apparatus main assembly A (to mount cartridge into cartridge compartment 130*a*), or detach the cartridge B from the apparatus main assembly A (to dismount cartridge from cartridge compartment 130*a*), is practically perpendicular to the axial line L3 of the drive shaft 180. This subject will be described later in detail.

(2) Description of Electrophotographic Image Forming Apparatus

Next, referring to FIG. 4, the electrophotographic image forming apparatus which uses the cartridge B will be described. The image forming apparatus 100 in this embodiment is a laser beam printer.

Designated by a referential letter A is the main assembly of the image forming apparatus 100. Incidentally, the apparatus main assembly A is what remains after the removal of the cartridge B from the image forming apparatus 100.

The apparatus main assembly A is provided with a charge roller 108 (charging member), which is parallel to the photosensitive drum 107. The charge roller 108 charges the photosensitive drum 107 with the voltage applied to the charge roller 108 from apparatus main assembly A. It is in contact with the photosensitive drum 107, and is rotated by the rotation of the photosensitive drum 107.

A drum unit 120 has the photosensitive drum 107 and a cleaning blade 117*a* (cleaning means). The drum unit 120 has also a storage bin 117*b* for removed developer, a screw 117*c* for conveying the removed developer to a box (unshown) with which the apparatus main assembly A is provided to store the removed developer, and the charge roller 108. These components are integrally disposed in the apparatus main assembly A. That is, the unit 120 (cartridge B) and the apparatus main assembly A are structured so that as the cartridge B is mounted into the apparatus main assembly A, the photosensitive drum 107 is precisely positioned in its preset position (cartridge position) in the apparatus main assembly A. More specifically, the unit 120 is provided with a pair of bearings (unshown), which protrude outward from the lengthwise ends of the cartridge B, one for one, and the axial line of each of which coincides with the axial line of the photosensitive drum 107. Thus, when the cartridge B is in the abovementioned preset image forming position in the apparatus main assembly A, the cartridge B is supported by the pair of bearings, which are in a pair of grooves (unshown), one for one, with which the apparatus main assembly A is provided.

The removed developer mentioned above is the developer which was removed from the photosensitive drum 107 by the blade 117*a*.

The unit 120 may be made solidly attachable to, or removably mountable in, the apparatus main assembly A. As for the structural arrangement for positioning the unit 120 in the apparatus main assembly A so that the photosensitive drum 107 in the unit 120 is precisely positioned for image formation, relative to the main assembly A, any one of the known structural arrangements may be employed.

Figure 5:
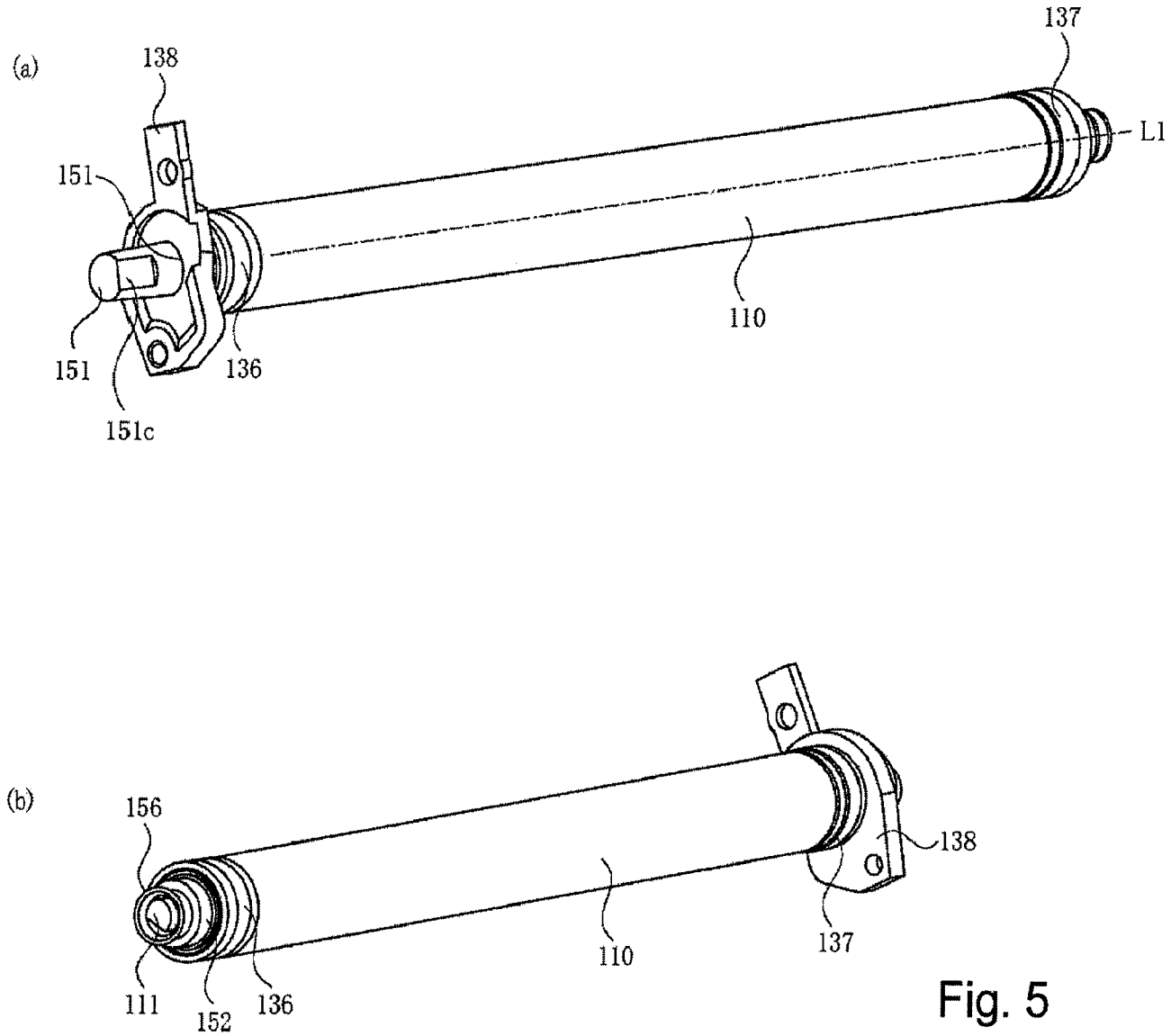
FIG. 5 is a perspective view of a developing roller according to the embodiment of the present invention.

The cartridge B is mounted in the apparatus main assembly A (cartridge compartment 130*a*). Then, a user is to close the cartridge compartment door 109 with which the apparatus main assembly A is provided. As the cartridge door 109 is closed, the cartridge B is pressed toward the photosensitive drum 107 by the resiliency of a pair of spring 192 which are on the inward side of the door 109 is provided. Therefore, the development roller 110 is kept pressed toward surface of the photosensitive drum 107, in such a manner that a proper amount of distance is maintained between the development roller 110 and photosensitive drum 107 (FIG. 4). That is, the cartridge B is precisely positioned relative to the photosensitive drum 107. Thus, the development roller 110 is precisely positioned relative to the photosensitive drum 107. More concretely, the lengthwise ends of the drum shaft (unshown) of the photosensitive drum 107 are fitted with the pair of bearings 107*a*, one for one, which are coaxial with the drum shaft. Further, the pair of bearings 107*a* are supported by a pair of bearing positioning portions 150, with which the apparatus main assembly A is provided. Thus, the photosensitive drum 107 is rotatable while remaining precisely positioned relative to the apparatus main assembly A (FIGS. 4 and 5).

The door 109 is to be opened by a user when the cartridge B needs to be attached to the apparatus main assembly A by the user, or when the cartridge B needs to be taken out the apparatus main assembly A by the user.

The image forming operation to be carried out by this electrophotographic image forming apparatus is as follows: The rotating photosensitive drum 107 is uniformly charged by the charge roller 108, across the portion of its peripheral surface, which is moving in contact with the charge roller 108. Then, a beam of laser light is projected, while being modulated with the information regarding the image to be formed, upon the charged portion of the peripheral surface of the photosensitive drum 107, by an optical means 101 having laser diodes, polygon mirror, lenses, and deflective mirrors (which are not shown). As a result, an electrostatic latent image, which reflects the information regarding the image to be made, on the peripheral surface of the photosensitive drum 107. This latent image is developed by the abovementioned development roller 110.

Meanwhile, in synchronism with the development of the electrostatic latent image, a sheet of recording medium 102 in a cassette 103*a* is sent out of the cassette 103, and then, is conveyed to the image transferring position by pairs 103*c*, 103*d*, and 103*e*, of recording medium conveyance rollers. There is a transfer roller 104 (transferring means) in the transferring position. To the transfer roller 104, voltage is applied from the apparatus main assembly A. As a result, the image formed on the photosensitive drum 107, of the developer, transfers onto the sheet of recording medium 102.

The apparatus main assembly A is provided with a cleaning blade 117*a*, which extends from one lengthwise end of the photosensitive drum 107 to the other, and the cleaning edge of which is elastically in contact with the peripheral surface of the photosensitive drum 107. The cleaning blade 117*a* is for removing the developer t remaining on the peripheral surface of the photosensitive drum 107 after the transfer of the developer image onto the recording medium 102. After the removal of the developer t from the peripheral surface of the photosensitive drum 107 by the blade 117*a*, the developer t is temporarily stored in the developer bin 117*b*. Then, the removed developer t in the developer bin 117*b* is conveyed to abovementioned box (unshown) for removed developer, by a developer conveying screw 117*c* in the developer bin 117*b*, and then, is accumulated in the box.

After the transfer of the developer image onto the recording medium 102, the recording medium 102 is conveyed to a fixing means 105 by a guide 103*f*. The fixing means 105 is provided with a driving roller 105*c*, and a fixing roller 105 which contains a heater 105*a*. The fixing means 105 fixes the developer image to the recording medium 102 by applying heat and pressure to the recording medium while the recording medium 102 is conveyed through the fixing means 105. After the formation of the image on the recording medium 102 (after the fixation of the developer image on recording medium 102), the recording medium 102 is conveyed further, and then, is discharged into a tray 106, by a pair of rollers 103*g* and a pair of rollers 103*h*. The pairs of rollers

103*c*, 103*d*, and 103*e*, guide 103*f*, and pairs of rollers 103*g* and 103*h*, etc., make up the recording medium conveying means 103.

The cartridge compartment 130*a* is the room (space) in which the cartridge B is to be set. As the cartridge B is mounted into this room, the coupling 150 of the cartridge B (which will be described later) becomes connected to the drive shaft 180 with which the apparatus main assembly A is provided. In this embodiment, the placement of the cartridge B in the cartridge compartment 130*a* is synonymous to the attachment of the cartridge B to the apparatus main assembly A. Further, the removal of the cartridge B from the cartridge compartment 130*a* is synonymous to the detachment of the cartridge B from the apparatus main assembly A.

(3) Structure of Development Roller

Next, referring to FIG. 5, the development roller 110 will be described about its structure. FIG. 5(*a*) is a perspective view of the development roller 110 as seen from its rotational force receiving side (which hereafter may be referred to as driving force receiving side). FIG. 5(*b*) is a perspective view of the development roller 110 as seen from the opposite side from the driving force receiving side (which hereafter may be referred to simply as opposite side).

The development roller 110 is made up of a development roller cylinder 110*a*, a development roller flange 151 (which is at driving force receiving end), a development roller flange 152 (which is at opposite end), and a magnetic roller 111.

The development roller cylinder 110*a* is made up of a cylinder made of an electrically conductive cylinder, such as an aluminum cylinder, and a coated layer. The cylinder 110*a* bears the developer on its peripheral surface. The developer borne on the cylinder 110*a* is charged. The lengthwise ends of the cylinder 110*a* are provided with openings 110*a*1 and 110*a*2, one for one, which are roughly the same in diameter as the cylinder 110*a*, and are fitted with the abovementioned flanges 151 and 152, respectively.

The flange 151 is formed of a metallic substance, such as aluminum, stainless steel, etc. However, it may be formed of a resinous substance, as long as it can withstand the amount of torque necessary to rotate the development roller 110.

Figure 8:
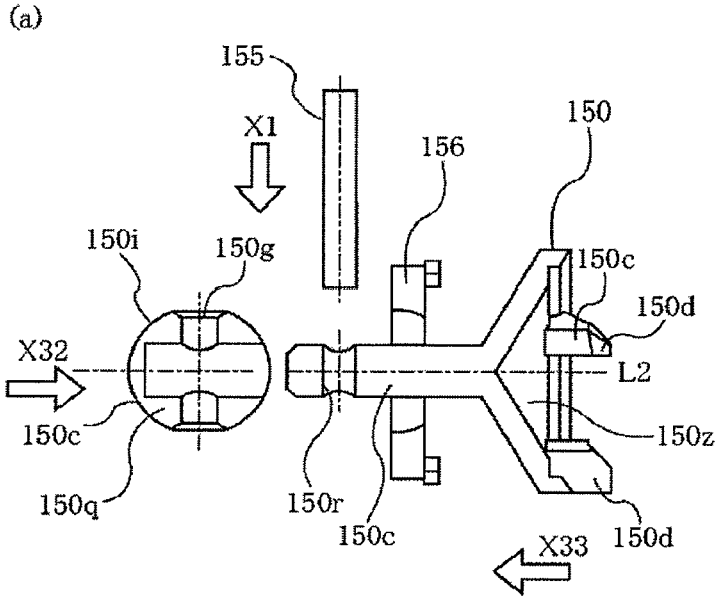
FIG. 8 is a view which shows the assembling process of the coupling and the driving gear according to the embodiment of the present invention.
Figure 8:
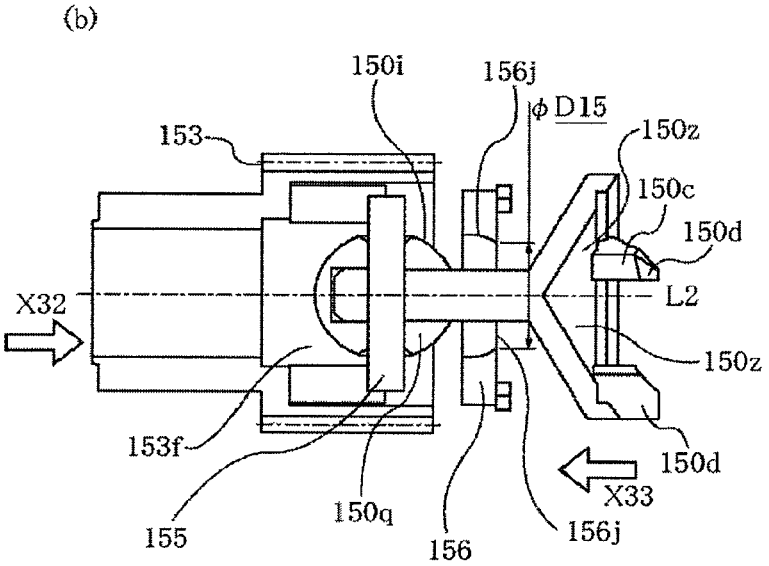

The flange 151 is provided with a gear fitting portion 151*c*, around which the development roller gear 153 (FIG. 8(*b*)) for driving the developer stirring members 115 and 116 (FIG. 1), etc., is fitted. It is also provided with a bearing fitting portion 151*d*, around which the development roller bearing 138 is fitted to rotatably support the development roller 110. The gear fitting portion 151*c* and bearing fitting portion 151*d* are coaxial with the flange 151. The flange 151 is also provided with an internal cavity for supporting the magnetic roller 111, which will be described later. The development roller gear 153, with which the flange 151 is fitted, is fitted with the coupling 150 (which will be described later) in such a manner that the coupling 150 can be tilted relative to the axial line of the development roller 110 even while being moved.

The flange 152 is made of a metallic substance, such as aluminum or stainless steel, as is the flange 151. The flange 152 also may be made of a resinous substance as long as it can withstand the amount of load to which the development roller 110 is subjected. Further, the axial line of the cylinder fitting portion 152*b* roughly coincides with that of the bearing 152*a*. Further, one of the lengthwise end portions of the magnetic roller 111 is made to extend beyond the corresponding lengthwise end of the development roller 110, and is supported by the bearing 152*a*.

The magnetic roller 111 is formed of a magnetic substance, or a resinous substance into which magnetic particles have been mixed. The magnetic roller 111 is provided with two to six magnetic poles, which are distributed in its circumferential direction. It contributes to the conveyance of the developer, by holding the developer on the peripheral surface of the development roller 110.

The above-described magnetic roller 111 is placed in the development roller cylinder 110*a*, and the fitting portion 151*a* of the flange 151 is fitted in the opening 110*a*1 of the development roller cylinder 110*a*. Further, the fitting portion 152*b* of the flange 152 is fitted in the opening 110*a*2 of the other lengthwise end of the development roller cylinder 110*a*. The method for solidly attaching the flanges 151 and 152 to the development roller cylinder 110*a* is adhesion, crimping, etc. Further, a spacer 136, the development roller bearing 138, and the development roller gear (unshown) are fitted from the driving force receiving side of the development roller 110. Further, a spacer 137 and development roller contact 156 is fitted from the opposite side of the development roller 110.

The spacers 136 and 137 are the members for regulating the gap between the development roller 110 and photosensitive drum 107. There are cylindrical members formed of a resinous substance, and are roughly 200-400 μm in thickness. The spacer 136 is fitted around one of the lengthwise end portions of the development roller cylinder 110*a*, and the spacer 137 is fitted around the other lengthwise end portion of the development roller cylinder 110*a*. With the fitting of the development roller 110 with the spacers 136 and 137, a gap of roughly 200-400 μm is maintained between the development roller 110 and photosensitive drum 107.

The bearing 138 is the bearing for rotatably supporting the development roller 110 by the development unit frame 113 (FIG. 1).

The development voltage contact 156 is formed of an electrically conductive substance (primarily, metallic substance), and is in the form of a coil. The internal surface of the electrically conductive development roller cylinder 110*a*, or the flange 152, is provided with the development voltage contact 156*b*. In this embodiment, the image forming apparatus is structured so that the development voltage contact 156 contacts the flange 152. Thus, as the cartridge B is mounted in the apparatus main assembly A, electrical connection is established between the apparatus main assembly A and cartridge B through the external electrical contact (unshown) of the cartridge B and the electrical contact 156*a* of the apparatus main assembly A. That is, while the cartridge B is in its image forming position in the apparatus main assembly A, the electrical contacts (unshown), with which the apparatus main assembly A is provided, remain in contact with the external electrical contacts of the cartridge B, making it possible for the cartridge B to receive electrical voltage from the apparatus main assembly A. The voltage received by the external electrical contact of the cartridge B is supplied to the development roller 110 through the electrical contact 156.

(5) Rotational Force Transmitting Portions (Coupling Member)

Figure 6:
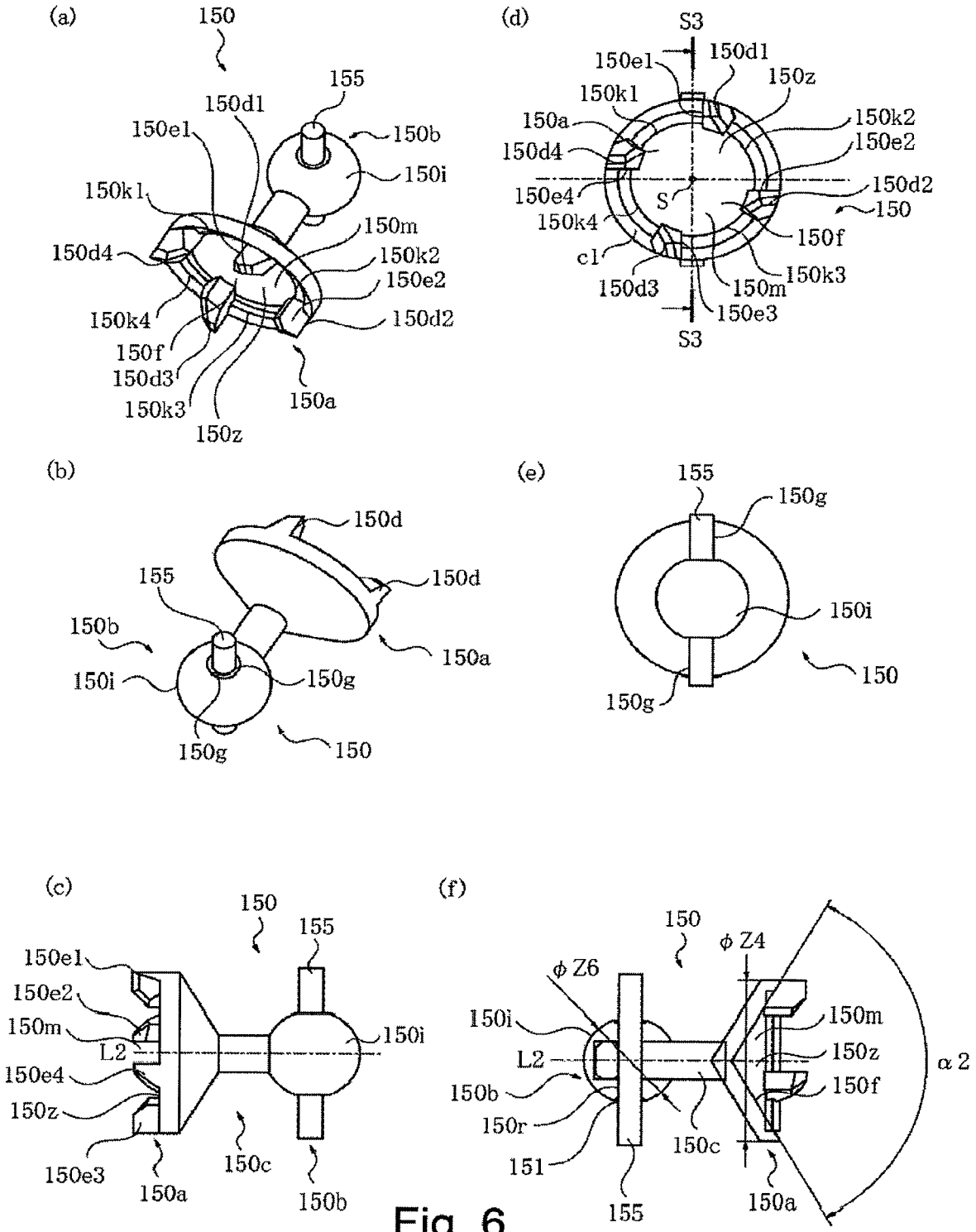
FIG. 6 is a perspective view and a longitudinal sectional view of the coupling according to the embodiment of the present invention.

Then, referring to FIG. 6, an example of the coupling member which is the rotational force transmitting portion will be described. FIG. 6(*a*) is a perspective view of a coupling member, as seen from the main assembly side, FIG. 6(*b*) is a perspective view of the coupling member, as seen from the developing roller side. FIG. 6(*c*) is a view, as seen in a direction perpendicular to a direction of the coupling axis L2. FIG. 6(*d*) is a side view of the coupling member, as seen from the main assembly side, FIG. 6(*e*) is a view, as seen from a developing roller side. FIG. 6(*f*) is a sectional view taken along the line S3 in FIG. 6(*d*).

In the state that the cartridge B is set in the set portion 130*a* the coupling member (coupling) 150 engages with the drive shaft 180 (FIG. 17) of the main assembly A. The coupling 150 is disengaged from the drive shaft 180 by taking the cartridge B out of the main assembly A. In this case, the cartridge B is moved in a direction substantially perpendicular to a direction of the axis L3 of the drive shaft 180 from the set portion in the main assembly A. At the time of the mounting, the cartridge B is moved to the set portion of the main assembly A in the direction substantially perpendicular to the direction of the axis L3 of the drive shaft 180. In the state of being in engagement with the drive shaft 180 the coupling 150 receives a rotational force from the motor 186 (FIG. 14) provided in the main assembly A through the drive shaft 180. In addition, the coupling 150 transmits the rotational force to the developing roller 110. By this, the developing roller 110 is rotated. Here, the material of the coupling 150 is the resin material of polyacetal, polycarbonate PPS, or the like. However, in order to raise the rigidity of the coupling 150, the glass fiber, the carbon fiber, or the like may be mixed in the resin material in accordance with the required load torque. When such material is mixed, a rigidity of the coupling 150 can be raised. In addition, in the resin material, the rigidity may further be raised by inserting a metal member. In addition, the whole coupling 150 may be manufactured from metal or the like. In addition, the material of the coupling is similar also in the embodiments as will be described hereinafter. The coupling 150 has three main parts (FIG. 6(*c*)).

The first portion is a driven portion 150*a* which has a rotational force reception surface (rotational force receiving portion) 150*e* (150*e*1 to 150*e*4) for receiving the rotational force from the pin 182 by engaging with the drive shaft 180. The second portion is a driving portion 150*b* for transmitting the rotational force by engaging with the development gear 153. In addition, the third portion is an intermediate part 150*c* between the driven portion 150*a* and the driving portion 150*b*. The development gear 153 transmits the rotational force received by the coupling 150 from the main assembly A to a developer supply roller, for example (as will be described hereinafter).

As shown in FIG. 6(*f*), the driven portion 150*a* has a drive shaft insertion opening 150*m* which is an expanded part which expands in the shape of conic away from the axis L2. As shown in the Figure, the opening 150*m* constitutes a recess 150*z*. The recess 150*z* is co-axial with the rotation axis L2 of the coupling 150.

The driving portion 150*b* has a spherical driving shaft receiving surface 150*i*. By the receiving surface 150*i*, the coupling 150 can substantially pivot (move) between a rotational force transmitting angular position and a pre-engagement angular position (or a disengaging angular position) relative to the axis L1. By this, the coupling 150 engages with the drive shaft 180 without being obstructed by a free end portion 180*b* of the drive shaft 180, irrespective of a rotational phase of the developing roller 110. As shown in the Figure, the driving portion 150*b* has a projecting configuration.

And, a plurality of drive receiving projections 150*d*1-*d*4 are provided on the circumference (FIG. 6(*d*), phantom circle C1) of an end surface of the driven portion 150*a*. In addition, the drive receiving stand-by portions 150*k*1, 150*k*2, 150*k*3, 150*k*4 is provided between the adjacent projections 150*d*1 or 150*d* 2 or 150*d*3, 150*d*4. The intervals of the adjacent projections 150*d*1-*d*4 are larger than an outer diameter of the pins 182 so that the pins (the rotational force applying portions) 182 can enter the intervals. These clearance portions of the intervals are standing-by portions 150*k*1-*k*4. Furthermore, in FIG. 6(*d*), the clockwise downstream side of the projection 150*d* is provided with a rotational force reception surface (the rotational force receiving portion) 150*e* crossing with the rotational direction of coupling 150, and (150*e*1-*e*4). When the drive shaft 180 rotates, the pins 182 abut to one of the receiving surfaces 150*e*1-*e*4. And, the receiving surfaces 150*e*1-*e*4 are pushed by the peripheries of the pins 182, so that the coupling 150 rotates about the axis L2.

The driving portion 150*b* has a spherical surface. For this reason, in the cartridge B, irrespective of the rotational phase of the developing roller 110, the coupling 150 can substantially pivot (move) between the rotational force transmitting angular position and the pre-engagement angular position (or the disengaging angular position). In the illustrated example, the driving portion 150*b* is constituted by the spherical developing shaft receiving surface 150*i* which has the axis L2 as the axis thereof. And, at the position passing through the center thereof, a fixing hole 150*g* penetrated by the pin (the rotational force transmitting portion) 155 is provided.

As has been described hereinbefore, the coupling 150 has the recess 150*z* co-axial with the rotation axis L2 of the coupling 150. In the state that the coupling 150 is in the rotational force transmitting angular position, the recess 150*z* covers the free end of the drive shaft 180. And, the rotational force reception surface 150*e* (150*e*1 to 150*e*4) engages with the rotational force transmitting pins (rotational force applying portion) 182 which project in the direction perpendicular to the axis L3 of the drive shaft 180 in the free end portion of the drive shaft 180 in the rotational direction of the coupling 150. The rotational force reception surface 150*e* is the rotational force receiving portion. The pin 182 is the rotational force applying portion. In this manner, the coupling 150 receives the rotational force from the drive shaft 180 to rotate. In dismounting the cartridge B from the main assembly A the cartridge B is moved, so that the coupling 150 moves in the direction substantially perpendicular to the axis L1 of the developing roller 110, in the cartridge In response to the movement of the cartridge B, the coupling 150 pivots (moves) to the disengaging angular position from the rotational force transmitting angular position, so that a part of recess 150*z* (free end position 150A1) circumvents the drive shaft 180. By this, the coupling 150 can disengage from the drive shaft 180.

The rotational force receiving surfaces (rotational force receiving portions) 150*e* (150*e*1 to 150*e*4) are positioned, interposing the center S, on the phantom circle which has a center S on the rotation axis L2 of the coupling 150 C1 (FIG. 6(*d*)). In this embodiment, the rotational force receiving surfaces 150*e* are disposed at four places.

Here, the force is uniformly applied to the coupling 150 by the opposing arrangement of the rotational force reception surfaces 150*e*. Accordingly, the rotational accuracy of the coupling 150 can be improved.

In the state of being in the rotational force transmitting angular position the axis L2 of the coupling 150 is substantially co-axial with the axis L1 of the developing roller 110. In the state that the coupling 150 is in the disengaging angular position, it inclines relative to the axis L1 so that in the removing direction X6 of dismounting the cartridge B, the upstream side (free end portion 150 A3) can pass by the free end of the drive shaft 180 from the main assembly A.

(6) Development Gear

Figure 7:
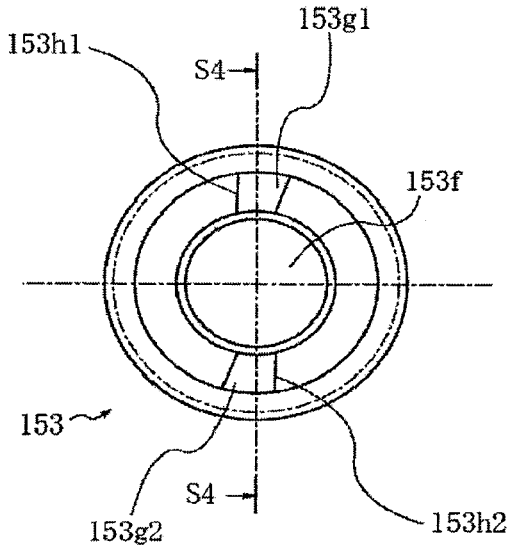
FIG. 7 is a side view and a longitudinal sectional view of the driving gear according to the embodiment of the present invention.
Figure 7:
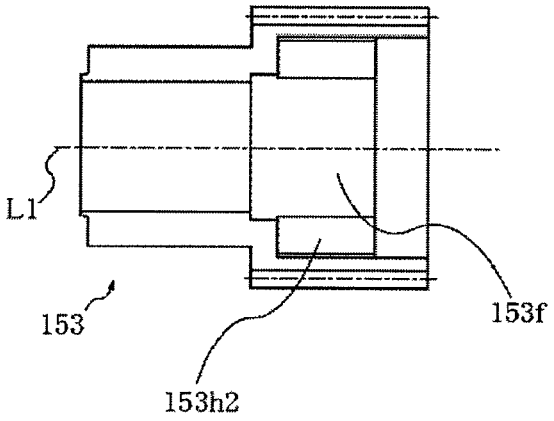

Referring to FIG. 7, an example of a development gear 153 which supports the coupling 150 will be described. FIG. 7(*a*) is a view, as seen from the drive shaft side, and FIG. 7(*b*) is a sectional view taken along a line S4-S4 in FIG. 7(*a*).

The openings 153*g*1 or 153*g*2 shown in FIG. 7 (*a*) are the grooves extended in a rotational axis direction of the development gear 153. A space portion 153*f* is provided between the openings 153*g*1, 153*g*2. In mounting the coupling 150 to the development gear 153 the pins 155 are received in the opening 153*g*1, 153*g*2. In addition, the developing shaft receiving surface 150*i* is accepted in the space portion 153*f*.

By the above-described structure, in the cartridge B, irrespective of the rotational phase (stop position of the pin 155) of the developing roller 110, the coupling 150 is pivotable (movable) between the rotational force transmitting angular position and the pre-engagement angular position (or the disengaging angular position).

In FIG. 7(*a*), the clockwisely upstream side of the openings 153*g*1, 153*g*2 is provided with the rotational force transmitting surfaces (rotational force transmitted portions) 153*h*1, 153*h*2. The sides of the rotational force transmitting pin (rotational force transmitting portion) 155 of coupling 150 contact to the transmitting surfaces 153*h*1 or 153*h*2. By this, the rotational force is transmitted to the developing roller 110 from the coupling 150. Here, the transmitting surface 153*h*1-153*h*2 is the surface which faces in the rotational direction of the development gear 153. Therefore, the transmitting surfaces 153*h*1-153*h*2 are pushed by the sides of the pin 15155. In the state in which the axis L1 and the axis L2 are substantially co-axial with each other the coupling 150 rotates about the axis L2.

The development gear 153 has transmitted portions 153*h*1 or 153*h*2 here, and therefore, they function as a rotational force transmitted member. Similarly to the projection 15150*d*, it is desirable to dispose the rotational force transmitting surfaces 15150*h*1, 15150*h*2 diametrically opposed on a circumference.

(7) Assembling of t Coupling

FIG. 8 is a sectional view illustrating the process in which the coupling 150 is assembled into the development gear 153.

FIG. 8(*a*) is a view illustrating the state of assembling the drive transmission pin and the retaining member 156 to the coupling 150 which comprises two parts. FIG. 8(*b*) is a view illustrating the process in which the structure thus assembled is assembled to the development gear. The retaining member 156 is locked with the development gear 153. By this, the coupling 150 is mounted so that they are pivotable (movable) between the rotational force transmitting angular position and the pre-engagement angular position (or the disengaging angular position). And, the movement, in the direction of the axis L2, of the coupling 150 is restricted. For this reason, the opening 156*j* has a diameter D15 smaller than the diameter of the shaft receiving surface 150*i*. More particularly, the movement of the coupling 150 is regulated by the development gear 153 and a retaining member 156. By this, the coupling 150 does not separate from the developing roller (the cartridge).

As shown in FIG. 8, the driving portion 150*b* of the coupling 150 is in engagement with the recess (space portion 153*f*) of the development gear 153.

A specific mounting method of the coupling will be described.

As shown in FIG. 8(*a*), the driven portion 150*a* and the intermediate part 150*c* are inserted in the direction X33 relative to the positioning member 150*q* which has the shaft receiving surface 150*i* (driving portion 150*c*). At this time, the retaining member 156 is placed between the driven portion 150*c* and the positioning member 150*q* beforehand. In this state, the pin 155 penetrates the fixing hole 150*g* of the positioning member 150*q* and the fixing hole 150*r* of the intermediate portion 150*c*. By this, the positioning member 150*q* is fixed to the intermediate portion 150*c*.

As shown in FIG. 8(*b*), then, the coupling 150 is moved in the direction X33. By this, the coupling 150 is inserted into the development gear 153. Then, the retaining member 156 is inserted in the direction of an arrow X33. And, the retaining member 156 is fixed to the development gear 153. By this mounting method, the coupling 150 can be mounted with play (gap) between the positioning member 150*q* and the development gear 153. By this, the coupling 150 can change the orientation thereof (inclination and/or movement relative to the axis L2).

The mounting method of the coupling is not limited to these mounting methods. For example, what is required is that the coupling not movable in the axial direction relative to the development gear 153, and that inclinable relative to the axis of the development gear 153 (developing roller 110).

In view of this, for example the coupling is formed integrally. And, a flexible locking claw is provided on the development gear 153, and the shaft receiving surface 150*i* is locked by this. In this manner the retention may be accomplished. In addition, even in this case the retaining member may also be used.

(8) Assembling of Cartridge (Developing Cartridge)

Figure 9:
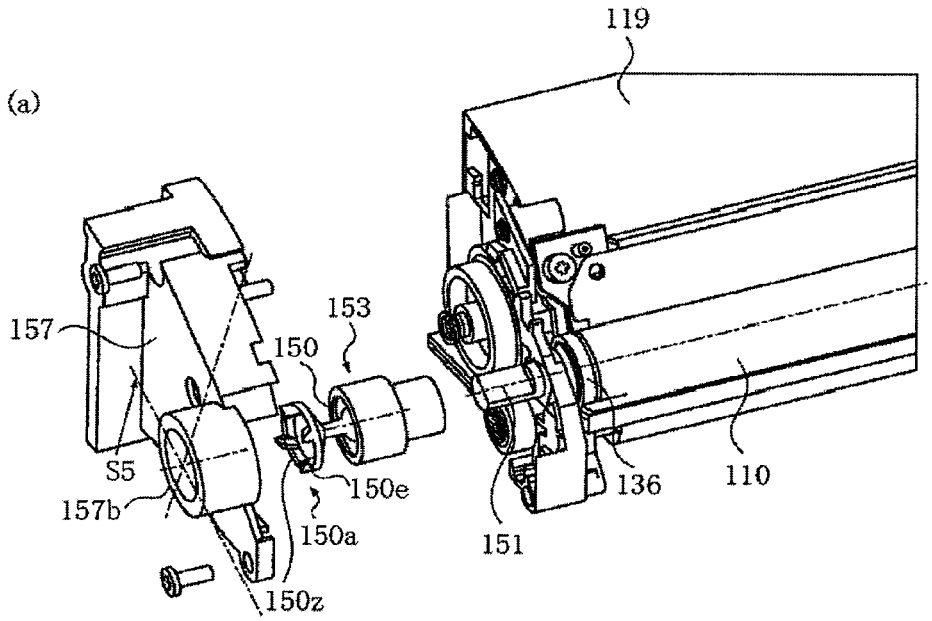
FIG. 9 is an exploded perspective view of the cartridge according to the embodiment of the present invention.
Figure 9:
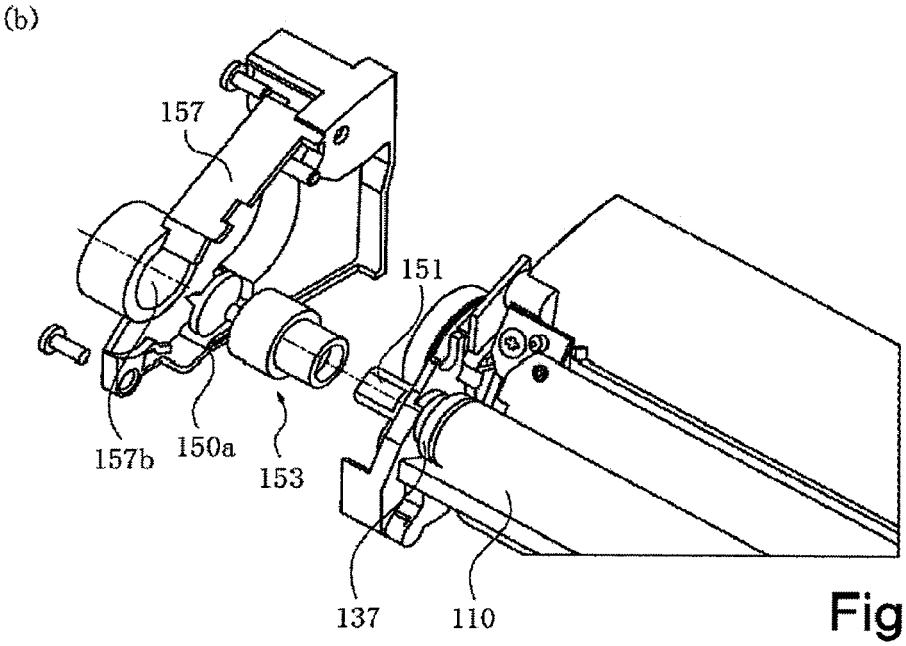
Figure 10:
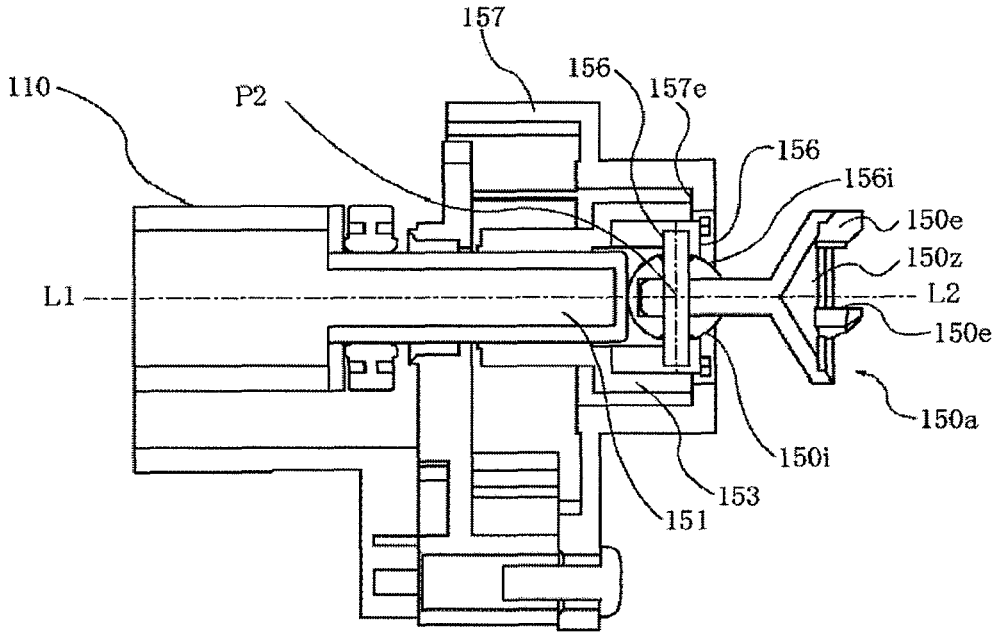
FIG. 10 is a longitudinal sectional view after the assembling of the cartridge according to an embodiment of the present invention.
Figure 10:
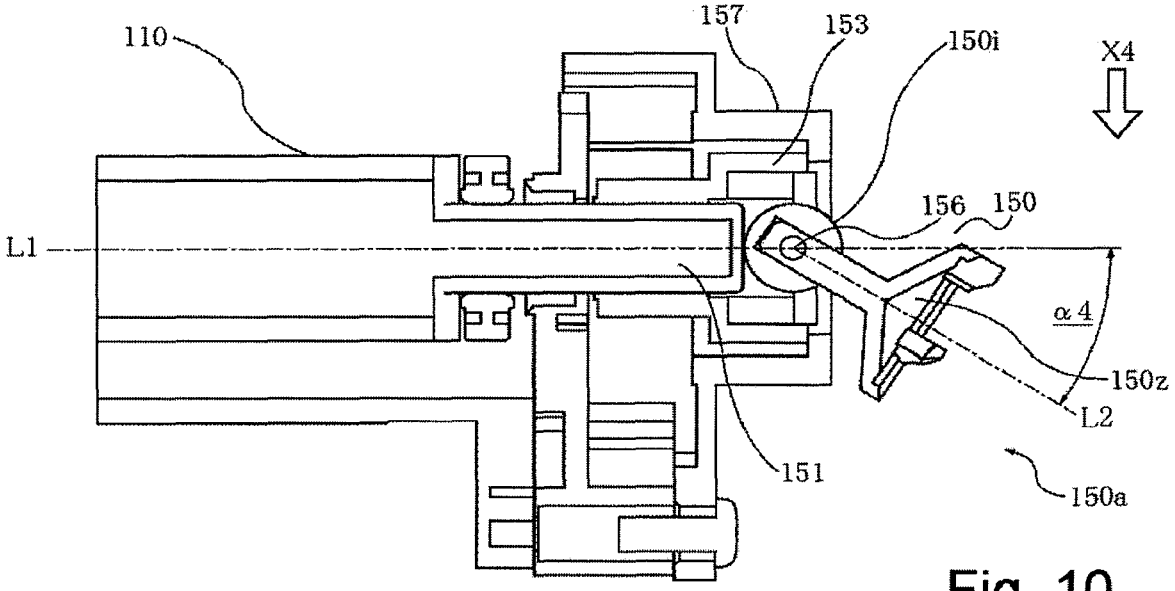

Referring to FIG. 9 and FIG. 10, the mounting of the cartridge will be described. FIG. 9 is an exploded perspective view illustrating the driving side of the cartridge. FIG. 10(*a*) is the sectional view taken along the line S4-S4 in FIG. 2 wherein the axis L2 is co-axial with the axis L1. FIG. 10(*b*) is a sectional view taken along the line S5-S5 in FIG. 2.

The development gear 153 which has the coupling 150 is fixed to the one-end portion (developing roller flange 151) of the developing roller 110 so that the driving portion 150*a* is exposed.

The driving side of the integral structure (developing roller 110, development gear 153, coupling 150) is supported by the bearing member 157, and the non-driving side is supported by the development supporting pin (unshown). And, in this state, the integral structure is rotatably supported on the developing device frame 119. By this, they are unified into the cartridge B (FIG. 2 and FIG. 3).

In this state, the rotational force received from the drive shaft 180 is transmitted to the developing roller 110 through the coupling 150 and the development gear 153. In addition, in this state, the axis L2 of the coupling 150 can be in the state of being substantially co-axial with the axis L1 of the developing roller 110 (FIG. 10(*a*)), and also can be in the state of inclining relative to the axis L1 (FIG. 10(*b*)).

Figure 11:
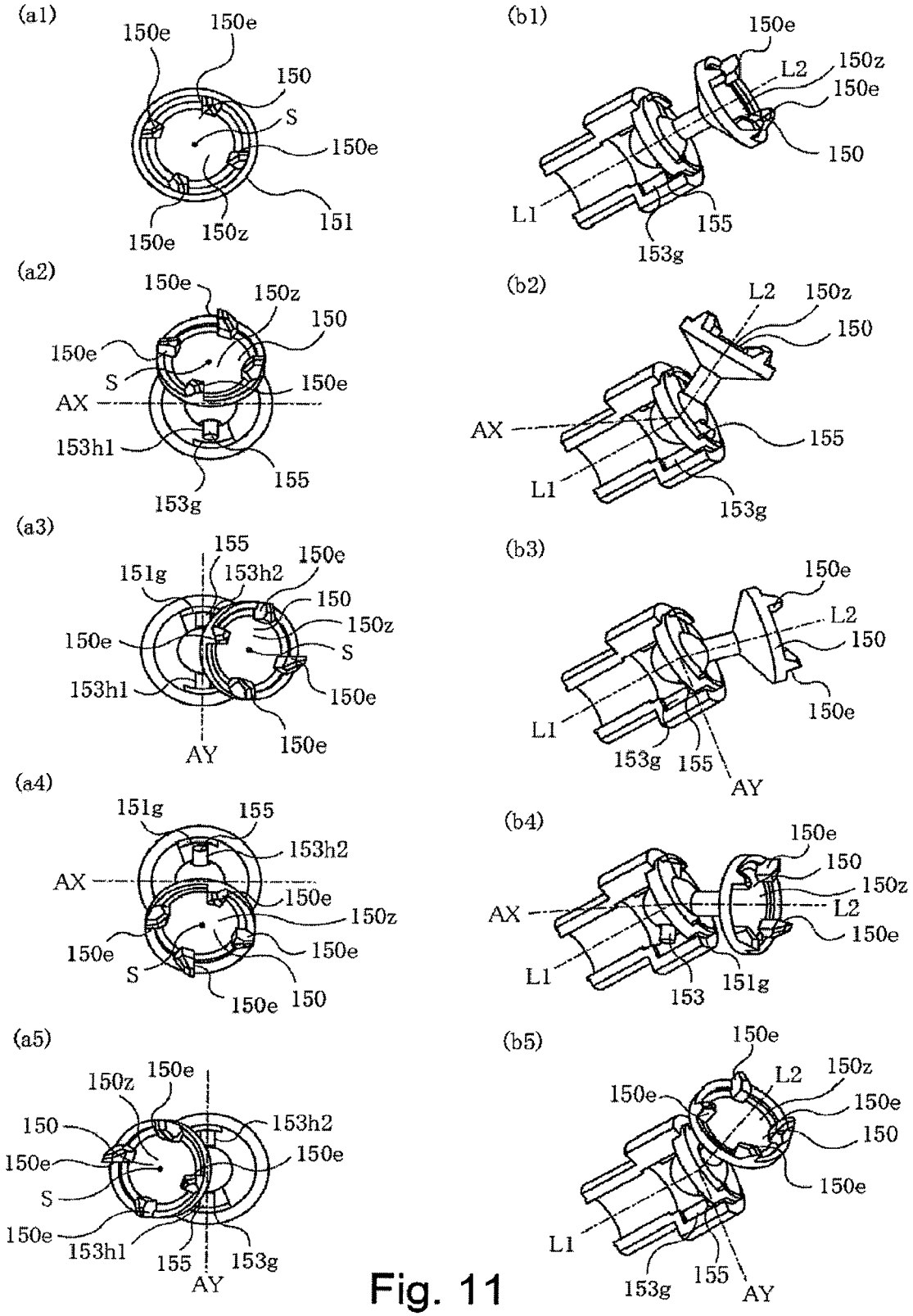
FIG. 11 is a perspective view illustrating the connection state of the development gear and the coupling.

As shown in FIG. 11, here, the coupling 150 is mounted to the developing device frame 119 so that the axis L2 can incline in any directions relative to the axis L1. FIGS. 11(*a*1)-(*a*5) is views as seen in the direction of the drive shaft 180, and is perspective views of the elements shown in FIG. 11 (*b*1)-(*b*5). Here, FIG. 11(*b*1)-(*b*5) illustrates a substantial entirety of the coupling 150 with the development gear 153 exploded partially.

In FIG. 11(*a*1) and (*b*1), the axis L2 is co-axial relative to the axis L1. The state when the coupling 150 has been inclined upward from this state is shown in FIGS. 11(*a*2) and (*b*2). As shown in this view, when the coupling 150 inclines toward the opening 153*g*, the pin 155 is moved along the opening 153*g*. As a result, the coupling 150 inclines about an axis AX perpendicular to the opening 153*g*.

In FIGS. 11(*a*3) and (*b*3), the coupling 150 inclines rightward. As shown in this view, when the coupling 150 inclines in the direction perpendicular to the opening 153*g*, the pin 155 rotates in the opening 153*g*. The pin 155 rotates about the central axis AY of the pin 155.

In FIG. 11(*a*4), (*b*4), and FIGS. 11(*a*5) and (*b*5), the state that the coupling 150 is inclined downward and the state of being inclined leftward are shown. The description of the rotation axes AX, AY is omitted for the sake of simplicity. In the direction different from the described inclining direction i.g. in the direction shown in FIG. 11(*a*1) 45 degrees, the rotations in the direction of the rotation axis AX and in the rotation axis AY are combined together, and therefore, such an inclination (the movement) is possible.

In this manner, according to this embodiment, the axis L2 can incline in the all directions relative to the axis L1.

In this embodiment, the opening 151*g* extends in the direction crossing with the projecting direction of the pin 155.

In addition, a gap as shown in the Figure between the development gear (rotational force transmitted member) 153 and the coupling 150 is provided. As has been described hereinbefore, the coupling 150 is inclinable (movable) in all the directions.

More particularly, the transmitting surface (rotational force transmitted portion) 153*h*, (153*h*1, *h*2) is movable relative to the pin 155 (rotational force transmitting portion). The pin 155 is movable relative to the transmitting surface 153*h*. In the rotational direction of the coupling, the transmitting surface 153*h* and the pin 155 are engaged to each other. In order to accomplish this, the gap is provided between the pin 155 and the transmitting surface 153*h*. By this, the coupling 150 is pivotable over substantially all directions relative to the axis L1. In this manner, the coupling 150 is mounted to the end of the developing roller 110.

It has been described that the axis L2 is inclinable in all the directions relative to the axis L1. However, the coupling 150 does not necessarily 360 degrees need to be inclinable linearly to the predetermined angle in any direction. In this case, the opening 150*g*, for example is more widely set in the circumferential direction. If it is set in this manner, it can be rotated to a slight degree by the coupling 150 relative to the axis L2, even in the case where the axis L2 cannot linearly incline by the predetermined angle, when the axis L2 inclines relative to the axis L1. By this, it can incline to the predetermined angle. In other words, the amount of the play of the rotational direction of the opening 150*g* can be selected properly if necessary.

This point applies to all of the embodiments described in this specification.

In this manner, the coupling 150 is pivotably mounted in any direction substantially. For this reason, the coupling 150 is revolvable (movable) over the full-circumference substantially relative to the development gear 153 (axis L1 of the developing roller 110). As has been described hereinbefore (FIG. 10), the spherical surface 150*i* of the coupling 150 contacts to the retaining portion (a part of recess) 156*i*. For this reason, the coupling 150 is mounted concentrically with the center P2 of the spherical surface 150*i* (FIG. 10). More particularly, irrespective of the phase of the development gear 153 (developing roller 110), the axis L2 of the coupling 150 is inclinable.

Figure 12:
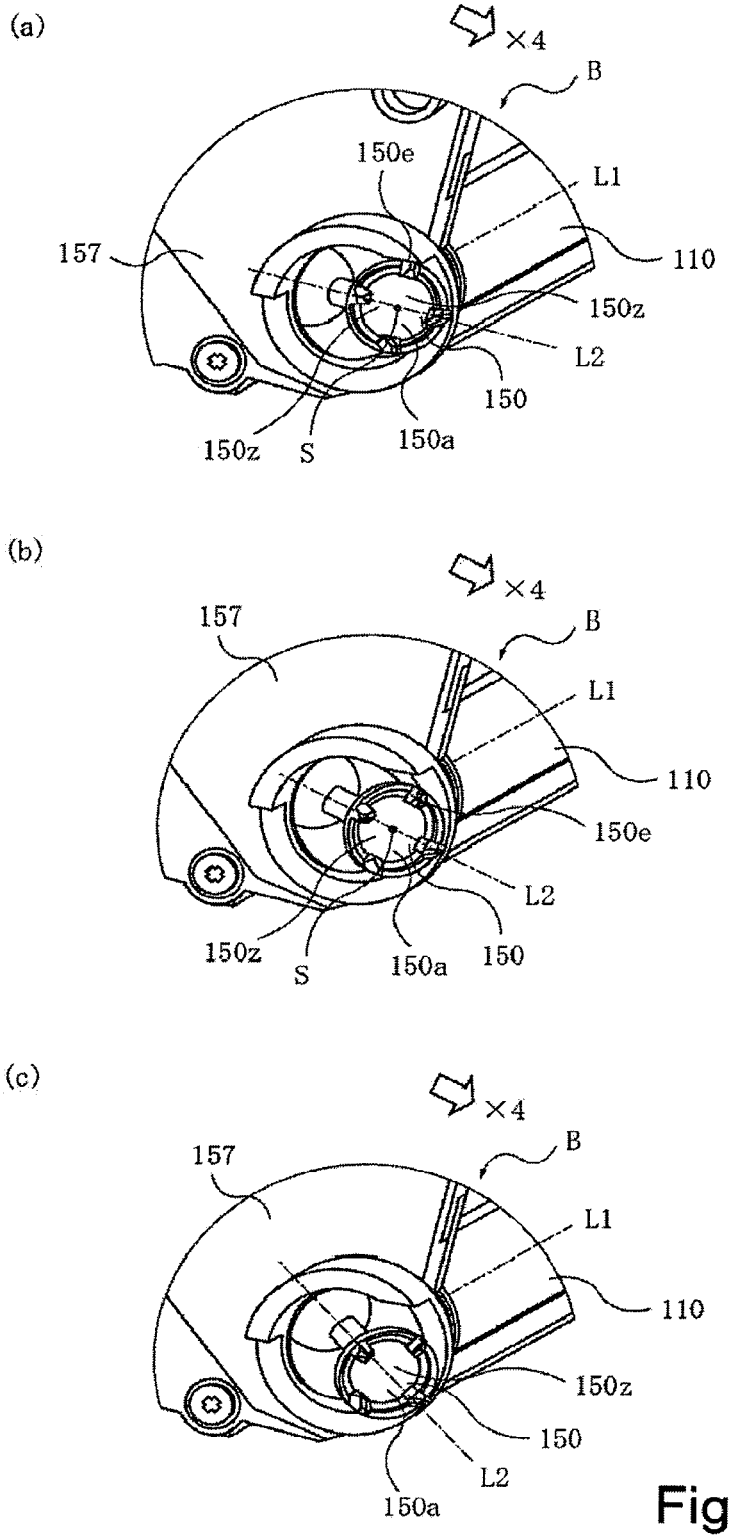
FIG. 12 is a perspective view showing the state that the coupling inclines.

In order for the coupling 150 to engage with the drive shaft 180, the axis L2 inclines toward the downstream side with respect to the mounting direction of the cartridge B relative to the axis L1, immediately before the engagement. As shown in FIG. 10(*b*), more particularly, the axis L2 is inclined so that the driven portion 150*a* is the downstream of the axis L1 with respect to the mounting direction X4. In FIG. 12(*a*)-(*c*), the position of the driven portion 150*a* is downstream relative to the mounting direction X4 in any case.

By the structure described heretofore, as shown in FIG. 10, the shift to the state that the axis L2 is substantially parallel to the axis L1 from the state that the axis L2 inclines, is possible. The maximum possible inclination angle a4 (FIG. 10(*b*)) between the axis L1 and the axis L2 is the inclination angle at which the driven portion 15150*a* or the intermediate portion 15150*c* contacts to the development gear 153 or the bearing member 157. This inclination angle is the angle which permits the engagement and disengagement of the coupling 150 relative to the drive shaft 180 at the time of mounting and demounting the cartridge B to the main assembly A.

(9) Drive Shaft and Driving Structure of Main Assembly

Figure 13:
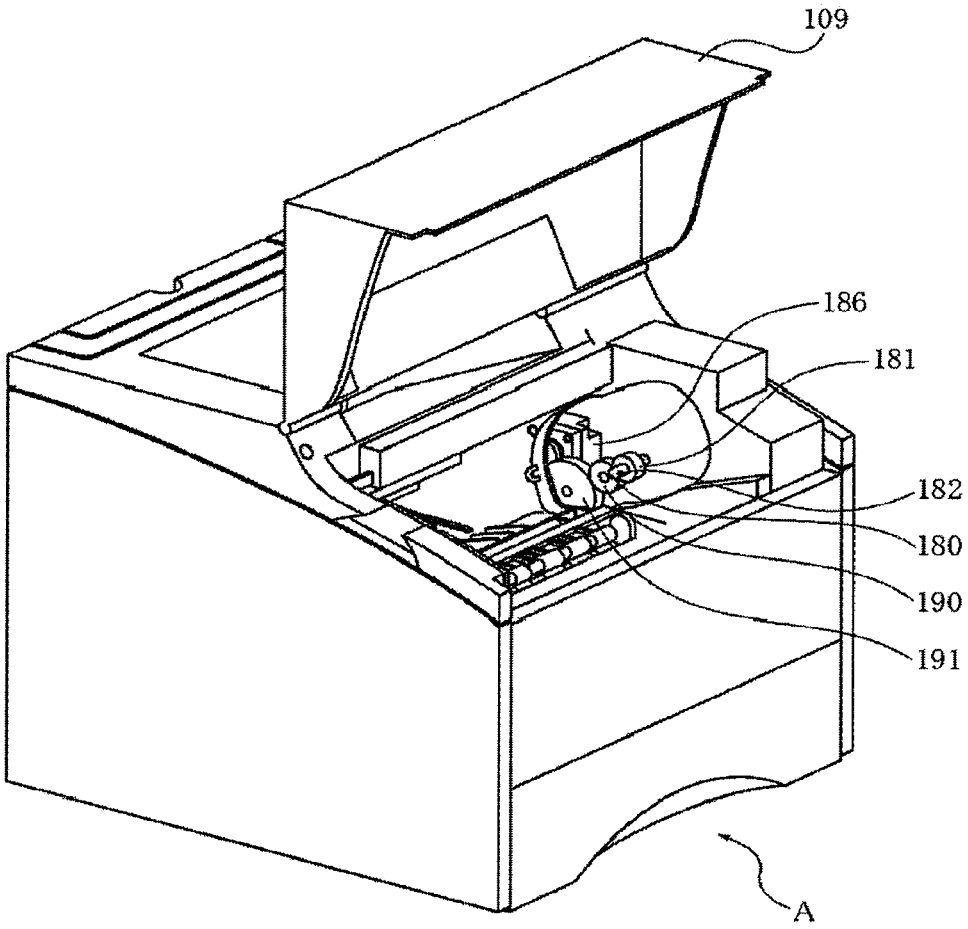
FIG. 13 is a perspective view and a longitudinal sectional view showing the driving structure of the main assembly according to an embodiment of the present invention.
Figure 14:
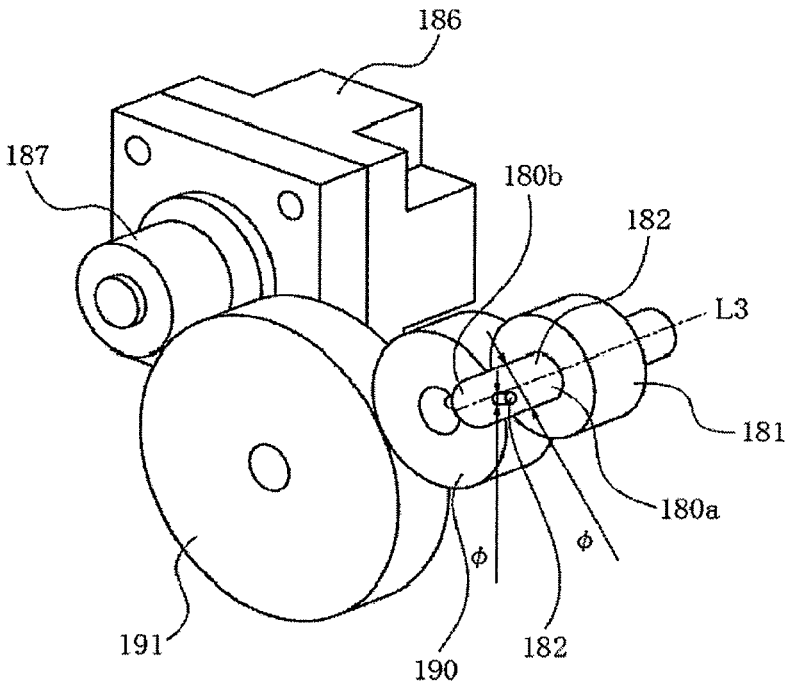
FIG. 14 is a perspective view showing the driving structure of the developing roller according to an embodiment of the present invention.

Then, referring to FIG. 13 and FIG. 14, a developing roller driving structure of the main assembly A will be described. FIG. 13 is a perspective view of the main assembly in the state that the cartridge B is not inserted, wherein the side plate of the driving side is omitted partially. FIG. 14 is a perspective view illustrating only the developing roller driving structure.

The free end portion 180*b* of the drive shaft 180 is a semispherical surface. It has a rotational force transmitting pin 182 as a rotational force applying portion which penetrates substantially the center of the cylindrical main part 180*a*. The rotational force is transmitted to the coupling 150 by this pin 182.

The longitudinally opposite side from the free end portion 180*b* is provided with a development drive gear 181 substantially co-axial with the axis L3. The gear 181 is fixed non-rotatably on the drive shaft 180. For this reason, when the gear 181 rotates, the drive shaft 180 also rotates.

The gear 181 receives the rotational force through a pinion gear (motor pinion) 187, an idler gear 191, and a photosensitive drum driving gear 190 from the motor 186. For this reason, when the motor 186 rotates, the drive shaft 180 also rotates.

The gear 181 is supported rotatably by the main assembly A by through bearing member (unshown). At this time, the gear 181 is not moved in the direction of the axis L1. For this reason, the gear 181 and the bearing member (unshown) can be disposed closely relative to each other.

It has been described that the gear 181 receives the transmission of the rotational force through the gears from the gear 187. This is not inevitable. For example, proper modification is possible from the viewpoint of the convenience of the disposition of the motor 186. The rotational force may be transmitted by belt or the like.

In addition, the drive shaft 180 is not moved in the direction thereof of the axis L3. For this reason, the gap between the drive shafts 180 and the bearing members 183, 184 is a gap for permitting the rotation of the drive shaft 180. Therefore, the position of the gear 181 relative to the gear 187 can also accurately be determined with respect to the diametrical direction.

However, because of the unavoidable dimensional tolerance, the drive shaft 180 may have play (gap) in the direction of the axis L3. In this case, in order to remove the play, the drive shaft 180 or the gear 181 may elastically be urged by a spring or the like in the direction of the axis L3.

(10) Structure of Cartridge Guide of Main Assembly

Figure 15:
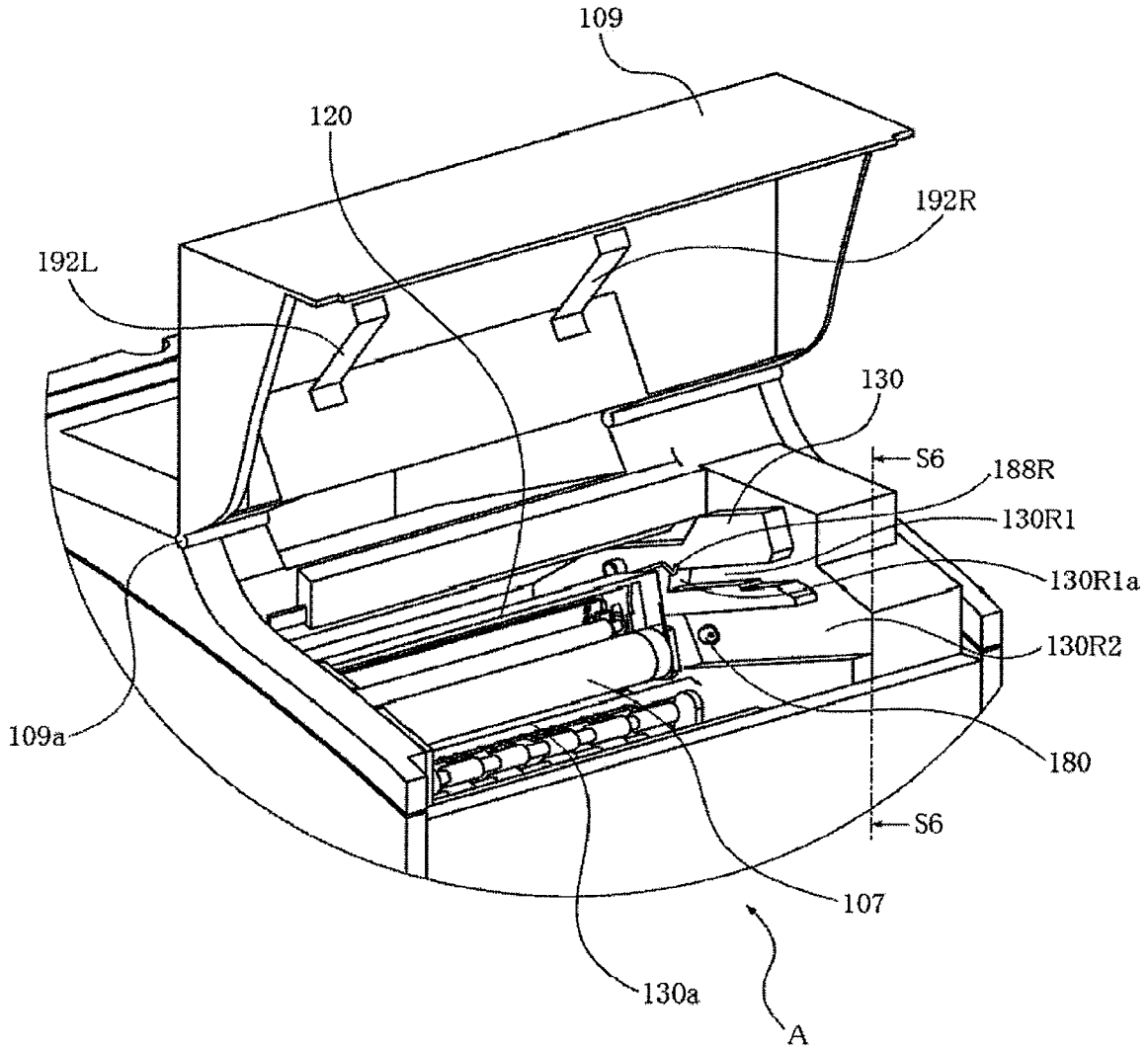
FIG. 15 is a perspective view of the cartridge set portion of the main assembly according to an embodiment of the present invention.
Figure 16:
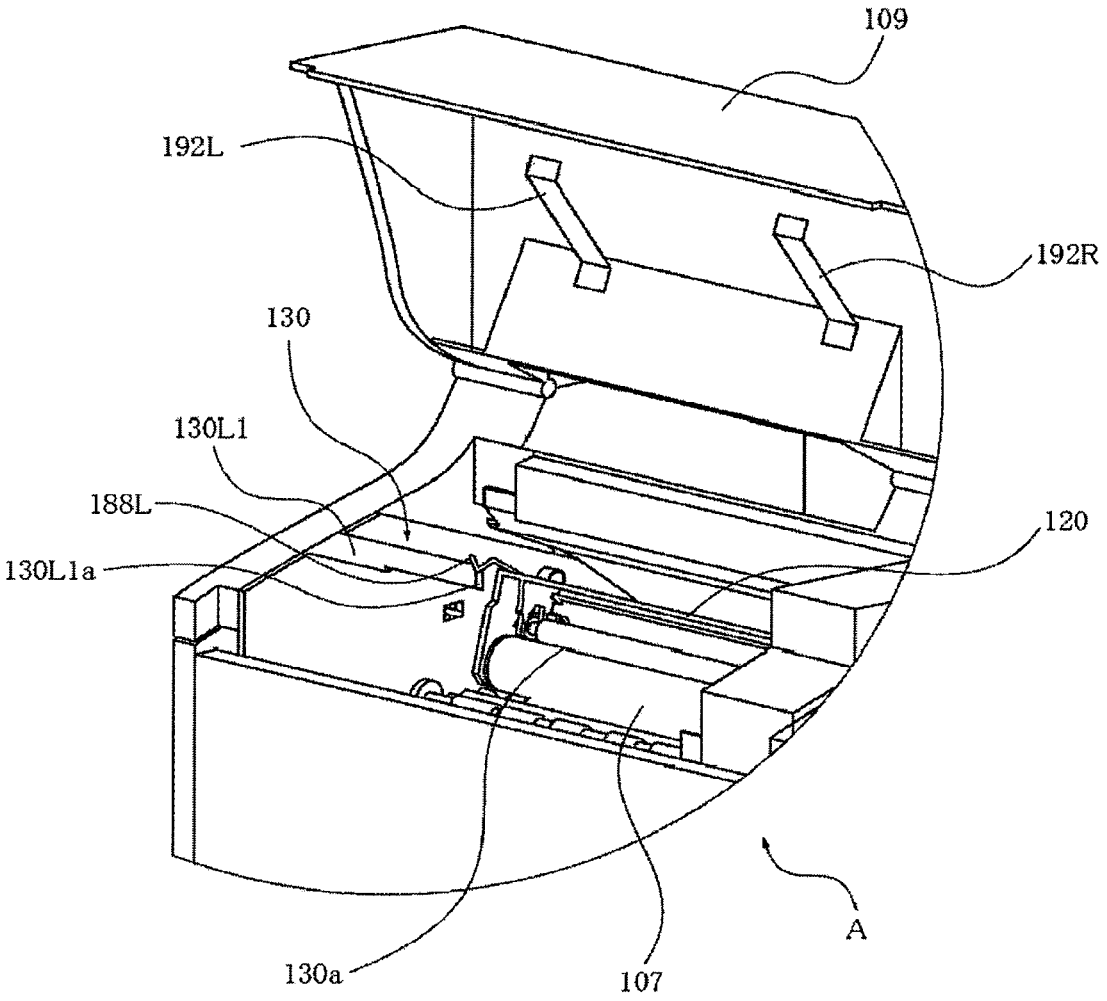
FIG. 16 is a sectional view illustrating the process that the cartridge is mounted to the main assembly according to an embodiment of the present invention.

Referring to FIGS. 15 and 16, the cartridge mounting means 130 in this embodiment has a pair of cartridge guides 130R1 and 130L1, with which the main assembly A is provided.

These guides 130R1 and 130L are in the space (cartridge compartment 130*a*) in which the cartridge B is to be mounted. That is, the cartridge compartment 130*a* is provided with the cartridge mounting means 130, the cartridge guides 130R1 and 130L1 of which are located next to its end walls (left and right walls), one for one, and extend in the direction in which the cartridge B is inserted (mounted) into the cartridge compartment 130*a*. The two guides 130R1 and 130L1 of the cartridge mounting means 130 are disposed next to the left and right walls of the cartridge compartment 130*a*, in such a manner that they squarely oppose each other across the cartridge compartment 130*a* (FIG. 15 shows side from which cartridge is driven, and FIG. 16 shows opposite side from which cartridge is driven).

The cartridge mounting means 130 is provided with the pair of cartridge guiding portions 130R1 and 130L1, which guide the cartridge B when the cartridge is mounted into the cartridge compartment 130*a*. In terms of the direction in which the cartridge B is mounted into the main assembly A, the guiding portion 130R1 is located at one end (right end, as seen from direction from which cartridge B is inserted) of the cartridge compartment 130*a*, and the guiding portion 130L1 is located at the other end. They are positioned so that they oppose each other across the cartridge compartment 130*a*. When a user mounts the cartridge B into the cartridge compartment 130*a*, the user is to insert the cartridge B in such a manner that a pair of portions (bosses, which will be described later) projecting from the lengthwise ends of the external portion of the cartridge frame are guided by the guiding portions 130R1 and 130L1. The procedure for mounting the cartridge B in the apparatus main assembly A is as follows: First, a user is to open the door 109, which can be opened or closed about the shaft 109*a*. Then, the user is to insert the cartridge B into the cartridge compartment 130*a* while allowing the abovementioned bosses to be guided by the guiding portions 130R1 and 130L1. Then, the user is to close the door 109. The closing of the door 109 ends the mounting of the cartridge B into the apparatus main assembly A. Incidentally, the user is to open the door 9 also when the user takes the cartridge B out of the apparatus main assembly A.

A groove 130R2, which is on the cartridge driving side of the cartridge compartment 130*a*, functions as a clearance for the coupling 150, until the coupling 150 engages with the drive shaft 180.

The door 109 is provided with a spring 192, which is on the inward side of the door 109. When the door 109 is in the closed position, the spring 192 keeps the cartridge B elastically pressed so that a preset amount of distance is maintained between the development roller 110 and photosensitive drum 107. That is, the spring 102 keeps the cartridge B elastically pressed so that the development roller 110 is kept pressed toward the photosensitive drum 107.

(11) Structural Arrangement for Guiding and Positioning Development Cartridge

Referring to FIGS. 2 and 3, the cartridge B is provided with a pair of cartridge guides 140R1 and 140R2, and a pair of cartridge guides 140L1 and 140L2. In terms of the axial (lengthwise) direction of the development roller 110, the cartridge guides 140R1 and 140R2 are at one of the lengthwise ends of the cartridge B, and the cartridge guides 140L1 and 140L2 are at the other lengthwise end.

In this embodiment, the guides 140R1, 140R2, 140L1 and 140L2 are integral parts of the development unit frame 119, development roller supporting members 157, or development roller bearings 139, and are integrally molded therewith. They protrude outward of the cartridge B.

(12) Development Cartridge Mounting Operation

Figure 17:
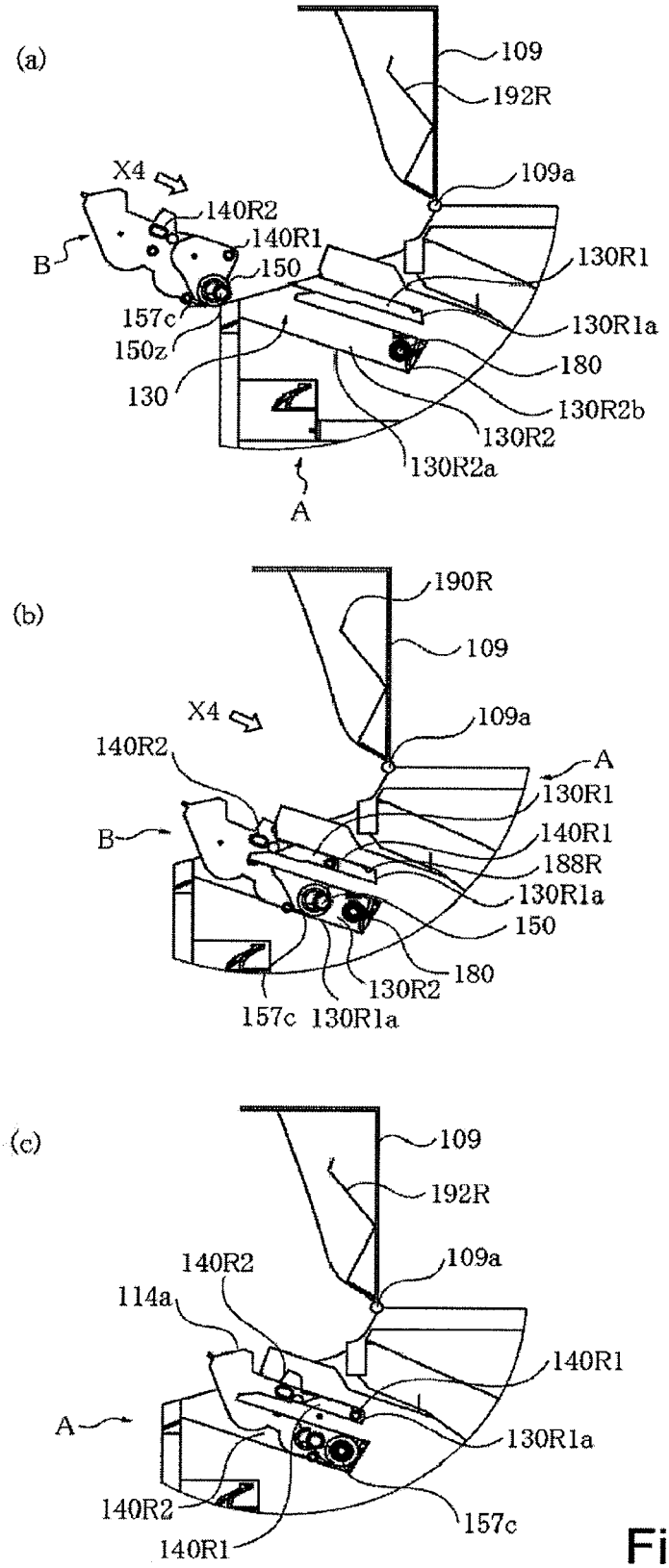
FIG. 17 is a perspective view illustrating the process that the drive shaft and the coupling engage with each other according to an embodiment of the present invention.

Next, referring to FIG. 17, the operation for mounting the cartridge B into the apparatus main assembly A will be describe. FIGS. 17(*a*)-17(*c*) are cross sectional views of the cartridge B and cartridge compartment portion of the apparatus main assembly A, at a plane S6-S6 in FIG. 15.

Referring to FIG. 17(*a*), a user is to open the door 109 of the apparatus main assembly A, and to mount the cartridge B into the cartridge mounting means 130 (cartridge compartment 130*a*).

More specifically, referring to FIG. 17(*b*), the cartridge B is to be mounted into the cartridge compartment 130*a* by inserting the cartridge B into the apparatus main assembly A in such a manner that the cartridge guides 140R1 and 140R2, which are on the driving force receiving side, follow the cartridge guide 130R1 of the apparatus main assembly A, and also, so that the cartridge guides 140L1 and 140L2 (FIG. 3), which are on the opposite side from the driving force receiving side, follow the cartridge guide 130L1 (FIG. 16) of the apparatus main assembly A. As the cartridge B is inserted as described above, the coupling 150, which is on the driving force receiving side, and the cylindrical portion 157*c* of the development roller supporting member 157, which surrounds the coupling 150, follow the groove 130R2 of the guide 130R1, with no contact between the cylindrical portion 157*c* and the walls of the groove 130R2.

Then, the cartridge B is to be inserted further in the direction indicated by an arrow mark X. As the cartridge B is inserted as described above, the coupling 150 engages with the drive shaft 180, allowing the cartridge B to properly settle in the cartridge compartment 130*a* (preset position in cartridge compartment 130*a*), as will be described later in more detail. More specifically, referring to FIG. 17(*c*), the guide 140R1 comes into contact with the cartridge positioning portion 130R1*a* of the guide 130R1. Further, the guide 140L1 comes into contact with the cartridge positioning portion 130L1*a* (FIG. 16) of the guide 130L1. As described above, the cartridge B is removably mounted into the cartridge compartment 130*a* while being assisted by the cartridge mounting means 130. The coupling 150 engages with the driving shaft 180 toward the end of the mounting (insertion) of the cartridge B into the cartridge compartment 130*a*. While the cartridge B remains properly positioned in the image forming position in the cartridge compartment 130*a*, the coupling 150 remains engaged with the drive shaft 180 so that the cartridge B can perform a part of an image forming operation. Incidentally, the cartridge compartment 130*a* is the space in the apparatus main assembly A, which the cartridge B occupies while the cartridge B remains in the apparatus main assembly A after being mounted into the apparatus main assembly A by the user while being assisted by the cartridge mounting means 130.

As described above, the cartridge B is provided with the pair of guides 140R1 and 140R2, which protrude from one of the lengthwise ends of the cartridge B (FIG. 2). In terms of the direction X4 in which the cartridge B is mounted into the apparatus main assembly A, there is provided a preset amount of distance (gap) between the guides 140R1 and 140R2. Further, the cartridge B is also provided with the pair of guides 140L1 and 140L2, which protrude from the other lengthwise end of the cartridge B (FIG. 3). In terms of the direction X4 in which the cartridge B is mounted into the apparatus main assembly A, a preset amount of distance (gap) is provided between the guides 140L1 and 140L2.

As for the apparatus main assembly A, one end of its cartridge compartment 130*a*, in terms of the direction perpendicular to the cartridge mounting direction X4, is provided with the guide 130R1 and 130R2, which align with each other in the direction parallel to the cartridge mounting direction X4, with the guide 130R1 positioned higher than the guide 130R2 (FIG. 15). The other end of the cartridge compartment 130*a* is provided with the guides 130L1 and 130L2, which align with each other in the direction parallel to the cartridge mounting direction X4 (FIG. 16).

Thus, when the cartridge B is mounted into the cartridge compartment 130*a*, it is to be inserted into the cartridge compartment 130*a* in such a manner that the guides 140R1 and guide 140R2 are guided by the guide 130R1, and the bottom surface of the cartridge B is guided by the guide 130R2 (FIG. 17). As for the opposite side from the guides 140R1 and 140R2, the guide 140L1 and guide 140L2 are guided by the guide 130L1.

Further, the guides 140R1 (FIG. 17) and 140L1 (FIG. 16) are precisely positioned relative to the cartridge compartment 130*a* by the cartridge positioning portions 130R1*a* and 130L1*a*, respectively, after the engagement of the coupling 150 with the drive shaft 180. That is, the cartridge B is precisely positioned in the cartridge compartment 130*a* after the engagement of the coupling 150 with the drive shaft 180.

How the coupling 150 engages with the drive shaft 180, and how the coupling 150 disengages from the drive shaft 180, will be described later.

If it is necessary to remove the cartridge B from the cartridge compartment 130*a*, the cartridge B can be taken out of the cartridge compartment 130*a* simply by carrying out in reverse the above described cartridge mounting operation.

The above described structural arrangement for the cartridge B and apparatus main assembly A makes it possible to remove the cartridge B from the cartridge compartment 130*a* by moving the cartridge B in the direction which is practically perpendicular to the axial line of the drive shaft 180. That is, the cartridge B can be mounted into, or removed from, the cartridge compartment 130*a*, by moving the cartridge B in the direction which is practically perpendicular to the axial line of the drive shaft 180.

After the proper positioning of the cartridge B in the image forming position in the cartridge compartment 130*a* of the apparatus main assembly A, the guide 140R1 remains under the pressure from the resiliency of the spring 188R, with which the apparatus main assembly A is provided (FIG. 2 as well as FIG. 15), whereas the guide 140L1 remains under the pressure from the resiliency of the spring 188L, with which the apparatus main assembly A is provided (FIG. 3 as well as FIG. 16). Then, after the closing of the door 109, the cartridge B is kept pressed upon the cartridge seat 114*a* (FIG. 4) by the resiliency of the spring 192R (as for spring 192L, that is, spring on opposite side from driving force receiving side, see FIG. 16) attached to the inward surface of the color 109. Thus, the spacers 136 and 137 (FIG. 2) fitted around the lengthwise end portions of the development roller 110, one for one, are kept in contact with the lengthwise end portions of the photosensitive drum 107, whereby the preset amount of distance is maintained between the development roller 110 and photosensitive drum 107.

In addition, the closing of the cover 109 causes a switching means (unshown) to be turned on, making it possible for the development roller 110 to receive the rotational force for rotating the development roller 110, from the apparatus main assembly A through the drive shaft 180 and coupling 150.

As described above, the cartridge B is removably mounted in the cartridge compartment 130*a* by a user while being guided by the cartridge mounting means 130. That is, the cartridge B is mounted into the cartridge compartment 130*a* while remaining precisely positioned relative to the apparatus main assembly A and photosensitive drum 107. Further, the drive shaft 180 and coupling 150 becomes fully engaged after the precise positioning of the cartridge B in the cartridge compartment 130*a*.

That is, the coupling 150 is made to take its rotational force receiving attitude.

That is, the electrophotographic image forming apparatus in this embodiment is enabled to form an image, by the mounting of the cartridge B into the cartridge compartment 130*a* of the image forming apparatus.

Incidentally, regarding how the cartridge B is to be mounted, the apparatus main assembly A and cartridge B may be structured so that the cartridge B is to be inserted all the way into the cartridge compartment 130*a* by a user himself or herself, or the cartridge B is to be inserted partway by the user to make it possible for the cartridge B to be mounted the rest of the way by another means. For example, the apparatus main assembly A may be structured so that as the door 109 is closed, a part of the door 109 comes into contact with the cartridge B, which has been inserted partway, and then, the cartridge B is pushed into its final position in the cartridge compartment 130*a* by the rest of the closing movement of the door 109. Or, the cartridge B and apparatus main assembly A may be structured so that the cartridge B is to be pushed partway into the cartridge compartment 130*a* by a user, and then, the cartridge B is advanced into its final the position in the cartridge compartment 130*a* by its own weight.

Figure 18:
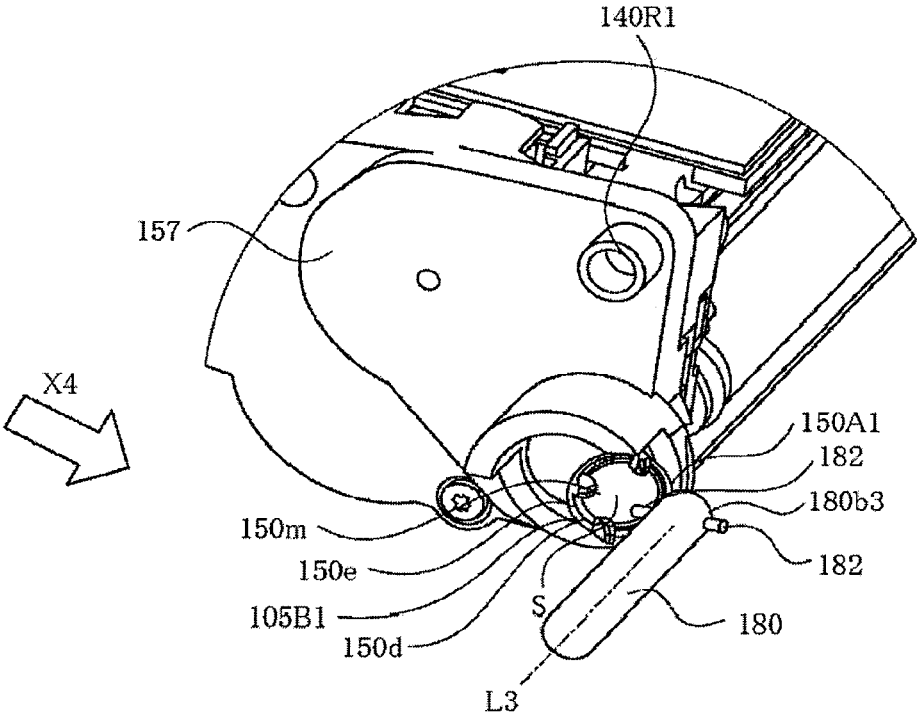
FIG. 18 is a perspective view illustrating the process that the coupling is mounted to the drive shaft according to an embodiment of the present invention.
Figure 18:
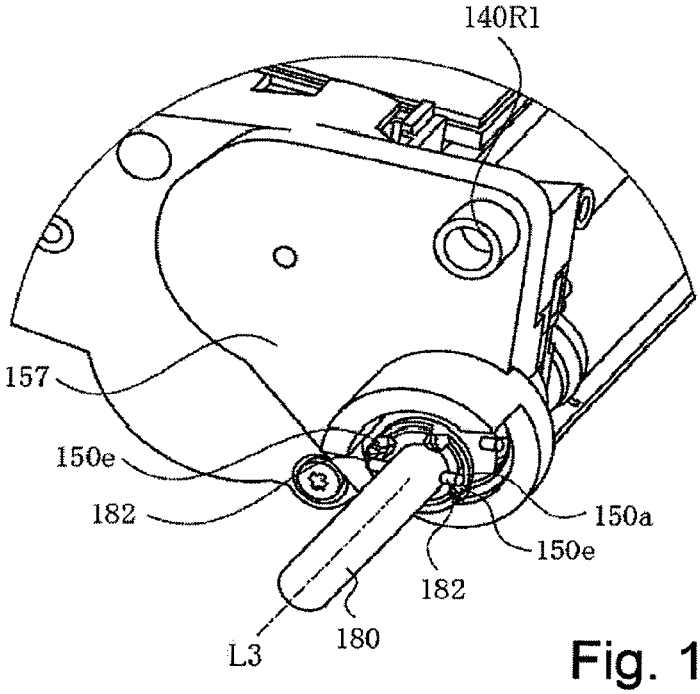

As shown in FIG. 17, the cartridge B is mounted and demounted relative to the main assembly A by moving in the direction substantially perpendicular to the direction of the axis L3 of the drive shaft 180 (FIG. 18). And, the drive shaft 180 and the coupling 150 are in the engaged state or the disengaged state.

The "substantial perpendicularity" will be described here.

In order to mount and demount the cartridge B smoothly between the cartridge B and the main assembly A, the small gap is given between they. More specifically, small gaps are provided between the longitudinal directions of the guide 140R1 and the guide 130R1, between the longitudinal directions of the guide 140R2 and the guide 130R1, between the longitudinal directions of the guide 140L1 and the guide 130L1, and between the longitudinal directions of the guide 140L2 and the guide 130L2. Therefore, in mounting and demounting the cartridge B relative to the main assembly A, the whole cartridge B may sometimes slightly be slanting within the limits of the gap thereof. Therefore, strictly speaking, the mounting and demounting is sometimes not in the orthogonality direction. However, even in such a case, the functional effect of the present invention is implementable. Therefore, the "substantial perpendicularity" includes the case where the cartridge slightly slanted.

(13) Engaging Operation and Rotational Force Transmission between Coupling and Drive Shaft As has been described in the foregoing, the coupling 150 of the cartridge B engages with the drive shaft 180 immediately before being positioned in the mounting portion 130*a* (predetermined position), or, simultaneously with the positioning to the predetermined position. More particularly, the coupling 150 is in the rotational force transmitting angular position. Here, the predetermined position is the set portion 130*a*.

Figure 19:
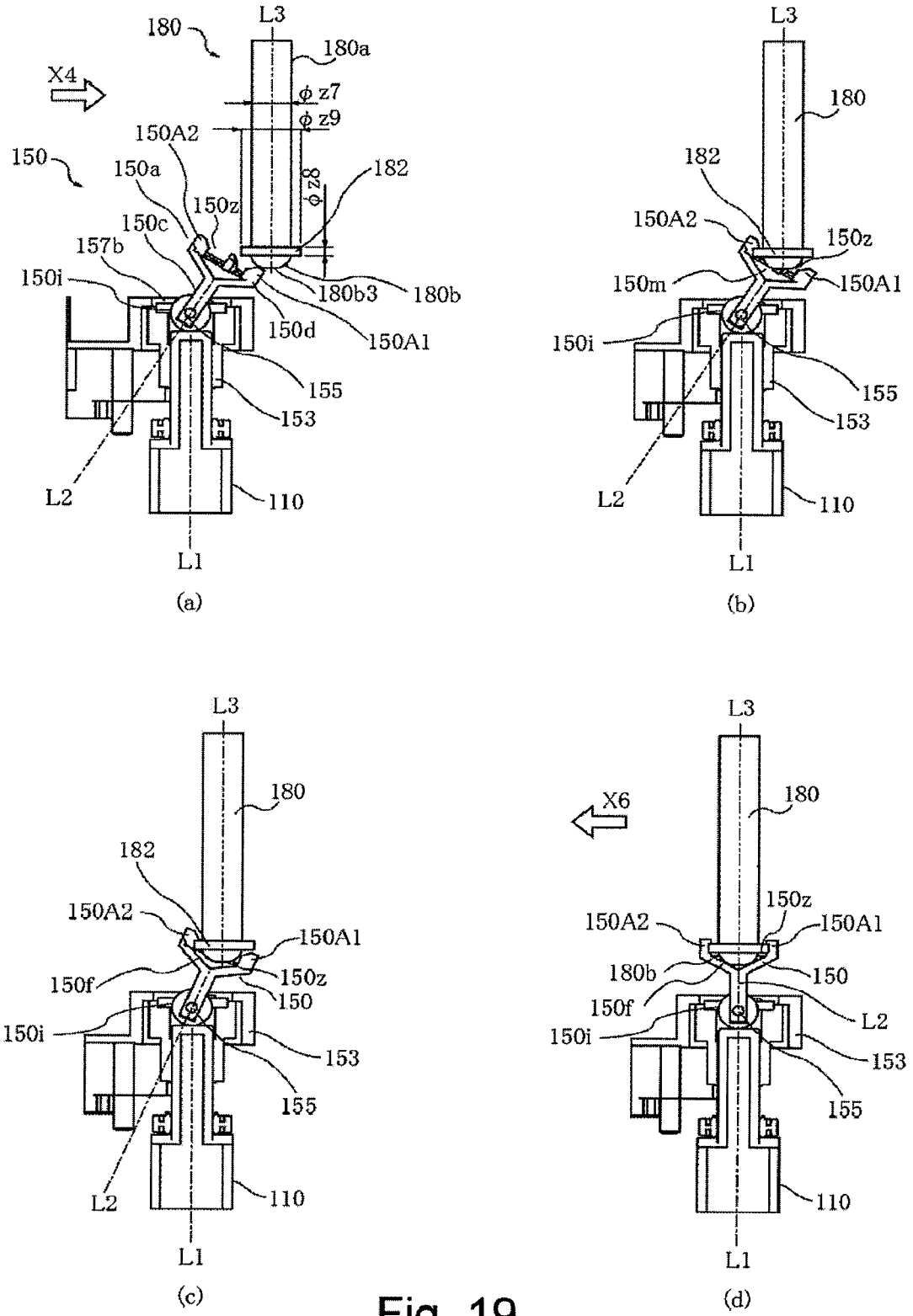
FIG. 19 is a perspective view of the coupling provided in the main assembly and the coupling provided in the cartridge according to an embodiment of the present invention.

Referring to FIG. 18 and FIG. 19, the description will be made as to the engaging operation between the coupling 150 and the drive shaft 180. FIG. 18 is a perspective view illustrating the drive shaft and the major part of the driving side of the cartridge. FIG. 19 is a longitudinal sectional view, as seen from below the main assembly. Here, the engagement means the state in which the axis L2 and the axis L3 are substantially co-axial with each other, and in which the transmission of the rotational force is possible.

As shown in FIG. 19, the cartridge B is mounted to the main assembly A in the direction (direction of arrow X4) substantially perpendicular to the axis L3 of the drive shaft 180. Or, it is dismounted from the main assembly A. The coupling 150 is in the pre-engagement angular position, wherein the axis L2 (FIG. 19(*a*)) inclines toward the mounting direction X4 relative to the axis L1 (FIG. 19(*a*)) of the developing roller 110 beforehand (FIG. 18(*a*) and FIG. 19(*a*)).

As for the structure for inclining the coupling to the pre-engagement angular position, the structures of the embodiment 4 as will be described hereinafter or the embodiment 5 are used for example. However, the present invention cannot be limited to these, but the other proper structure can be used.

By the coupling 150 inclining in the direction described above, the downstream free end position 150A1 of the coupling 150 with respect to the mounting direction X4 is nearer, than the free end 180*b*3 of the drive shaft, to the position that the developing roller 110 is provided with respect to the direction of the axis L1. In addition, the upstream free end position 150A2 is nearer, than the free end 180*b*3 of the shaft, to the position that the pin 182 is provided with respect to the mounting direction X4 (FIG. 19(*a*), (*b*)). Here, the free end position means the position which is remotest from the axis L2 at position closest to the drive shaft with respect to the direction of the axis L2 in the driven portion 150*a* shown in FIG. 6(*a*), (*c*). In other words, it is one of an edge line of the driven portion 150*a* or an edge line of the projection 150*d* of the coupling 150 depending on the rotational phase of the coupling 150, (FIG. 6(*a*), (*c*), 150A).

First, the free end position (a part of coupling 150) 150A1 of the coupling 150 passes by the free end 180*b*3 of the shaft. And, after the coupling 150 passes the free end 180*b*3 of the shaft, the receiving surface 150*f* or the projection 150*d* contacts to the free end portion 180*b* or the pin 182 of the drive shaft 180 (FIG. 19(*b*)). The receiving surface 150*f* and the projection 150*d* are the cartridge side contact portions. The drive shaft 180 is the main assembly side engaging portion. , the pins 182 are the main assembly side engaging portion and the rotational force applying portion. In the coupling 150, in response to the mounting operation of the cartridge B, the coupling 150 inclines (FIG. 19(*c*)) so that the axis L2 becomes coaxial with the axis L1. The coupling 150 inclines from the pre-engagement angular position, it pivots (moves) to the rotational force transmitting angular position at which the axis L2 thereof is substantially co-axial with the axis L1. Finally, the position of the cartridge B is determined relative to the main assembly A. At this time, the drive shaft 180 and the developing roller 110 are substantially co-axial with each other. Furthermore, in this state, the receiving surface 150*f* opposes to the spherical surface free end portion 180*b* of the drive shaft 180. And, the coupling 150 and the drive shaft 180 are engaged with each other (FIG. 18(*b*) and FIG. 19(*d*)). In addition, at this time, the pin 155 (unshown) is positioned in the opening 150*g* (FIG. 6(*b*)). In addition, the pin 182 is positioned in the standing-by portion 150*k*. Here, the coupling 150 covers the free end portion 180*b*.

As has been described hereinbefore, when the cartridge B is mounted to the main assembly A, the coupling 150 makes the following motion. More particularly, while a downstream part of coupling 150 (free end position 150A1) with respect to the mounting direction X4 circumvents the drive shaft 180, the coupling 150 inclines moves toward the rotational force transmitting angular position from the pre-engagement angular position. The receiving surface 150*f* constitutes the recess 150*z*. The recess 150*z* has a conical shape. The mounting direction X4 is the direction for mounting the cartridge B to the main assembly A.

As has been described hereinbefore, the coupling 150 is mounted for inclining motion relative to the axis L1. And, in response to the movement of the cartridge B, the a part of coupling 150 (receiving surface 150*f* and/or projection 150*d*) which is the cartridge side contact portion contacts to the main assembly side engaging portion (drive shaft 180 and/or pin 182). By this, the pivoting motion of the coupling 150 is carried out. As shown in FIG. 19, the coupling 150 is mounted in the state that it overlaps, with respect to the direction of the axis L1, with the drive shaft 180. However, by the pivoting motion of the coupling s as described above, the coupling 150 can be engaged with the drive shaft 180 in the overlapping state.

Figure 20:
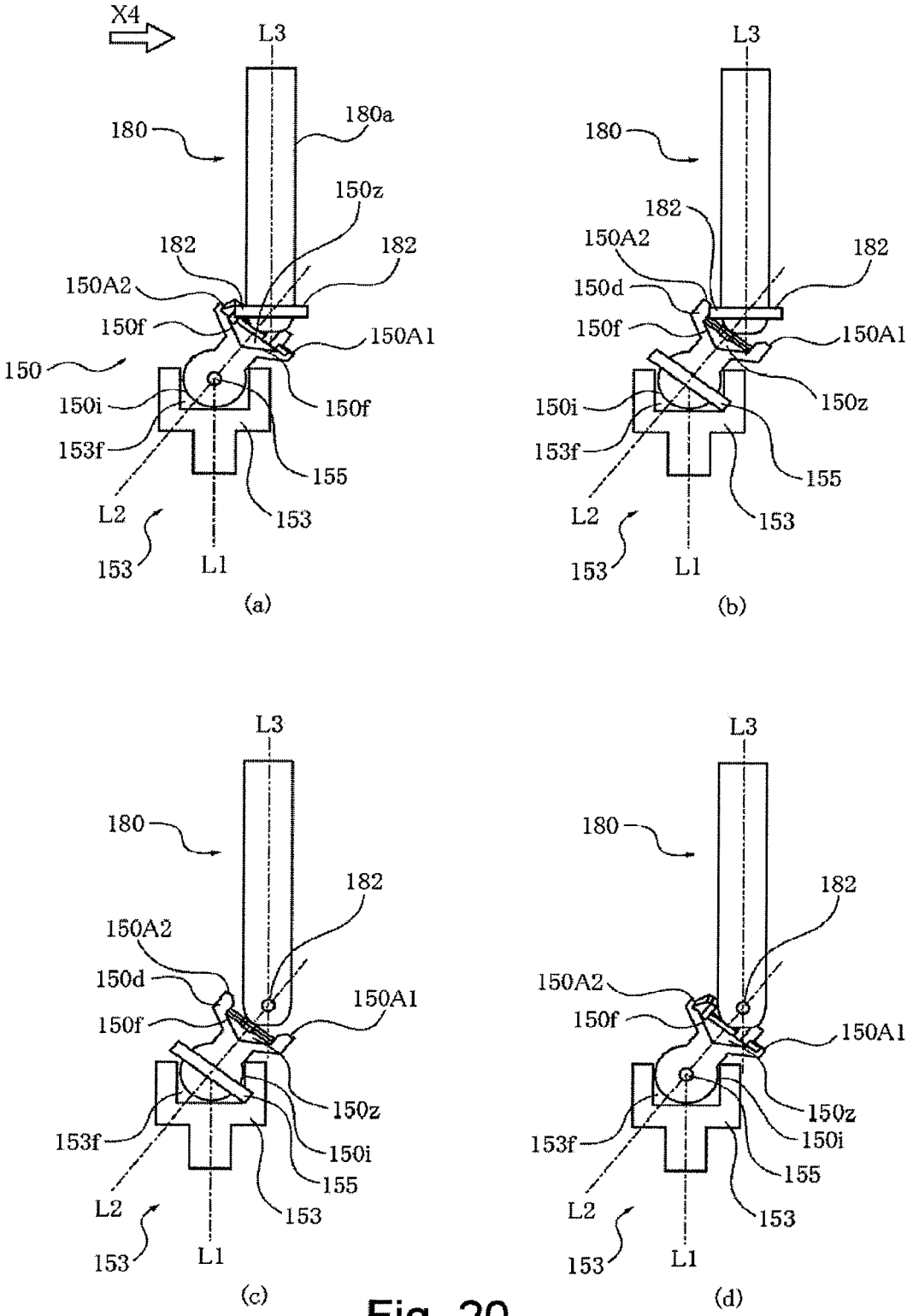
FIG. 20 is a perspective view illustrating the process that the coupling is mounted to the drive shaft according to an embodiment of the present invention.

Furthermore, the engaging operation of the coupling 150 described above can be carried out regardless of the phase difference between the drive shaft 180 and the coupling 150. Referring to FIGS. 11 and 20, this reason will be described. FIG. 20 is a view showing the respective phases of the coupling 150 and the drive shaft 180. FIG. 20(*a*) is a view showing the state that the pin 182 and the receiving surface 150*f* oppose to each other in the downstream side, with respect to the mounting direction X4, of the cartridge. FIG. 20(*b*) is a view showing the state that the pin 182 and the projection 150*d* oppose to each other. FIG. 20(*c*) is a view showing the state that the free end portion 180*b* and the projection 150*d* oppose to each other. FIG. 20(*d*) is a view showing the state that the free end portion 180*b* and the receiving surface 150*f* oppose to each other.

As shown in FIG. 11, the coupling 150 is inclinable in all directions relative to the axis L1 of the developing roller 110. More particularly, the coupling 150 is revolvable. As shown in FIG. 20, for this reason, in the mounting direction X4 of the cartridge B, it is inclinable irrespective of the phase of the development gear 153 (developing roller). Regardless of the phases of the drive shaft 180 and the coupling 150, the free end position 150A1 is inclinable in a set range of the inclination angle of the coupling 150 so that it is in the developing roller side beyond the free end 180*b*3 of the shaft in the direction of the axis L1. In addition, the range of the inclination angle of the coupling 150 is set so that the free end position 150A2 is positioned in the pin 182 side with respect to the free end 180*b*3 of the shaft. With such a setting, in response to the mounting operation of the cartridge B, the free end position 150A1 with respect to the mounting direction X4 is passed by the free end 180*b*3 of the shaft. And, in the case shown in FIG. 20(*a*), the receiving surface 150*f* contacts to the pin 182. In the case shown in FIG. 20(*b*), the projection (engaging portion) 150*d* contacts to the pin (rotational force applying portion) 182. In the case shown in FIG. 20(*c*), the projection 150*d* contacts to the free end portion 180*b*. In the case shown in FIG. 20(*d*), the receiving surface 150*f* contacts to the free end portion 180*b*. Furthermore, by the contact force between the coupling 150 and the drive shaft 180 at the time of mounting the cartridge B, the coupling 150 is moved so that the axis L2 is substantially co-axial with the axis L1. More particularly, after the coupling 150 starts the contact to the drive shaft 180, the cartridge B is moved, until the axis L2 becomes substantially co-axial with the axis L1. And, in the state in which the axis L2 is substantially co-axial with the axis L1, the cartridge B is positioned in the main assembly A as described above. By this, the coupling 150 engages with the drive shaft 180. More particularly, the recess 150*z* covers the free end portion 180*b*. Therefore, the coupling 150 can be engaged with the drive shaft 180 (pin 182) irrespective of the phases of the drive shaft 180 and the coupling 150 or the development gear 153 (developing roller).

In addition, as shown in FIG. 20, the gap is provided between the development gear 153 and the coupling 150, the inclination (movement) is permitted as described above.

In this embodiment, the case where the coupling 150 pivots in the plane of the sheet of the drawing of FIG. 20 has been described. However, since the coupling 150 can also revolve as described above, the pivoting in the direction other than the in of plane of FIG. 20 may be included. Also in such a case, it results in reaching, from the state of FIG. 20(*a*), the state of FIG. 20(*d*). This applies to the following embodiments unless otherwise described.

Figure 21:
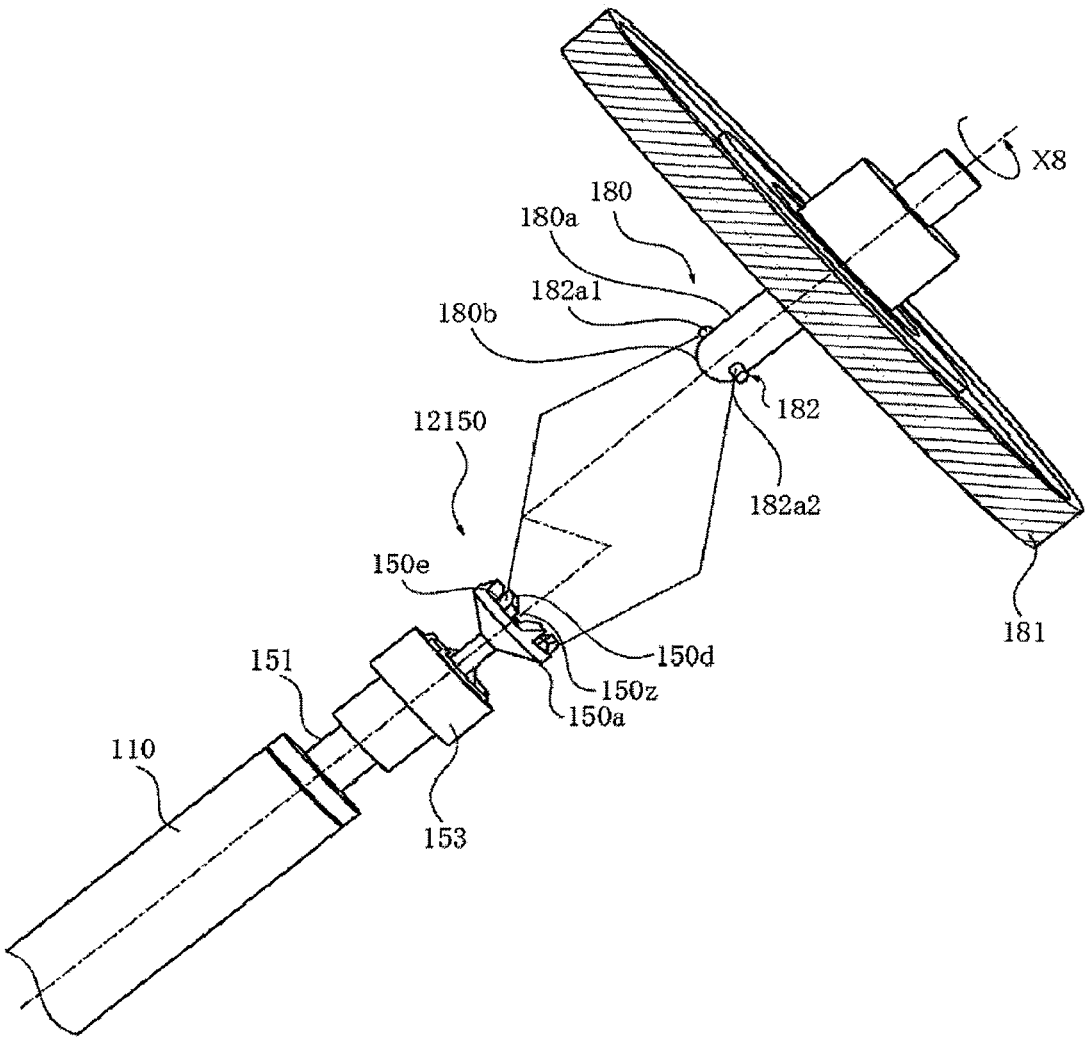
FIG. 21 is an exploded perspective view illustrating the drive shaft, the driving gear, the coupling, and the development shaft according to an embodiment of the present invention.

Referring to FIG. 21, the rotational force transmitting operation at the time of rotating the developing roller 110 will be described. By the rotational force received from the driving source (motor 186), the drive shaft 180 rotates with the gear 181 in the direction X8 in the Figure. And, the pin 182 (182*a*1, 182*a*2) integral with the drive shaft 180 contacts to one of the rotational force receiving surfaces (rotational force receiving portions) 150*e*1 to 150*e*4. More particularly, the pin 182*a*1 contacts to one of the rotational force receiving surfaces 150*e*1 to 150*e*4. In addition, the pin 182*a*2 contacts to one of the rotational force receiving surfaces 150*e*1 to 150*e*4. By this, the rotational force of the drive shaft 180 is transmitted to the coupling 150 to rotate the coupling 150. Furthermore, by the rotation of the coupling 150, the pin 155 (rotational force transmitting portion) of the coupling 150 contacts to the development gear 153. By this, the rotational force of the drive shaft 180 is transmitted to the developing roller 110 through the coupling 150, the pin 155, the development gear 153, and the developing roller flange 151. By this, the developing roller 110 is rotated.

In addition, in the rotational force transmitting angular position, the free end portion 153*b* is contacted to the receiving surface 150*i*. And, the free end portion (positioning portion) 180*b* of the drive shaft 180 is contacted to the receiving surface (portion to be positioned) 150*f*. By this, the coupling 150 is, in the state of hanging over the drive shaft 180, positioned relative to the drive shaft 180 (19*d* of Figures).

Here, in this embodiment, the developing roller 110 is positioned relative to the photosensitive drum 107 through a spacer member. On the contrary, the drive shaft 180 is positioned in the side plate of the main assembly A or the like. In other words, the axis L1 is positioned through the photosensitive drum to the axis L3. For this reason, the dimensional tolerance tends to become large. Therefore, the axis L3 and the axis L1 deviate from the co-axial state easily. In such a case, by inclining to a slight degree, the coupling 150 can properly transmit the rotational force. Even in such a case, the coupling 150 can rotate without applying the large load to the development gear 153 (developing roller 110) and the drive shaft 180. For this reason, at the time of the assembling mounting of the drive shaft 180 and the developing roller 110 (the developing cartridge), the accuracy required to the positioning adjustment can be reduced. Therefore, the assembling operativity can be improved.

This is one of the advantageous effects according to an embodiment of the present invention in addition to the effects described above as the effect of the present invention.

In addition, as it has been described with FIG. 14, the drive shaft 180 and the gear 181 are positioned, with respect to the diametrical direction and the axial direction, in the predetermined position (mounting portion 130*a*) of the main assembly A. In addition, the cartridge B is positioned to mounting portion 130*a* as described above. And, the drive shaft 180 positioned in the mounting portion 130*a* and the cartridge B positioned in the mounting portion 130*a* are coupled with each other by the coupling 150. The coupling 150 is swingable pivotable relative to the developing roller 110). Therefore, as has been described hereinbefore, between the drive shaft 180 positioned in the predetermined position and the cartridge B positioned in the predetermined position, the coupling 150 can transmit the rotational force smoothly. In other words, even when a slight deviation exists between the driving shaft 180 and the developing roller 110, the coupling 150 can transmit the rotational force smoothly.

This is also one of the effects of the present embodiment according to the present invention.

The coupling 150 contacts to the drive shaft 180. By this, it has been described that the coupling 150 swings to the rotational force transmitting angular position from the pre-engagement angular position, but this is not inevitable. For example, an abutting portion as the main assembly side engaging portion may be provided in the position other than the drive shaft of the main assembly. And, in the mounting process of the cartridge B, after the free end position 150A1 passes by the free end 180*b*3 of the drive shaft, a part of coupling 150 (cartridge side contact portion) contacts to the abutting portion. By this, the coupling receives the force in the swinging directions (pivoting direction), and it swings (pivots) so that the axes L2 is substantially coaxial with the axis L3. In other words, any other means are usable if the axis L1 is able to become substantially co-axial with the axis L3 in interrelation with the mounting operation of the cartridge B.

Figure 22:
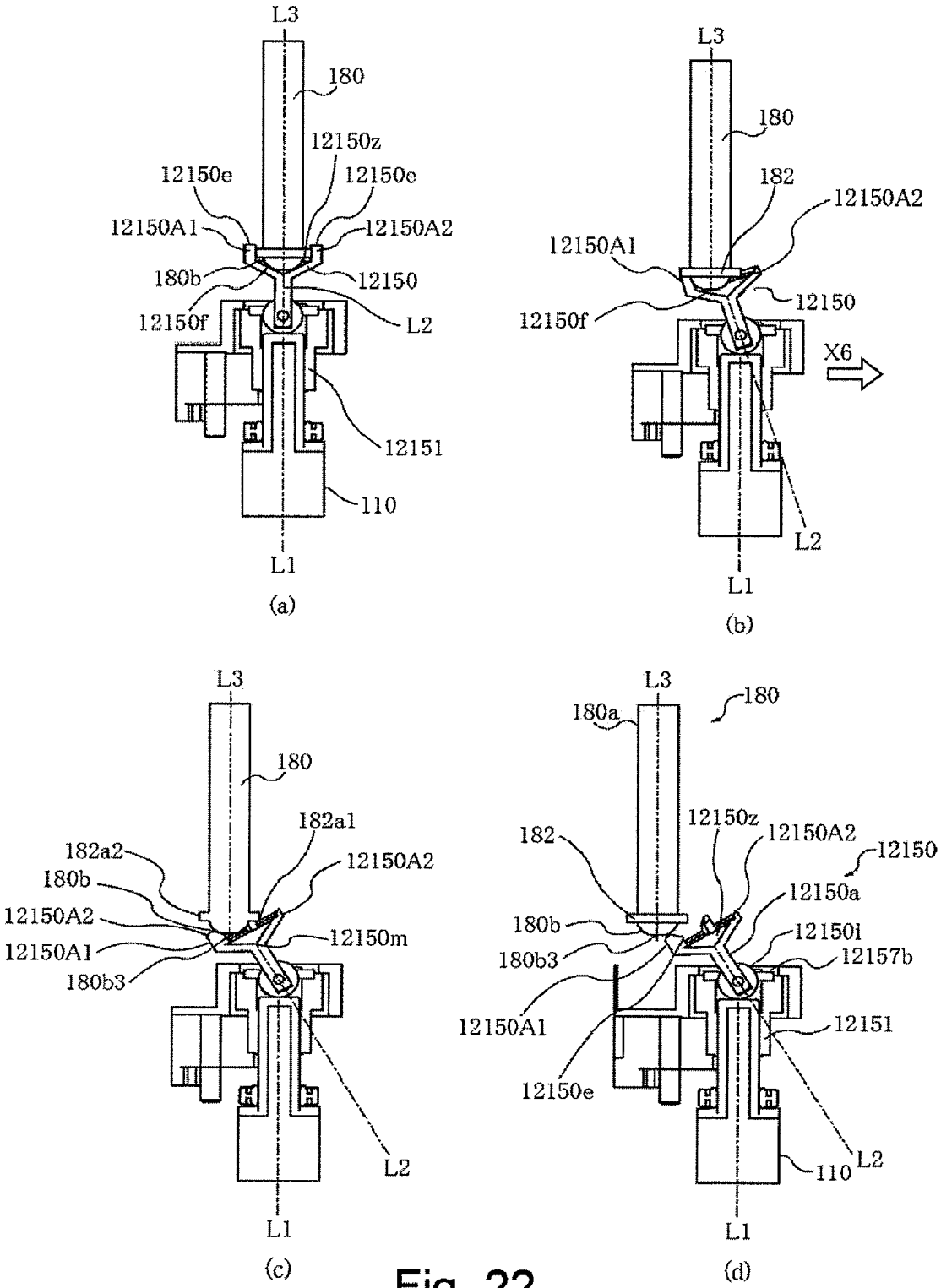
FIG. 22 is a perspective view illustrating the process that the coupling disengages from the drive shaft according to an embodiment of the present invention.

(14) Disengaging Operation between Coupling and Drive Shaft and Operation for taking out Cartridge Referring to FIG. 22, the operation for disengaging the coupling 150 from the drive shaft 180 In taking out the cartridge B from the main assembly A will be described. FIG. 22 is a sectional view, as seen from below of the main assembly.

As shown in FIG. 22, at the time of dismounting from the main assembly A, the cartridge B is dismounted in the direction perpendicular to the direction substantially to the axis L3 (direction of the arrow X6).

In the state that the development gear 153 (developing roller 110) does not rotate, the axis L2 of the coupling 150 is substantially co-axial relative to the axis L1 in the rotational force transmitting angular position (FIG. 22(*a*)). And, in response to the user taking the cartridge B out of the mounting portion 130*a*, the development gear 153 moves in a take-out direction X6 with the cartridge B. And, the receiving surface 150*f* or the projection 150*d* which is in the upstream side of the coupling 150 with respect to the take-out direction X6 contacts to at least the free end portion 180*b* of the drive shaft 180 (FIG. 22(*a*)). And, the axis L2 of the coupling 150 begins to incline to the upstream side of the take-out direction X6 (FIG. 22(*b*)). The direction of the inclination start of the coupling 150 is the same as the inclining direction of the coupling 150 (pre-engagement angular position) at the time of the mounting of the cartridge B. By the operation taking the cartridge B out of the main assembly A, the coupling 150 is moved while the upstream side free end portion 150 A3 with respect to the take-out direction X6 contacts to the free end portion 180*b*. In more detail, the coupling 150 makes the following motion in response to the movement of the cartridge B in the take-out direction X6. More particularly, while a part of coupling 150 (receiving surface 150*f* and/or projection 150*d*) which is the cartridge side contact portion contacts to the main assembly side engaging portion (drive shaft 180 and/or pin 182) the coupling 150 is moved. And, in the disengaging angular position, the axis L2 inclines until the free end portion 150 A3 reaches the free end 180*b*3 (FIG. 22(*c*)). And, in this state, the coupling 150 is passed by the drive shaft 180, and while contacting to the free end 180*b*3, it disengages from the drive shaft 180 (FIG. 22(*d*)). Thereafter, the cartridge B is taken out of the main assembly A through the process opposite from the mounting process described with FIG. 17.

As will be apparent from the foregoing description, the angle of the pre-engagement angular position relative to the axis L1 is larger than the angle of the disengaging angular position relative to the axis L1. By this, in consideration of the dimensional tolerance of the parts, at the time of the engagement of the coupling, the free end position (a part of coupling 150) 150A1 can pass assuredly by the free end portion 180*b*3 in the pre-engagement angular position. This is because, in the pre-engagement angular position, the gap is between the coupling 150 and the free end portion 180*b*3 (FIG. 19(*b*)). On the contrary, at the time of the coupling disengagement, the axis L2 inclines toward the disengaging angular position in interrelation with the removal of the cartridge B. For this reason, the free end portion 150 A3 of the coupling 150 is along the free end portion 180*b*3. In other words, the upstream side of the coupling 150 with respect to the cartridge take-out direction X6 and the free end portion 180*b* of the drive shaft 180 are substantially in the same position (FIG. 22(*c*)). Therefore, the angle at the pre-engagement angular position relative to the axis L1 is larger than the angle at the disengaging angular position relative to the axis L1.

In addition, similarly to the case where the cartridge B is mounted to the main assembly A, the cartridge B can be taken out of the main assembly A irrespective of the phases of the coupling 150 and the pin 182.

As has been described hereinbefore, in the state that the cartridge B is set to the main assembly A, a part of coupling 150 (free end position 150A1) as seen in the opposite direction to the removing direction X6 is behind the drive shaft 180 (FIG. 19(*d*)). And, in dismounting the cartridge B from the main assembly A the coupling 150 makes the following motion. In response to moving the cartridge B in the direction substantially perpendicular to the axis L1, the coupling 150 is moved inclined to the disengaging angular position from the rotational force transmitting angular position so that a part of coupling 150 (free end position 150A1) circumvents the drive shaft 180. In the state in which the cartridge B is mounted to the main assembly A the coupling 150 receives the rotational force from the drive shaft 180 in the rotational force transmitting angular position of the coupling 150 to rotate. More particularly, the rotational force transmitting angular position is an angular position for transmitting the rotational force for rotating the developing roller 110 to the developing roller 110. FIG. 21 shows the state that the coupling 150 is in the rotational force transmitting angular position.

The pre-engagement angular position of the coupling 150 is the angular position of the coupling 150 relative to the axis L1 immediately before the coupling 150 engages with the drive shaft 180 at the time of mounting the cartridge B to the main assembly A. More particularly, it is an angular position relative to the axis L1 at which the downstream side free end portion 150A1 of the coupling 150 can pass by the drive shaft 180 in the mounting direction of the cartridge B.

The disengaging angular position of the coupling 150 is the angular position of the coupling 150 relative to the axis L1 when the coupling 150 disengages from the drive shaft 180 in the case where the cartridge B is removed from the main assembly A. More particularly, as shown in FIG. 22, it is an angular position relative to the axis L1 at which the free end portion 150 A3 of the coupling 150 can pass by the drive shaft 180 in the removing direction of the cartridge B.

In the pre-engagement angular position or the disengaging angular position, an angle θ2 between the axis L2 and the axis L1 is larger than an angle θ1 between the axis L2 and the axis L1 in the rotational force transmitting angular position. The angle θ1 is preferably zero. However, according to this embodiment, if the angle θ1 is below approx. 15 degrees, the smooth transmission of the rotational force is accomplished. It is preferable that the angle θ2 is approx. 20-60 degrees.

As has been described hereinbefore, the coupling is mounted so that it is inclinable relative to the axis L1. And, in response to the removing operation of the cartridge B, the coupling 150 inclines. By this, the coupling 150 in the state of overlapping with the drive shaft 180 with respect to the direction of the axis L1 can be disengaged from the drive shaft 180. More particularly, the cartridge B is moved in the direction substantially perpendicular to the axial direction L3 of the drive shaft 180. By this, the coupling 150 of the state of covering the drive shaft 180 can be disengaged from the drive shaft 180.

In the foregoing description, in interrelation with the cartridge B moving in the take-out removing direction X6, the receiving surface 150*f* or the projection 150*d* of the coupling 150 contacts to the free end portion 180*b*. By this, the axis L2 starts the inclination (movement) to the upstream side with respect to the take-out direction. However, in this embodiment, this is not inevitable. For example, a structure may be employed so that the urging force (elastic force) is applied beforehand to the upstream side of the coupling 150 with respect to the take-out direction. And, in response to the movement of the cartridge B, by the urging force relative to the coupling 150, the axis L2 starts the inclination to the downstream side with respect to the take-out direction (the movement). The free end 150 A3 passes by the free end 180*b*3, and the coupling 150 disengages from the drive shaft 180. In other words, the coupling can be disengaged from the drive shaft 180, without the contact between the upstream (with respect to the take-out direction of the coupling 150) receiving surface 150*f* or projection 150*d* and the free end portion 180*b*. Therefore, if the axis L2 can be inclined in interrelation with the take-out operation of the cartridge B, any structure can be applied.

By the time immediately before the coupling 150 is mounted to the drive shaft 180, the driven portion of the coupling 150 is inclined toward the downstream side with respect to the mounting direction. In other words, the coupling 150 is moved to the pre-engagement angular position beforehand.

The pivoting in the plane of the sheet of the drawing of FIG. 22 has been described, but, the revolution may be included, similarly to the case of FIG. 19.

As has been described hereinbefore, the axis L2 of the coupling 150 can incline in all directions relative to the axis L1 of the developing roller 110 (FIG. 11).

More particularly, the axis L2 is inclinable in any direction relative to the axis L1. However, as for the coupling 150, the axis L2 is not necessarily inclinable linearly to the predetermined angle in any direction over 360 degrees range. In this case, for example the opening 150*g* is more widely formed in the circumferential direction. With such an opening, when the axis L2 incline relative to the axis L1, the coupling 150 can be rotated to a slight degree about the axis L2 even in the case where it cannot incline to the predetermined angle linearly. By this, the coupling 150 can incline to the predetermined angle. In other words, the amount of the play in the rotational direction of the opening 150*g* can be selected properly if necessary.

In this manner, the coupling 150 is revolvable (swingable) over the full-circumference thereof substantially relative to the axis L1 of the developing roller 110. More particularly, the coupling 150 is pivotable substantially over the full-circumference thereof relative to the developing roller 110.

As will be apparent from the foregoing description, the coupling 150 is revolvable substantially over the full-circumference thereof relative to the axis L1.

Here, the revolution of the coupling does not mean that the coupling itself rotates about the axis L2 of the coupling, but means that the inclined axis L2 rotates about the axis L1 of the developing roller 110. However, it does not exclude that the coupling 150 itself rotates about the axis L2 in the range of the play or the gap provided positively.

More particularly, the coupling 150 is revolvable so that in the state of positioning the developing roller 110 side end of the driving portion 150*b* on the axis L2, the free end of the driven side 150*a* draws a circle having the center thereof on the axis L2.

In addition, the coupling 150 is provided to the end of the developing roller 110 pivotably substantially in all directions relative to the axis L1. By this, the coupling 150 can be smoothly pivoted between the pre-engagement angular position, the rotational force transmitting angular position, and the disengaging angular position.

Here, the pivotability substantially in all directions is as follows. More particularly, when the user mounts the cartridge B to the main assembly A, the coupling 150 can pivot to the rotational force transmitting angular position irrespective of the stoppage phase of the drive shaft 180 which has the rotational force applying portion.

In addition, when the user dismounts the cartridge B from the main assembly A, the coupling 150 can pivot to the disengaging angular position irrespective of the stoppage phase of the drive shaft 180.

In addition, the coupling 150 has the gap between the rotational force transmitting portion (pin 155, for example), and the rotational force transmitted portion (rotational force transmitting surface 153*h*1, 153*h*2, for example) which is in engagement with the rotational force transmitting portion so that it is inclinable substantially in all directions relative to the axis L1. In this manner, the coupling 150 is mounted to the end of the developing roller 110. Therefore, the coupling 150 is inclinable substantially in all directions relative to the axis L1. As has been described hereinbefore the coupling of the present embodiment is mounted so that the axis L2 thereof can incline move in any direction relative to the axis L1 of the developing roller 110. Here, the inclination (movement) includes the pivoting, the swinging, and the revolution described above, for example.

Figure 23:
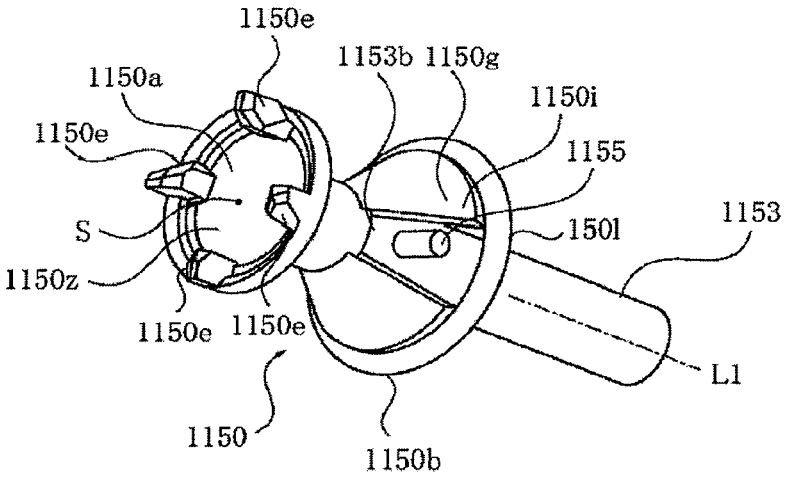
FIG. 23 is a perspective view illustrating the coupling according to a modified example according to an embodiment of the present invention.
Figure 23:
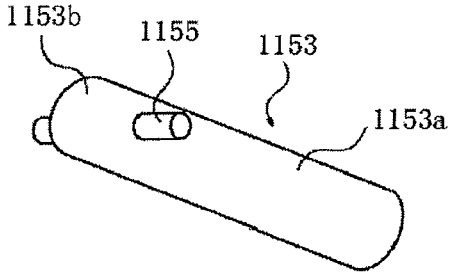
Figure 24:
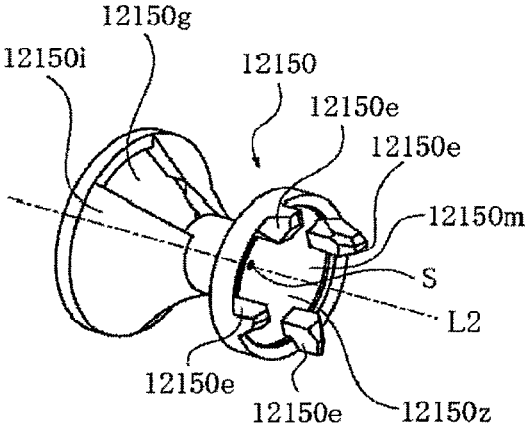
FIG. 24 is a perspective view illustrating the coupling according to a modified example according to an embodiment of the present invention.
Figure 24:
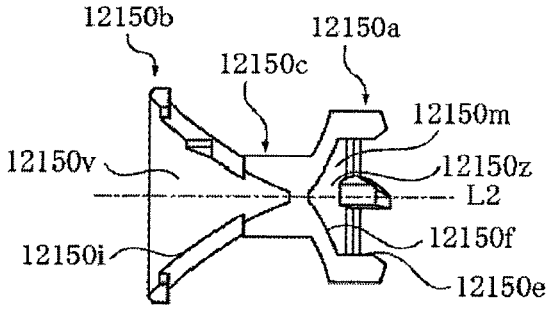

Referring to FIGS. 23-24, a modified example of the coupling will be described.

FIG. 23 shows a first modified example. A driving portion 1150*b* of a coupling 1150 of this modified example has the expanding shape similarly to a driven portion 1150*a*. A development shaft 1153 is provided co-axially with the developing roller.

The development shaft 1153 has a circular column portion 1153*a*, and it has a diameter approx. 5-15 mm in consideration of the material, the load, and the spacing. The circular column portion 1153*a* is fixed, by press-fitting, bonding, insert molding, and so on, to an engaging portion of a developing roller flange (unshown). By this, the development shaft 1153 transmits the rotational force from the main assembly A to the developing roller 110 through the coupling 1150 as will be described hereinafter. The circular column portion 1153*a* thereof is provided with a free end portion 1153*b*. The free end portion 1153*b* has a spherical configuration so that when the axis L2 of the coupling 1150 inclines, it can incline smoothly. In the neighborhood of a free end of the development shaft 1153, in order to receive the rotational force from the coupling 1150, the drive transmission pin (rotational force transmitting portion, rotational force receiving portion) 1155 extends in the direction crossing with an axis L1 of the development shaft 153.

The pin 1155 is made of metal, and is fixed by the press-fitting, bonding, and so on relative to the development shaft 1153. The position thereof may be any, if it is such a position that the rotational force is transmitted (direction crossing with the axis L1 of development shaft 153 (developing roller 110)). Preferably, it passes through the spherical surface center of the free end portion 1153*b* of the development shaft 1153.

The driven portion 1150*a* of the coupling 1150 has the configuration the same as the configuration described above, and therefore, the description is omitted for simplicity.

An opening 1150*g* is provided with a rotational force transmitting surface (rotational force transmitting portion) 1150*i*. In the state of the coupling is set in the cartridge B, an opening 11501 has a conical shape as an expanded part which expands toward the side which has the development shaft 153. By the coupling 1150 rotating, the rotational force transmitting surface 1150*i* pushes the pin 1155 to transmit the rotational force to the developing roller 110.

By this, irrespective of the rotational phase of the developing roller 110 in the cartridge B, the coupling 1150 can pivot (move) between the rotational force transmitting angular position, the pre-engagement angular position, and the disengaging angular position relative to the axis L1 without being prevented by the free end portion of the development shaft 1153. In the illustrated example, the receiving surface 1150*i* is provided with a stand-by opening 1150*g* (1150*g*1, 1150*g*2). The coupling 1150 is mounted to the development shaft 1153 so that the pin 1155 is received in the opening 1150*g*1 or 1150*g*2. The size of the opening 1150*g*1 or 1150*g*2 is larger than the outer diameter of the pin 1155. By this, irrespective of the rotational phase of the developing roller 110 in the cartridge B, the coupling 1150 is pivotable (movable) between the rotational force transmitting angular position and the pre-engagement angular position (or the disengaging angular position), without being prevented by the pin 1155.

And, the rotational force transmitting surface 1150*i* pushes the pin 1155 by the rotation of the coupling 1150 to transmit the rotational force to the developing roller 110.

Referring to FIG. 24, a second modified example will be described.

In the embodiments described above, the driving shaft receiving surface or the developing shaft receiving surface of coupling is conical. In this embodiment, the different configuration is employed.

A coupling 12150 shown in FIG. 24 has three main parts similarly to the coupling 150 shown in FIG. 6. More particularly, the coupling 12150 has a driven portion 12150*a* for receiving the rotational force from the drive shaft 180, a driving portion 12150*b* for transmitting the rotation to the development shaft 153, and an intermediate portion 12150*c* for connecting a driven portion 12150*a* and a driving portion 12150*b* (FIG. 24(*b*)).

The driven portion 12150*a* and the driving portion 12150*b* are provided with a drive shaft insertion opening 12150*m* which expands toward the drive shaft 180 relative to the axis L2 and a development shaft insertion opening 12150*v* which expands toward the direction of the development shaft 153, respectively (FIG. 24(*b*)). The opening 12150*m* and the opening 12150*v* constitute the expanded parts. The opening 12150*m* and the opening 12150*v* is constituted by the horn-like driving shaft receiving surface 12150*f* and the developing shaft receiving surface 12150*i*. The receiving surface 12150*f* and the receiving surface 12150*i* are provided with recesses 12150*x*, 12150*z* (FIG. 24). At the time of the rotational force transmission, the recess 12150*z* opposes to the free end of the drive shaft 180. More particularly, the recess 12150*z* covers the free end of the drive shaft 180.

As has been described hereinbefore, the developing shaft receiving surface of the coupling has the expanding shape, and therefore, the coupling can be mounted for inclining motion relative to the axis of the development shaft. Furthermore, the driving shaft receiving surface of the coupling has the expanding shape, and therefore, the coupling can be inclined, without interfering with the drive shaft in response to the mounting operation or take-out operation of the cartridge B. By this, in this embodiment, the effects similar to the first embodiment or the second embodiment can be provided.

Each the configurations of the openings 12150*m*, 12250*m* and the openings 12150*v*, 12250*v* may be a combination of a horn-like shape and a bell-like shape or the like.

Figure 25:
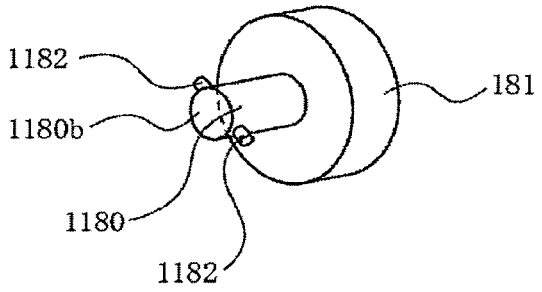
FIG. 25 is an exploded perspective view illustrating the drive shaft according to a modified example of an embodiment of the present invention.
Figure 25:
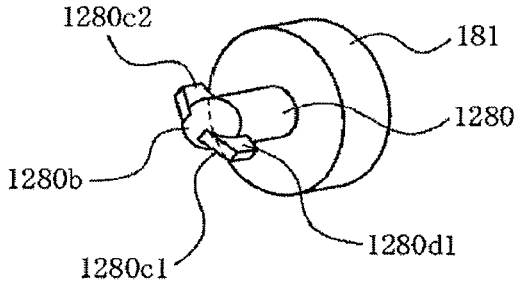

Referring to FIG. 25, a further embodiment of the drive shaft will be described. FIG. 25 is perspective views of a drive shaft and a development drive gear.

As shown in FIG. 25, the free end of the drive shaft 1180 has a flat surface 1180*b*. In this case, the configuration of the shaft is simple, and therefore, the manufacturing cost can be reduced.

As shown in FIG. 25(*b*), a rotational force applying portion (drive transmitting portion) 1280, (1280*c*1, 1280*c*2) may be integrally molded with a drive shaft 1280. In the case of the drive shaft 1280 being a molded resin part, the rotational force applying portion may be molded integrally. In this case, the cost reduction can be accomplished. In addition, designated by 1280*b* is a flat surface portion.

a positioning method of the developing roller 110 in the direction of the axis L1 will be described. Here, for example, the description will be made as to the coupling expanded toward the developing roller in the axial direction (FIG. 24) similarly to the coupling of the first modified example. However, the present embodiment can be applied also to the coupling of the first embodiment.

Figure 26:
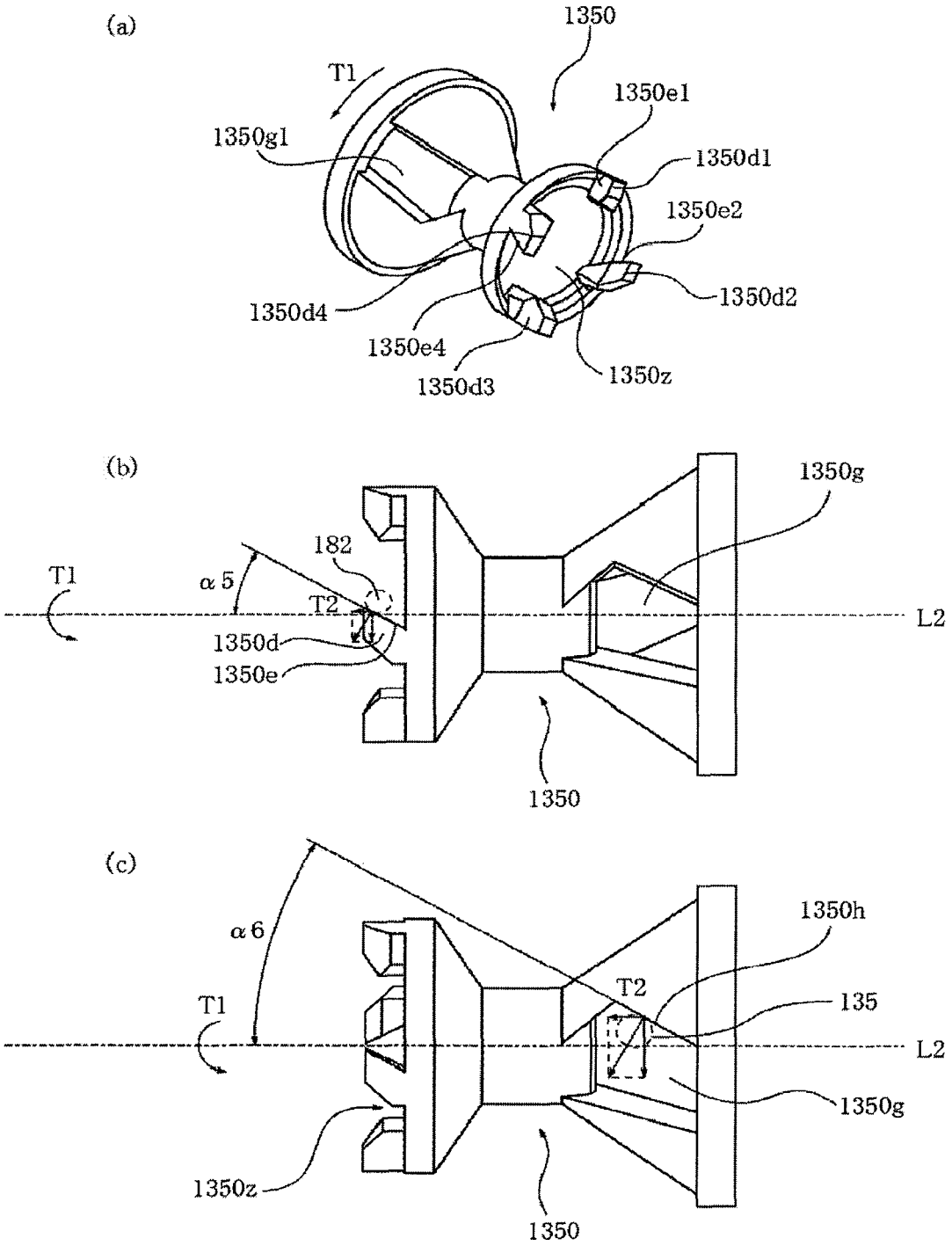
FIG. 26 is a perspective view illustrating the coupling according to the modified example of the present invention.
Figure 27:
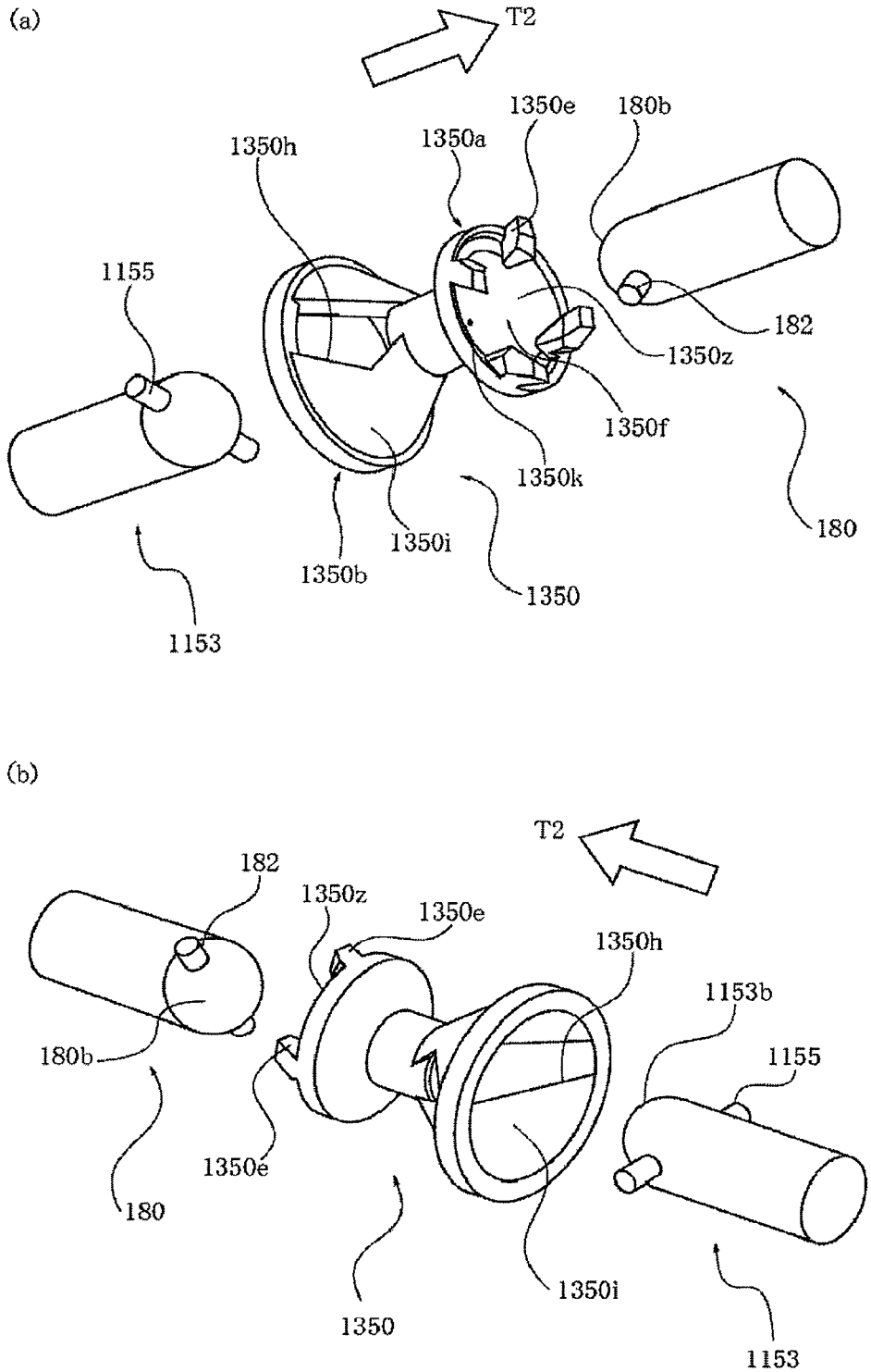
FIG. 27 is an exploded perspective view illustrating the drive shaft, the development shaft and the coupling only according to the embodiment of the present invention.

A coupling 1350 is provided with a tapered surface (inclinded surface) 1350*e*, 1350*h*. The tapered surface 1350*e*, 1350*h* produces a thrust force at the time of the rotation of the drive shaft 181. By this thrust force, the coupling 1350 and the developing roller 110 are correctly positioned in the direction of the axis L1. Referring to FIG. 26 and FIG. 27, a further description is made. FIG. 26 is a perspective view and a top plan view of the coupling alone. FIG. 27 is an exploded perspective view illustrating a drive shaft, a development shaft, a coupling.

As shown in FIG. 26(*b*), the rotational force reception surface 1350*e* (1350*e*1 to 1350*e*4, inclinded surface, rotational force receiving portion) is tapered at the angle α5 relative to the axis L2. When the drive shaft 180 rotates in a direction T1, the pin 182 and the rotational force reception surface 1350*e* contact with each other. Then, a component force is applied in the direction T2 to the coupling 1350 to move it in the direction. And, until the driving shaft receiving surface 1350*f* (FIG. 27*a*) contacts to the free end 180*b* of the drive shaft 180, the coupling 1350 moves in the direction of the axis L2. By this, the position of the coupling 1350 is determined with respect to the direction of the axis L2. In addition, the free end 180*b* of the drive shaft 180 is spherical. The receiving surface 1350*f* is conical. For this reason, the position of the driven portion 1350*a* relative to the drive shaft 180 is determined in the orthogonal direction to the axis L2. In addition, in the case of the coupling 1350 set to the developing roller 110, the developing roller 110 is also moved in the axial direction by a force applied in the direction T2. In this case, the position of the developing roller 110 relative to the main assembly A in the longitudinal direction is also determined. The developing roller 110 is mounted with play in the longitudinal direction in the cartridge frame.

As shown in FIG. 26(*c*), in addition, the rotational force transmitting surface (rotational force transmitting portion) 1350*h* is tapered at a angle α6 relative to the axis L2 (inclinded surface). When the coupling 1350 rotates in the direction T1, the transmitting surface 1350*h* and the pin 1155 contact to each other. And, the transmitting surface 1350*h* pushes the pin 1155. Then, a component force is applied in the direction T2 to the pin 1155 to move in the direction T2. Until the free end 1153*b* of the development shaft 1153 contacts to the developing shaft receiving surface 1350*i* (FIG. 27(*b*)) of the coupling 1350, the development shaft 1153 moves. By this, the position of the development shaft 1153 (the developing roller) is determined in the direction of the axis L2. The developing shaft receiving surface 1350*i* is conical and free end 1153*b* of the development shaft 1153 is spherical. In the orthogonal direction to the axis L2, the position of the driving portion 1350*b* relative to the development shaft 1153 is determined.

The taper angles α5, α6 are selected so that the sufficient force to move the coupling and the developing roller in the thrust direction is produced. Such a force is different depending on the torque required by the developing roller 110. However, if another means for positioning it in the thrust direction is employed, the taper angles α5, α6 may be small.

As has been described hereinbefore, the coupling 1350 is provided with a tapered portion for producing retraction thrust in the direction of the axis L2 and a conic surface for the positioning in the orthogonal direction to the axis L2. By this, the coupling 1350 can simultaneously be determined in the position and the axis L1 in the direction of the axis L1, the position in the orthogonality direction. In addition, the coupling 1350 can transmit the rotational force assuredly. As compared with the case where the rotational force reception surface (the rotational force receiving portion) or the rotational force transmitting surface (the rotational force transmitting portion) of the coupling 1350 does not have the taper angle described above, the following effects are provided. In the present embodiment, the contact between the pin 182 (rotational force applying portion) of the drive shaft 180 and the rotational force reception surface 1350*e* of the coupling 1350 can be stabilized. In addition, the contact between the pin 8 (rotational force transmitted portion) 1155 of the development shaft 1153 and the transmitting surface (rotational force transmitting portion) 1350*h* of the coupling 1350 can be stabilized.

However, the tapered surface (inclinded surface) described above and conic surface described above of the coupling 1350 is not inevitable. For example, in place of the taper described above, a part for applying the urging force in the direction of the axis L2 may be added.

Figure 28:
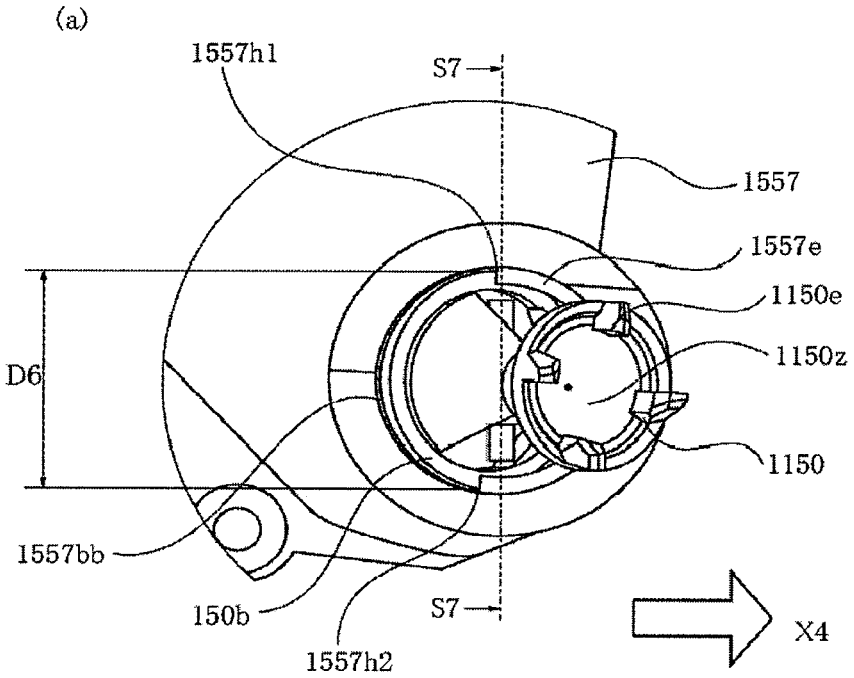
FIG. 28 is a side view and a longitudinal section of the cartridge side according to the embodiment of the present invention.
Figure 28:
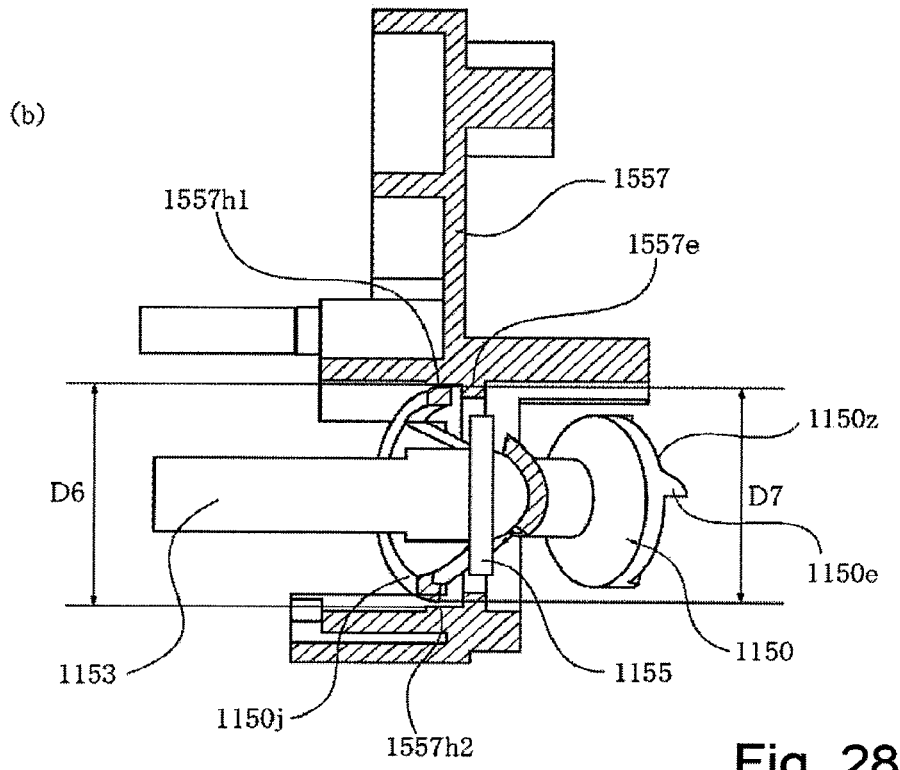

Referring to FIG. 28, the description will be made as to the regulating means for regulating the inclining direction of the coupling relative to the cartridge B. FIG. 28(*a*) is a side view illustrating a major part of the driving side of the cartridge. FIG. 28(*b*) is a sectional view taken along a line S7-S7 of FIG. 28(*a*). For example, the description will be made as to the coupling (FIG. 24) of the first modified example. The driving portion expands toward the developing roller in the axial direction in the coupling of the first modified example. However, the present embodiment is applicable also to the coupling of the first embodiment. The coupling of the first embodiment has the spherical driving portion.

In this embodiment by employing the regulating means, the coupling 1150 and the drive shaft 180 can be engaged further assuredly.

In this embodiment, a development supporting member 1557 is provided with a regulating portion 1557*h*1, 1557*h*2 as a regulating means. The swinging directions of the coupling 1150 relative to the cartridge B can be regulated by this regulating means. The regulating portions 1557*h*1 or 1557*h*2 are contacted to the flange portion 1150*j* to regulate the swinging directions of the coupling 1150. The regulating portions 1557*h*1 and 1557*h*2 are provided so that immediately before the coupling 1150 engages with the drive shaft 180, it is parallel to the mounting direction X4 of the cartridge B. In addition, the intervals D6 between them is slightly larger than the outer diameter D7 of the driving portion 1150*b* of the coupling 1150 (FIG. 28(*d*)). By this, the coupling 1150 is inclinable only toward the mounting direction X4 of the cartridge B. In addition, the coupling 1150 is inclinable in the all directions relative to the development shaft 1153. For this reason, irrespective of the phase of the development shaft 1153, the coupling 1150 can incline in the regulated direction. Accordingly, the drive shaft 180 is further assuredly acceptable in the opening 1150*m* of the coupling 1150. By this, the coupling 1150 is engageable further assuredly with the drive shaft 180.

Figure 29:
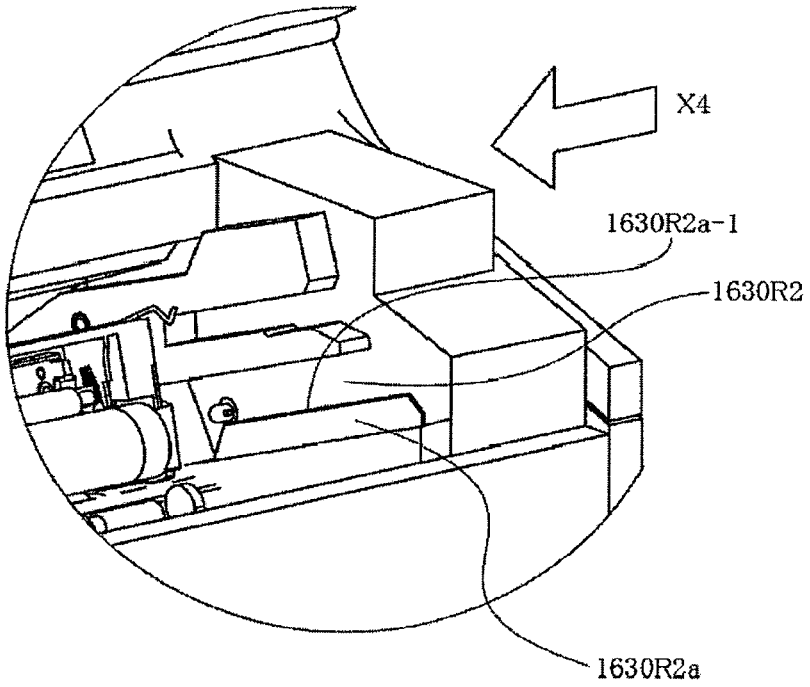
FIG. 29 is a perspective view of the cartridge set portion of the main assembly, and a view, as seen from the device, according to the embodiment of the present invention.
Figure 29:
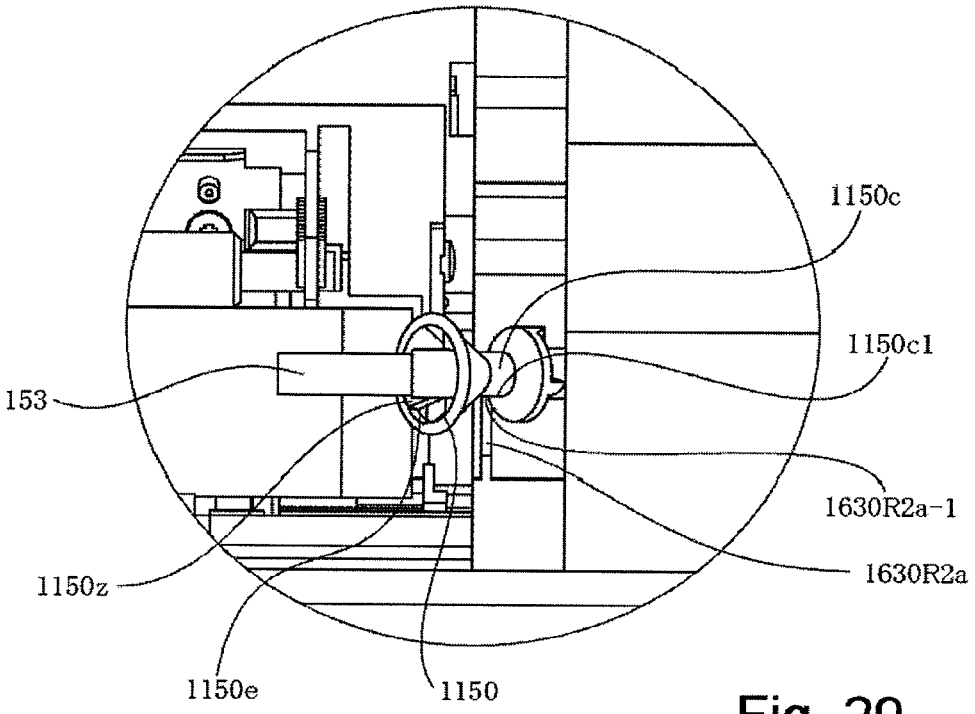

Referring to FIG. 29, another structure for regulating the inclining direction of the coupling will be described. FIG. 29(*a*) is a perspective view showing an inside of a driving side of the main assembly. FIG. 29(*b*) is a side view of the cartridge seen from the upstream side of the mounting direction X4.

In the foregoing description, the regulating portions 1557*h*1, 1557*h*2 are provided in the cartridge B. In this embodiment, a part of a mounting guide 1630R1 of the driving side of the main assembly A is a rib-like regulating portion 1630R1*a*. By this, the regulating portion 1630R1*a* is the regulating means for regulating the swinging directions of the coupling 1150. And, when the user inserts the cartridge B, the outer periphery of the intermediate portion 1150*c* of the coupling 1150 is contacted to the upper surface 1630R1*a*-1 of the regulating portion 1630R1*a*. By this, the coupling 1150 is guided by the upper surface 1630R1*a*-1. Therefore, the inclining direction of the coupling 1150 is regulated. Similarly to the embodiment described above, in addition, irrespective of the phase of the development shaft 1153, the coupling 1150 can incline in the regulated direction.

In the embodiment shown in FIG. 29(*a*), the regulating portion 1630R1*a* is provided below the coupling 1150. Similarly to the regulating portion 1557*h*2 shown in FIG. 28, however, the more assured regulation can be performed when the regulating portion is added to the upper side.

As has been described hereinbefore, it may be combined with the structure which provides the regulating portion in the cartridge B. In this case, even further assured regulation even can be carried out.

In addition, a shaft is provided substantially co-axial with the axis of the coupling 150 (FIG. 6) of the first embodiment, the shaft may be regulated by another part (bearing member, for example) of a cartridge.

However, in this embodiment, the means for regulating the inclining direction of the coupling may not be provided. For example, the coupling 1150 inclines toward the downstream side of the cartridge B with respect to the mounting direction. The driving shaft receiving surface 1150*f* of the coupling is increased. By this, the drive shaft 180 and the coupling 150 can be engaged with each other.

In the foregoing description, the angle of the pre-engagement angular position of the coupling 150 relative to the axis L1 is larger than the angle of the disengaging angular position. However, this is not inevitable.

Figure 30:
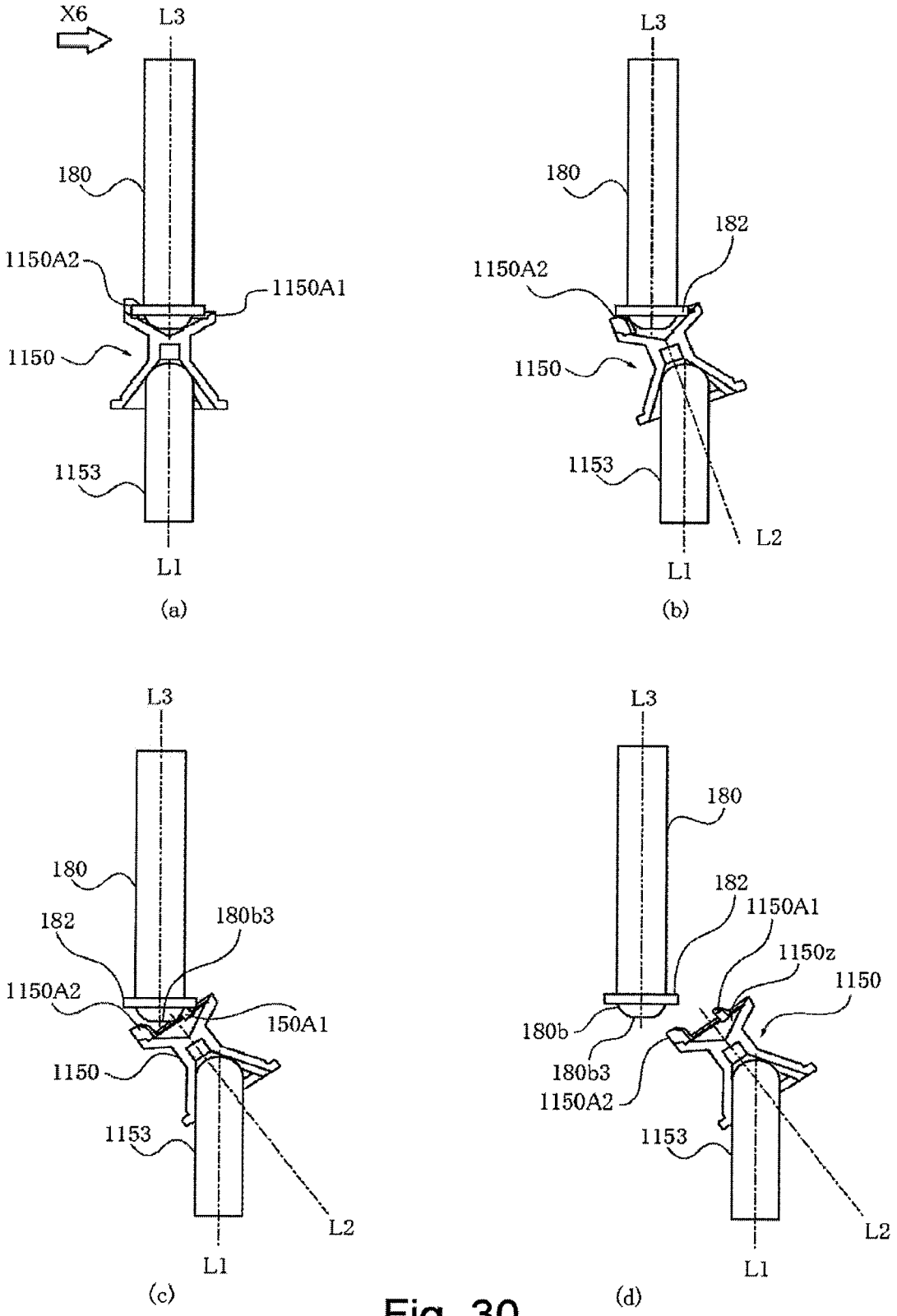
FIG. 30 is a longitudinal sectional view illustrating the take-out process in which the cartridge according to the embodiment of the present invention is taken out of the main assembly.

Referring to FIG. 30, this will be described. FIG. 30 is a longitudinal sectional view illustrating a process in which the cartridge B is taken out of the main assembly A. For example, the coupling of the first modified example is taken. However, this is applicable also to the coupling of the first embodiment.

In the process in which the cartridge B is taken out of the main assembly A, the angle of the disengaging angular position (FIG. 30*c*) of the coupling 1750 with respect to the axis L1 may be as follows. The angle may be equivalent to the angle of the coupling 1150 at the pre-engagement angular position relative to the axis L1 at the time of the coupling 1150 engaging with the drive shaft 180. Here, the disengagement process of the coupling 1150 will be described with FIG. 30(*a*)-(*b*)-(*c*)-(*d*).

More particularly, when the free end portion 1150 A3 passes by the free end portion 180*b*3 of the drive shaft 180 with respect to the upstream side in the take-out direction X6 of the coupling 1150, the distance between the free end portion 1150 A3 and the free end portion 180*b*3 is equivalent to that in the pre-engagement angular position. The coupling 1150 can be disengaged from the drive shaft 180 with such a setting.

As to the other operations when the cartridge B is taken out, the same as that of the operation described above applies. For this reason, the description is omitted for simplicity.

In the foregoing description, at the time of mounting the cartridge B to the main assembly A, the downstream side free end with respect to the mounting direction of the coupling is nearer, than the free end of the drive shaft 180, to the development shaft. However, this is not inevitable.

Figure 31:
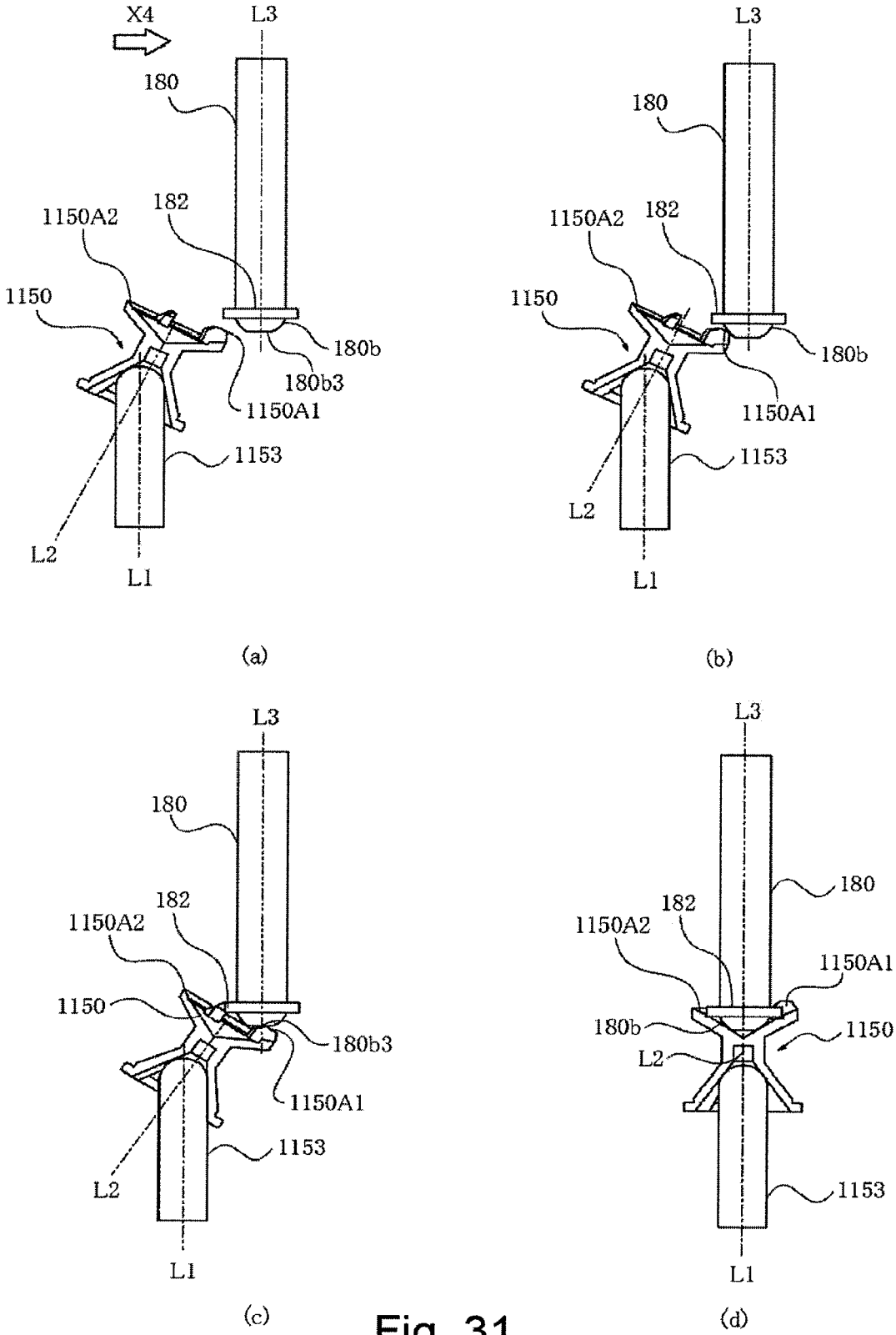
FIG. 31 is a longitudinal sectional view illustrating the mounting process in which the cartridge according to the embodiment of the present invention is mounted to the main assembly.

Referring to FIG. 31, the description will be made as to this point. For example, the coupling of the first modified example is taken. However, it is applicable also to the coupling of the first embodiment.

FIG. 31 is a longitudinal sectional view illustrating a mounting process of the cartridge B. The mounting of the cartridge B is carried out in order of (*a*)-(*b*)-(*c*)-(*d*). In the state shown in FIG. 31(*a*), in the direction of the axis L1, the downstream free end position 1150A1 with respect to the mounting direction X4 is nearer, than a free end 180*b*3 of the shaft, to the pin 182 (rotational force applying portion). In the state shown in FIG. 31(*b*), the free end position 1150A1 is contacted to the free end portion 180*b*. At this time, the free end position 1150A1 is moved toward the development shaft 1153 along the free end portion 180*b*. The free end position 1150A1 is passed by the free end portion 180*b*3 (at this time, the coupling 1150 is in the pre-engagement angular position) (FIG. 31(*c*)). Finally, the coupling 1150 and the drive shaft 180 engage with each other (rotational force transmitting angular position) (FIG. 31(*d*)).

In the developing cartridge in which such a coupling is used, the following effects are provided in addition to the effects described heretofore.

(1) An external force is applied to the cartridge by the engagement force between the gears. In the case that the direction of the external force is such that the developing roller and the photosensitive drum are separated from each other, there is a possibility that the image quality may deteriorate. Therefore, the position of a center of swinging or the gear of the cartridge is restricted so that that the moment in the direction of the developing roller approaching to the photosensitive drum is produced. For this reason, the design latitude is narrow. Therefore, there is a possibility that the main assembly or the cartridge may become bulky. However, according to this embodiment, the latitude about the driving input position is wide. Therefore, the main assembly or the cartridge can be downsized.

(2) In the case of the operative connection gear between cartridge s and the main assembly: in order to prevent the tooth tip bearing between a gear and a gear at the time of the mounting of the cartridge, it is required to consider the positions of the gears so that the gears approach beyond the tangential direction. For this reason, there is a possibility that the design latitude may be narrow and the main assembly or the cartridge may be become to bulky. However, according to this embodiment, the latitude of the driving input position is high. Therefore, it is possible to downsize the main assembly or the cartridge.

An example according to the present embodiment will be described.

The maximum outer diameter of the driven portion 150*a* of the coupling 150 is Z4, the diameter of a phantom circle C1 contacting the end surface of the inside of the projections 150*d*1, 150*d*2, 150*d*3, 150*d*4 is Z5, and the maximum outer diameter of the driving portion 150*b* is Z6 (FIG. 6(*d*), (*f*)). The angle of the receiving surface 150*f* of the coupling 150 is α2. The shaft diameter of the drive shaft 180 is Z7, the shaft diameter of the pin 182 is Z8, and the length thereof is Z9 (FIG. 19). Relative to the axis L1, the angle at the rotational force transmitting angular position is β1, and the angle at the pre-engagement angular position is β2, and the angle at the disengaging angular position is β3. At this time, for example, z4=13 mm, z5=8 mm, z6=10 mm, z7=6 mm, z8=2 mm, z9=14 mm, α1=70 degree, β1=0 degree, β2=35 degree, β3=30 degree.

It has been confirmed that the coupling 150 can engage with the drive shaft 180 with the above described setting. However, the similar operation is possible with the other settings. The coupling 150 can transmit the rotational force to the developing roller 110 with high precision. The values described above are examples and, the present invention is not limited to these values.

In this embodiment, the pin (rotational force applying portion) 182 is disposed at a position in a range of 5 mm from the free end of the drive shaft 180. The rotational force reception surface (rotational force receiving portion) 150*e* provided in the projection 150*d* is disposed at a position in the range of 4 mm from the free end of the coupling 150. In this manner, the pin 182 is provided on the free end portion of the drive shaft 180. The rotational force reception surface 150*e* is disposed on the free end portion of the coupling 150.

By this, in mounting the cartridge B to the main assembly A, the drive shaft 180 and the coupling 150 can engage with each other smoothly. More particularly, the pin 182 and the rotational force reception surface 150*e* can engage with each other smoothly.

In dismounting the cartridge B from the main assembly A, the drive shaft 180 and the coupling 150 can disengage from each other smoothly. More particularly, the pin 182 and the rotational force reception surface 150*e* can disengage from each other smoothly.

These values are examples and the present invention is not limited to the values. However, the effects described above are effectively provided by disposing the pin (rotational force applying portion) 182 and the rotational force reception surface 150*e* in the ranges of the values.

As has been described in the foregoing, according to the embodiment of the present invention, the coupling 150 can take the rotational force transmitting angular position and the pre-engagement angular position. Here, the rotational force transmitting angular position is an angular position for transmitting the rotational force for rotating the developing roller 110 to the developing roller 110. The pre-engagement angular position is the angular position which is the position inclined, in the direction away from the axis L1 of the developing roller 110, from the rotational force transmitting angular position. The coupling 150 can take a disengaging angular position which is the position inclined, in the direction away from the axis L1 of the developing roller 110, from the rotational force transmitting angular position. In dismounting the cartridge B, in the direction substantially perpendicular to the axis L1, from the main assembly A, the coupling 150 moves to the disengaging angular position from the rotational force transmitting angular position. By this, the cartridge B can be dismounted from the main assembly A. In mounting the cartridge B to the main assembly A in the direction substantially perpendicular to the axis L1, the coupling 150 moves to the rotational force transmitting angular position from the pre-engagement angular position. By this, the cartridge B can be mounted to the main assembly A. This applies to the following embodiments. However, in the embodiment 2 only the case where it dismounts the cartridge B from the main assembly A will be described.

(Embodiment 2)

Referring to FIGS. 32-36, the second embodiment of the present invention will be described. For example, the coupling of the first modified example is taken. However, the present embodiment is applicable also to the coupling of the first embodiment, for example. As for the structure of the coupling, the proper structure is selected by the person skilled in the art.

In the description of this embodiment, the same reference numerals as in Embodiment 1 are assigned to the elements having the corresponding functions in this embodiment, and the detailed description thereof is omitted for simplicity The same applies all the subsequent embodiments.

The present embodiment may be applied only for the case of dismounting the cartridge B from the main assembly A.

In the case of stopping the drive shaft 180 by the controlling operations of the main assembly A, the drive shaft 180 is stopped in the predetermined phase (A predetermined orientation of the pin 182). The phase of the coupling 14150 (150) is set in alignment with the phase of the drive shaft 180. For example, the position of the standing-by portion 14150*k* (150*k*) aligns with the stop position of the pin 182. With such a setting, in mounting the cartridge B to the main assembly A the coupling 14150 (150) is in the state of opposing to the drive shaft 180, without the pivoting (swinging, revolving). By the rotation of the drive shaft 180, the rotational force is transmitted from the drive shaft 180 to the coupling 14150 (150). By this, the coupling 14150 (150) can be rotated with high precision.

However, in the case of dismounting the cartridge B, in the direction substantially perpendicular to the direction of the axis L3, from the main assembly A, the structure of the embodiment 2 of the present invention is effective. Here, the pin 182 and the rotational force reception surface 14150*e*1, 14150*e*2 (150*e*) are in engagement with each other. This is because, in order for the coupling 14150 (150) to disengage from the drive shaft 180, the coupling 14150 (150) must be pivoted.

In the embodiment 1 described above, in the case of mounting and dismounting relative to the main assembly A of the cartridge B, the coupling 14150 (150) inclines (move). Therefore, it is not necessary to align the phase of the coupling 14150 (150) with the phase of the stopped drive shaft 180 beforehand, at the time of mounting the cartridge B to the main assembly A with the control of the main assembly A described above.

Referring to the drawing, the description is made.

Figure 32:
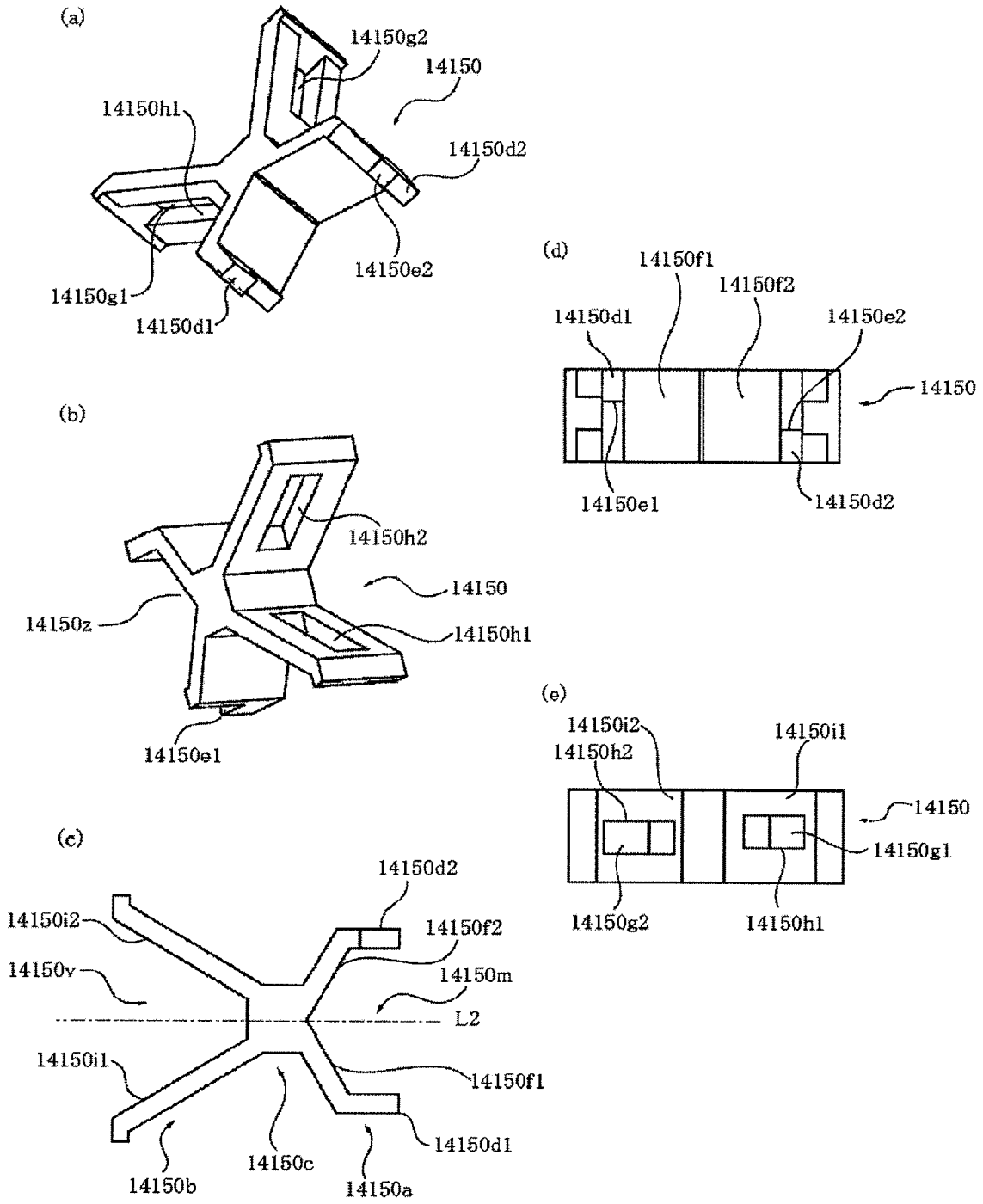
FIG. 32 is a perspective view and a top plan view of the coupling according to a second embodiment of the present invention.
Figure 33:
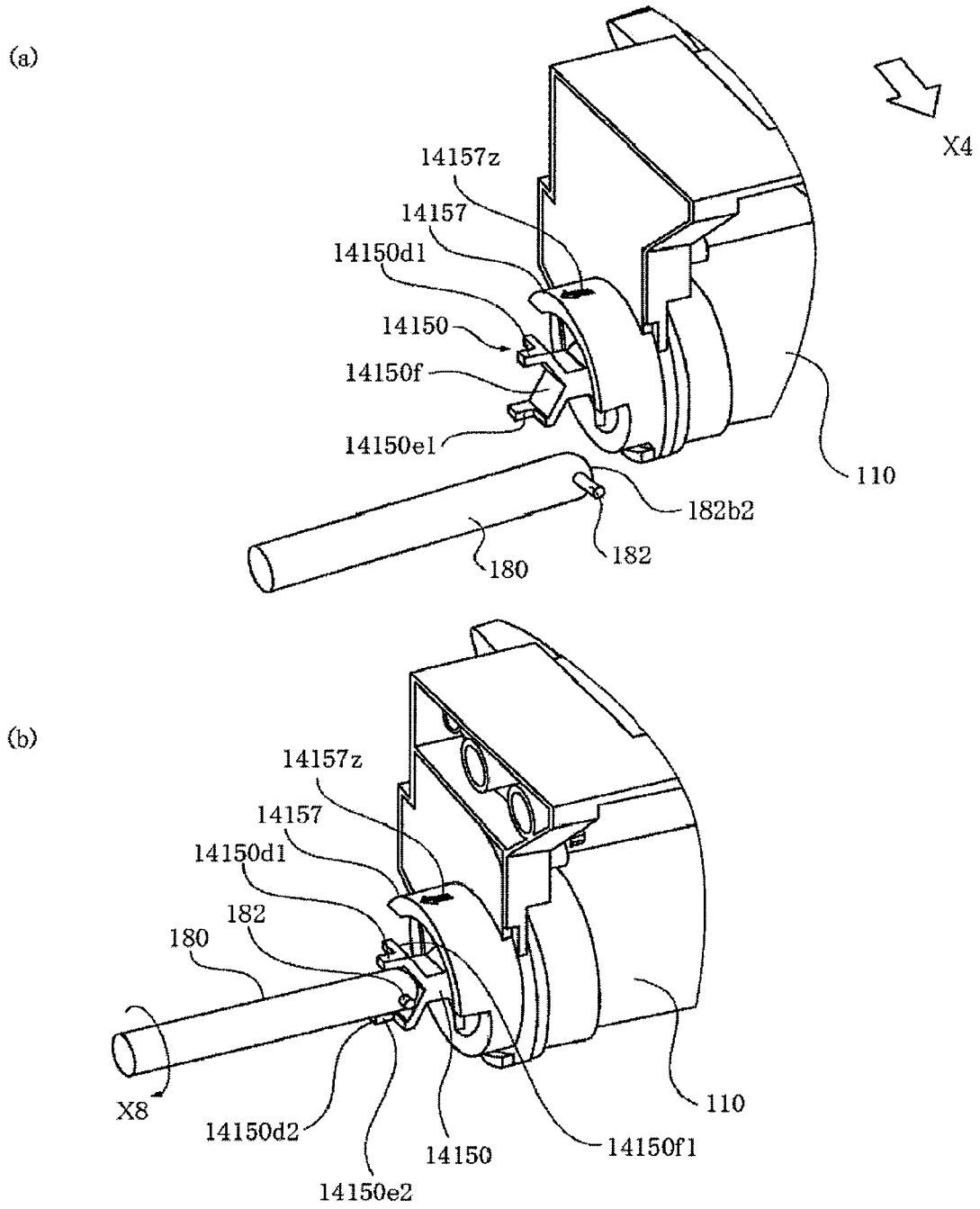
FIG. 33 is a perspective view illustrating the mounting operation of the cartridge according to the second embodiment of the present invention.
Figure 34:
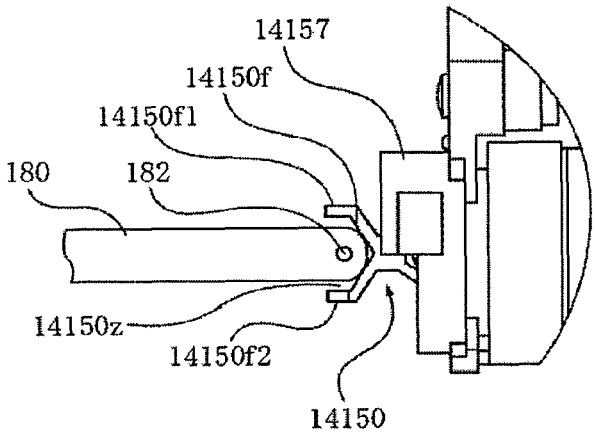
FIG. 34 is a top plan view of the cartridge, as seen in the mounting direction, in the state of mounting the cartridge according to the second embodiment of the present invention.
Figure 34:
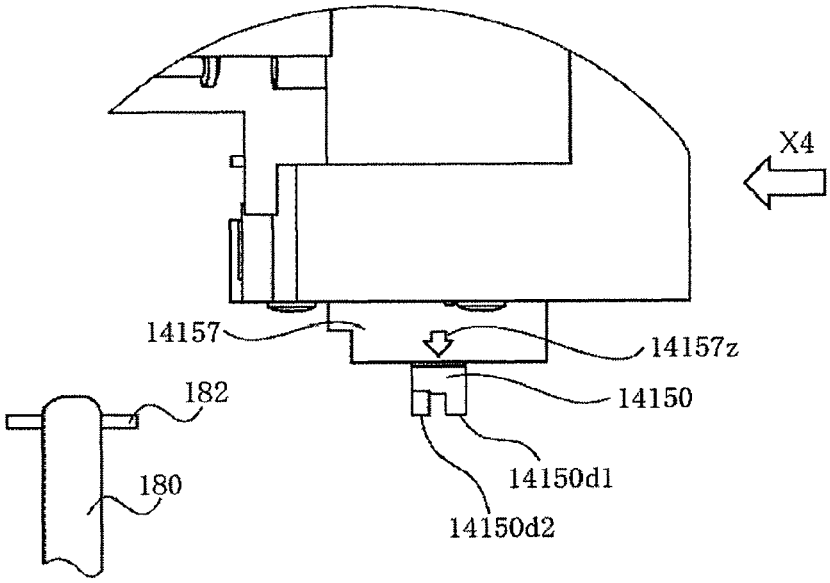
Figure 35:
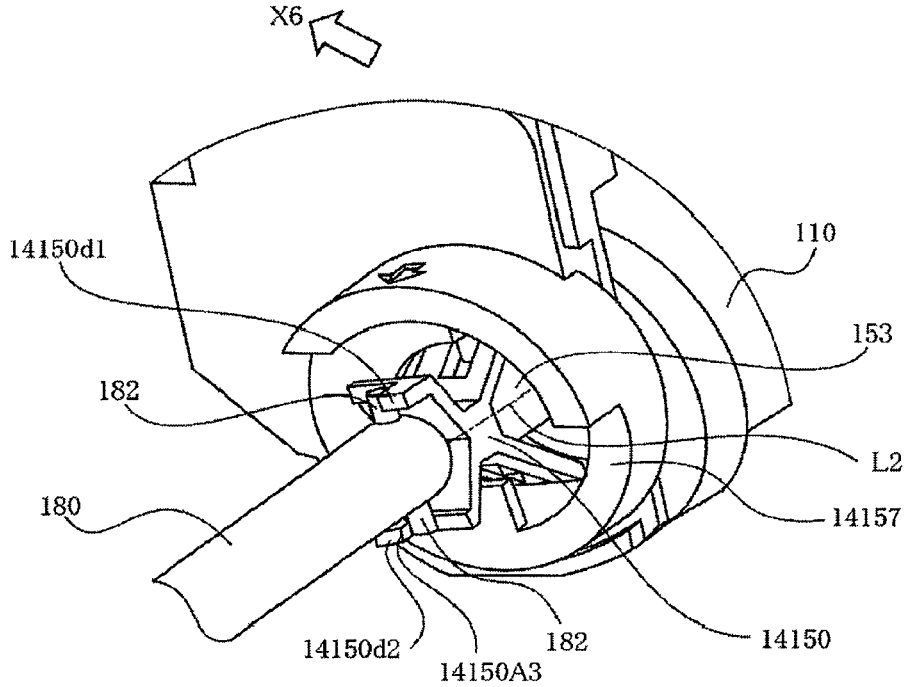
FIG. 35 is a perspective view illustrating the cartridge in the state that the drive of the cartridge according to the second embodiment of the present invention stops.
Figure 35:
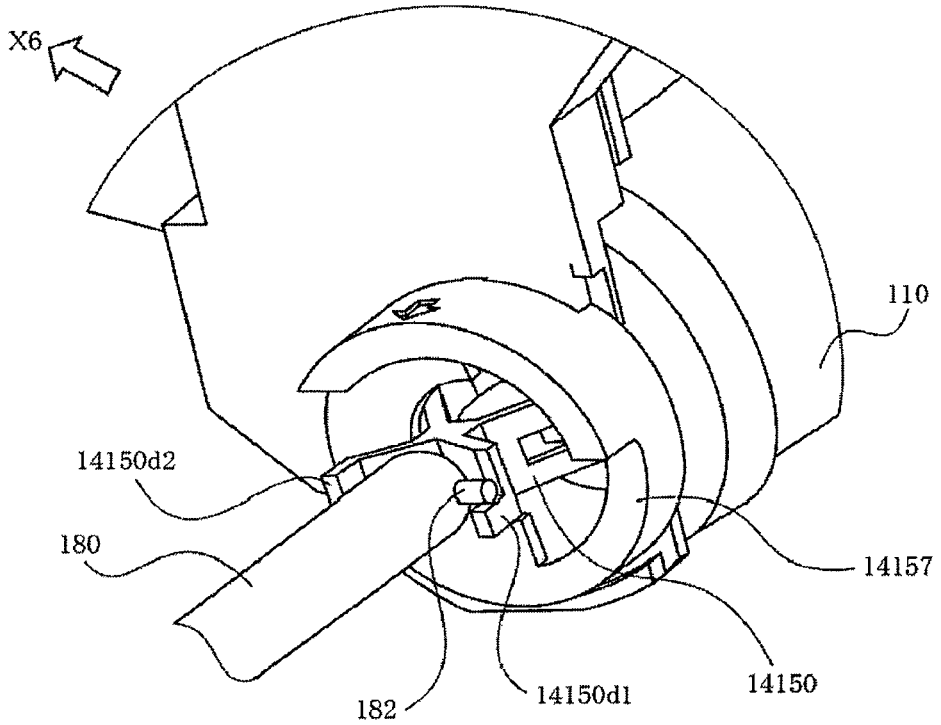
Figure 36:
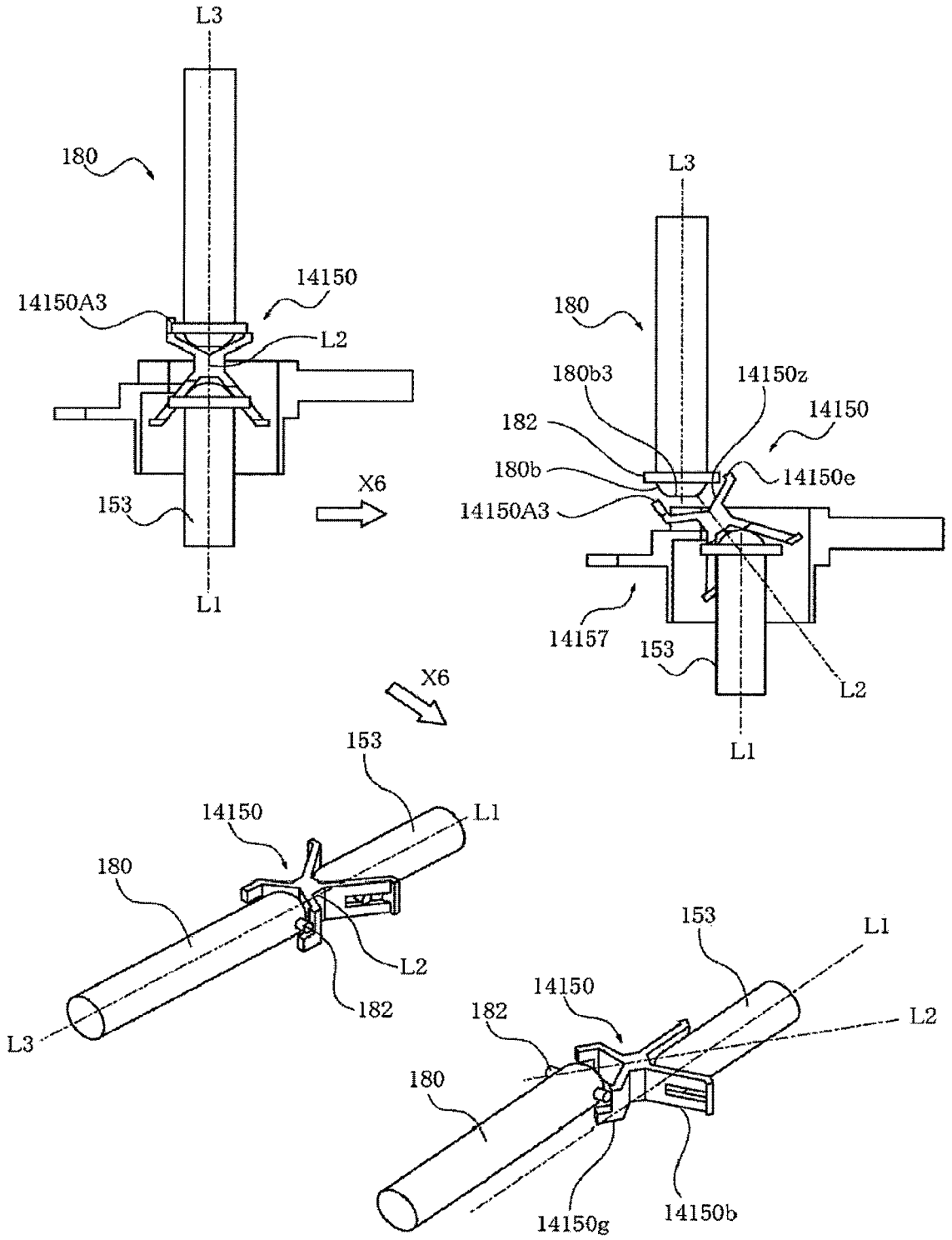
FIG. 36 is a longitudinal sectional view and a perspective view illustrating the operation of taking out the process cartridge according to the second embodiment of the present invention.

FIG. 32 is a perspective view and a top plan view of the coupling. FIG. 33 is a perspective view showing a mounting operation of the cartridge. FIG. 34 is a top plan view, as seen in the mounting direction in the state at the time of the cartridge mounting. FIG. 35 is a perspective view illustrating the state that the drive of the cartridge (developing roller) stops. FIG. 36 is a longitudinal sectional view and a perspective view illustrating the operation for taking out the cartridge.

In this embodiment, the cartridge detachably mountable to the main assembly A provided with the control means for controlling the phase of the stop position of the pin 182 (unshown) will be described.

Referring to FIG. 32, the coupling used for the present embodiment will be described.

The coupling 14150 comprises three main parts. As shown in FIG. 32(*c*), they are a driven portion 14150*a* for receiving the rotational force from the drive shaft 180, a driving portion 14150*b* for transmitting the rotational force to the development shaft 153, and an intermediate portion 14150*c* for connecting the driven portion 14150*a* and the driving portion 14150*b*.

The driven portion 14150*a* has a drive shaft inserting portion 14150*m* which comprises two surfaces which expand from the axis L2. The driving portion 14150*b* has a development shaft insertion part 14150*v* which comprises two surfaces which expand from the axis L2.

The inserting portion 14150*m* has a tapered shape driving shaft receiving surfaces 14150*f*1, 14150*f*2. The respective end surface is provided with projections 14150*d*1, 14150*d*2. The projections 14150*d*1, 14150*d*2 are disposed on the circumference having, as the center thereof, the axis L2 of the coupling 14150. As shown in the Figure, the receiving surfaces 14150*f*1 or 14150*f*2 constitute the recesses 14150*z*. As shown in FIG. 32(*d*), the downstream side of the projections 14150*d*1, 14150*d*2 with respect to the clockwise direction is provided with a rotational force reception surface (rotational force receiving portion) 14150*e* (14150*e*1, 14150*e*2). The pin (rotational force applying portion) 182 contacts to this receiving surface 14150*e*1, 14150*e*2. By this, the rotational force is transmitted to the coupling 14150. An interval W between the adjacent projections 14150*d*1-d2 is larger than an outer diameter of the pin 182 so that the pin 182 can be received. This interval functions as a standing-by portion 14150*k*.

An inserting portion 14150*v* is constituted by the two surfaces 14150*i*1, 14150*i*2. Stand-by openings 14150*g*1 or 14150*g*2 are provided in the surface 14150*i*1, 14150 i2 thereof (FIG. 32(*a*) and FIG. 32(*e*)). In FIG. 32(*e*), the clockwisely upstream side of the opening 14150*g*1, 14150*g*2 is provided with a rotational force transmitting surface (rotational force transmitting portion) 14150*h* (14150*h*1, 14150*h*2) (FIG. 32(*b*), (*e*)). As has been described hereinbefore, the pins (rotational force transmitted portions) 155*a* contact to the rotational force transmitting surfaces 14150*h*1, 14150*h*2. By this, the rotational force is transmitted to the developing roller 110 from the coupling 14150.

With such a configuration of the coupling 14150, in the state that the cartridge is mounted to the main assembly the coupling covers the free end of the drive shaft. By this, the effects as will be described hereinafter are provided.

The coupling 14150 has the structure similar to the structure of the first modified example, and is inclinable (movable) in all directions relative to the development shaft 153.

Referring to FIG. 33 and FIG. 34, the mounting operation of the coupling will be described. FIG. 33(*a*) is a perspective view illustrating the state before the mounting of the coupling. FIG. 33(*b*) is a perspective view illustrating the state that the coupling is in engagement. FIG. 34(*a*) is a top plan view as seen in the mounting direction. FIG. 34(*b*) is a top plan view.

The axis L3 of the pins (rotational force applying portion) 182 is parallel to the mounting direction X4 by the control means described above. As for the cartridge, the phase is aligned (FIG. 33(*a*)) so that the receiving surfaces 14150*f*1, 14150*f*2 oppose to each other in the direction perpendicular to the mounting direction X4. As shown in the Figure, for example, as a structure for aligning the phase, one of the receiving surfaces 14150*f*1, 14150*f*2 is aligned with a register mark 14157*z* provided on a bearing member 14157. This is carried out when the cartridge is shipped from the plant. However, the user may carry out this, before mounting the cartridge B to the main assembly. In addition, another phase aligning means may be used. By doing so, the coupling 14150 and the drive shaft 180 (pin 182) do not interfere with each other, as shown in FIG. 34(*a*). For this reason, the coupling 14150 and the drive shaft 180 are in the engageable positional relation (FIG. 33(*b*)). The drive shaft 180 rotates in the direction X8, the pin 182 contacts to the receiving surfaces 14150*e*1, 14150*e*2. By this, the rotational force is transmitted to the developing roller 110.

Referring to FIG. 35 and FIG. 36, the description will be made as to the operation of disengaging the coupling 14150 from the drive shaft 180 in interrelation with the operation of taking out the cartridge B from the main assembly A. The control means (unshown) stops the pin 182 at the predetermined phase relative to the drive shaft 180. From the standpoint of easiness of the mounting of the cartridge B, it is desirable to stop the pin 182 in the position parallel to the cartridge take-out direction X6 (FIG. 35(*b*)). The operation at the time of taking out the cartridge B is shown in FIG. 36. In this state (FIG. 36(*a*1) and (*b*1)), the axis L2 of the coupling 14150 is substantially co-axial relative to the axis L1 in the rotational force transmitting angular position. Similarly to the case of mounting the cartridge B, at this time, the coupling 14150 is inclinable (movable) in the all directions relative to the development shaft 153 (FIG. 36(*a*1) and FIG. 36(*b*1)). For this reason, the axis L2 inclines, in the opposite direction to the take-out direction, relative to the axis L1 in interrelation with the take-out operation of the cartridge B. More particularly, the cartridge B is dismounted in the direction substantially perpendicular to the axis L3 (the direction of the arrow X6). In the take-out process of the cartridge, the axis L2 inclines to the position that the free end 14150 A3 of the coupling 14150 is along at the free end 180*b* of the drive shaft 180 (disengaging angular position). Or, it inclines until it is positioned in the side of the axis L2 to the development shaft 153 with respect to the free end portion 180*b*3 (FIG. 36(*a*2) and FIG. 36(*b*2)). In this state, the coupling 14150 is passed adjacent to the free end portion 180*b*3. By doing so, the coupling 14150 is dismounted from the drive shaft 180.

In the state that the cartridge B is mounted to the main assembly A, a part of coupling 14150 (free end 14150 A3) is behind the drive shaft 180 (FIG. 36(*a*1)), as seen in the opposite direction to the removing direction X6 of dismounting the cartridge B from the main assembly A. And, in dismounting the cartridge B from the main assembly A, in response to moving the cartridge B in the direction substantially perpendicular to the axis L1 of the developing roller 110, the coupling 14150 makes the following motion. More particularly, the coupling 150 is moved to the disengaging angular position from the rotational force transmitting angular position so that said portion (free end 14150 A3) of the coupling 150 circumvents the drive shaft 180.

As shown in FIG. 35(*a*), the axis of the pin 182 may stop with the direction perpendicular to the cartridge take-out direction X6. In other words, the pin 182 is normally stopped at the position shown in FIG. 35(*b*) by the control operation of the control means (unshown). However, when the voltage source of the device (the printer) is OFF, and the control means (unshown) does not work, the pin 182 may be stopped at the position shown in FIG. 35(*a*). However, even in such a case, the axis L2 inclines relative to the axis L1 to permit the dismounting. In the rest state of the device, the pin 182 is downstream of the projection 14150*d*2 in the take-out direction X6. For this reason, by the inclination of the axis L2, the free end 14150 A3 of the projection 14150*d*1 of the coupling passes by the side nearer, than the pin 182, to the development shaft 153. By this, the coupling 14150 can be dismounted from the drive shaft 180.

In the case that the coupling 14150 is engaged with the drive shaft 180 by a certain method in the mounting of the cartridge B, and there is no means for controlling the phase of the drive shaft, the cartridge can be removed by the inclination of the axis L2 relative to the axis L1. By this, the coupling 14150 can be dismounted from the drive shaft 180 only by take-out operation of the cartridge.

As has been described hereinbefore, Embodiment 2 is effective, even when only the case where the cartridge B is dismounted from the main assembly A is considered.

As has been described hereinbefore, Embodiment 2 has the following structures.

The cartridge B is dismounted by being moved in the direction substantially perpendicular to the direction of the axis L3 of the drive shaft 180 from the main assembly A provided with the drive shaft 180 which has the pin (the rotational force applying portion) 182. The cartridge B has the developing roller 110 and the coupling 14150.

I>> The developing roller 110 is rotatable about the axis L1 thereof, and develops the electrostatic latent image formed on the photosensitive drum 7. Ii>> The coupling 14150 engages with the pin 182 to receive the rotational force for rotating the developing roller 110. The coupling 14150 can take the rotational force transmitting angular position for transmitting the rotational force for rotating the developing roller 110 to the developing roller 110 and the disengaging angular position for disengaging the coupling 14150 from the drive shaft 180 in which it inclined from the rotational force transmitting angular position.

In dismounting the cartridge B in the direction substantially perpendicular to the axis L1 of the developing roller 110 from the main assembly A the coupling 14150 is moved to the disengaging angular position from the rotational force transmitting angular position.

(Embodiment 3)

Embodiment 3 to which the present invention is applied will be described with reference to FIGS. 37 to 41. A structure of the coupling is as described in Embodiment 2.

Figure 37:
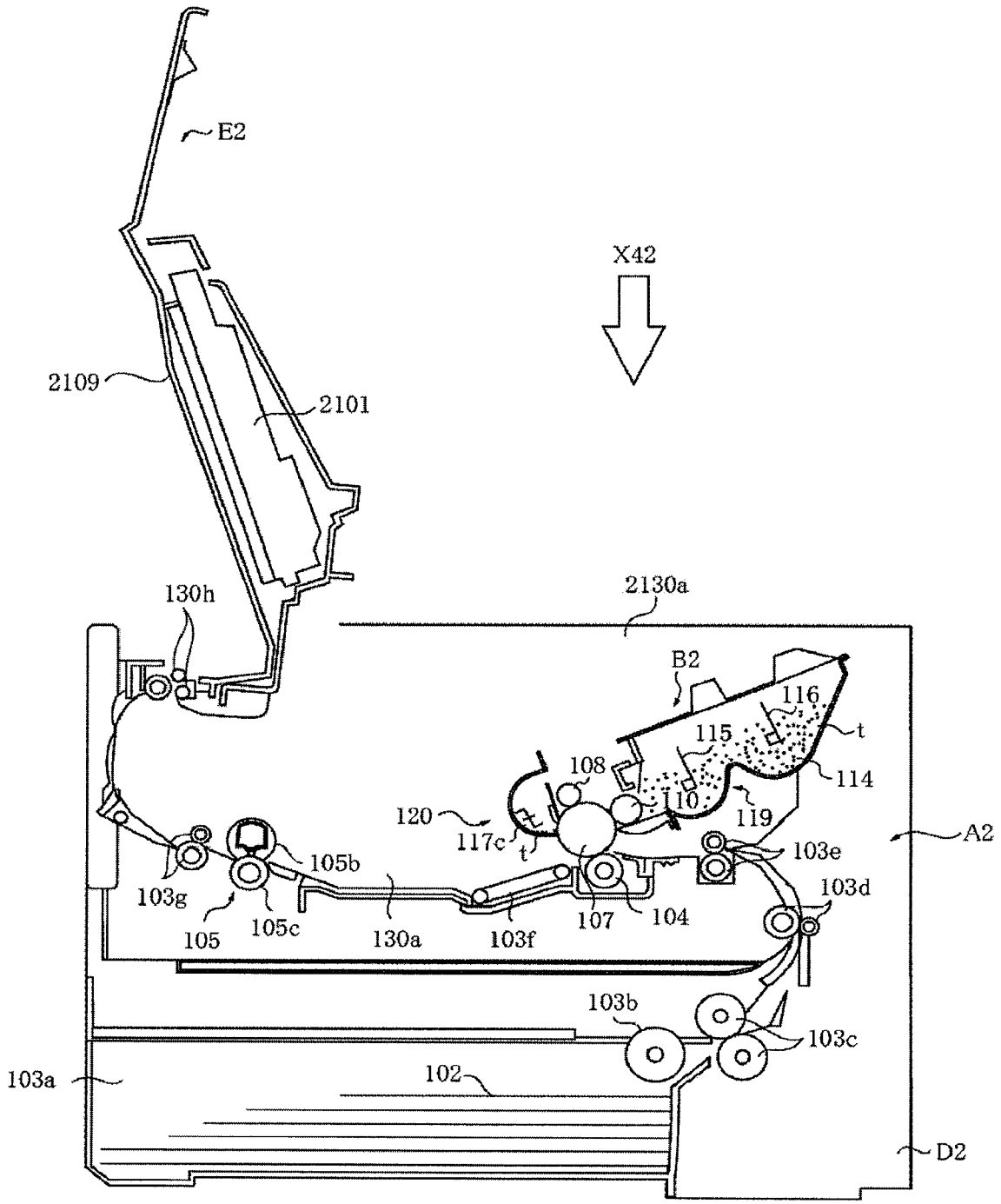
FIG. 37 is a sectional view illustrating the state of opening the door provided in the main assembly according to an embodiment of the present invention.
Figure 38:
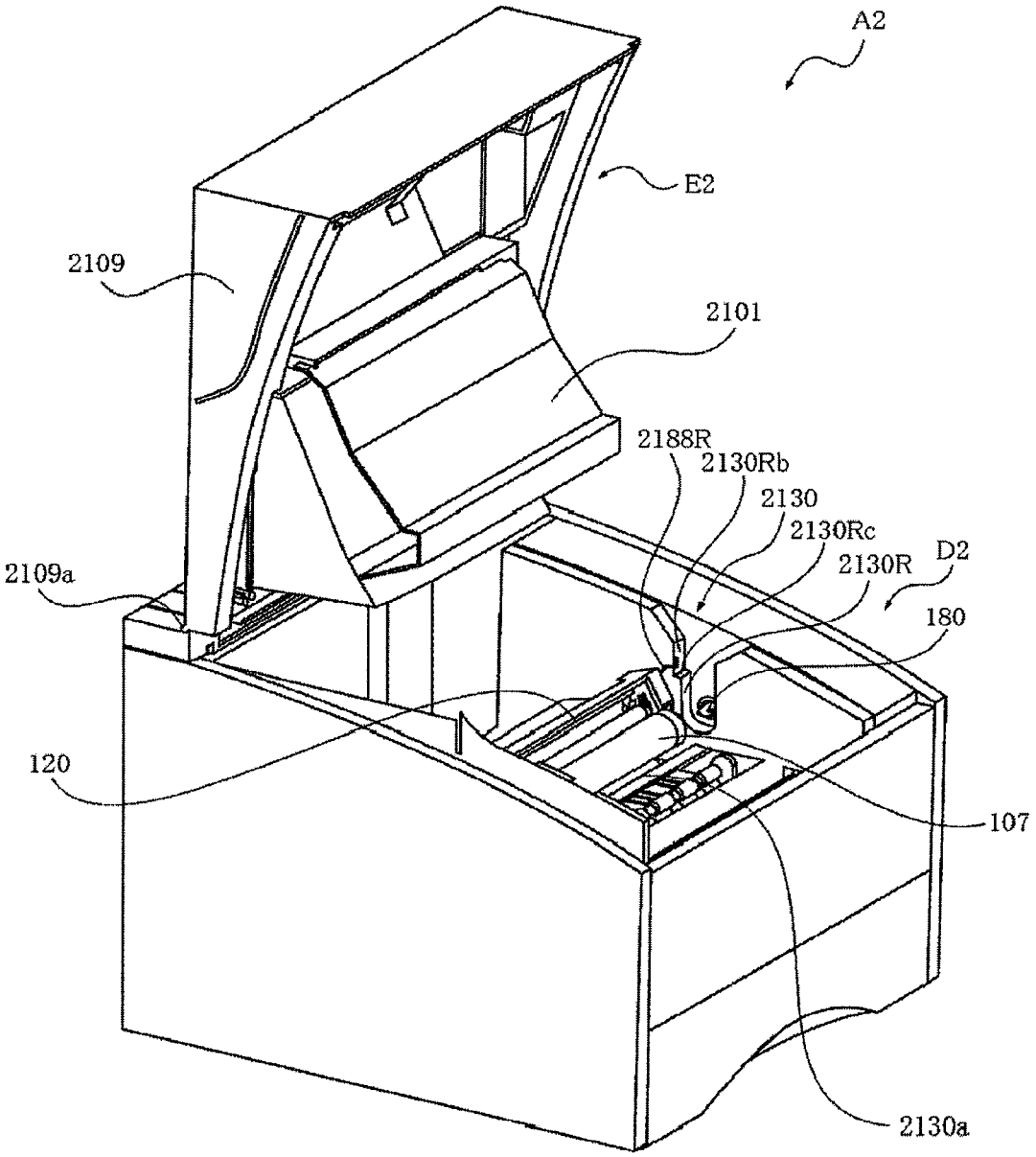
FIG. 38 is a perspective view illustrating a mounting guide of the driving side of the main assembly according to an embodiment of the present invention.
Figure 39:
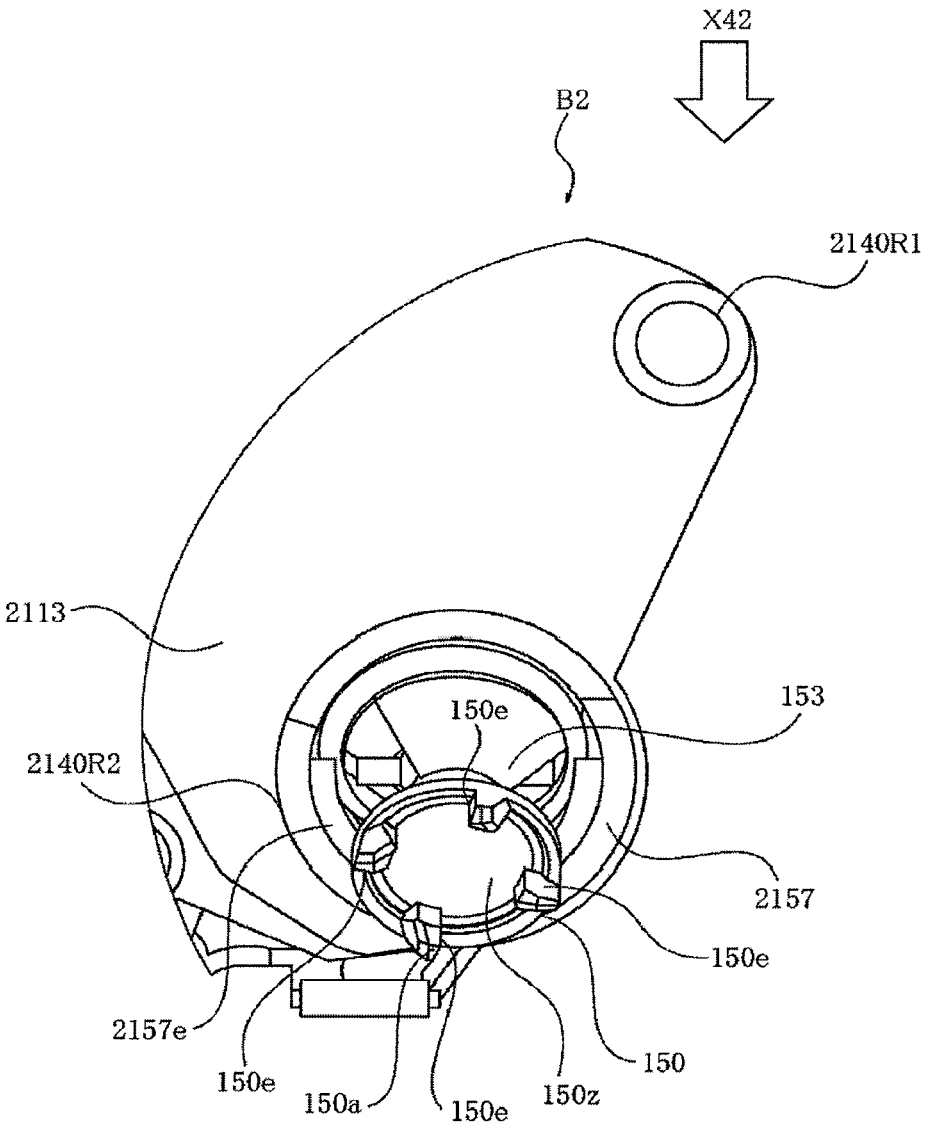
FIG. 39 is a side view of the driving side of the cartridge according to an embodiment of the present invention.
Figure 40:
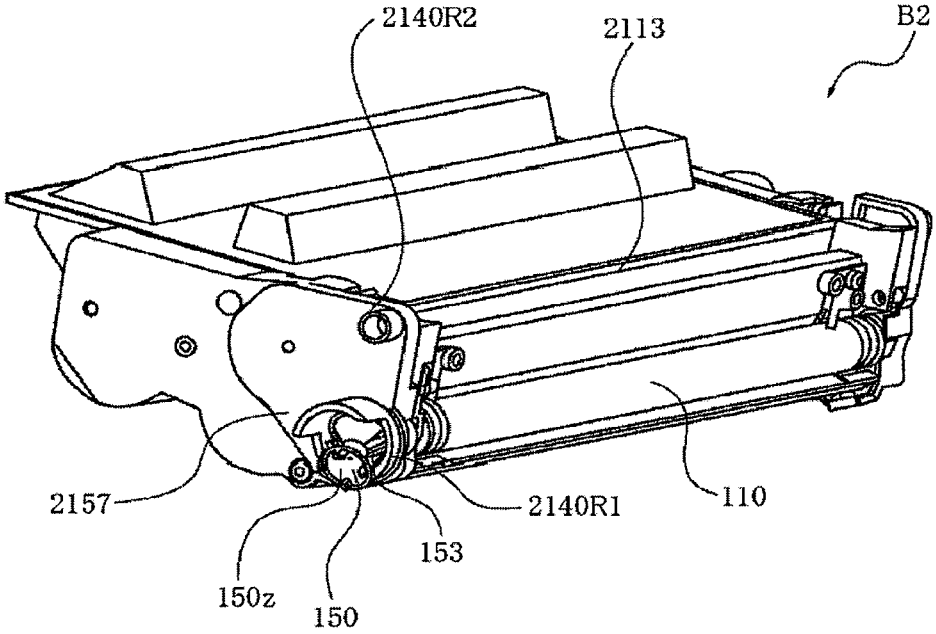
FIG. 40 is a perspective view of the cartridge as seen from the driving side according to an embodiment of the present invention.
Figure 41:
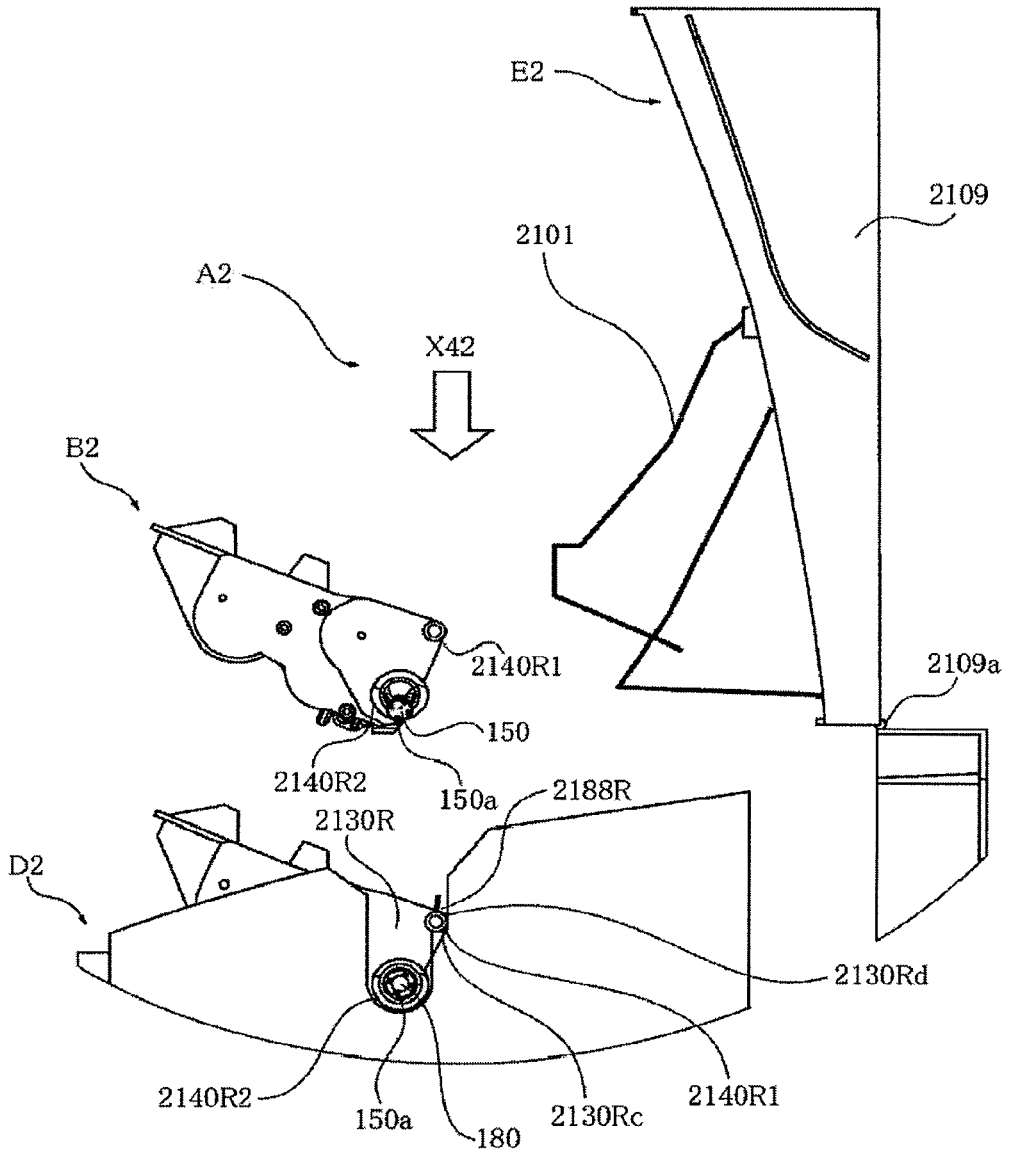
FIG. 41 is a side view illustrating the state of inserting the cartridge into the main assembly according to an embodiment of the present invention.

FIG. 37 is a sectional view showing a state in which a door of the apparatus main assembly A2 is opened. FIG. 38 is perspective view showing a mounting guide in the state in which the door of the apparatus main assembly 42 is opened. FIG. 39 is an enlarged view of a driving-side surface of the cartridge. FIG. 40 is a perspective view as seen from the driving side of the cartridge. FIG. 41 is a schematic view for illustrating two states including a state immediately before the cartridge is inserted into the apparatus main assembly and a state after the cartridge is mounted at a predetermined position in a single drawing for simplicity.

In this embodiment, the case of mounting the cartridge toward a vertically lower portion, e.g., as a clamshell type image forming apparatus will be described. A representative clamshell type image forming apparatus is shown in FIG. 37. The apparatus main assembly A2 is capable of being divided into a lower casing D2 and an upper casing E2. The upper casing E2 is provided with a door 2109 and an exposure device 2101 inside the door 2109. For that reason, when the upper casing E2 is upwardly opened, the exposure device 2101 is retracted. Then, an upper portion of a cartridge mounting portion 2130*a* is opened. Therefore, the user may only be required to drop the cartridge B2 in a vertically downward direction (a direction X42 in the figure) when the user mounts the cartridge B2 in the mounting portion 2130*a*. Thus, the cartridge is more liable to be mountable. Further, jam clearance in the neighborhood of the fixing device 105 can be performed from above the apparatus. Therefore, the jam clearance is readily performed.

Here, the jam clearance refers to an operation for removing the recording material (medium) 102 jammed or stuck during conveyance.

Next, the mounting portion 2130*a* will be described. As shown in FIG. 38, the image forming apparatus (apparatus main assembly) A2 includes, as a mounting means 2130, a driving side mounting guide 2130R and a non-driving side mounting guide (not shown) opposite to the driving side mounting guide 2130R. The mounting portion 2130*a* is a space enclosed by the opposing guides. In a state in which the cartridge B2 is mounted in the mounting portion 2130*a*, a rotational force is transmitted from the apparatus main assembly A2 to the coupling 150.

To the mounting guide 2130R, a groove 2130*b* is provided with respect to a substantially vertical direction. Further, at a lowermost portion of the mounting guide 2130R, an abutting portion 2130Ra for positioning the cartridge B2 at a predetermined position is provided. Further, a driving shaft 180 is projected from the groove 2130*b* in order to transmit the rotational force from the apparatus main assembly A2 to the coupling 150 in the state in which the cartridge 32 is positioned at the predetermined position. Further, in order to position the cartridge B2 at the predetermined position with reliability, an urging spring 2188R is provided at a lower portion of the mounting guide 2130R. By the above-described structure, the cartridge B2 is positioned at the mounting portion 2130*a*.

As shown in FIGS. 39 and 40, to the cartridge B2, cartridge side mounting guides 2140R1 and 2140R2 are provided. By these guides, an attitude of the cartridge B2 is stabilized during the mounting. The mounting guide 2140R1 is formed integrally with a developing device supporting member 2157. Further, the mounting guide 2140R2 is provided vertically above the mounting guide 2140R1. The mounting guide 2140 R2 is provided in a rib shape to the supporting member 2157.

Incidentally, the guides 2140R1 and 2140R2 of the cartridge B2 and the mounting guide 2130R provided to the apparatus main assembly A2 provide the above-described guide structure. That is, the guide structure in this embodiment is the same as the guide structure described with reference to FIGS. 2 and 3. Further, this is true for the guide structure on the other end. Thus, the cartridge B2 is moved in a direction substantially perpendicular to a direction of an axis L3 of the driving shaft 180 and is mounted to the apparatus main assembly A2 (the mounting portion 2130*a*). Further, the cartridge B2 is demounted from the apparatus main assembly A2 (the mounting portion 2130*a*).

As shown in FIG. 41, when the cartridge B is mounted, the casing E2 is rotationally driven clockwise about a shaft 2109*a*. Then, the user moves the cartridge B2 toward above the casing D2. At this time, the coupling 150 is inclined downwardly by its own weight (see also FIG. 39). That is, an axis L2 of the coupling 150 is inclined with respect to the axis L1 so that a driven portion 150*a* of the coupling 150 is directed downwardly (an angular position before engagement).

In this state, the user downwardly moves the cartridge B2 by fitting the mounting guides 2140R1 and 2140R2 of the cartridge B2 to the mounting guide 2130R of the apparatus main assembly A2. It is possible to mount the cartridge B2 to the apparatus main assembly A2 (the mounting portion 2130*a*) only by this operation. In this mounting process, similarly as in Embodiment 1 (FIG. 19), the coupling 150 is engageable with the driving shaft 180. In this state, the coupling 150 takes a rotational force transmitting angular position. That is, by moving the cartridge B2 in the direction substantially perpendicular to the direction of the axis L3 of the driving shaft 180, the coupling 150 engages with the driving shaft 180. Further, also when the cartridge B2 is demounted, similarly as in Embodiment 1, only by a demounting operation of the cartridge, the coupling 150 is disengageable from the driving shaft 180. That is, the coupling 150 is moved from the rotational force transmitting angular position to a disengagement angular position (FIG. 22). Thus, the coupling 150 is disengaged from the driving shaft 180 by moving the cartridge B2 in the direction substantially perpendicular to the direction of the axis L3 of the driving shaft 180.

As described above, in the case where the cartridge is downwardly mounted to the apparatus main assembly A2, the coupling 150 is downwardly inclined by its own weight. For that reason, the coupling 150 is engageable with the driving shaft 180.

In this embodiment, the clamshell type image forming apparatus is described. However, the present invention is not limited thereto. For example, this embodiment is applicable when a mounting path of the cartridge is directed downwardly. The mounting path may also be downwardly non-linear. For example, the cartridge mounting path may be obliquely downward at an initial stage and be directed downwardly at a final stage. In short, the mounting path may be only required to be directed downwardly immediately before the cartridge reaches the predetermined position (the mounting portion 2130*a*).

(Embodiment 4)

Embodiment 4 to which the present invention is applied will be described with reference to FIGS. 42 to 45. The structure of the coupling is as described in Embodiment 2. In this embodiment, a means for keeping the axis L2 in an inclined state with respect to the axis L1 will be described.

Figure 42:
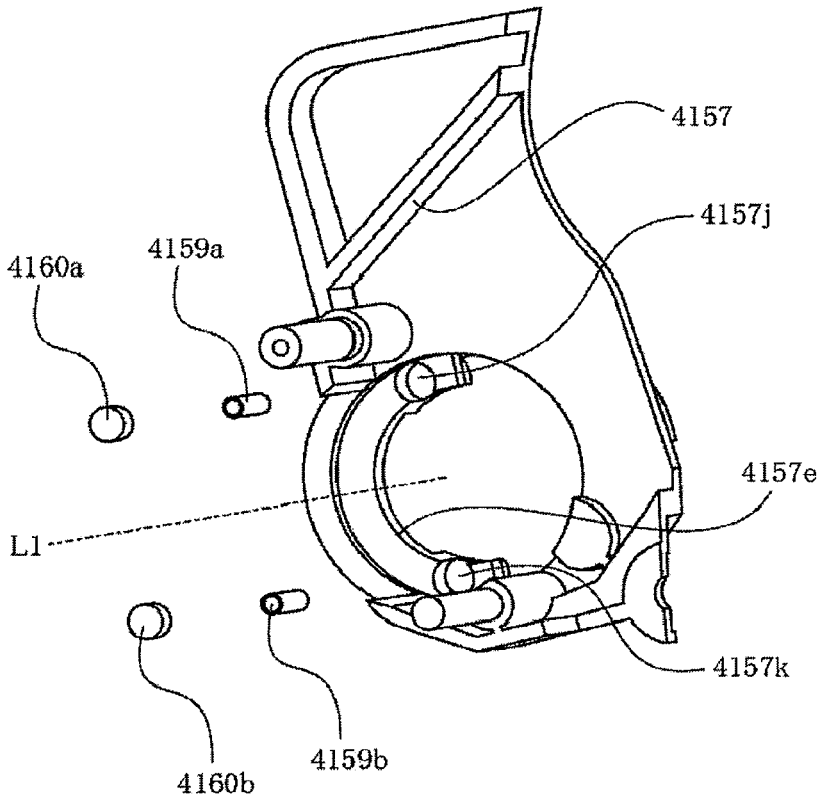
FIG. 42 is an exploded perspective view illustrating the state of mounting the pressing member (peculiar to the present embodiment) to the development supporting member according to an embodiment of the present invention.
Figure 43:
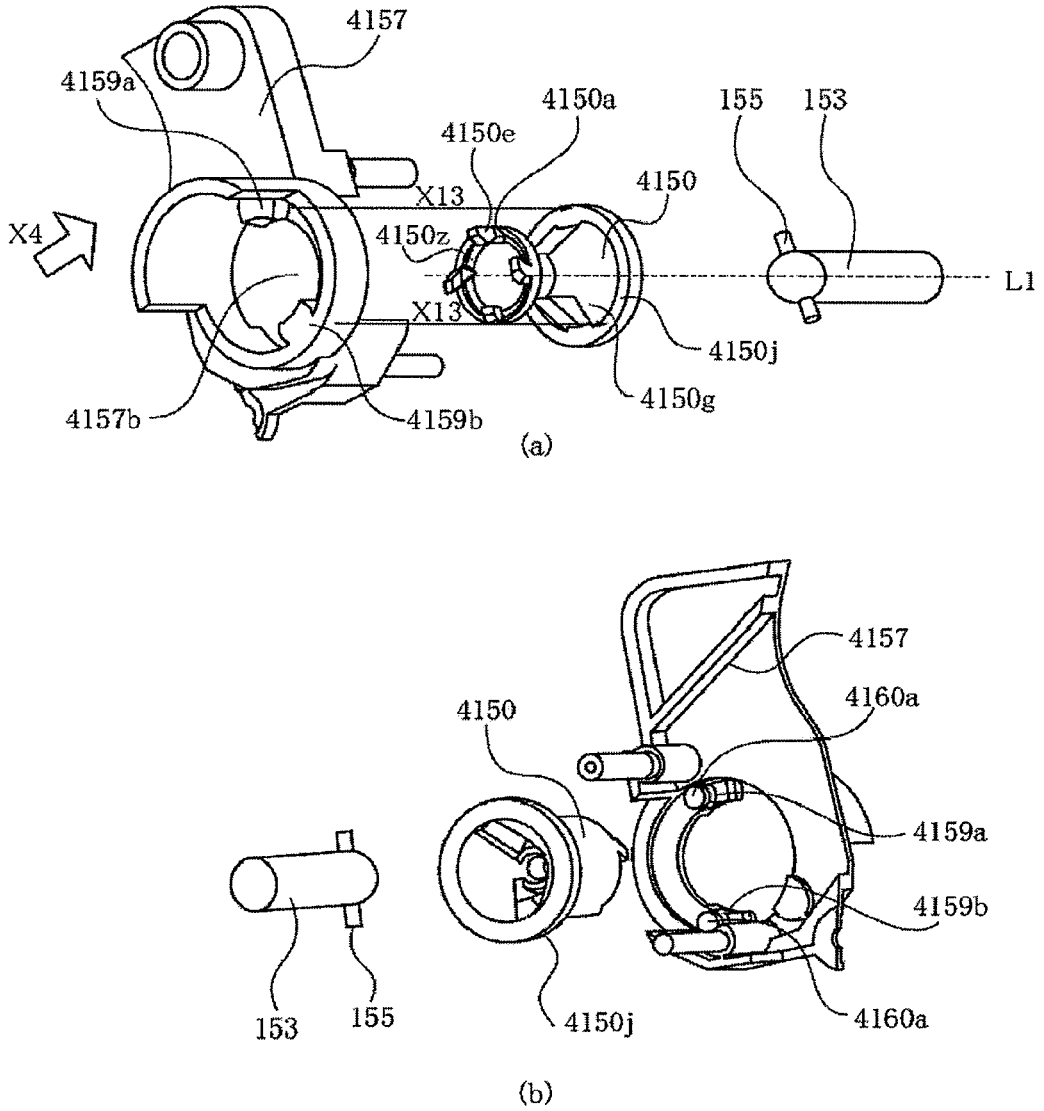
FIG. 43 is an exploded perspective view illustrating a development supporting member, a coupling, and a development shaft according to an embodiment of the present invention.
Figure 44:
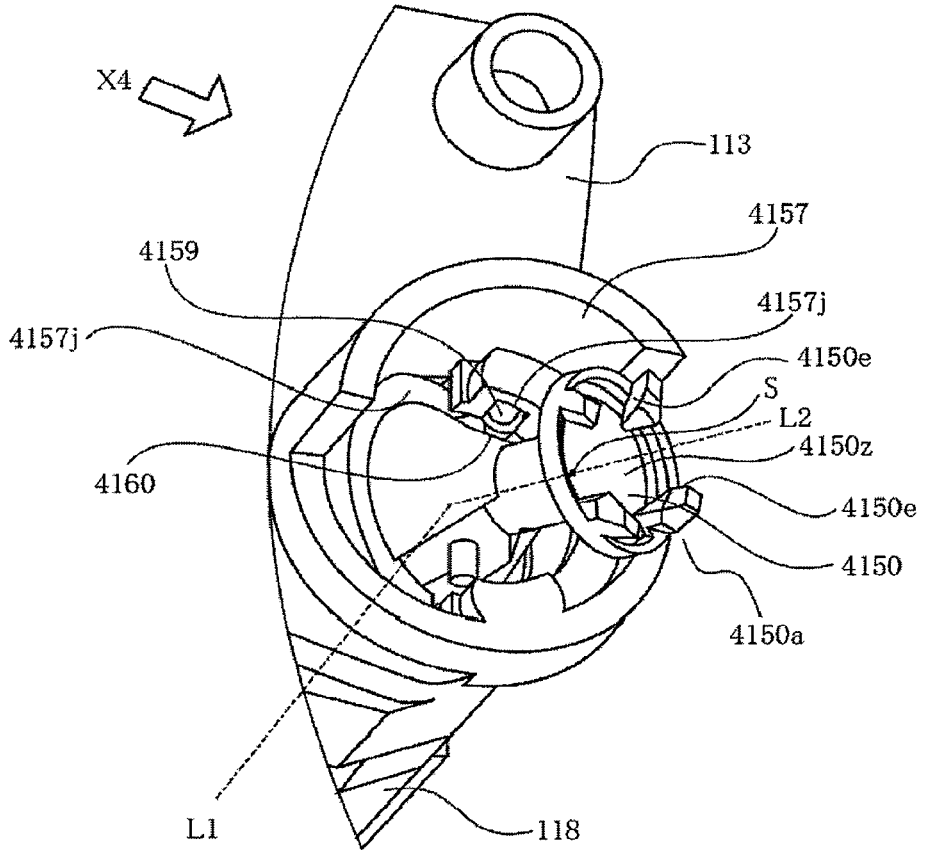
FIG. 44 is a perspective view illustrating the driving side of the cartridge according to an embodiment of the present invention.
Figure 45:
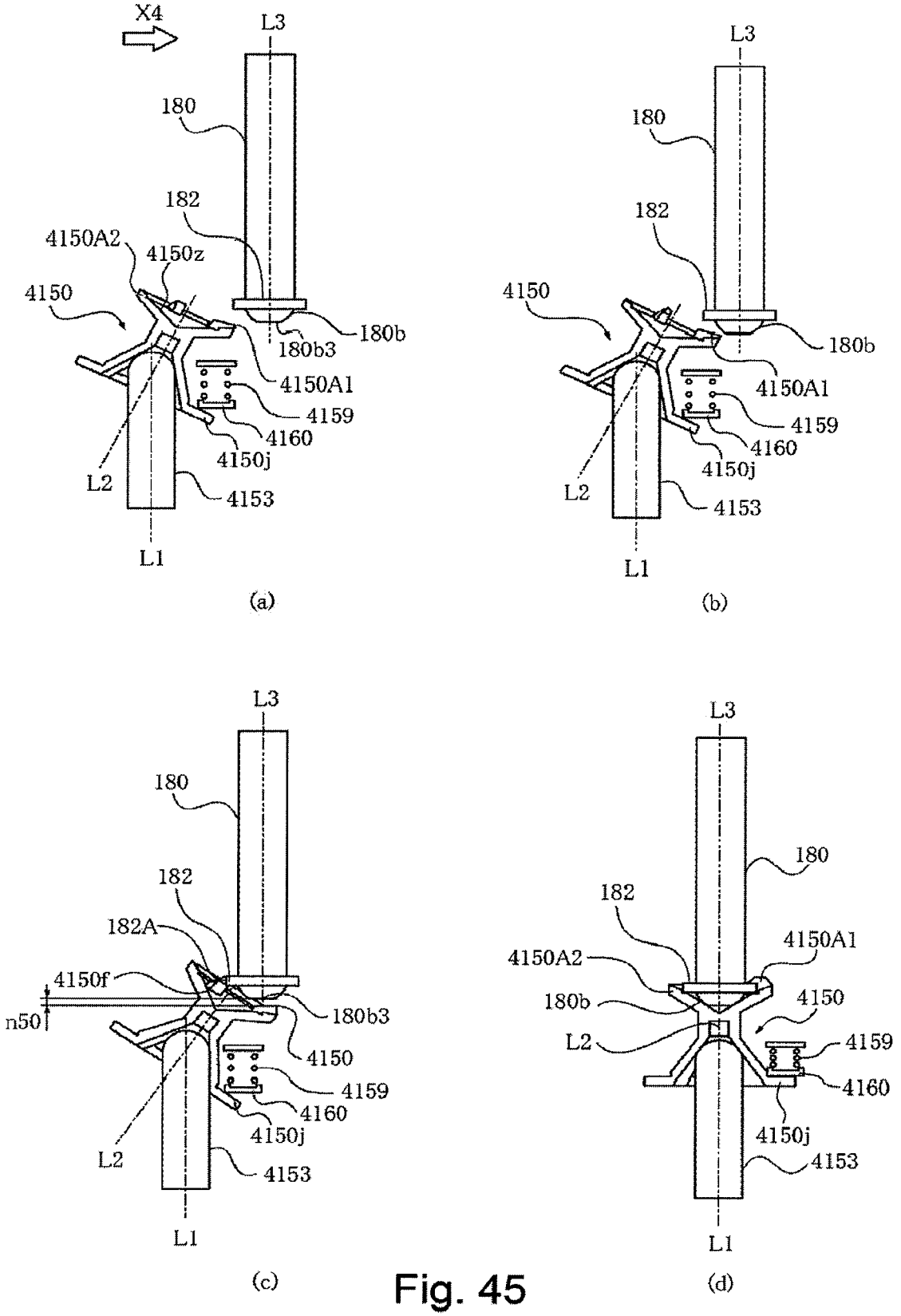
FIG. 45 is a longitudinal sectional view illustrating the engaged state between the drive shaft and the coupling according to an embodiment of the present invention.

FIG. 42 is an exploded perspective view showing a state in which a coupling urging member (peculiar to this embodiment) is mounted to the developing device supporting member. FIGS. 43(*a*) and 32(*b*) are exploded perspective views showing the developing device supporting member, the coupling, and a developing shaft. FIG. 44 is an enlarged perspective view showing a driving side principal portion of the cartridge. FIGS. 45(*a*) to 45(*d*) are longitudinal sectional views showing the process in which the driving shaft engages with the coupling.

As shown in FIG. 42, the developing device supporting member 4157 is provided with a holding hole 4157*j* in a rib 4157*e*. In the holding hole 4157*j*, coupling urging members 4159*a* and 4159*b* as a keeping member for keeping the inclination of a coupling 4150 are mounted. The urging members 4159*a* and 4159*b* urge the coupling 4150 so that the coupling 4150 is inclined toward a downstream side with respect to the mounting direction of the cartridge B2. The urging members 4159*a* and 4159*b* are compression springs (elastic members). As shown in FIGS. 43(*a*) and 43(*b*), the urging members 4159*a* and 4159*b* urge a flange portion 4150*j* of the coupling 4150 in the direction of the axis L1 (in a direction indicated by an arrow X13 in FIG. 43(*a*)). A contact position of the urging members with the flange portion 4150*j* is set on a downstream side of a center of the developing shaft 153 with respect to a mounting direction X4. For that reason, the axis L2 is inclined with respect to the axis L1 by an elastic force of the urging members 4159*a* and 4159*b* so that the driven portion 4150*a* side is directed to the downstream side with respect to the cartridge mounting direction X4 (FIG. 44).

Further, as shown in FIG. 42, at coupling-side ends of the urging members 4159*a* and 4159*b*, contact members 4160*a* and 4160*b* are provided. The contact members 4160*a* and 4160*b* contact the flange portion 4150*j*. Therefore, a material for the contact members 4160*a* and 4160*b* is selected from those having good slidability. By using such a material, as described later, the influence of the urging force (elastic force) of the urging members 4159*a* and 4159*b* on the rotation of the coupling 4150 during the rotational force transmission. However, the contact members 4160*a* and 4160*b* may also be omitted when a load on the rotation is sufficiently small and the coupling 4150 is satisfactorily rotated.

In this embodiment, two urging members are used. However, the number of the urging members may be changed when the axis L2 can be inclined with respect to the axis L2 downwardly in the cartridge mounting direction X4. For example, in the case of a single urging member, it is urging position may desirably be a lowermost-stream position of the cartridge mounting position. As a result, the coupling 4150 can be stably inclined toward the downstream direction in its mounting direction X4.

As the urging member, in this embodiment, the compression coil spring is used. However, as the urging member, any material such as a leaf spring, a torsion spring, a rubber or a sponge may appropriately be selected when the material generates the elastic force. However, the urging member needs a stroke to some extent in order to incline the axis L2. For that purpose, it is desirable that the material for the urging member is the coil spring or the like capable of giving the stroke.

Next, with reference to FIGS. 43(*a*) and 43(*b*), a mounting method of the coupling 4150 will be described.

As shown in FIGS. 43(*a*) and 43(*b*), a pin 155 is inserted into a stand-by space 4150*g* of the coupling 4150. Then, a part of the coupling 4150 is inserted into a space 4157*b* of the developing device supporting member 4157. At this time, as described above, the urging members 4157*a* and 4159*b* press the predetermined portion of the flange portion 4157*j* through the contact members 4160*a* and 4160*b*. Further, the supporting member 4157 is fixed to a developing device frame 118 with a screw or the like. As a result, the urging members 4159*a* and 4159*b* can obtain a force of urging the coupling 4150. Thus, the axis L2 is inclined with respect to the axis L1 (state of FIG. 44).

Next, with reference to FIG. 45, an operation for engaging the coupling 4150 with the driving shaft 180 (as a part of the cartridge mounting operation) will be described. FIGS. 45(*a*) and 45(*c*) show a state immediately before the engagement, and FIG. 45(*d*) shows an engaged state. In the state shown in FIG. 45(*a*), the axis L2 of the coupling 4150 is inclined in advance with respect to the axis L1 in the mounting direction X4 (the angular position before the engagement). By the inclination of the coupling 4150, in the axis L1 direction, a downstream side end position 4150A1 with respect to the mounting direction X4 is located at a position closer to the developing roller 110 than an end 180*b*3. Further, an upstream side end position 4150A2 with respect to the mounting direction X4 is located at a position closer to the pin 182 than the end 180*b*3. That is, as described above, the flange portion 4150*j* of the coupling 4150 is urged by the urging member 4159. For that reason, the axis L2 is inclined with respect to the axis L1 by the urging force.

Therefore, by moving the cartridge B in the mounting direction X4, an end surface 180*b* or an end (a main assembly-side engaging portion) of the pin (rotational force imparting portion) 182 contacts a driving shaft receiving surface 4150*f* of the coupling 4150 or a projection (cartridge-side contact portion) 4150*d*. A contact state of the pin 182 with the receiving surface 4150*f* is shown in FIG. 45(*c*). Then, by the contact force (a mounting force of the cartridge), the axis L2 approaches a direction parallel to the axis L1. At the same time, the urging portion 4150*j*1 urged by the elastic force of the spring 4159 provided to the flange portion 4150*j* is moved in the direction in which the spring 4159 is compressed. Then, finally, the axis L1 and the axis L2 are substantially in line with each other. Then, the cartridge 4150 is placed in a stand-by state for performing the transmission of the rotational force (rotational force transmission angular position) (FIG. 45(*d*)).

Thereafter, similarly as in Embodiment 1, the rotational force is transmitted from the motor 186 to the developing roller 110 through the driving shaft 180, the coupling 4150, the pin 155, and the developing shaft 4153. During the rotation, on the coupling 4150, the urging force of the urging member 4159 is exerted. However, as described above, the urging force of the urging member 4159 is exerted on the coupling 4150 through the contact member 4160. For that reason, the coupling 4150 can be rotated under not much load. Further, when there is a margin of a driving torque of the motor 186, the contact member 4160 may be omitted. In this case, the coupling 4150 can transmit the rotational force with accuracy even when the contact member is not provided.

Further, in the process of demounting the cartridge B from the apparatus main assembly A, steps which are the reverse of the mounting steps are pursued (FIG. 45(*d*)-FIG. 45(*c*)-FIG. 45(*b*)-FIG. 45(*a*)). That is, the cartridge 4150 is urged always toward the downstream side with respect to the mounting direction X4 by the urging member 4159. For that reason, in the process of demounting the cartridge B, on the upstream side with respect to the mounting direction X4, the receiving surface 4150*f* contacts the end portion 182A of the pin 182 (a state between those shown in FIGS. 45(*d*) and 45(*d*)). Further, on the downstream side with respect to the mounting direction X4, a gap n50 is always created between the transmitting (receiving) surface 4150*f* and the end 180*b* of the driving shaft 180. In the above-described Embodiments, in the cartridge demounting process, the receiving surface 4150*f* or projection 4150*d* which are located on the downstream side with respect to the cartridge mounting direction X4 is described as contacting at least the end 180*b* of the driving shaft 180 (e.g., FIG. 19). However, as in this embodiment, even when the downstream-side receiving surface 4150*f* or the projection 4150 does not contact the end 180*b* of the driving shaft 180, the coupling 4150 can be separated from the driving shaft 180 in accordance with the demounting operation of the cartridge B. Then, also after the coupling 4150 comes out of the driving shaft 180, by the urging force of the urging member 4159, the axis L2 is inclined downwardly with respect to the axis L1 in the mounting direction X4 (the demounting angular position). That is, in this embodiment, an angle at the angular position before the engagement with respect to the axis L1 and an angle at the demounting angular position are equal to each other. This is because the coupling 4150 is urged by the elastic force of the spring.

The urging member 4159 has the functions of inclining the axis L2 and regulating the inclination direction of the coupling 4150. That is, the urging member 4159 also functions as a regulating means for regulating the inclination direction of the coupling 4150.

As described above, in this embodiment, the coupling 4150 is urged by the urging force of the urging member 4159 provided to the supporting member 4157. As a result, with respect to the axis L1, the axis L2 is inclined. Accordingly, the inclined state of the coupling 4150 is retained. Therefore, the coupling 4150 is engageable with the driving shaft 180 with reliability.

Incidentally, in this embodiment, the urging member 4159 is provided to the rib 4157*e* of the supporting member 4157 but is not limited thereto. For example, the urging member 4159 may also be provided to another portion of the supporting member 4157 or provided to a member other than the supporting member so long as the member is fixed to the cartridge B.

Further, in this embodiment, the urging direction of the urging member 4159 is the direction of the axis L1. However, the urging direction may be any direction in which the axis L2 can be inclined (moved) toward the downstream side with respect to the mounting direction X4 of the cartridge B.

Further, in this embodiment, at the urging position of the urging member 4159, the flange portion 4150*j* is located. However, the urging position may also be any position of the coupling so long as the axis L2 is inclined toward the cartridge mounting direction downstream side.

(Embodiment 5)

Embodiment 5 to which the present invention is applied will be described with reference to FIGS. 46 to 50. The structure of the coupling is as described above.

In this embodiment, another means for inclining the axis L2 with respect to the axis L1 will be described.

Figure 46:
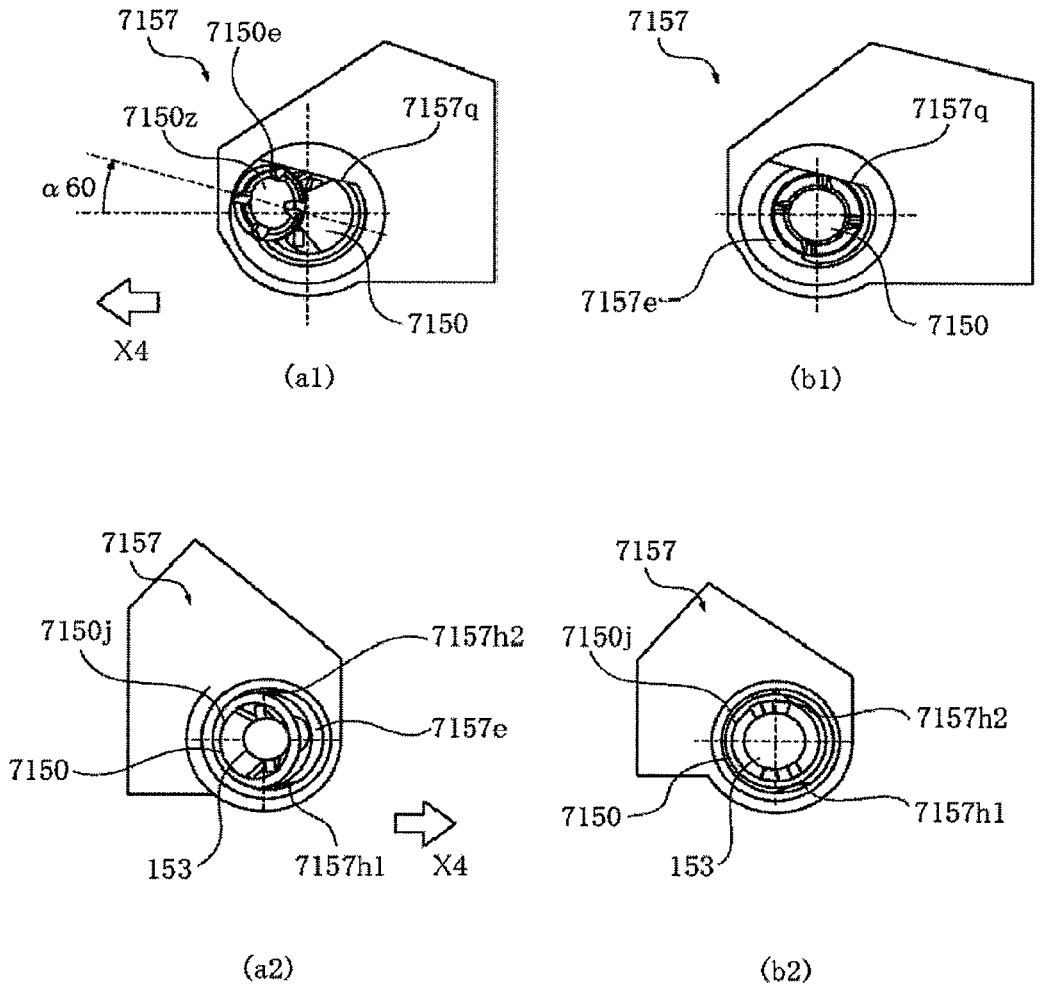
FIG. 46 is a side view illustrating the driving side of the cartridge according to an embodiment of the present invention.
Figure 47:
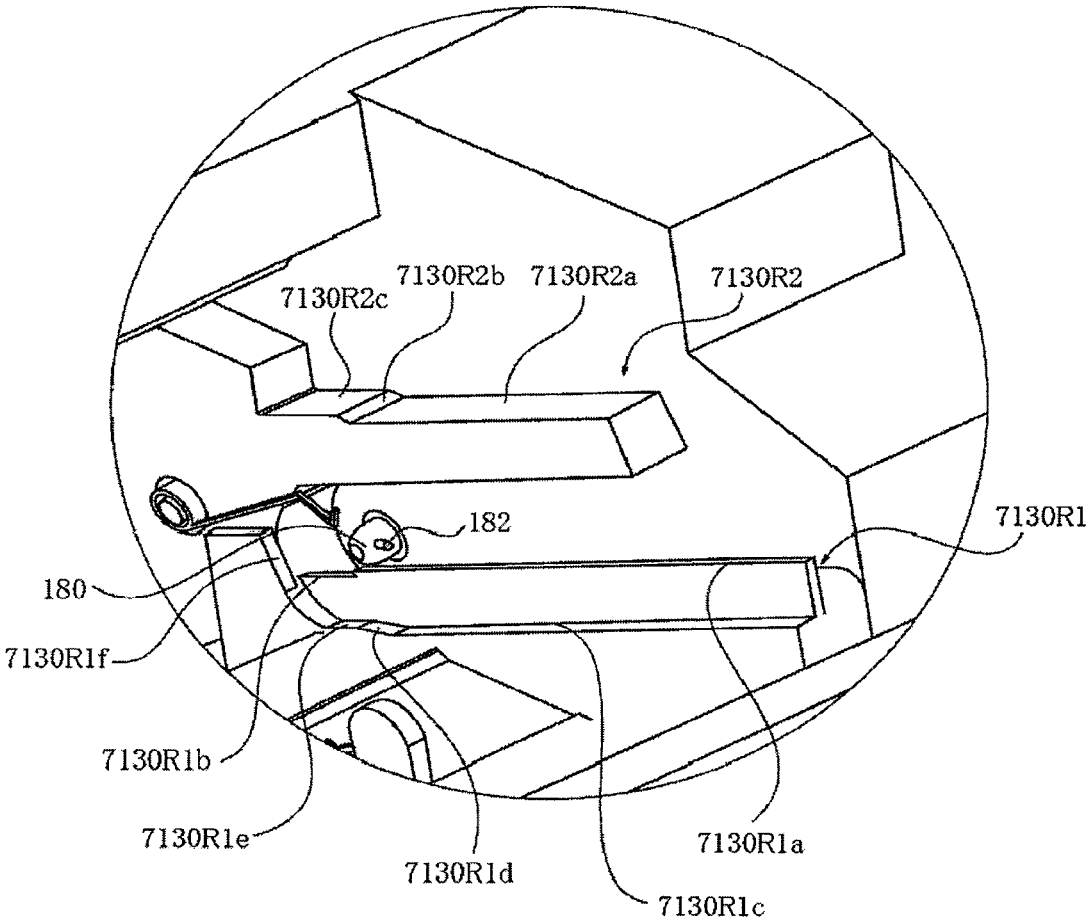
FIG. 47 is a perspective view illustrating the driving side of the main assembly guide according to an embodiment of the present invention.
Figure 48:
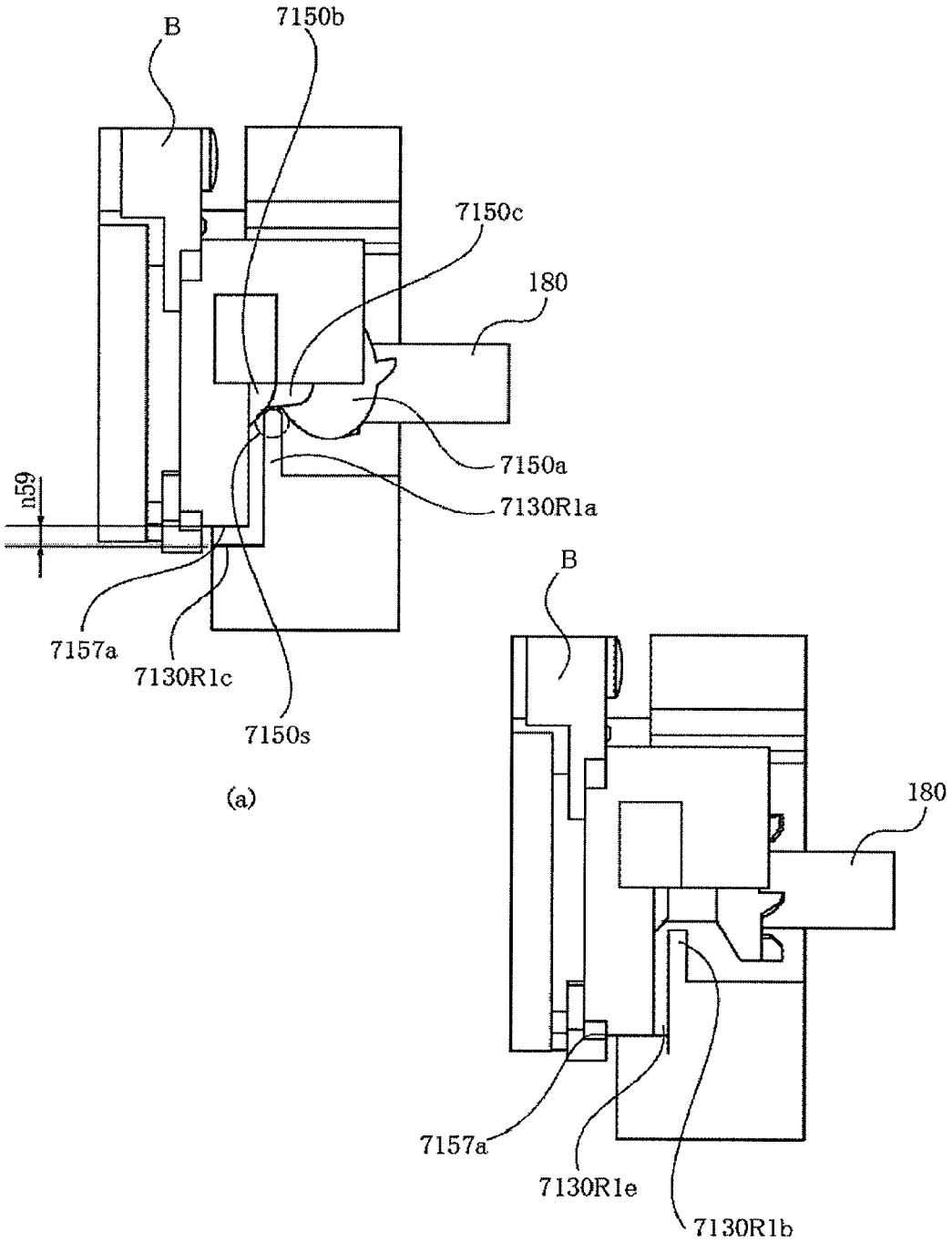
FIG. 48 is a side view illustrating the relation between the cartridge and the main assembly guide according to an embodiment of the present invention.
Figure 49:
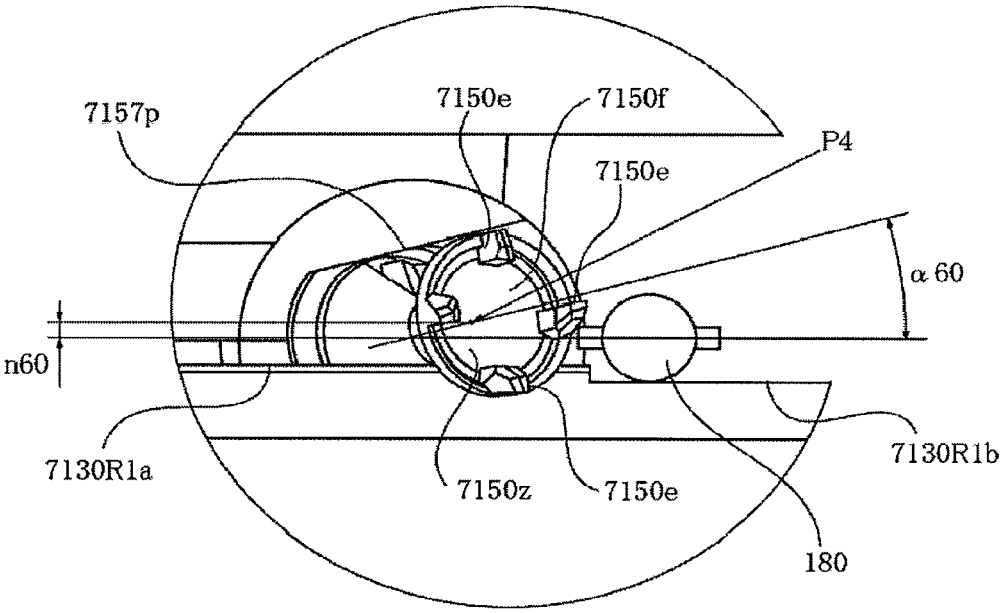
FIG. 49 is a side view and a perspective view illustrating the relation between the main assembly guide and the coupling according to an embodiment of the present invention.
Figure 49:
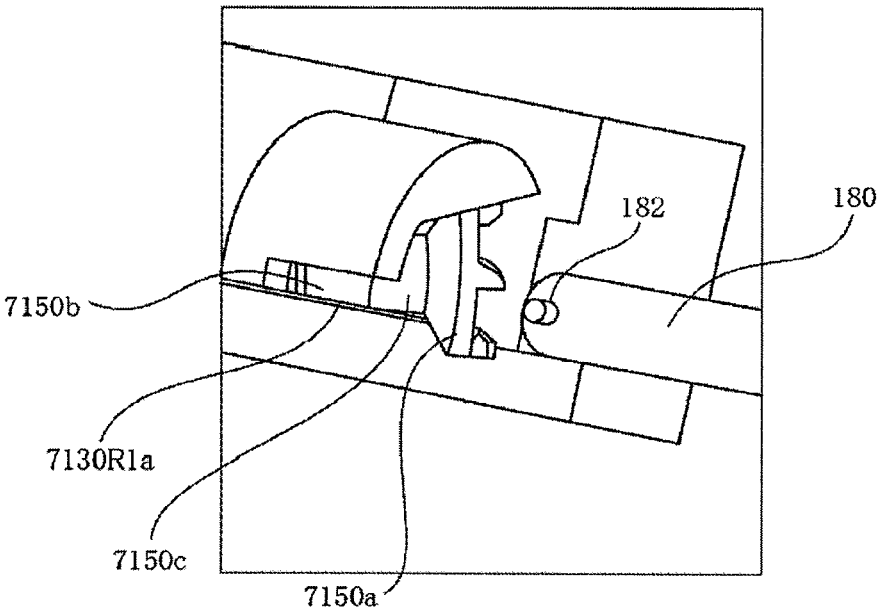
Figure 50:
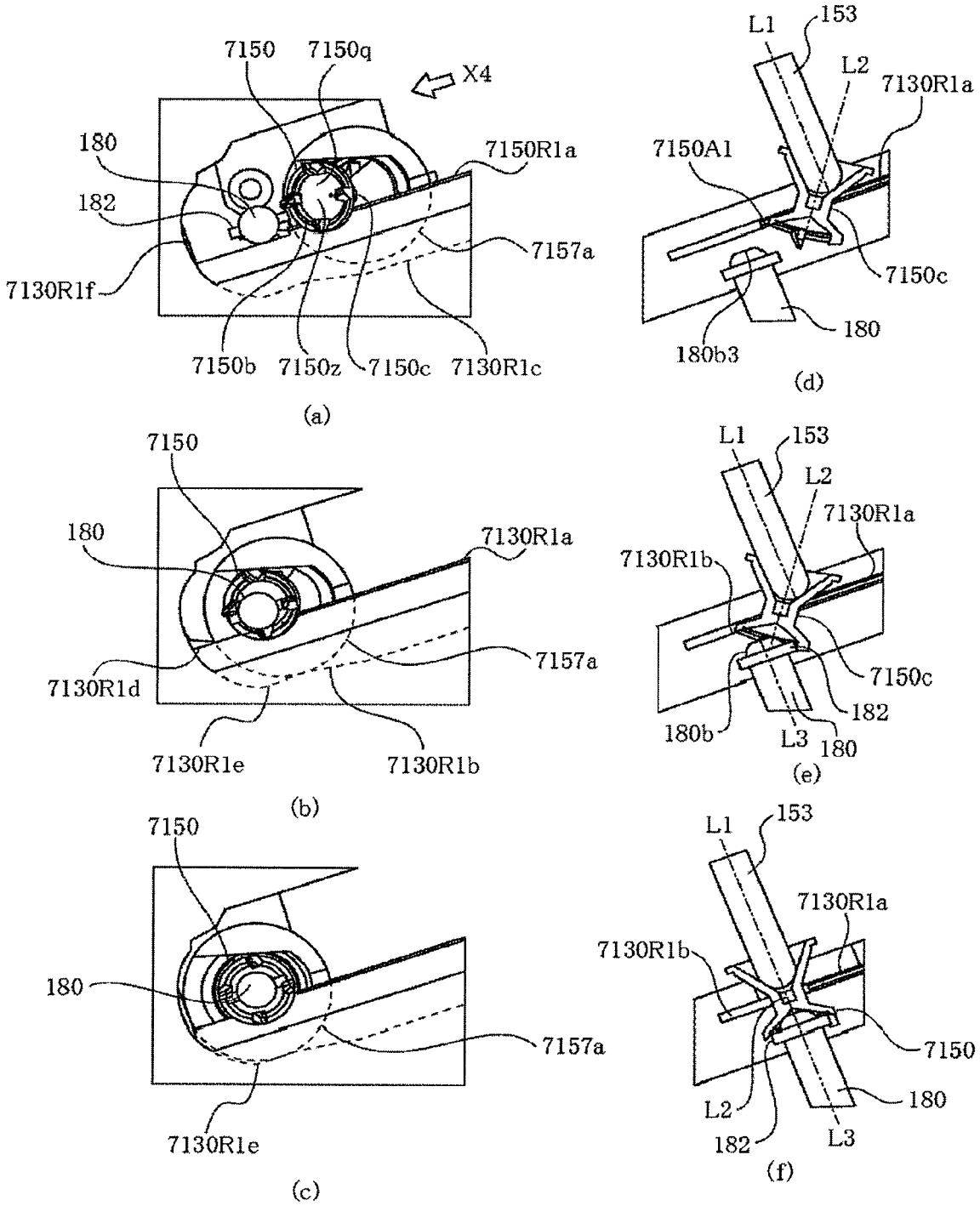
FIG. 50 is a side view, as seen from the driving side, of the process in which the cartridge according to an embodiment of the present invention is mounted to the main assembly.

FIGS. 46(*a*1), 46(*a*2), 46(*b*1) and 46(*b*2) are enlarged side views of the driving side of the cartridge. FIG. 47 is a perspective view showing the driving side of an apparatus main assembly guide. FIGS. 48(*a*) and 48(*b*) are side views showing a relationship between the cartridge and the apparatus main assembly guide. FIGS. 49(*a*) and 49(*b*) are schematic views showing a relationship between the apparatus main assembly guide and the coupling as seen from the mounting direction upstream side. FIGS. 50(*a*) to 50(*f*) are side views for illustrating the mounting process.

FIG. 46(*a*1) and FIG. 46(*b*1) are side views of the cartridge as seen from the driving shaft side, and FIG. 46(*a*2) and FIG. 46(*b*2) are side views of the cartridge as seen from a side opposite from the driving shaft side. As shown in these figures, a coupling 7150 is mounted to a developing device supporting member 7157 in a state in which the coupling 7150 can be inclined toward the mounting direction X4 downstream side. Further, with respect to the inclination direction, the coupling 7150 can be inclined only toward the mounting direction X4 downstream side. Further, the coupling 7150 has the axis L2 inclined at an angle α60 with respect to the horizontal line in the state of FIG. 46(*a*1). The reason for the inclination of the coupling 7150 at the angle α60 is as follows. A flange portion 7150*j* of the coupling 7150 is regulated by regulating portions 7157*h*1 and 7157*h*2 as the regulating means (FIG. 46(*a*2)). For that reason, the coupling 7150 can be inclined upwardly at the angle α60 with respect to the mounting direction downstream side.

Next, with reference to FIG. 47, a main assembly guide 7130R will be described. The main assembly guide 7130R principally includes, through the coupling 7150, a guide rib 7130R1*a* for guiding the cartridge B and cartridge position portions 7130R1*e* and 7130R1*f*. The rib 7130R1*a* is located on a mount locus of the cartridge B. The rib 7130R1*a* extends to a portion in front of the driving shaft 180 in the mounting direction X4. Further, a rib 7130R1*b* in the neighborhood of the driving shaft 180 has a height such that the rib 7130R1*b* does not interfere with the coupling 7150 when the coupling 7150 is engaged with the driving shaft 180. A main assembly guide 7130 R2 principally includes a guide portion 7130R2*a* for guiding a part of the cartridge frame to determine an attitude of the cartridge during the mounting and includes a cartridge position portion 7130R2*c*.

Next, the relationship between the main assembly guide 7130R and the cartridge at the time of mounting the cartridge will be described.

As shown in FIG. 48(*a*), the cartridge B is moved on the driving side in a state in which an intermediary portion (a force receiving portion) 7150*c* contacts the surface of the guide rib (fixed portion, contact portion) 7130R1*a*. At this time, a cartridge guide 7157*a* of the supporting member 7157 is distant from the guide surface 7130R1*c* by n59. For that reason, on the coupling 7150, a self weight of the cartridge B is exerted. On the other hand, as described above, the coupling 7150 is set so that the mounting direction downstream side portion thereof can be inclined upwardly at the angle α60 with respect to the mounting direction X4. For that reason, the coupling 7150 is inclined toward the downstream side with respect to the mounting direction X4 at the driven portion 7150*a* (in the direction in which the driven portion 7150*a* is inclined at the angle α60) (FIG. 49(*a*)).

The reason that the coupling 7150 is inclined is as follows. The intermediary portion 7150*c* receives reaction force of the self weight of the cartridge B from the guide rib 7130R1*a*. The reaction force acts on the regulating portions 7157*h*1 and 7157*h*2 for regulating the inclination direction. As a result, the coupling is inclined in a predetermined direction.

When the intermediary portion 7150*c* moves on the guide rib 7130R1*a*, a frictional force occurs between the intermediary portion 7150*c* and the guide rib 7130R1*a*. Accordingly, the coupling 7150 receives a force toward a direction opposite to the mounting direction X4 by the frictional force. However, the frictional force generated by friction coefficient between the intermediary portion 7150*c* and the guide rib 7130R1*a* is smaller than a force of inclining the coupling 7150 toward the downstream side with respect to the mounting direction X5 by the reaction force. For that reason, the coupling 7150 is inclined and moved downwardly with respect to the mounting direction X4 by overcoming the frictional force.

Incidentally, a regulating portion 7157*g* of the supporting member 7157 (FIGS. 46(*a*1) and 46(*b*1)) can also be provided as the regulating means for regulating the inclination. As a result, the inclination direction of the coupling is regulated by the regulating portions 7157*h*1 and 7157*h*2 (FIGS. 46(*a*2) and 46(*b*2)) and the regulating portion 7157*g* at different positions with respect to the direction of the axis L2. Thus, the inclination direction of the coupling 7150 can be regulated with reliability. Further, the coupling 7150 can be inclined always at the angle α60. The regulation of the inclination direction of the coupling 7150 may also be performed by another means.

The guide rib 7130R1*a* is located in a space 7150*s* constituted by the driven portion 7150*a*, the driving portion 7150*b*, and the intermediary portion 7150*c*. Therefore, in the mounting process, a longitudinal position (with respect to the direction of the axis L2) of the coupling 7150 in the apparatus main assembly A is regulated (FIGS. 48(*a*) and 48(*b*)). By regulating the longitudinal position of the coupling 7150, the coupling 7150 is engageable with the driving shaft 180 with reliability.

Next, the engaging operation for engaging the coupling 7150 with the driving shaft 180 will be described. The engaging operation is the substantially same as that in Embodiment 1 (FIG. 19). In this embodiment, a relationship between the main assembly guide 7130R2 and the supporting member 7157 and the coupling 7150 in the engaging process of the coupling 7150 with the driving shaft 180 will be described with reference to FIGS. 50(*a*) to 50(*f*). During the contact of the intermediary portion 7150*c* with the rib 7130R1*a*, the cartridge guide 7157*a* is placed in a separated state from the guide surface 7130R1*c*. As a result, the coupling 7150 is inclined (the angular position between the engagement) (FIG. 50(*a*) and FIG. 50(*d*)). Then, at the time when an end 7150A1 of the inclined coupling 7150 passes through a shaft end 180*b*3, the intermediary portion 7150*c* does not contact the guide rib 7130R1*a* (FIG. 50(*b*) and FIG. 50(*e*)). In this case, the cartridge guide 7157*a* passes through the guide surface 7130R1*c* and an inclined surface 7130R1*d* and is in a state in which the cartridge guide 7157*a* starts to contact the positioning surface 7130R1*e* (FIG. 50(*b*) and FIG. 50(*e*)). Thereafter, a receiving surface 7150*f* or a projection 7150*d* contacts the end portion 180*b* or the pin 182. Then, in accordance with the cartridge mounting operation, the axis L2 and the axis L1 come near to the same line, and the center position of the developing shaft and the center position of the coupling come near to a co-axial line. Then, finally, as shown in FIG. 50(*c*) and FIG. 50(*f*), the axis L1 and the axis L2 are substantially in line with each other. Thus, the coupling 7150 is in a rotation stand-by state (the rotational force transmission angular position).

In the process of demounting the cartridge B from the apparatus main assembly A, steps which are substantially the reverse of the engaging operation are pursued. Specifically, the cartridge B is moved in the demounting direction. As a result, the end portion 180*b* pushes the receiving surface 7150*f*. As a result, the axis L2 starts to be inclined with respect to the axis L1. By the demounting operation of the cartridge, the upstream side end portion 7150A1 moves along the surface of the end portion 180*b* in the demounting direction X6, so that the axis L2 is inclined until the end portion Al reaches a shaft end 180*b*3. In this state, the coupling 7150 completely passes through the shaft end 180*b*3 (FIG. 50(*b*)). Thereafter, the coupling 7150 contacts the surface of the rib 7130R1*a* at the intermediary portion 7150*c*. As a result, the coupling 7150 is demounted in a state in which the coupling 7150 is inclined toward the downstream side with respect to the mounting direction X4. That is, the coupling 7150 is inclined (swung) from the rotational force transmission angular position to the demounting angular position.

As described above, by the mounting operation of the cartridge to the main assembly by the user, the coupling is swung to be engaged with the main assembly driving shaft. Further, a means for keeping the attitude of the coupling is not particularly required. However, as described in FIG. 4, the structure in which the attitude of the coupling is kept in advance can also be carried out in combination with the structure of this embodiment.

In this embodiment, by applying the self weight to the guide rib, the coupling is inclined in the mounting direction X4. However, in addition to the self weight, the elastic force of the spring or the like may also be utilized.

In this embodiment, the intermediary portion of the coupling receives the force to incline the coupling. However, the present invention is not limited thereto. For example, a portion other than the intermediary portion may also be brought into contact with the contact portion when the portion can receive the force from the contact portion of the main assembly to incline the coupling.

Further, this embodiment can also be carried out in combination with any of Embodiments 2 to 4. In this case, the engagement and disengagement of the coupling with respect to the driving shaft can be performed with further reliability.

(Embodiment 6)

Embodiment 6 will be described with reference to FIGS. 51 to 55. In the above-described Embodiments, the surface of the developing roller 6110 is held with a predetermined spacing with respect to the photosensitive drum 107. In that state, the developing roller 6110 develops the latent image formed on the photosensitive drum 107. In the above-described Embodiments, the cartridge employing the so-called non-contact developing system is described. In this embodiment, a cartridge employing a so-called contact developing system in which development is carried out in a state in which the developing roller surface is in contact with the latent image formed on the photosensitive drum. That is, the case where an embodiment of the present invention is applied to the cartridge employing the contact developing system will be described.

Figure 51:
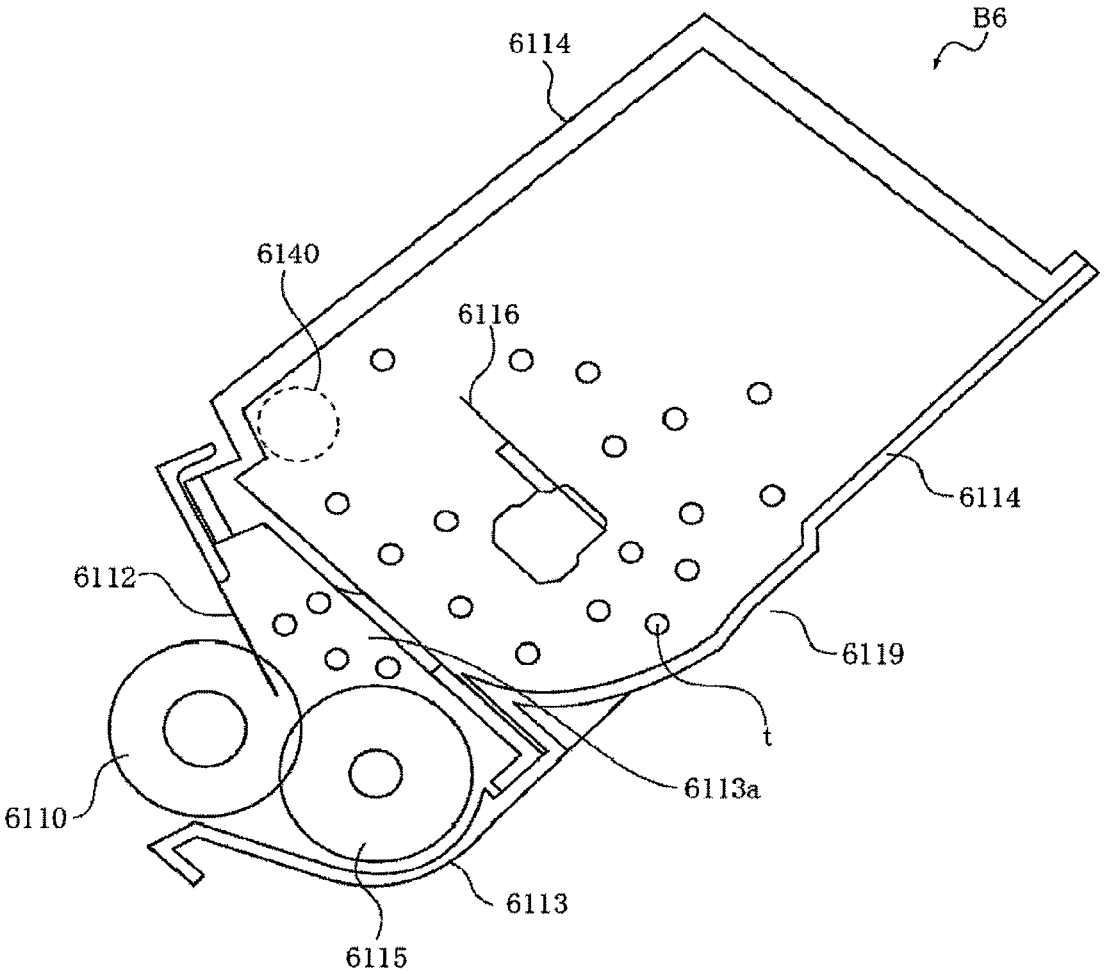
FIG. 51 is a side sectional view of the cartridge according to an embodiment of the present invention.
Figure 52:
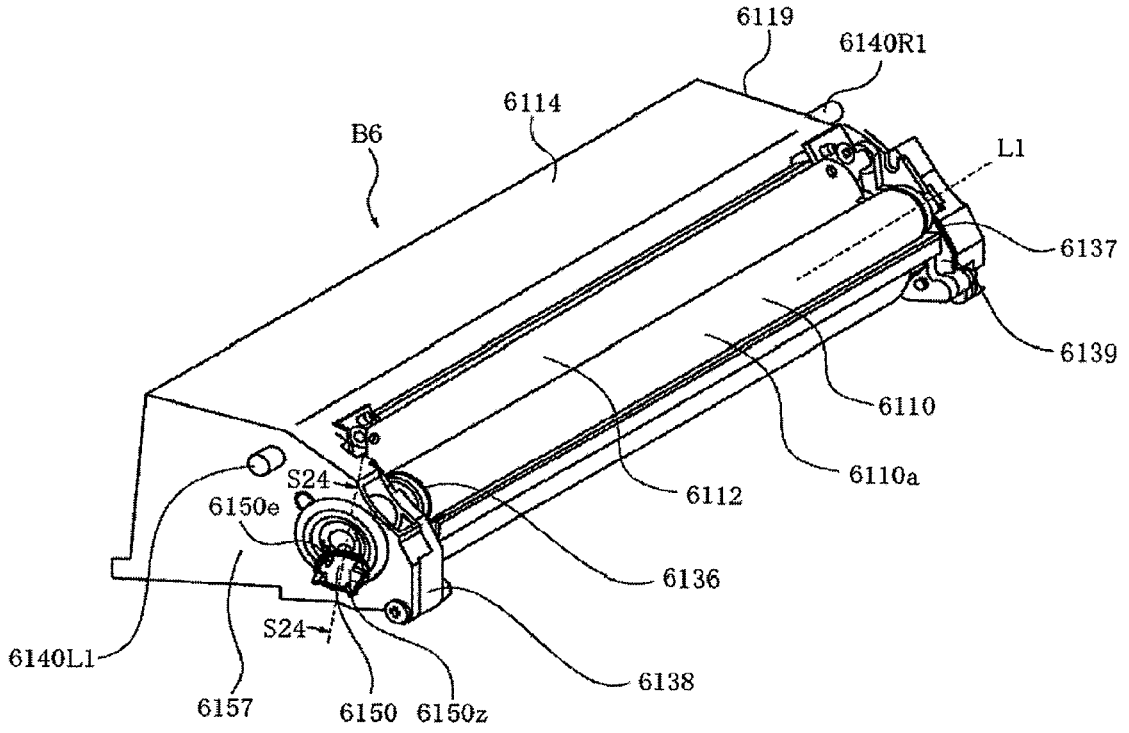
FIG. 52 is a perspective view of the cartridge according to an embodiment of the present invention.
Figure 53:
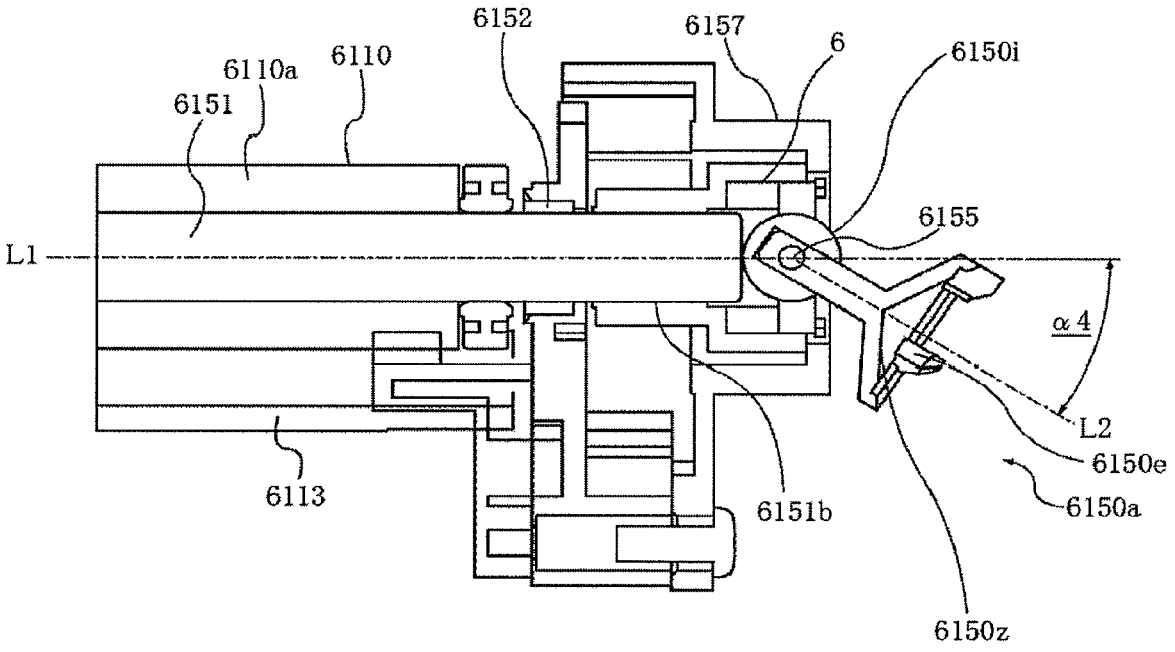
FIG. 53 is a longitudinal sectional view of the cartridge according to an embodiment of the present invention.
Figure 54:
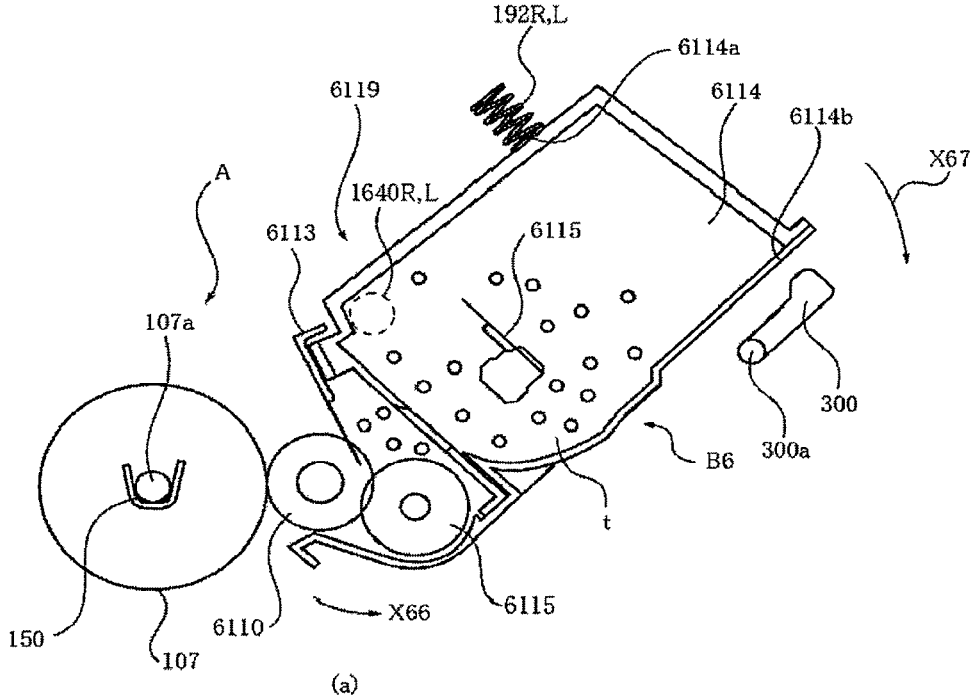
FIG. 54 is a side sectional view of the cartridge according to an embodiment of the present invention.
Figure 54:
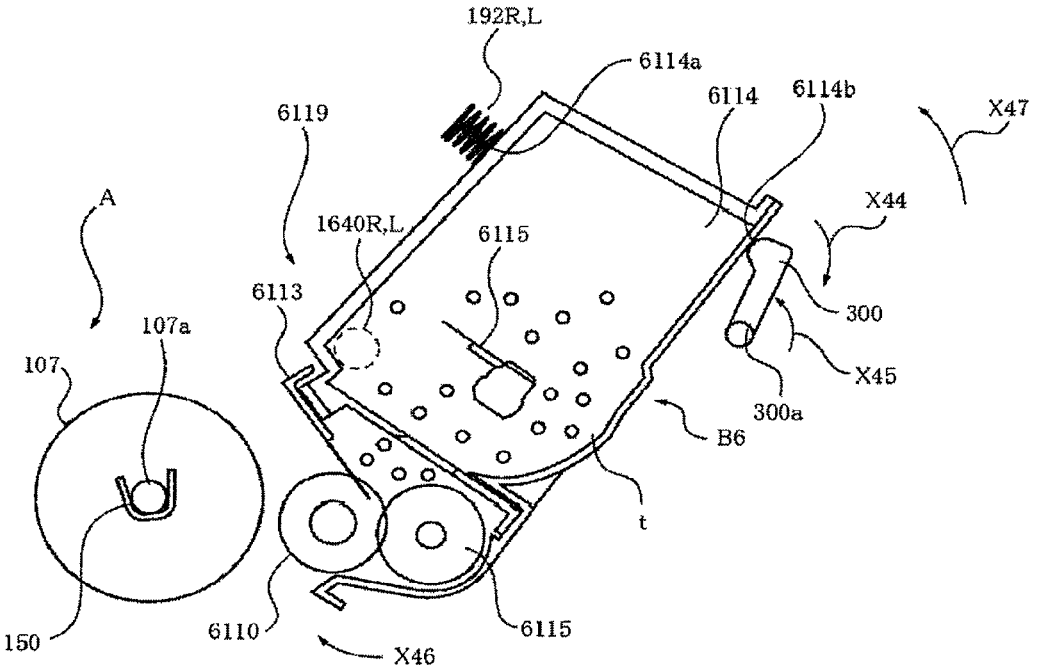
Figure 55:
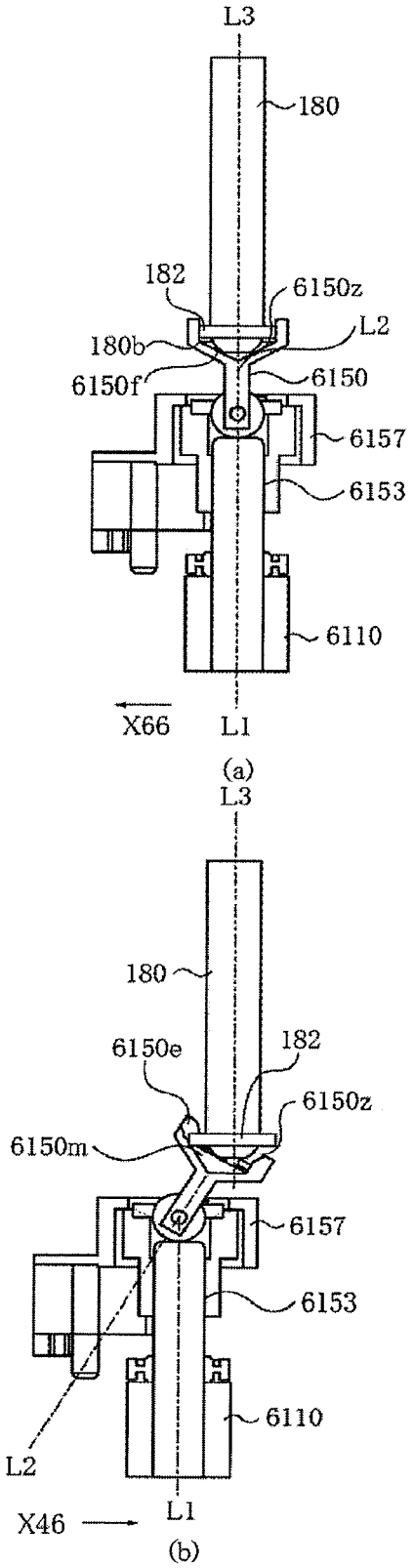
FIG. 55 is a longitudinal sectional view of the cartridge according to an embodiment of the present invention.

FIG. 51 is a sectional view of the developing cartridge of this embodiment. FIG. 52 is a perspective vie showing a developing device side of the cartridge. FIG. 53 is a sectional view of the cartridge taken along S24-S24 line indicated in FIG. 52. FIGS. 54(*a*) and 54(*b*) are sectional views showing the case where the developing cartridge is in a development enabled state and the case where the developing cartridge is in a development disabled state, respectively. FIGS. 55(*a*) and 55(*b*) are longitudinal sectional views showing drive connection in the states of FIGS. 54(*a*) and 54(*b*), respectively. The development disabled state refers to a state in which the developing roller 6110 is moved apart from the photosensitive drum 107.

First, the structure of the developing cartridge B6 employing the contact developing system will be described with reference to FIGS. 51 and 52.

The cartridge B6 includes the developing roller 6110. The developing roller 6110 rotates, during a developing action, by receiving a rotational force from the apparatus main assembly A through a coupling mechanism described later.

In a developer accommodating frame (developer accommodating portion) 6114, developer t is accommodated. This developer is fed to a developing chamber 6113*a* by rotation of a stirring member 6116. The fed developer is supplied to the surface of the developing roller 6110 by rotation of a sponge-like a developer supplying roller 6115 in the developing chamber 6113*a*. Then, the developer is supplied with electric charges by friction between a thin plate-like developing blade 6112 and the developing roller 6110 to be formed in a thin layer. The developer formation in the thin layer is fed to a developing position by the rotation. Then, to the developing roller 6110, a predetermined developing bias is applied. As a result, the developing roller 6110 develops the electrostatic latent image formed on the photosensitive drum 107 in a state in which the surface thereof contacts the surface of the photosensitive drum 107. That is, the electrostatic latent image is developed by the developing roller 6110.

The developer which has not contributed to the development of the electrostatic latent image, i.e., the developer t remaining on the surface of the developing roller 6110 is removed by the developer supplying roller 6115. At the same time, fresh developer t is supplied to the surface of the developing roller 6110 by the supplying roller 6115. As a result, the developing operation is performed continuously.

The cartridge B6 includes a developing unit 6119. The developing unit 6119 includes a developing device frame 6113 and the developer accommodating frame 6114. Further, the developing unit 6119 includes the developing roller 6110, the developing blade 6112, the developer supplying roller 6115, the developing chamber 6113*a*, the developer accommodating frame 6114, and the stirring member 6116.

The developing roller 6110 rotates about the axis L1.

The structure of the apparatus main assembly A is the substantially same as that in Embodiment 1, thus being omitted from the description. However, to the apparatus main assembly A applied to Embodiment 6, in addition to the structure of the main assembly A described above, a lever (a force-imparting member shown in FIGS. 54(*a*) and 54(*b*)) 300 for contact and separation between the surface of the photosensitive drum 107 and the surface of the developing roller 6110. Incidentally, the lever 300 will be described later. The developing cartridge B is, described in Embodiment 1, mounted to a mounting portion 130*a* (FIG. 3) by guiding cartridge guides 6140L1, 6140R2 and the like to the apparatus main assembly A by the user. Incidentally, the cartridge B6 is also, similarly as in the above-described cartridge, mounted to the mounting portion 130*a* by being moved in the direction substantially perpendicular to the axial direction of the driving shaft 180. Further, the cartridge 6B is demounted from the mounting portion 130*a*.

Incidentally, when the cartridge B6 is mounted to the mounting portion 130*a* as described above, a guide (projection) 6140R1 of the cartridge B6 is subjected to pressure application by the elastic force of the urging spring (elastic member) 188R as shown in FIGS. 15 and 16. Further, by the elastic force of the urging spring 188L, a guide (dowel) 6140L1 (FIG. 52) of the cartridge B6 is subjected to pressure application. As a result, the cartridge B6 is rotatably held about the guides 6140R1 and 6140L1 by the apparatus main assembly A. That is, the guide 6140R1 is rotatably supported by the main assembly guide 130R1 and the guide 6140L1 is rotatably supported by the main assembly guide 130L1. Then, when the door 109 (FIG. 3) is closed, by the elastic force of the urging spring 192R provided to the door 109 (and the urging spring 192L on the non-drive side shown in FIG. 16), the urging portion 6114*a* of the cartridge B6 (FIGS. 51 and 52) is subjected to pressure application. As a result, the cartridge B6 is subjected to rotation moment about the guide 6140. Then, nip width regulating members (spacing regulating members) 6136 and 6137 (FIG. 52) disposed at end portions of the developing roller 6110 of the cartridge 6B contact the end portions of the photosensitive drum 107. For that reason, the developing roller 6110 and the photosensitive drum 107 are kept with a constant contact nip. That is, the developing roller 6110 includes the developing shaft 6151 and a rubber portion (elastic member) 6110*a* (FIGS. 52 and 53). The developing roller 6110 contacts the photosensitive drum 107 in a state in which the rubber portion 6110*a* is bent. In this state, the developing roller develops the electrostatic latent image formed on the photosensitive drum 107 with the toner t.

Next, with reference to FIGS. 52 and 53, the structure of the developing roller 6110 and the mounting structure (supporting structure) of the coupling 6150 will be described.

The developing shaft 6151 is an elongated member of an electroconductive material such as iron or the like. The developing shaft 6151 is rotatably supported by the developing device frame 6113 through a shaft supporting member 6152. Further, the developing gear 6150*b* is fixedly positioned to the developing shaft 6151 in a non-rotatable manner. The coupling 6150 is mounted in an inclinable member to the developing gear 6150*b* with the same structure as described in Embodiment 1. That is, the coupling 6150 is mounted so that the axis L2 is inclinable with respect to the axis L1. The rotational force of the coupling 6150 received from the apparatus main assembly A is transmitted to the developing roller 6110 through the drive transmitting pin (rotational force transmitting portion) 6155, the developing gear 6153, and the developing shaft 6151. As a result, the developing roller 6110 is rotated.

The rubber portion 6110*a* is coated on the developing shaft 6151 so as to be co-axial with the developing shaft 6151. The rubber portion 6110*a* carries the developer (toner) t at its peripheral surface and to the developing shaft 6151, a bias is applied. As a result, the rubber portion 6110*a* develops the electrostatic latent image with the developer t carried thereon.

The regulating members 6136 and 6137 are members for regulating the nip width at a constant level when the surface of the developing roller 6110 contacts the surface of the photosensitive drum 107. That is, the regulating members 6136 and 6137 regulate an amount of depression of the surface of the developing roller 6110.

In the case of the contact developing system as in this embodiment, when the state in which the developing roller 6110 always contacts the photosensitive drum 107 is kept, there is a possibility of deformation of the rubber portion 6110*a* of the developing roller 6110. For this reason, during the non-development, it is preferable that the developing roller 6110 is moved apart from the photosensitive drum 107. That is, as shown in FIGS. 54(*a*) and 54(*b*), it is preferable that a state in which the developing roller 6110 contacts the photosensitive drum 107 (FIG. 54(*a*)) and a state in which the developing roller 6110 is moved apart from the photosensitive drum 107 (FIG. 54(*b*)) are created.

In the state in which the cartridge B6 is mounted to the mounting portion 130*a*, an upper surface (force receiving portion) 6114*a* of the developer accommodating frame 6114 of the cartridge B6 is urged by the elastic force of the springs 192R and 192L. Thus, the cartridge B6 is rotated about the guides (supporting points) 6140R and 6140L of the cartridge B6 (in the clockwise direction X67 in FIG. 54(*a*)). Therefore, the surface of the developing roller 6110 contacts the surface of the photosensitive drum 107 (the state shown in FIG. 54(*a*)).

Then, in this embodiment, the lever (urging member, force-imparting member) 300 provided to the apparatus main assembly A is rotated by a force of a motor (not shown) rotated by a developing device separation signal (i.e., rotated in the counterclockwise direction (direction indicated by an arrow X45 in FIG. 54(*b*))). Then, the lever 300 urges the bottom (force receiving portion) 6114*a* of the cartridge B6 (the developer accommodating frame 6114). As a result, the cartridge B6 rotates about the guide 6140 against the elastic force of the springs 192R and 192L (i.e., rotates in the counterclockwise direction X47). Therefore, the surface of the developing roller 6110 is placed in a separated state from the surface of the photosensitive drum 107 (the state shown in FIG. 54(*b*)). That is, the cartridge B6 rotates about the guides (supporting points) 6140R and 6140L to move in the direction X66.

The lever 300 is rotated to the stand-by position by the force of a motor (not shown) rotated in an opposite direction by a developing device contact signal (i.e., rotated in the clockwise direction (the direction indicated by an arrow X44 shown in FIG. 54(*b*))). Then, the cartridge B6 returns to the developing device contact portion by the elastic force of the springs 192R and 192L (the state shown in FIG. 54(*a*)). That is, the cartridge B6 rotates about the guides (supporting points) 6140R and 6140L to move in the direction X46.

Here, the stand-by position of the lever 300 refers to a state (position) in which the lever 300 is separated from the cartridge B6 (the position shown in FIG. 54(*a*)).

According to this embodiment, while the developing roller 6110 is left to rotate, it is possible to move the cartridge B6 from the state of FIG. 54(*b*) to the state of FIG. 54(*a*) and from the state of FIG. 54(*a*) to the state of FIG. 54(*b*).

This operation will be described. The rotation of the developing roller 6110 may preferably be started immediately before the state of the cartridge B6 is changed from the state of FIG. 54(*b*) to the state of FIG. 54(*a*). That is, the developing roller 6110 may preferably contact the photosensitive drum 107 while rotating. In this way, by bringing the developing roller 6110 into contact with the photosensitive drum 107 while rotating the developing roller 6110, it is possible to damage the photosensitive drum 107 and the developing roller 6110. This is true for the case where the developing roller 6110 is moved apart from the photosensitive drum 107, so that the developing roller 6110 may preferably be separated from the photosensitive drum 107.

With reference to FIGS. 55(*a*) and 55(*b*), an example, of a drive input structure in this embodiment will be described.

A state of FIG. 55(*a*) corresponds to the state of FIG. 54(*a*), i.e., the state in which the developing roller 6110 contacts the photosensitive drum 107 and is rotatable. That is, the axis L1 of the developing roller 6110 and the axis L2 of the coupling 6150 are substantially in the same line, so that the coupling 6150 is in a state in which it can receive the rotational force from the driving shaft 180. When the development is completed, the cartridge B6 is moved from this state in the direction X66 (see also FIG. 54(*a*) in combination). At this time, the developing shaft 6153 is gradually moved in the direction X66, so that the axis L2 is gradually inclined. When the cartridge B6 is placed in the state of FIG. 55(*b*), the developing roller 6110 is completed moved away from the photosensitive drum 107. Thereafter, the rotation of the motor 186 is stopped. That is, even in the state of FIG. 55(*b*), the motor 186 is rotated for a time. According to this embodiment, the cartridge B6 can transmit the rotational force even in the state in which the axis L2 is inclined. Accordingly, even in the state shown in FIG. 55(*b*), the cartridge B6 can transmit the rotational force to the developing roller 6110. Therefore, according to the present invention, while rotating the developing roller 6110, the developing roller 6110 can be moved away from the photosensitive drum 107.

A similar operation is performed in the case where the state of the cartridge B6 is changed from the state of FIG. 55(*b*) to the state of FIG. 55(*a*). That is, the rotation of the motor 186 is started from the state of FIG. 55(*b*), so that the developing roller 6110 can be rotated. That is, according to this embodiment, the developing roller 6110 can be brought into contact with the photosensitive drum 107 while rotating the developing roller 6110.

Incidentally, the engaging operation and disengaging operation of the coupling 6150 with respect to the driving shaft 180 are the same as those described in Embodiment 1, thus being omitted from the description.

The structure described in Embodiment 6 is as follows.

The apparatus main assembly A described in Embodiment 6 is provided with the lever (urging member) 300 in addition to the above-described structure of the apparatus main assembly A.

The cartridge B6 in Embodiment 6 includes the bottom (force receiving portion) 6114*b*. The bottom 6114*b* receives the urging force for moving the developing roller 6110 away from the photosensitive drum 107 in the state in which the cartridge B6 is mounted to the apparatus main assembly A.

The cartridge B6 is urged by the elastic force of the springs 192R and 192L at the upper surface (force receiving portion) 6114*a* of the developer accommodating frame 6114. As a result, the developing roller 6110 of the cartridge B6 presses against the photosensitive drum 107 rotatably positioned to the apparatus main assembly A. Therefore, the cartridge B6 is placed in the contact state in which the developing roller 6110 contacts the photosensitive drum 107.

When the upper surface (force receiving portion) 6114*a* of the cartridge B6 is urged by the lever 300, the cartridge B6 is placed in the separation state in which the developing roller 6110 is separated from the photosensitive drum 107.

The cartridge B6 placed in either of the contact state and the separation state can transmit the rotational force from the coupling 6150 to the developing roller 6110 since the coupling 6150 is located at the above-described rotational force transmission angular position. When the cartridge B6 is demounted from the apparatus main assembly A in the direction substantially perpendicular to the axis L1, the coupling 6150 is moved from the above-described rotational force transmission angular position to the above-described disengagement angular position. As a result, the coupling 6150 can be disengaged from the driving shaft 180.

Thus, even when the cartridge B6 is in the above-described disengagement state and the axis L3 and the axis L1 deviate from each other, according to the coupling 6150 to which the present invention is applied, it is possible to smoothly transmit the rotational force from the driving shaft 180 to the developing roller 6110.

Incidentally, the axis L1 represents the rotational axis of the developing roller 6110 and the axis L3 represents the rotational axis of the driving shaft 180.

Thus, in Embodiment 6, the effects of the embodiment to which the present invention is applied are effectively utilized.

As described above, even when the drive input position is not located at the swing center, in the state in which the developing cartridge is moved away from the photosensitive drum, it is possible to transmit the rotational force to the developing roller. For that reason, it is possible to allow latitude for the drive input position, so that the cartridge and the apparatus main assembly can be downsized.

Incidentally, in this embodiment, the drive input position is located so as to be co-axial with the developing roller. However, as described in a subsequent embodiment, a similar effect can be achieved also in the case where the drive input position is located so as not to be co-axial with the developing roller.

In this embodiment, the engagement and disengagement of the coupling during the developing device separation are described. However, also in this embodiment, the engagement and disengagement of the coupling can also be applicable to those as described in Embodiment 1. As a result, in this embodiment, it is possible to perform mounting/demounting of the cartridge without particularly providing the driving connection mechanism and the releasing mechanism to the apparatus main assembly. Further, it is possible to the driving connection and release during contact/separation of the developing roller of the cartridge with respect to the photosensitive drum.

That is, according to the cartridge B6 to which this embodiment is applied, the cartridge B6 can be mounted to and demounted from the apparatus main assembly A by being moved in the direction substantially perpendicular to the axis L3 of the driving shaft 180. In addition, according to the cartridge B6, even during the developing device separation, the transmission of the rotational force from the apparatus main assembly A to the developing roller 6110 can be performed smoothly.

Here, "during the developing device separation" refers to a state in which the photosensitive drum 107 and the developing roller 6110 which have contacted each other at their surfaces are separated (moved away) from each other.

FIG. 6 is described by taking the so-called developing cartridge as an example of the cartridge but the present invention is also applicable to the so-called process cartridge as the cartridge.

The structure of the cartridge is not limited to that in Embodiment 6 but may also be appropriately changed to other structures.

Embodiment 6 is also applicable to other embodiments.

(Embodiment 7)

Embodiment 7 will be described with reference to FIGS. 56 and 57.

Embodiment 7 is different from Embodiment 6 in drive input position (coupling position) and structure for transmitting the rotational force from the coupling to the developing roller and the developer feeding roller. Specifically, a coupling 8150 is not located on the axis L1 of a developing roller 8110 but is located at a position deviating from the axis L1.

Figure 56:
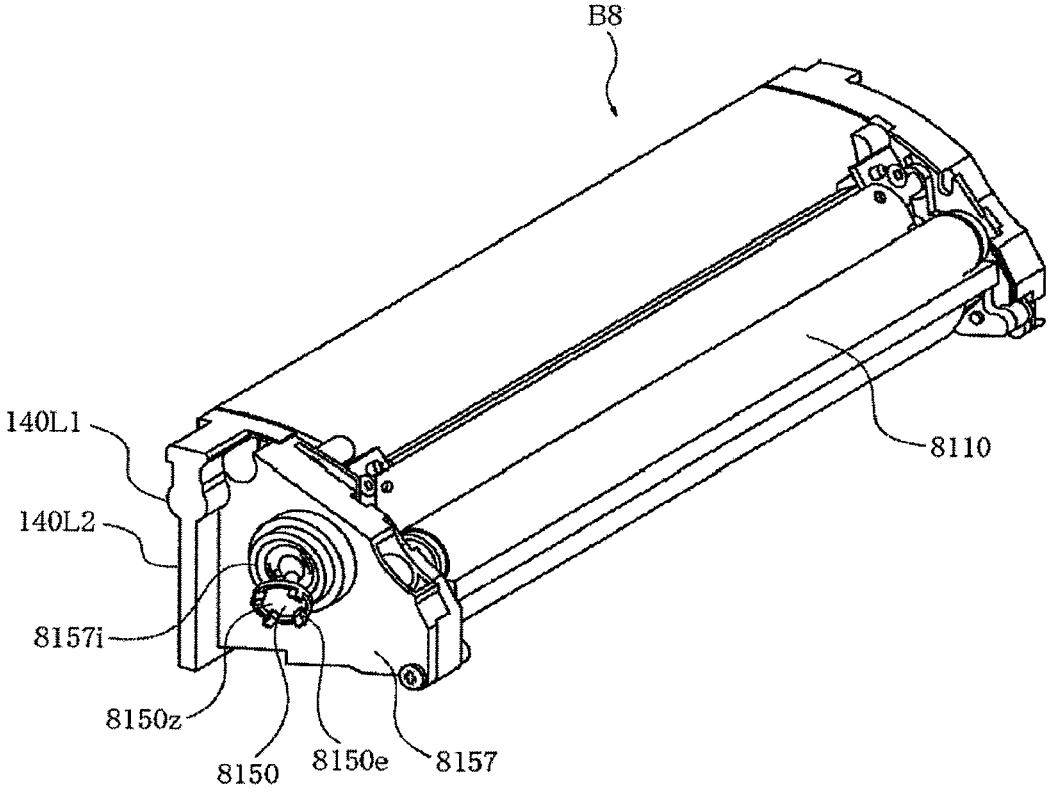
FIG. 56 is a perspective view of the cartridge according to an embodiment of the present invention.

FIG. 56 is a perspective view of a cartridge B8. FIG. 57 is a perspective view showing a driving portion of the cartridge B8.

A developing roller gear 8145 and a developer feeding roller gear 8146 are disposed at driving-side end portions of the developing roller 8110 and the developer feeding roller 6115 (FIG. 51), respectively. The gears 8145 and 8146 are fixed to shafts (not shown). These gears transmit the rotational force, received from the apparatus main assembly A by the coupling 8150, to other rotatable members (the developing roller 8110, the developer feeding roller 6115, a toner stirring member (not shown) and the like) of the cartridge B8.

Next, a drive input gear 8147 to which the coupling 8150 is mounted (by which the coupling 8150 is supported) will be described.

Figure 57:
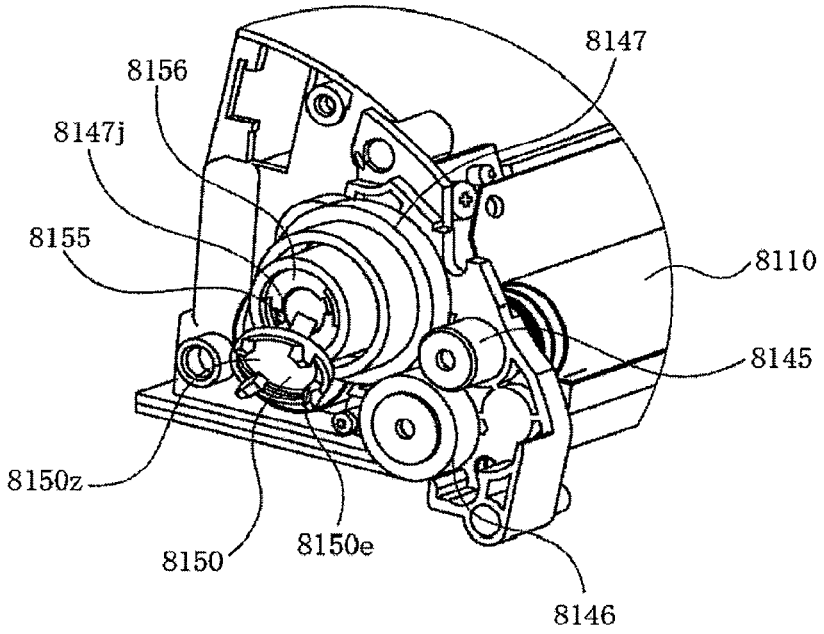
FIG. 57 is a perspective view illustrating a state that the development supporting member of the cartridge according to an embodiment of the present invention is omitted.

As shown in FIG. 57, the gear 8147 is rotatably fixed at a position in which the gear 8147 engages with the developing roller gear 8145 and the developer feeding roller gear 8146. The gear 8147 includes a coupling accommodating portion 8147*j* similarly as in the developing roller gear 151 described in Embodiment 1. The coupling 8150 is mounted to the gear 8147 in an inclinable manner by a retaining member 8156. That is, the coupling 8150 is disposed on the axis L1 of the developing roller 8110 but is disposed at a position deviated from the axis L1. The rotational force received from the driving shaft 180 by the coupling 8150 is transmitted to the developing roller 8110 through the gears 8147 and 8145. The rotational force is further transmitted to the developer feeding roller 6115 through the gears 8147 and 8146.

A supporting member 8157 is provided with a hole which defines an inner peripheral surface 8157*i* engageable with the gear 8147. The description on the engagement, drive, and disengagement of the coupling by the mounting and demounting operations of the cartridge is the same as that in Embodiment 1, thus being omitted.

Further, as the structure for inclining the axis L2 of the coupling 8150 to the angular position before the engagement immediately before the coupling 8150 engages with the driving shaft, any of those in Embodiment 2 to Embodiment 5 may be employed.

As described above, the coupling 8150 is not required to be disposed at the end portion co-axial with the developing roller 8110. According to this embodiment, it is possible to improve design latitude of the image forming apparatus main assembly and the cartridge.

(Embodiment 8)

Embodiment 8 will be described with reference to FIGS. 58 to 62.

Figure 58:
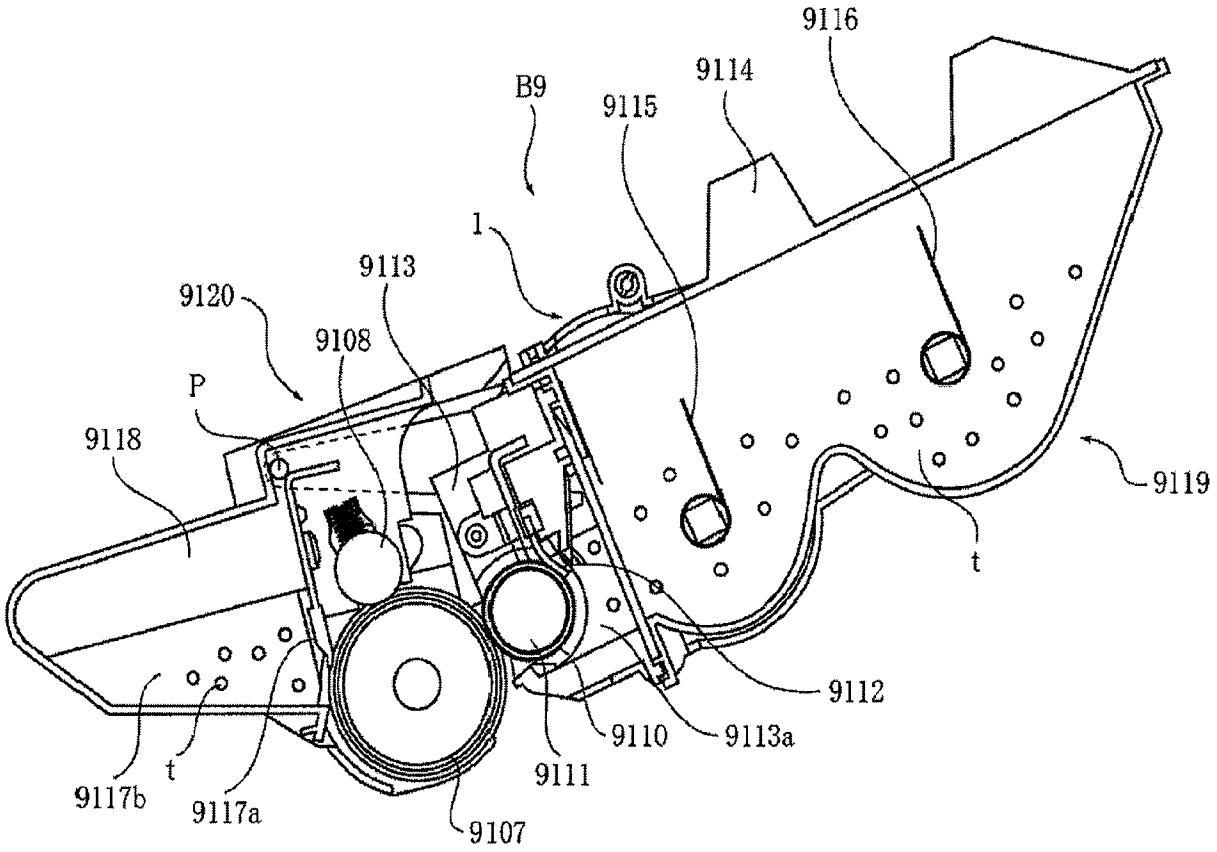
FIG. 58 is a side sectional view of the cartridge according to an embodiment of the present invention.
Figure 59:
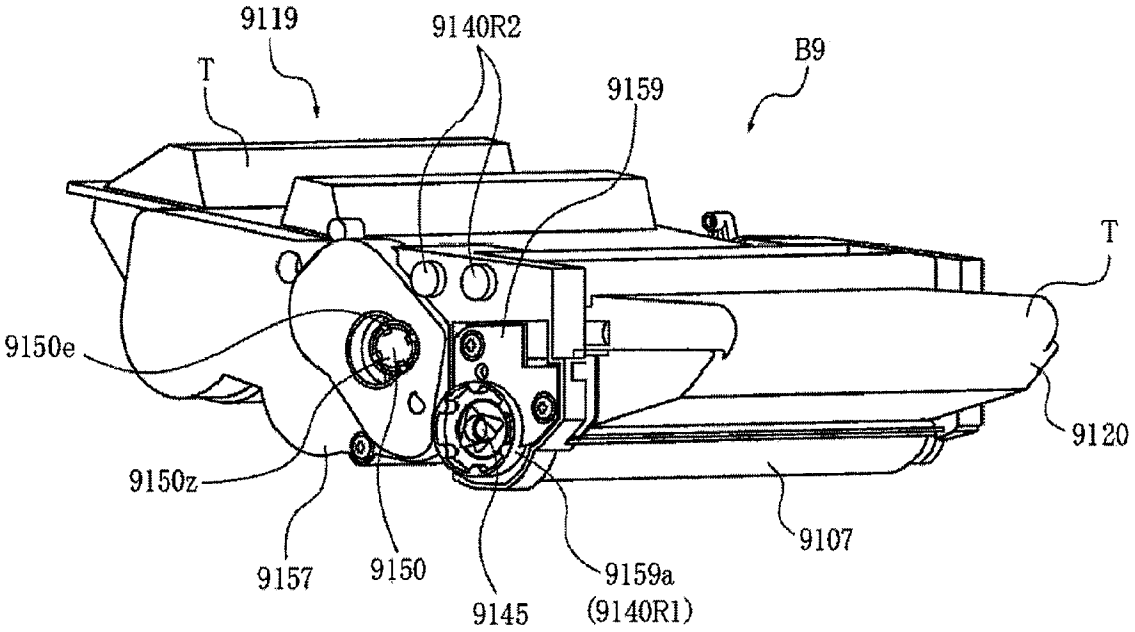
FIG. 59 is a perspective view of the cartridge according to an embodiment of the present invention.
Figure 60:
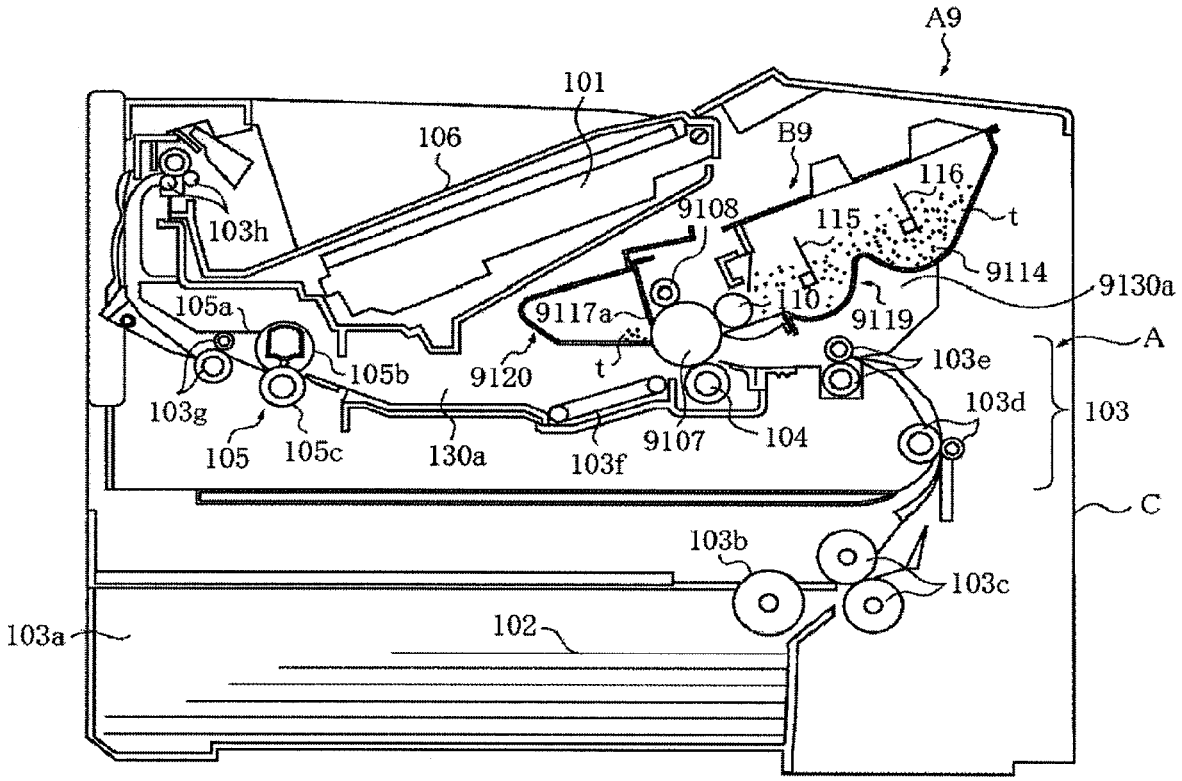
FIG. 60 is a side sectional view of the main assembly according to an embodiment of the present invention.
Figure 61:
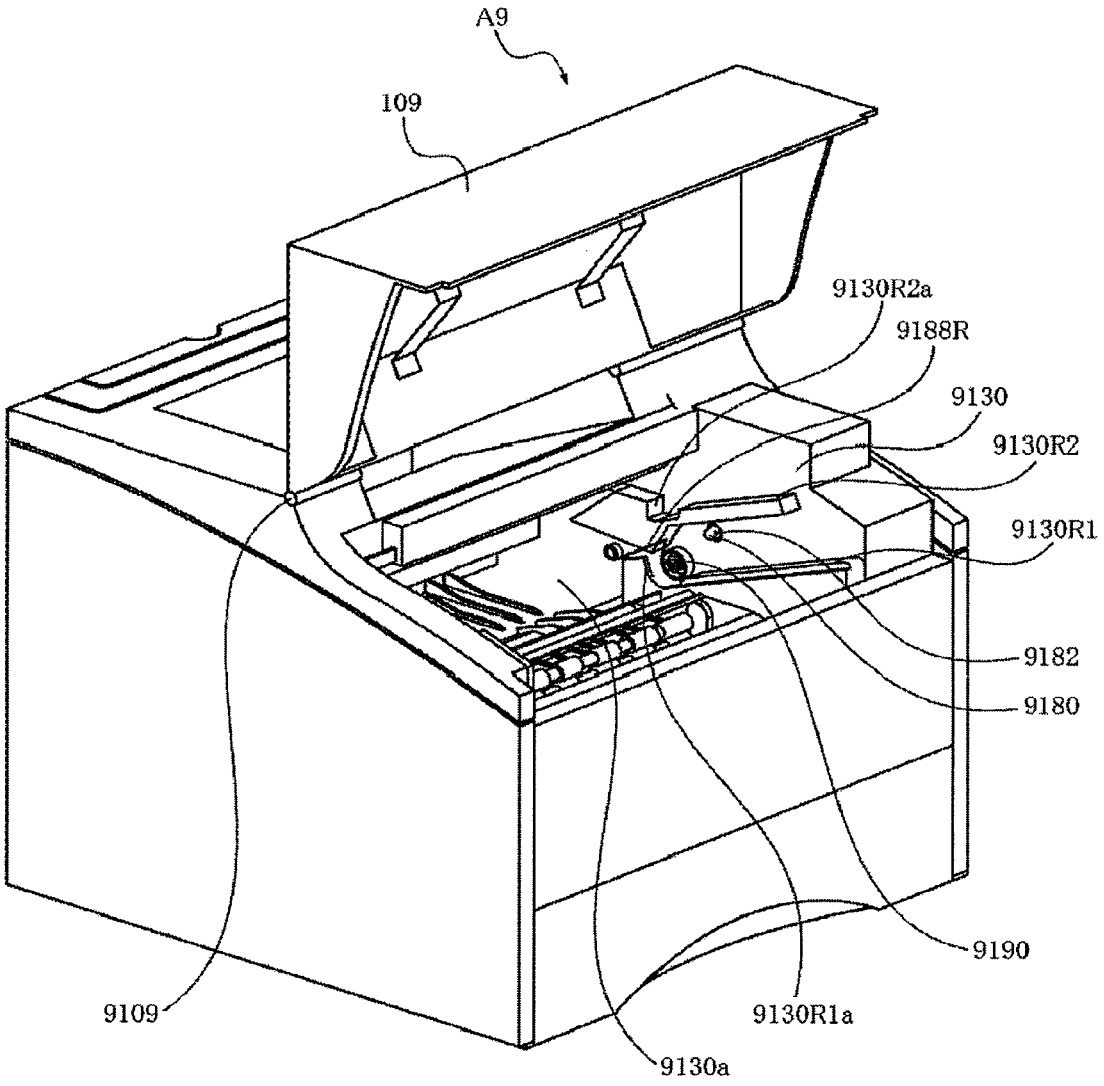
FIG. 61 is a perspective view of the cartridge set portion of the main assembly according to an embodiment of the present invention.
Figure 62:
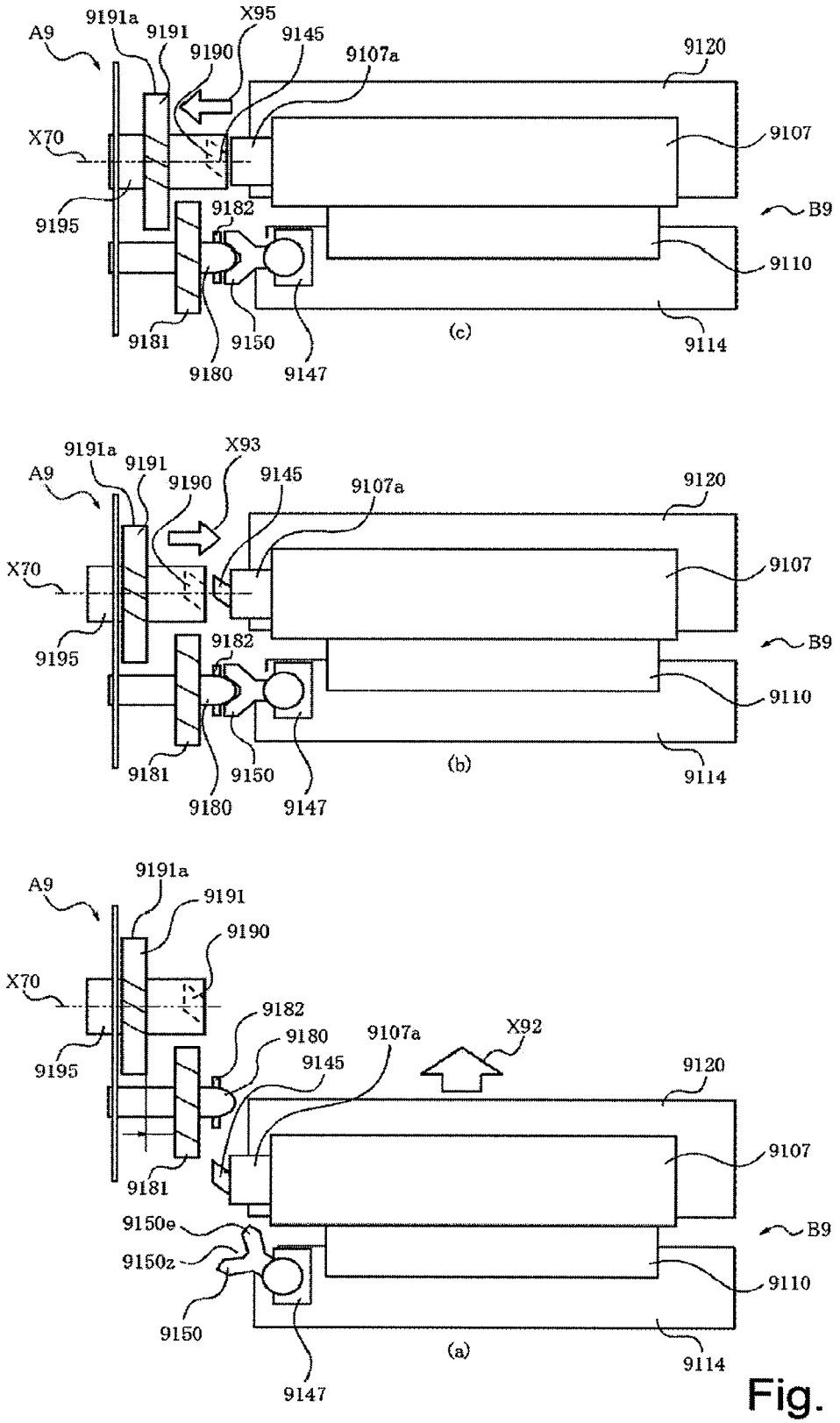
FIG. 62 is a schematic illustration, as seen from the upper part of the device, of the process in which the process cartridge according to an embodiment of the present invention is mounted to the main assembly.

FIG. 58 is a principal sectional view of a process cartridge B9 of this embodiment and FIG. 59 is a perspective view of the process cartridge B9. FIG. 60 is a principal sectional view of the apparatus main assembly and FIG. 61 is a perspective view showing a mounting guide (drive side) of the apparatus main assembly and a driving connection portion. FIGS. 62(*a*) to 62(*c*) are schematic views for illustrating a process of mounting the process cartridge to the apparatus main assembly as seen from above the apparatus. The process cartridge is an example of the above-described cartridge.

In this embodiment, the present invention is applied to the process cartridge which is prepared by integrally supporting the photosensitive drum and the developing roller as a unit and is detachably mountable to the apparatus main assembly. That is, this embodiment relates to the process cartridge mountable to and demountable from the apparatus main assembly A provided with the driving shaft by moving the process cartridge in a direction substantially perpendicular to an axial direction of the driving shaft. According to this embodiment, the process cartridge (hereinafter simply referred to as the cartridge) includes two portions for receiving the rotational force from the apparatus main assembly.

That is, the cartridge to which the present invention is applied separately receives the rotational force for rotating the photosensitive drum from the apparatus main assembly and the rotational force for rotating the developing roller from the apparatus main assembly.

Also to such a structure, the present invention is applicable, and it is possible to achieve effects described later. In contact with a photosensitive drum 9107, a charging roller 9108 as the charging means (process means).

Further, the cartridge B9 includes the developing roller 9110 as the developing means (process means). The developing roller 9110 feeds the developer t to a developing area of the photosensitive drum 9107. The developing roller 9110 develops the electrostatic latent image formed on the photosensitive drum 9107 by using the developer t. The developing roller 9110 contains a magnet roller (fixed magnet) 9111.

In contact with the developing roller 9110, a developing blade 9112 is provided. The developing blade 9112 determines an amount of the developer t to be deposited on the peripheral surface of the developing roller 9110.

The developer accommodated in a developer accommodating container 9114 is fed by rotation of stirring members 9115 and 9116. Then, a developer layer to which electric charges are imparted by the developing blade 9112 is formed on the surface of the developing roller 9110. Then, the developer t is transferred onto the photosensitive drum 9107 depending on the latent image. As a result, the latent image is developed.

In contact with the photosensitive drum 9107, an elastic cleaning blade 9117*a* as the cleaning means (process means) is disposed. The blade 9117*a* removes the developer t remaining on the photosensitive drum 9107 after the developer image is transferred onto a recording material 9102. The developer t removed from the surface of the photosensitive drum 9107 by the blade 9117*a* is collected in a removed developer container 9117*b*.

The cartridge B9 includes a first frame unit 9119 and a second frame unit 9120 which are swingably (rotatably) connected with each other.

The first frame unit (developing device) 9119 is constituted by a first frame 9113 as a part of a cartridge frame. The unit 9119 includes the developing roller 9110, the developing blade 9112, a developing chamber 9113*a*, the developer accommodating container (developer accommodating portion) 9114, and the stirring members 9115 and 9116.

The second frame unit 9120 is constituted by a second frame 9118 as a part of the cartridge frame. The unit 9120 includes the photosensitive drum 9107, the cleaning blade 9117*a*, the removed developer container (removed developer accommodating portion) 9117*b*, and the charging roller 9108.

The first frame unit (developing device) 9119 and the second frame unit 9120 are rotatably connected by a pin P. By an elastic member (not shown) provided between the units 9119 and 9120, the developing roller 9110 is pressed against the photosensitive drum 9107. That is, the first frame unit (developing device) 9119 determines the position of the second frame unit 9120.

The user grips a handle T and mounts the cartridge B9 to a cartridge mounting portion 9130*a* provided to an apparatus main assembly A9. At this time, as described later, in interrelation with the mounting operation of the cartridge B9, the driving shaft 9180 provided to the apparatus main assembly A9 and a cartridge-side developing roller coupling (rotational force transmitting part) 9150 of the cartridge B9 are connected with each other. The developing roller 9110 and the like are rotated by receiving the rotational force from the apparatus main assembly A9.

After the completion of the cartridge B9 to the apparatus main assembly A9, the door 109 is closed. In interrelation with the closing operation of the door 109, a main assembly-side drum coupling 9190 and a cartridge-side drum coupling (rotational force transmitting part) 9145 are connected with each other. Thus, the photosensitive drum 9107 is rotated by receiving the rotational force from the apparatus main assembly A9. The main assembly-side drum coupling 9190 is a non-circular twisted hole having a plurality of corners in cross section. This coupling 9190 is provided at a central portion of a rotatable drive member 9191. At a peripheral surface of the rotatable drive member 9191, a gear (helical gear) 9191*a* is provided. To the gear 9191*a*, the rotational force from the motor 196 is transmitted.

Further, the cartridge-side drum coupling 9145 is a non-circular twisted projection having a plurality of corners in cross section. The coupling 9145 engages with the coupling 9190 to receive the rotational force from the motor 186. That is, the rotatable member 9191 is rotated in a state in which the hole of the coupling 9145 and the projection of the coupling 9190 are engaged with each other. As a result, in a state in which the projection receives a drawing force into the hole, the rotational force of the rotatable drive member 9191 is transmitted to the photosensitive drum 9107 through the projection.

The shape of the projection may appropriately be changed so long as the projection can receive the rotational force from the hole in the engaged state with the hole. In this embodiment, the hole shape is a substantially equilateral triangle and the projection shape is a substantially twisted equilateral triangular column. As a result, according to the present invention, it is possible to transmit the rotational force from the hole to the projection in a state in which the axis of the hole and the axis of the projection are aligned with each other (center alignment) and in a state in which the projection receives the drawing force into the hole. Therefore, the photosensitive drum 9107 can be rotated accurately and smoothly. Further, the hole is provided co-axially with the axis of a shaft portion 9107*a* of the photosensitive drum 9107. The shaft portion 9107*a* is provided at one end portion of the photosensitive drum 9107 and is rotatably supported by the unit 9120.

The main assembly-side drum coupling 9190 (the rotatable drive member 9191) is, as described later, moved by a moving member (a retractable mechanism) 9195 moved in interrelation with the closing operation of the door 109. That is, the coupling 9190 is moved by the moving member 9195 in a direction along a rotational axis X70 of the coupling 9190 and in a direction X93 in which the coupling 9145 is provided. As a result, the coupling 9190 and the coupling 9145 are engaged with each other. Then, the rotational force of the coupling 9190 is transmitted to the coupling 9145 (FIG. 62(*b*)).

The coupling 9190 (the rotatable drive member 9191) is moved by the moving member 9195, moved in interrelation with the opening operation of the door 109, in the direction along the rotational axis X70 and in a direction X95 in which the coupling 9190 is moved apart from the coupling 9145. As a result, the coupling 9190 and the coupling 9145 are separated from each other (FIG. 62(*c*)).

That is, the coupling 9190 is moved toward and away from the coupling 9145 in the direction along the rotational axis X70 by the moving member (retractable member) 9195 as described later (in the directions indicated by the arrows X93 and X95 in FIGS. 62(*b*) and 62(*c*)). Incidentally, details of the structure of the moving member 9195 will be omitted from explanation since a known structure may appropriately be used as the structure of the moving member 9195. For example, the structures of the coupling 9145, the coupling 9190, and the moving member 9195 are described in Japanese Patent No. 2875203.

As shown in FIG. 61, a mounting means 9130 in this embodiment includes main assembly guides 9130R1 and 9130R2 provided in the apparatus main assembly A9.

These guides are oppositely provided in the cartridge mounting portion 9130*a* (cartridge mounting space) provided in the apparatus main assembly A9. FIG. 61 shows the drive-side surface and a non-drive side has a symmetrical shape with respect to the drive side, thus being omitted from explanation. The guides 9130R1 and 9130R2 are provided along the mounting direction of the cartridge B9.

When the cartridge B9 is mounted to the apparatus main assembly A9, a cartridge guide described later is inserted while being guided by the guides 9130R1 and 9130R2. The mounting of the cartridge B9 to the apparatus main assembly A9 is performed in a state in which the cartridge door 109 openable about a shaft 9109*a* with respect to the apparatus main assembly A9. By closing the door 109, the mounting of the cartridge B9 to the apparatus main assembly A9 is completed. Incidentally, also when the cartridge B9 is demounted from the apparatus main assembly A9, the demounting operation is performed in the state in which the door 109 is opened. These operations are performed by the user.

In this embodiment, as shown in FIG. 59, an outer end peripheral portion 9159*a* of the shaft supporting member 9195 also functions as a cartridge guide 9140R1. That is, the shaft supporting member 9159 is outwardly projected, so that its outer peripheral surface has a guiding function.

At a longitudinal end (drive side) of the second frame unit 9120, cartridge guides 9140R2 are provided above the cartridge guide 9140R1.

When the cartridge B9 is mounted to the apparatus main assembly A9 and when the cartridge B9 is demounted from the apparatus main assembly A9, the guide 9140R1 is guided by the guide 9130R1 and the guides 9140R2 are guided by the guide 9130R2.

The guide structure on the other end-side of the apparatus main assembly and the guide structure on the other end-side of the cartridge are the same as those described above, thus being omitted from the description. In the above-described manner, the cartridge B9 is moved in the direction substantially perpendicular to the direction of the axis L3 of the driving shaft 9180 to be mounted to and be demounted from the apparatus main assembly A9.

When such a cartridge B9 is mounted to the apparatus main assembly A9, similarly as in Embodiments described above, the coupling 9150 is engaged with the driving shaft 9180 of the apparatus main assembly A9. Then, by rotating the motor 186, the driving shaft 9180 is rotated. By the rotational force transmitted to the developing roller 9110 through the coupling 9150, the developing roller 9110 is rotated. Incidentally, with respect to the drive transmitting path in the cartridge, as described in Embodiment 1, the coupling may be disposed co-axially with the developing roller 9110 or disposed at the position deviated from the axis of the developing roller 9110. The engagement and disengagement operations between the coupling 9150 and the driving shaft 9180 are the same as those described above, thus being omitted from the description.

As the structure of the cartridge-side developing roller coupling 9150, those of the above-described couplings may appropriately be employed.

Here, with reference to FIGS. 62(*a*) to 62(*c*), the process in which the above-described process cartridge B9 is mounted to the mounting portion 9130*a* to establish the drive connection between the apparatus main assembly A9 and the cartridge B9 will be described.

In FIG. 62(*a*), the cartridge B9 is being mounted to the apparatus main assembly A9. At this time, the axis L2 of the coupling 9150 is, as described above, inclined toward the downstream side with respect to the mounting direction (X92). Further, the apparatus main assembly-side drum coupling 9190 to be engaged with the drum coupling 9145 is retracted so as not to obstruct the mounting path of the cartridge B9. An amount of retraction is indicated by X91 in FIG. 62(*a*). In this figure, the driving shaft 9180 seems to be located in the mounting (demounting) path of the cartridge B9. However, as is apparent from FIG. 61, the drum coupling 9145 and the developing roller coupling 9150 are deviated from each other with respect to the moving path in the cross-sectional direction (the vertical direction). Therefore, the driving shaft 9180 does not obstruct the mounting and demounting of the cartridge B9.

Then, from this state, when the user inserts the cartridge B9 into the apparatus main assembly A9, the cartridge B9 is mounted to the mounting portion 9130*a*. Similarly as in the aforementioned description, the coupling 9150 is engaged with the driving shaft 9180 by this operation. Thus, the coupling 9150 is placed in the state in which it can transmit the rotational force to the developing roller 9110.

Then, by the moving member 9195 interrelated with the closing operation of the door 109 (FIG. 61) by the user, the drum coupling 9190 on the apparatus main assembly A9 side is moved in the direction X93 (FIG. 62(*b*)). Then, the coupling 9190 engages with the drum coupling 9145 of the cartridge B9 to be placed in a rotational force transmittable state. Thereafter, by the image forming operation, the rotational force from the motor 186 is transmitted to the drum gear 9190 fixed to the drum coupling 9190. Further, the rotational force is transmitted to a developing gear 9181 fixed to the driving shaft 9180 for receiving the rotational force from the coupling 9150. As a result, the rotational force from the motor 196 is transmitted to the photosensitive drum 9107 through the drum coupling 9190 and the drum gear 9190. Further, the rotational force from the motor 196 is transmitted to the developing roller 9110 through the coupling 9150, the rotational force-receiving driving shaft 9180, and the developing gear 9181. Incidentally, details of the transmission path from the coupling 9150 in the developing unit 9114 to the developing roller 9110 through the supporting member 9147 are same as those described above, thus being omitted from explanation. When the cartridge B9 is demounted from the apparatus main assembly A9, the user opens the door 109 (FIG. 61). By the moving member 9195 interrelated with the opening operation of the door 109, the drum coupling 9190 on the apparatus main assembly A9 side is moved in the direction X95 opposite from the direction X93 (FIG. 62(*c*)). As a result, the drum coupling 9190 is moved apart from the drum coupling 9145. Thus, the cartridge B9 can be demounted from the apparatus main assembly A9.

As descried above, the apparatus main assembly A9 in Embodiment 8 includes, in addition to the above-described structure of the apparatus main assembly A, the moving member (retractable mechanism) 9195 for moving the main assembly-side drum coupling 9190 and the coupling 9145 in their axis direction (the rotational axis direction X70).

In Embodiment 8, the cartridge (process cartridge) B9 integrally includes the photosensitive drum 9107 and the developing roller 9110.

In Embodiment 8, when the cartridge B9 is demounted from the apparatus main assembly A9 in the direction substantially perpendicular to the axis L1 of the developing roller 9110, the cartridge-side developing roller coupling 9150 is moved as follows. That is, the coupling 9150 is moved from the rotational force transmission angular position to the disengagement angular position to be disengaged from the driving shaft 9180. Then, by the moving member 9185, the main assembly-side drum coupling 9190 is moved in its axis direction and also in the direction in which the coupling 9190 is moved apart from the cartridge-side drum coupling 9145. As a result, the cartridge-side drum coupling 9145 is disengaged from the main assembly-side drum coupling 9190.

According to Embodiment 8, with respect to the coupling structure for transmitting the rotational force from the apparatus main assembly A9 to the photosensitive drum 9107 and the coupling structure for transmitting the rotational force from the apparatus main assembly A9 to the developing roller 9110, the number of the moving members can be reduced as compared with those requiring the moving member for each.

Therefore, according to Embodiment 8, the apparatus main assembly can be downsized. Further, when the apparatus main assembly is designed, it is possible to allow increased design latitude.

Further, this embodiment can also be applied to the case of the contact developing system as described in Embodiment 6. In this case, this embodiment is applicable to not only the mounting and demounting of the cartridge but also the drive connection during the developing device separation.

Further, in this embodiment, with respect to the drive connection of the photosensitive drum, such a manner as in this embodiment is not employed but the couplings as in this embodiment may also be disposed.

As described above, according to this embodiment, by applying the present invention to at least the case where the developing roller is rotated (i.e., the rotational force is transmitted to the developing device), the number of the moving members (retractable mechanisms) can be reduced by at lease one. Therefore, according to this embodiment, it is possible to realize the downsizing of the apparatus main assembly and the increased design latitude.

Incidentally, in Embodiment 8, as the cartridge-side drum coupling for receiving the rotational force from the apparatus main assembly in order to rotate the photosensitive drum, the twisted projection is described as an example. However, the present invention is not limited thereto. The present invention is appropriately applicable to such a coupling structure that the main assembly-side drum coupling is movable (retractable) in the rotational direction of the cartridge-side drum coupling. That is, in the present invention, such a coupling structure that the main assembly-side drum coupling approaches the cartridge-side drum coupling to engage therewith in the above-described movement direction and is moved apart from the cartridge-side drum coupling in the above-described movement direction. To the embodiment to which the present invention is applied, e.g., a so-called pin-drive coupling structure is applicable.

According to Embodiment 8, in the structure in which the rotational forces for rotating the photosensitive drum and the developing roller are separately transmitted from the apparatus main assembly, the moving structure for moving (retracting) the coupling with respect to its rotational direction can be reduced in number. That is, as the moving structure, only the structure for transmitting the rotational force to the photosensitive drum can be used.

Therefore, according to Embodiment 8, it is possible to achieve an effect of simplifying the structure of the apparatus main assembly as compared with the case where the moving structure is required for both of the structure for transmitting the rotational force to the photosensitive drum and the structure for transmitting the rotational force to the developing roller.

(Embodiment 9)

Figure 63:
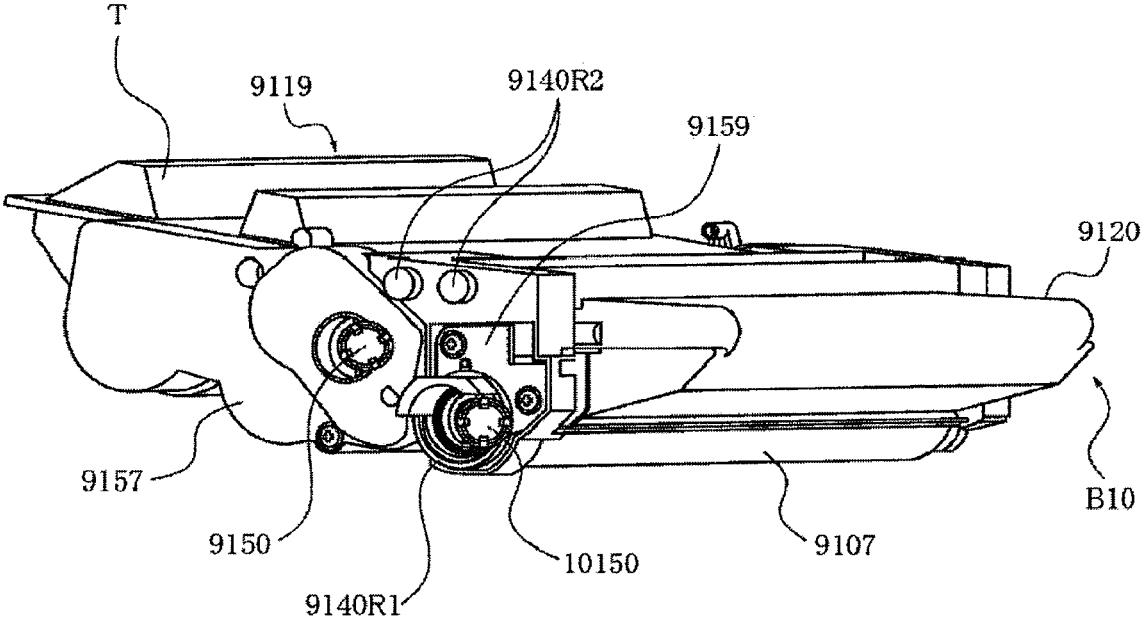
FIG. 63 is a perspective view of the process cartridge according to an embodiment of the present invention.

Embodiment 9 will be described with reference to FIG. 63.

In Embodiment 9, the present invention is applied to both of the coupling for receiving the rotational force, from the apparatus main assembly, for rotating the photosensitive drum and the coupling for receiving the rotational force, from the apparatus main assembly, for rotating the developing roller.

That is, a cartridge B10 to which the present invention is applied and the cartridge B9 described in Embodiment 8 are different in that the photosensitive drum 9107 also receives the rotational force from the apparatus main assembly by using the coupling structure similar to that in Embodiment 8.

According to Embodiment 9, without using the moving member (retractable mechanism) described in Embodiment 8, the process cartridge B10 can be moved in the direction substantially perpendicular to the direction of the axis L3 of the driving shaft 180 to be mounted to and demounted from the apparatus main assembly.

The cartridge B10 in Embodiment 9 and the cartridge B9 in Embodiment 8 are merely different in the cartridge-side drum coupling structure and the structure for transmitting the rotational force received by the coupling to the photosensitive drum and are the same in other structures.

Further, with respect to the apparatus main assembly-side structures, both cartridges are only different in the main assembly side drum coupling structure.

The apparatus main assembly to which Embodiment 9 is applied includes the driving shaft described in the above-described embodiments in place of the main assembly-side drum coupling structure in Embodiment 8, thus being omitted from the description. To the apparatus main assembly in this embodiment (Embodiment 9), a driving shaft (first driving shaft) 180 and a driving shaft (second driving shaft) (not shown) having the same structure as the driving shaft 180 are provided. However, similarly as in Embodiment 8, the moving paths of a cartridge-side drum coupling 10150 and the cartridge-side developing roller coupling 9150 are deviated from each other in the cross-sectional direction (the vertical direction). Therefore, the first driving shaft 180 and the second driving shaft (not shown) do not obstruct the mounting and demounting of the cartridge B10.

Similarly as in the case of the cartridge-side developing roller coupling 9150, the cartridge-side drum coupling 10150 of the cartridge B10 has the same structure as those in the above-described embodiments, thus being explained by making reference to the above-described coupling structures.

According to Embodiment 9, the cartridge B10 is moved in the direction substantially perpendicular to the direction of the axis L3 of the first driving shaft 180 and the second driving shaft (not shown) to be mounted to and demounted from the apparatus main assembly.

Further, in Embodiment 9, when the cartridge B10 is mounted to the cartridge mounting portion 130*a*, the first driving shaft 180 and the developing roller coupling 9150 are engaged with each other, so that the rotational force is transmitted from the driving shaft 180 to the coupling 9150. By the rotational force received by the coupling 9150, the developing roller 9110 is rotated.

Further, the second driving shaft and the drum coupling 10150 are engaged with each other, so that the rotational force is transmitted from the second driving shaft to the coupling 10150. By the rotational force received by the coupling 10150, the photosensitive drum 9107 is rotated.

To Embodiment 9, the structures described in the above-described embodiments are appropriately applicable.

According to this embodiment, without using the moving member (retractable mechanism) described in Embodiment 8, the process cartridge B10 can be mounted to and demounted from the apparatus main assembly by being moved in the direction substantially perpendicular to the direction of the axis of the driving shaft.

As a result, the structure of the apparatus main assembly can be simplified.

In the above-described embodiments, the apparatus main assembly includes the driving shafts (180, 1180, 9180) provided with the rotational force transmitting pin (rotational force imparting portion) 182. Further, the cartridges (B, B2, B6, B8, B9, B10) are moved in the direction substantially perpendicular to the direction of the axis L3 of the driving shafts, thus being mounted to and demounted from the apparatus main assemblies (A, A2, A9). The above-described respective cartridges include the developing rollers (110, 6110, 8110, 9110) and the couplings (150, 1150, 4150, 6150, 7150, 8150, 9150, 10150, 12150, 14150).

i) The developing roller (110, 6110, 8110, 9110) is rotatable about the axis L1 thereof, and develops the electrostatic latent image formed on the photosensitive drum (107, 9107).

ii) The coupling is engaged with the rotational force transmitting pin (the rotational force applying portion) (182, 1182, 9182) to receive the rotational force for rotating the developing roller from the pin. The coupling may be one of the couplings 150, 1150, 4150, 6150, 7150, 8150, 9150, 10150, 12150, 14150. The coupling can take the rotational force transmitting angular position for transmitting the rotational force for rotating the developing roller to the developing roller. The coupling can take the pre-engagement angular position which is a position inclined, in the direction away from the axis L1 of the developing roller, from the rotational force transmitting angular position and the disengaging angular position which is a position inclined from the rotational force transmitting angular position. In mounting the cartridge (B, b-2, b6, b8, b9, b10) to the main assembly in the direction substantially perpendicular to the axis L1 of the developing roller, the coupling moves to the rotational force transmitting angular position from the pre-engagement angular position. By this, the coupling opposes to the drive shaft. In dismounting the cartridge, in the direction substantially perpendicular to the axis L1 of the developing roller, from the main assembly the coupling moves to the disengaging angular position from the rotational force transmitting angular position. By this, the coupling disengages from the drive shaft.

In the state that the cartridge is set in the main assembly, a part of the coupling is positioned behind the drive shaft as seen in the opposite direction to the removing direction X6 (FIG. 19(*d*), for example). A part of the coupling is one of the free end positions 150A1, 1150A1, 4150A1, 12150A1, 14150 A3. The removing direction X6 is the direction for dismounting the cartridge from the main assembly. In dismounting the cartridge B from the main assembly A in response to moving the cartridge in the direction substantially perpendicular to the axis L1 of the developing roller 110, the coupling makes the following motion. The coupling is moved (inclined) to the disengaging angular position from the rotational force transmitting angular position so that the part of the coupling circumvents the drive shaft.

In mounting the cartridge to the main assembly the coupling makes the following motion. The coupling is moved (inclined) to the rotational force transmitting angular position from the pre-engagement angular position so that the part of the coupling at the downstream side with respect to the mounting direction X4 circumvents the drive shaft. The mounting direction X4 is the direction of for mounting the cartridge to the main assembly.

In the state that the cartridge is mounted to the main assembly the part or portion of the coupling is behind the drive shaft as seen in the opposite direction to the removing direction X6 for dismounting the cartridge from the main assembly. In dismounting the cartridge from the main assembly the coupling makes the following motion. In response to moving the cartridge in the direction substantially perpendicular to the axis L1 of the developing roller, the coupling is moved (inclined) to the disengaging angular position from the rotational force transmitting angular position so that the portion of the coupling circumvents the drive shaft.

In the embodiment described above, the coupling has the recesses (150*z*, 1150*z*, 1350*z*, 4150*z*, 6150*z*, 7150*z*, 9150*z*, 12150*z*, 14150*z*) co-axial with the rotation axis L2 of the coupling. In the state that the coupling is in the rotational force transmitting angular position, the recess covers the free end of the drive shaft 180. The rotational force reception surface (rotational force receiving portion) engages in the rotational direction of the coupling with the rotational force transmitting pin (rotational force applying portion) (182, 1182, 9182) which projects in the direction perpendicular to the axis L3 of the drive shaft in the free end portion of the drive shaft. The rotational force reception surface is one of the rotational force receiving surfaces 150*e*, 1150*e*, 1350*e*, 4150*e*, 6150*e*, 7150*e*, 9150*e*, 12150*e*, 14150*e*. By this, the coupling receives the rotational force from the drive shaft to rotate. In dismounting the cartridge from the main assembly the coupling makes the following motion. In response to moving the cartridge in the direction substantially perpendicular to the axis L1 of the developing roller, the coupling is pivoted (moved) to the disengaging angular position from the rotational force transmitting angular position so that the portion of the recess circumvents the drive shaft. By this, the coupling can disengage from the drive shaft. The portion is one of the free end positions 150A1, 1150A1, 4150A1, 12150A1, 14150 A3.

As has been described hereinbefore, the coupling has the recess co-axially with the rotation axis L2 thereof. In the state that the coupling is in the rotational force transmitting angular position, the recess covers the free end of the drive shaft. The rotational force reception surface (rotational force receiving portion) engages in the rotational direction of the coupling with the rotational force transmitting pin of the free end portion of the drive shaft. By this, the coupling receives the rotational force from the drive shaft to rotate. In dismounting the cartridge from the main assembly the coupling makes the following motion. In response to moving the cartridge B in the direction substantially perpendicular to the axis L1 of the developing roller, the coupling is pivoted (moved) to the disengaging angular position from the rotational force transmitting angular position so that the portion of the recess circumvents the drive shaft. By this, the coupling can disengage from the drive shaft.

The rotational force receiving surfaces (rotational force receiving portions) are provided so that they are positioned, interposing the center S, on the phantom circle C1 which has the center S on the rotation axis L2 of the coupling (FIG. 6(*d*), for example). In this embodiment, the four rotational force reception surfaces are provided. By this, according to this embodiment, the coupling can uniformly receive the force from the main assembly. Accordingly, the coupling can be rotated smoothly.

In the state that the coupling is in the rotational force transmitting angular position, the axis L2 of the coupling is co-axial with the axis L1 of the developing roller substantially. In the state that the coupling is in the disengaging angular position, the coupling inclines relative to the axis L1 so that the upstream side thereof can pass by the free end of the drive shaft in the removing direction X6. The upstream side is one of the free end position 150A1, 1150A1, 4150A1, 12150A1, 14150 A3.

The cartridge described above is a developing cartridge not containing the photosensitive drum. Or, the cartridge is the process cartridge including the photosensitive drum as a unit. By applying to these cartridges the present invention the effects as described above are provided.

(Other Embodiments)

In the embodiments described above, the cartridge is mounted and demounted downwardly or angularly upwardly relative to the drive shaft of the main assembly. However, the present invention is not limited to the structure thereof. The present invention can suitably be applied to the cartridge which can be mounted and demounted in the direction perpendicular to the axis of the drive shaft.

In the foregoing embodiments, the mounting path is straight relative to the main assembly, but the present invention is not limited to such a structure. The present invention can suitably be applied also to the case where the mounting path includes a path provided as a combination of the straight lines or curvilinear path.

The developing cartridge of the embodiments forms a monochromatic image. However, the present invention can suitably be applied also to the cartridge having a plurality of developing means to form a color image (two-color image, three-color image, or full-color image).

The process cartridge of the embodiments forms a monochromatic image. However, the present invention can suitably be applied also to the cartridge may contain a plurality of photosensitive drums, and developing means and charging means, respectively to form a color images such as two-color images, three-color images, or full-color images.

The developing cartridge includes at least the developing roller (developing means).

The process cartridge contains, as a unit, the electrophotographic photosensitive member and the process means which is actable on the electrophotographic photosensitive member and is detachably mountable to the main assembly of the electrophotographic image forming apparatus. For example, it contains at least the electrophotographic photosensitive member and the developing means as the process means.

This cartridge (developing cartridge and process cartridge) is detachably mountable to the main assembly by the user. In view of this, the maintenance of the main assembly can be carried out in effect by the user.

According to the foregoing embodiments, the coupling can be mounted and demounted, in the direction substantially perpendicular to the axis of the drive shaft, relative to the main assembly which is not provided with the mechanism for moving the main assembly side coupling member for transmitting the rotational force in axial direction thereof. The developing roller can be rotated smoothly.

According to the embodiments described above, the cartridge can be dismounted, in the direction substantially perpendicular to the axis of the drive shaft, from the main assembly of the electrophotographic image forming apparatus provided with the drive shaft.

According to the embodiments described above, the cartridge can be mounted, in the direction substantially perpendicular to the axis of the drive shaft, to the main assembly of the electrophotographic image forming apparatus provided with the drive shaft.

According to the embodiments described above, the developing cartridge can be mounted and dismounted, in the direction substantially perpendicular to the axis of the drive shaft, relative to the main assembly of the electrophotographic image forming apparatus provided with the drive shaft.

According to the embodiments of coupling described above, the developing cartridge is moved in the direction substantially perpendicular to the axis of the drive shaft to mount and demount the developing cartridge relative to the main assembly, even if the drive rotor (driving gear) provided in the main assembly does not move in the axial direction thereof.

According to the embodiments described above, the developing roller can be rotated smoothly, as compared with the case in which the drive connecting portion between the main assembly and the cartridge employs the gear-gear engagement.

According to the embodiments described above, both of the dismounting of the cartridge in the direction substantially perpendicular to the axis of the drive shaft provided in the main assembly and the smooth rotation of the developing roller, can be accomplished.

According to the embodiments described above, both of the mounting of the cartridge in the direction substantially perpendicular to the axis of the drive shaft provided in the main assembly and the smooth rotation of the developing roller, can be accomplished.

According to the embodiments described above, both of the mounting and dismounting of the cartridge in the direction substantially perpendicular to the axis of the drive shaft provided in the main assembly and the smooth rotation of the developing roller, can be accomplished.

According to the embodiments described above, in the developing cartridge (or developing device of the process cartridge) positioned relative to the photosensitive drum, the drive can be assuredly applied to the developing roller, and the smooth rotation can be accomplished.

INDUSTRIAL APPLICABILITY

As has been described hereinbefore, in the present invention, the axis of the coupling member can take the different angular positions relative to the axis of the developing roller. With this structure in the present invention, the coupling member can be brought into engagement with the drive shaft in the direction substantially perpendicular to the axis of the drive shaft provided in the main assembly. Also, the coupling member can be brought into disengagement from the drive shaft in the direction substantially perpendicular to the axis of the drive shaft. The present invention can be applied to the developing cartridge, the electrophotographic image forming apparatus usable with the detachably mountable developing cartridge, the process cartridge, and the electrophotographic image forming apparatus usable with the detachably mountable process cartridge.

The present invention can be applied to a so-called contact type developing system wherein in the state in which the electrophotographic photosensitive member and the developing roller contact to each other, the electrostatic latent image formed on the electrophotographic photosensitive member is developed.

The present invention can be applied to a so-called contact type developing system wherein in the state in which the electrophotographic photosensitive member and the developing roller are spaced from each other, the electrostatic latent image formed on the electrophotographic photosensitive member is developed.

The developing roller can be rotated smoothly.

According to the embodiments of the present invention, the rotational force for rotating the photosensitive drum and the rotational force for rotating the developing roller can be received individually from the main assembly. According to the embodiments of the present invention, the structure for receiving the rotational force for rotating the photosensitive drum can employ the structure for making the coupling move in the axial direction thereof.

While the invention has been described with reference to the structures disclosed herein, it is not confined to the details set forth and this application is intended to cover such modifications or changes as may come within the purpose of the improvements or the scope of the following claims.

The invention claimed is:

1. A process cartridge comprising:

a casing;

a developing roller having a roller axis, the developing roller being rotatably supported in the casing to permit rotation about the roller axis;

a photosensitive drum having a drum axis, the photosensitive drum being rotatably supported in the casing to permit rotation about the drum axis;

a first coupling member having an axis, the first coupling member including (i) a first end portion operatively connected to the developing roller, (ii) a second end portion, and (iii) a connecting portion connecting the first end portion and the second end portion; and a second coupling member having an axis, the second coupling member including a projection, wherein the first coupling member is movable between a first position in which the axis of the first coupling member is substantially parallel to the roller axis, and a second position in which the axis of the first coupling member is inclined with respect to the roller axis, and wherein a maximum angle of inclination of the axis of the first coupling member with respect to the roller axis is about 20 degrees to about 60 degrees.

2. The process cartridge according claim 1, wherein a maximum angle of inclination of the axis of the first coupling member is about 35 degrees.

3. The process cartridge according to claim 1, wherein a maximum distance from the axis of the first coupling member to an outermost surface of at least part of the connecting portion of the first coupling member along a line perpendicular to the axis of the first coupling member is less than a maximum distance from the axis of the first coupling member to an outermost surface of at least part of the second end portion along a line perpendicular to the axis of the first coupling member.

4. The process cartridge according to claim 1, wherein the projection has a plurality of corners in cross section.

5. The process cartridge according to claim 1, wherein the connecting portion of the first coupling member comprises a shaft along the axis of the first coupling member.

6. The process cartridge according to claim 1, wherein, for at least part of the second end portion of the first coupling member, a maximum distance from the axis of the first coupling member to an outermost surface along a line perpendicular to the axis of the first coupling member increases as the distance along the axis of the first coupling member from the connecting portion of the first coupling member increases.

7. The process cartridge according to claim 1, wherein the second end portion of the first coupling member comprises a projection, and the second end portion of the first coupling member comprises an opening to a surface forming a recess, with the surface facing away from the connecting portion of the first coupling member.

8. The process cartridge according to claim 1, wherein the axis of the first coupling member at the first position of the first coupling member is offset from and substantially parallel to the roller axis, and wherein the axis of the second coupling member is substantially coaxial with the drum axis.

9. The process cartridge according to claim 1, further comprising a rotational force receiving gear for receiving a rotational force from the first coupling member, wherein the first coupling member is pivotably connected to the rotational force receiving gear.

10. The process cartridge according to claim 9, wherein a rotational axis of the rotational force receiving gear is offset from and substantially parallel to the roller axis.

11. The process cartridge according to claim 10, further comprising a developing roller gear that is provided at a longitudinal end of the developing roller, wherein the rotational force is transmitted from the rotational force receiving gear to the developing roller through the developing roller gear.

12. The process cartridge according to claim 11, wherein the rotational force receiving gear meshes with the developing roller gear.

13. The process cartridge according to claim 1, further comprising a first rotational force receiving member for receiving a rotational force from the first coupling member, wherein the first coupling member is pivotably connected to the first rotational force receiving member.

14. The process cartridge according to claim 13, wherein a rotational axis of the first rotational force receiving member is offset from and substantially parallel to the roller axis, and wherein the axis of the second coupling member is substantially coaxial with the drum axis.

15. The process cartridge according to claim 14, further comprising a second rotational force receiving member that is provided at a longitudinal end of the developing roller, wherein the rotational force is transmitted from the first rotational force receiving member to the developing roller through the second rotational force receiving member, and wherein the second coupling member is provided at a longitudinal end of the photosensitive drum.

16. The process cartridge according to claim 1, wherein the casing includes a first frame rotatably supporting the developing roller and a second frame rotatably supporting the photosensitive drum.

17. The process cartridge according to claim 16, wherein the second frame includes a projection positioned adjacent to the second coupling member.

18. The process cartridge according to claim 1, further comprising a spring for urging the first coupling member from the first position toward the second position.

19. A process cartridge comprising:

a casing;

toner contained within the casing;

a developing roller having a roller axis, the developing roller being rotatably supported in the casing to permit rotation about the roller axis;

a photosensitive drum having a drum axis, the photosensitive drum being rotatably supported in the casing to permit rotation about the drum axis;

a first coupling member having an axis, the first coupling member including (i) a first end portion operatively connected to the developing roller, (ii) a second end portion, and (iii) a connecting portion connecting the first end portion and the second end portion; and a second coupling member having an axis, the second coupling member including a projection, wherein the first coupling member is movable between a first position in which the axis of the first coupling member is substantially parallel to the roller axis, and a second position in which the axis of the first coupling member is inclined with respect to the roller axis, and wherein a maximum angle of inclination of the axis of the first coupling member with respect to the roller axis is about 20 degrees to about 60 degrees.

20. The process cartridge according claim 19, wherein a maximum angle of inclination of the axis of the first coupling member is about 35 degrees.

21. The process cartridge according to claim 19, wherein a maximum distance from the axis of the first coupling member to an outermost surface of at least part of the connecting portion of the first coupling member along a line perpendicular to the axis of the first coupling member is less than a maximum distance from the axis of the first coupling member to an outermost surface of at least part of the second end portion along a line perpendicular to the axis of the first coupling member.

22. The process cartridge according to claim 19, wherein the projection has a plurality of corners in cross section.

23. The process cartridge according to claim 19, wherein the connecting portion of the first coupling member comprises a shaft along the axis of the first coupling member.

24. The process cartridge according to claim 19, wherein, for at least part of the second end portion of the first coupling member, a maximum distance from the axis of the first coupling member to an outermost surface along a line perpendicular to the axis of the first coupling member increases as the distance along the axis of the first coupling member from the connecting portion of the first coupling member increases.

25. The process cartridge according to claim 19, wherein the second end portion of the first coupling member comprises a projection, and the second end portion of the first coupling member comprises an opening to a surface forming a recess, with the surface facing away from the connecting portion of the first coupling member.

26. The process cartridge according to claim 19, wherein the axis of the first coupling member at the first position is offset from and substantially parallel to the roller axis, and wherein the axis of the second coupling member is substantially coaxial with the drum axis.

27. The process cartridge according to claim 19, further comprising a rotational force receiving gear for receiving a rotational force from the first coupling member, wherein the first coupling member is pivotably connected to the rotational force receiving gear.

28. The process cartridge according to claim 27, wherein a rotational axis of the rotational force receiving gear is offset from and substantially parallel to the roller axis.

29. The process cartridge according to claim 28, further comprising a developing roller gear that is provided at a longitudinal end of the developing roller, wherein the rotational force is transmitted from the rotational force receiving gear to the developing roller through the developing roller gear.

30. The process cartridge according to claim 29, wherein the rotational force receiving gear meshes with the developing roller gear.

31. The process cartridge according to claim 19, further comprising a first rotational force receiving member for receiving a rotational force from the first coupling member, wherein the first coupling member is pivotably connected to the first rotational force receiving member.

32. The process cartridge according to claim 31, wherein a rotational axis of the first rotational force receiving member is offset from and substantially parallel to the roller axis, and wherein the axis of the second coupling member is substantially coaxial with the drum axis.

33. The process cartridge according to claim 32, further comprising a second rotational force receiving member that is provided at a longitudinal end of the developing roller, wherein the rotational force is transmitted from the first rotational force receiving member to the developing roller through the second rotational force receiving member, and wherein the second coupling member is provided at a longitudinal end of the photosensitive drum.

34. The process cartridge according to claim 19, wherein the casing includes a first frame rotatably supporting the developing roller and a second frame rotatably supporting the photosensitive drum.

35. The process cartridge according to claim 34, wherein the second frame includes a projection positioned adjacent to the second coupling member.

36. The process cartridge according to claim 19, further comprising a spring for urging the first coupling member from the first position toward the second position.

37. A process cartridge comprising:

a casing;

a developing roller having a roller axis, the developing roller being rotatably supported in the casing to permit rotation about the roller axis;

a photosensitive drum having a drum axis, the photosensitive drum being rotatably supported in the casing to permit rotation about the drum axis;

a first coupling member having an axis, the first coupling member being operatively connected to the developing roller, and the first coupling member being movable between (i) a first position in which the axis of the first coupling member is substantially parallel to the roller axis and (ii) a second position in which the axis of the first coupling member is inclined with respect to the roller axis; and a second coupling member having an axis, the second coupling member being operatively connected to the photosensitive drum, and the second coupling member including a projection having a plurality of corners in cross section.

38. The process cartridge according to claim 37, wherein a maximum angle of inclination of the axis of the first coupling member with respect to the roller axis is about 20 degrees to about 60 degrees.

39. The process cartridge according claim 38, wherein a maximum angle of inclination of the axis of the first coupling member is about 35 degrees.

40. The process cartridge according to claim 37, wherein the first coupling member includes (i) a first end portion operatively coupled to the developing roller, (ii) a second end portion opposite to the first end portion, and (iii) a connecting portion connecting the first end portion and the second end portion, and wherein a maximum distance from the axis of the first coupling member to an outermost surface of at least part of the connecting portion along a line perpendicular to the axis of the first coupling member is less than a maximum distance from the axis of the first coupling member to an outermost surface of at least part of the second end portion along a line perpendicular to the axis of the first coupling member.

41. The process cartridge according to claim 40, wherein the connecting portion comprises a shaft along the axis of the first coupling member.

42. The process cartridge according to claim 40, wherein, for at least part of the second end portion, a maximum distance from the axis of the first coupling member to an outermost surface along a line perpendicular to the axis of the coupling member increases as the distance along the axis of the coupling member from the connecting portion increases.

43. The process cartridge according to claim 40, wherein the second end portion comprises the projection, and the second end portion comprises an opening to a recess, with a surface of the recess facing away from the connecting portion.

44. The process cartridge according to claim 37, wherein the axis of the first coupling member at the first position is offset from and substantially parallel to the roller axis, and wherein the axis of the second coupling member is substantially coaxial with the drum axis.

45. The process cartridge according to claim 37, further comprising a rotational force receiving gear for receiving a rotational force from the first coupling member, wherein the first coupling member is pivotably connected to the rotational force receiving gear.

46. The process cartridge according to claim 45, wherein a rotational axis of the rotational force receiving gear is offset from and substantially parallel to the roller axis.

47. The process cartridge according to claim 46, further comprising a developing roller gear that is provided at a longitudinal end of the developing roller, wherein the rotational force is transmitted from the rotational force receiving gear to the developing roller through the developing roller gear.

48. The process cartridge according to claim 47, wherein the rotational force receiving gear meshes with the developing roller gear.

49. The process cartridge according to claim 37, further comprising a first rotational force receiving member for receiving a rotational force from the first coupling member, wherein the first coupling member is pivotably connected to the first rotational force receiving member.

50. The process cartridge according to claim 49, wherein a rotational axis of the first rotational force receiving member is offset from and substantially parallel to the roller axis, and wherein a rotational axis of the second coupling member is substantially coaxial with the drum axis.

51. The process cartridge according to claim 50, further comprising a second rotational force receiving member that is provided at a longitudinal end of the developing roller, wherein the rotational force is transmitted from the first rotational force receiving member to the developing roller through the second rotational force receiving member, and wherein the second coupling member is provided at a longitudinal end of the photosensitive drum.

52. The process cartridge according to claim 37, wherein the casing includes a first frame rotatably supporting the developing roller and a second frame rotatably supporting the photosensitive drum.

53. The process cartridge according to claim 52, wherein the second frame includes a projection positioned adjacent to the second coupling member.

54. The process cartridge according to claim 37, further comprising a spring for urging the first coupling member from the first position toward the second position.

55. A process cartridge comprising:

a casing;

toner contained within the casing;

a developing roller having a roller axis, the developing roller being rotatably supported in the casing to permit rotation about the roller axis;

a photosensitive drum having a drum axis, the photosensitive drum being rotatably supported in the casing to permit rotation about the drum axis;

a first coupling member having an axis, the first coupling member being operatively connected to the developing roller, and the first coupling member being movable between (i) a first position in which the axis of the first coupling member is substantially parallel to the roller axis and (ii) a second position in which the axis of the first coupling member is inclined with respect to the roller axis; and a second coupling member having an axis, the second coupling member being operatively connected to the photosensitive drum, and the second coupling member including a projection having a plurality of corners in cross section.

56. The process cartridge according to claim 55, wherein a maximum angle of inclination of the axis of the first coupling member with respect to the roller axis is about 20 degrees to about 60 degrees.

57. The process cartridge according claim 56, wherein a maximum angle of inclination of the axis of the first coupling member is about 35 degrees.

58. The process cartridge according to claim 55, wherein the first coupling member includes (i) a first end portion operatively coupled to the developing roller, (ii) a second end portion opposite to the first end portion, and (iii) a connecting portion connecting the first end portion and the second end portion, and wherein a maximum distance from the axis of the first coupling member to an outermost surface of at least part of the connecting portion along a line perpendicular to the axis of the first coupling member is less than a maximum distance from the axis of the first coupling member to an outermost surface of at least part of the second end portion along a line perpendicular to the axis of the first coupling member.

59. The process cartridge according to claim 58, wherein the connecting portion comprises a shaft along the axis of the first coupling member.

60. The process cartridge according to claim 58, wherein, for at least part of the second end portion, a maximum distance from the axis of the first coupling member to an outermost surface along a line perpendicular to the axis of the coupling member increases as the distance along the axis of the coupling member from the connecting portion increases.

61. The process cartridge according to claim 58, wherein the second end portion comprises the projection, and the second end portion comprises an opening to a recess, with a surface of the recess facing away from the connecting portion.

62. The process cartridge according to claim 55, wherein the axis of the first coupling member at the first position is offset from and substantially parallel to the roller axis, and wherein the axis of the second coupling member is substantially coaxial with the drum axis.

63. The process cartridge according to claim 55, further comprising a rotational force receiving gear for receiving a rotational force from the first coupling member, wherein the first coupling member is pivotably connected to the rotational force receiving gear.

64. The process cartridge according to claim 63, wherein a rotational axis of the rotational force receiving gear is offset from and substantially parallel to the roller axis.

65. The process cartridge according to claim 64, further comprising a developing roller gear that is provided at a longitudinal end of the developing roller, wherein the rotational force is transmitted from the rotational force receiving gear to the developing roller through the developing roller gear.

66. The process cartridge according to claim 65, wherein the rotational force receiving gear meshes with the developing roller gear.

67. The process cartridge according to claim 55, further comprising a first rotational force receiving member for receiving a rotational force from the first coupling member, wherein the first coupling member is pivotably connected to the first rotational force receiving member.

68. The process cartridge according to claim 67, wherein a rotational axis of the first rotational force receiving member is offset from and substantially parallel to the roller axis, and wherein a rotational axis of the second coupling member is substantially coaxial with the drum axis.

69. The process cartridge according to claim 67, further comprising a second rotational force receiving member that is provided at a longitudinal end of the developing roller, wherein the rotational force is transmitted from the first rotational force receiving member to the developing roller through the second rotational force receiving member, and wherein the second coupling member is provided at a longitudinal end of the photosensitive drum.

70. The process cartridge according to claim 55, wherein the casing includes a first frame rotatably supporting the developing roller and a second frame rotatably supporting the photosensitive drum.

71. The process cartridge according to claim 70, wherein the second frame includes a projection positioned adjacent to the second coupling member.

72. The process cartridge according to claim 55, further comprising a spring for urging the first coupling member from the first position toward the second position.

73. A process cartridge comprising:

a casing;

a developing roller having a roller axis, the developing roller being rotatably supported in the casing to permit rotation about the roller axis;

a photosensitive drum having a drum axis, the photosensitive drum being rotatably supported in the casing to permit rotation about the drum axis;

a first coupling member having an axis, the first coupling member being operatively connected to the developing roller, and the first coupling member being movable between (i) a first position in which the axis of the first coupling member is substantially parallel to the roller axis and (ii) a second position in which the axis of the first coupling member is inclined with respect to the roller axis; and a second coupling member having an axis, the second coupling member being operatively connected to the photosensitive drum, and the second coupling member including a projection having a plurality of corners in cross section, wherein the first coupling member and the second coupling member are disposed at same side of the casing in a direction of the drum axis.

74. The process cartridge according to claim 73, wherein a maximum angle of inclination of the axis of the first coupling member with respect to the roller axis is about 20 degrees to about 60 degrees.

75. The process cartridge according claim 74, wherein a maximum angle of inclination of the axis of the first coupling member is about 35 degrees.

76. The process cartridge according to claim 73, wherein the first coupling member includes (i) a first end portion operatively coupled to the developing roller, (ii) a second end portion opposite to the first end portion, and (iii) a connecting portion connecting the first end portion and the second end portion, and wherein a maximum distance from the axis of the first coupling member to an outermost surface of at least part of the connecting portion along a line perpendicular to the axis of the first coupling member is less than a maximum distance from the axis of the first coupling member to an outermost surface of at least part of the second end portion along a line perpendicular to the axis of the first coupling member.

77. The process cartridge according to claim 76, wherein the connecting portion comprises a shaft along the axis of the first coupling member.

78. The process cartridge according to claim 76, wherein, for at least part of the second end portion, a maximum distance from the axis of the first coupling member to an outermost surface along a line perpendicular to the axis of the coupling member increases as the distance along the axis of the coupling member from the connecting portion increases.

79. The process cartridge according to claim 76, wherein the second end portion comprises the projection, and the second end portion comprises an opening to a recess, with a surface of the recess facing away from the connecting portion.

80. The process cartridge according to claim 73, wherein the axis of the first coupling member at the first position is offset from and substantially parallel to the roller axis, and wherein the axis of the second coupling member is substantially coaxial with the drum axis.

81. The process cartridge according to claim 73, further comprising a rotational force receiving gear for receiving a rotational force from the first coupling member, wherein the first coupling member is pivotably connected to the rotational force receiving gear.

82. The process cartridge according to claim 81, wherein a rotational axis of the rotational force receiving gear is offset from and substantially parallel to the roller axis.

83. The process cartridge according to claim 82, further comprising a developing roller gear that is provided at a longitudinal end of the developing roller, wherein the rotational force is transmitted from the rotational force receiving gear to the developing roller through the developing roller gear.

84. The process cartridge according to claim 83, wherein the rotational force receiving gear meshes with the developing roller gear.

85. The process cartridge according to claim 73, further comprising a first rotational force receiving member for receiving a rotational force from the first coupling member, wherein the first coupling member is pivotably connected to the first rotational force receiving member.

86. The process cartridge according to claim 85, wherein a rotational axis of the first rotational force receiving member is offset from and substantially parallel to the roller axis, and wherein a rotational axis of the second coupling member is substantially coaxial with the drum axis.

87. The process cartridge according to claim 86, further comprising a second rotational force receiving member that is provided at a longitudinal end of the developing roller, wherein the rotational force is transmitted from the first rotational force receiving member to the developing roller through the second rotational force receiving member, and wherein the second coupling member is provided at a longitudinal end of the photosensitive drum.

88. The process cartridge according to claim 73, wherein the casing includes a first frame rotatably supporting the developing roller and a second frame rotatably supporting the photosensitive drum.

89. The process cartridge according to claim 88, wherein the second frame includes a projection positioned adjacent to the second coupling member.

90. The process cartridge according to claim 73, further comprising a spring for urging the first coupling member from the first position toward the second position.

91. A process cartridge comprising:

a casing;

toner contained within the casing;

a developing roller having a roller axis, the developing roller being rotatably supported in the casing to permit rotation about the roller axis;

a photosensitive drum having a drum axis, the photosensitive drum being rotatably supported in the casing to permit rotation about the drum axis;

a first coupling member having an axis, the first coupling member being operatively connected to the developing roller, and the first coupling member being movable between (i) a first position in which the axis of the first coupling member is substantially parallel to the roller axis and (ii) a second position in which the axis of the first coupling member is inclined with respect to the roller axis; and a second coupling member having an axis, the second coupling member being operatively connected to the photosensitive drum, and the second coupling member includes a projection having a plurality of corners in cross section, wherein the first coupling member and the second coupling member are disposed at same side of the casing in a direction of the drum axis.

92. The process cartridge according to claim 91, wherein a maximum angle of inclination of the axis of the first coupling member with respect to the roller axis is about 20 degrees to about 60 degrees.

93. The process cartridge according claim 92, wherein a maximum angle of inclination of the axis of the first coupling member is about 35 degrees.

94. The process cartridge according to claim 91, wherein the first coupling member includes (i) a first end portion operatively coupled to the developing roller, (ii) a second end portion opposite to the first end portion, and (iii) a connecting portion connecting the first end portion and the second end portion, and wherein a maximum distance from the axis of the first coupling member to an outermost surface of at least part of the connecting portion along a line perpendicular to the axis of the first coupling member is less than a maximum distance from the axis of the first coupling member to an outermost surface of at least part of the second end portion along a line perpendicular to the axis of the first coupling member.

95. The process cartridge according to claim 94, wherein the connecting portion comprises a shaft along the axis of the first coupling member.

96. The process cartridge according to claim 94, wherein, for at least part of the second end portion, a maximum distance from the axis of the first coupling member to an outermost surface along a line perpendicular to the axis of the coupling member increases as the distance along the axis of the coupling member from the connecting portion increases.

97. The process cartridge according to claim 94, wherein the second end portion comprises the projection, and the second end portion comprises an opening to a recess, with a surface of the recess facing away from the connecting portion.

98. The process cartridge according to claim 91, wherein the axis of the first coupling member at the first position is offset from and substantially parallel to the roller axis, and wherein the axis of the second coupling member is substantially coaxial with the drum axis.

99. The process cartridge according to claim 91, further comprising a rotational force receiving gear for receiving a rotational force from the first coupling member, wherein the first coupling member is pivotably connected to the rotational force receiving gear.

100. The process cartridge according to claim 99, wherein a rotational axis of the rotational force receiving gear is offset from and substantially parallel to the roller axis.

101. The process cartridge according to claim 100, further comprising a developing roller gear that is provided at a longitudinal end of the developing roller, wherein the rotational force is transmitted from the rotational force receiving gear to the developing roller through the developing roller gear.

102. The process cartridge according to claim 101, wherein the rotational force receiving gear meshes with the developing roller gear.

103. The process cartridge according to claim 91, further comprising a first rotational force receiving member for receiving a rotational force from the first coupling member, wherein the first coupling member is pivotably connected to the first rotational force receiving member.

104. The process cartridge according to claim 103, wherein a rotational axis of the first rotational force receiving member is offset from and substantially parallel to the roller axis, and wherein a rotational axis of the second coupling member is substantially coaxial with the drum axis.

105. The process cartridge according to claim 103, further comprising a second rotational force receiving member that is provided at a longitudinal end of the developing roller, wherein the rotational force is transmitted from the first rotational force receiving member to the developing roller through the second rotational force receiving member, and wherein the second coupling member is provided at a longitudinal end of the photosensitive drum.

106. The process cartridge according to claim 91, wherein the casing includes a first frame rotatably supporting the developing roller and a second frame rotatably supporting the photosensitive drum.

107. The process cartridge according to claim 106, wherein the second frame includes a projection positioned adjacent to the second coupling member.

108. The process cartridge according to claim 91, further comprising a spring for urging the first coupling member from the first position toward the second position.

* * * * *